US005640651A

United States Patent [19]

Katoh et al.

[11] Patent Number: 5,640,651

[45] Date of Patent: Jun. 17, 1997

[54] DEVELOPING DEVICE

[75] Inventors: Keiji Katoh, Nara; Hiroshige Araki, Yamatokoriyama; Yasuo Imai, Kitakatsuragi-gun; Shigeyuki Wakada; Eiichi Kido, both of Yamatokoriyama; Toshihiro Ota, Nara; Yuhi Yui, Nabari, all of Japan

[73] Assignee: Sharp Kabushiki Kaisha, Osaka, Japan

[21] Appl. No.: 564,516

[22] Filed: Nov. 29, 1995

[30] Foreign Application Priority Data

Nov. 30, 1994 [JP] Japan ..... 6-297056
Dec. 20, 1994 [JP] Japan ..... 6-317057

[51] Int. Cl.[6] ..... G03G 15/04

[52] U.S. Cl. ..... 399/119; 399/279; 399/281; 399/286

[58] Field of Search ..... 355/245, 259, 355/260; 118/653, 661

[56] References Cited

U.S. PATENT DOCUMENTS

| | | | |
|---|---|---|---|
| 4,836,135 | 6/1989 | Kohyama et al. | 118/653 |
| 4,920,916 | 5/1990 | Mizuno et al. | 118/653 |
| 5,091,748 | 2/1992 | Morisawa et al. | 355/245 |
| 5,339,140 | 8/1994 | Zeman et al. | 355/245 X |

FOREIGN PATENT DOCUMENTS

| | | |
|---|---|---|
| 58-107560 | 6/1983 | Japan . |
| 2101485 | 4/1990 | Japan . |

*Primary Examiner*—Matthew S. Smith

[57] ABSTRACT

A developer cartridge for image forming apparatuses which performs development to form images with non-magnetic, one-component type developer. The cartridge includes a developing roller for supplying developer to a photoconductor drum, a developer feed roller in non-contact with the developing roller for supply developer to the developing roller, and a developer-layer thickness control member for controlling the thickness of the developer layer on the developing roller. The developer feed roller is shaped as a regular polygonal prism. Since no recesses are formed in the surface of the regular polygonal prism, driving torque does not increase when developer is scrubbed from the prism, thus ensuring consistent operation and improved image quality. Non-magnetic, one-component type developer is compressed onto the developing roller by supplying the developer via the developer feed roller into a bottleneck between the developing roller and a developer applying member. The amount of developer which passes through the bottleneck onto the developing roller is controlled by a temporary reservoir, the pressurization thereof ensuring application of the developer to the developing roller. A control roller may be used against the developing roller to lower friction of developer, thereby preventing deposition of developer on the control roller while establishing a consistent amount of developer on the developing roller.

50 Claims, 73 Drawing Sheets

$$\text{DEVELOPER CONVEYANCE RATIO I} = \frac{\text{AMOUNT OF DEVELOPER CONVEYED BY DEVELOPER AGITATION ROLLER}}{\text{AMOUNT OF DEVELOPER CONVEYED BY DEVELOPER FEED ROLLER}}$$

$$\text{DEVELOPER CONVEYANCE RATIO H} = \frac{\text{AMOUNT OF DEVELOPER CONVEYED BY DEVELOPER FEED ROLLER}}{\text{AMOUNT OF DEVELOPER DEPOSITED ON DEVELOPING ROLLER}}$$

DEVELOPING DEVICE

BACKGROUND OF THE INVENTION

1. Field of the Invention

The present invention relates to a developing device for image forming apparatuses, which is used in image forming apparatuses such as xerographic copiers, laser printers and facsimile machines which form images by development using a non-magnetic, one-component type developer, and which comprises, all received in a developer tank: a developing roller for supplying a developer to a photoconductor; a developer feed roller for conveying and supplying the developer to the developing roller, placed in non-contact with the developing roller; and a toner (or developer)-layer thickness control member which controls the thickness of the developer layer on the developing roller.

In addition, the present invention relates to a developing device which develops an electrostatic latent image formed on a recording medium, wherein a one-component type developer is conveyed to the developing region while being applied to the developing roller at a constant thickness.

2. Description of the Related Art

Developing devices for supplying developer to an electrostatic latent image on a photoconductor drum have been provided according to the prior art in image forming apparatuses such as printers which form images in a xerographic manner using a non-magnetic, one-component type developer.

This type of developing device is disclosed in Japanese Unexamined Patent Publication JPA 2-101485(1990), for example. The developing device 100 described in the publication comprises, as shown in FIG. 114, a sleeve 102 which rotates to supply developer 106 deposited on its periphery to a photoconductor drum 101; a developer feed roller 103 with recess sections on its periphery, placed near and in noncontact with the sleeve 102; a scrubbing member 105 for scrubbing developer 106 in the recess sections 104 on the periphery of the developer feed roller 103, etc. The developer 106 in the developing device 100 is loaded in the recess sections 104 on the periphery as the developer feed roller 103 is rotated and scrubbed by the scrubbing member 105 to be received in a developer-supplying chamber 107. The developer 106 received in the developer-supplying chamber 107 is then deposited on the sleeve 102 and then on the photoconductor drum 101 at the section 108 of contact with the photoconductor drum 101 as the sleeve 102 is rotated.

The publication also discloses other types of developer feed rollers with recess sections formed on the periphery, including a developer feed roller 110 having curved recess sections 111 as shown in FIG. 115, a developer feed roller 120 coated with a sponge 121 as shown in FIG. 116, and a developer feed roller 130 covered with bristles 131 as shown in FIG. 117, all of which are designed to scrub the developer 106 on the surfaces of the developer feed rollers 103, 110, 120 and 130 with a scrubbing member 105.

Other embodiments of this type of developing device include, for example, the one shown in FIG. 118 which is manufactured by Epson, Inc. This developing device is designed in such a manner that a circular developer feed roller 201 is rotated opposite to the direction of a developing roller 202, and a developer-scrubbing member 203 is provided at the bottom of the developer feed roller 201 to convey developer to the developing roller 202.

Xerography-based image forming apparatuses such as copiers and laser printers are equipped with a developing device for depositing developer comprising a coloring pigment on an electrostatic latent image formed on a photoconductor as a recording medium in order to visualize the electrostatic latent image. Here, the electrostatic latent image need not be black; replaceable developing devices which contain differently colored types of developer may be mounted in the body of an image forming apparatus for color printing.

Specifically, the dominating developing developer for color printing of the prior art is two-component type. This means that developer composed of a coloring pigment and a resin fails to produce a desired color if mixed with a magnetic material or another material.

Therefore, if one-component type color developer is desired, the one-component type developer is inevitably non-magnetic developer rather than magnetic developer. In cases where such non-magnetic developer is used, developing devices with a magnetic brush according to the prior art can no longer be used. This is because magnetic force fails to adsorb developer on the periphery of a developing roller in a given amount as controlled by a control member.

As a countermeasure, the above-mentioned developing device shown in FIG. 115 has been presented. The developing device 112 shown in the drawing is equipped with a developing roller 113 which conveys a given amount of one-component type developing developer 106, which is stored in a developer tank 114 supporting the developing roller 113 in a rotatable manner, to a photoconductor with an electrostatic latent image formed thereon to visualize the electrostatic latent image, and with a developer feed roller 110 for supplying the developer 106 to the developing roller 113 for its deposition thereon. Here, a controller member 115 is pressed against the periphery of the developing roller 113 in order to ensure that a constant amount of developer 106 is deposited on the developing roller 113. With this configuration, developer 106 supplied to the curved recess sections 111 of the feed roller 110 is forcedly brought into contact with the developing roller 113 for its deposition on the developing roller 113 as the developer 106 passes along the developing roller 113, leveled to a constant amount as it passes along the control member 115 halfway during conveyance by rotation of the developing roller 113, and then conveyed to the developing region facing the photoconductor.

With the above-mentioned prior art developing devices for image forming apparatuses, however, the developer feed rollers 103 and 110 shown in FIG. 114 and FIG. 115 tend to have different levels of torque in the case where the scrubbing member 105 scrubs developer 106 in the peripheral recess sections 104 or the curved recess sections 111 and in the case where the scrubbing member 105 scrubs developer 106 on the shoulder sections of the developer feed rollers 103 and 110. That is, a load on the developer feed rollers 103 and 110 during scrubbing is larger at the shoulder sections than at the peripheral recess sections 104 or the curved recess sections 111. As a result, this difference in torque has the adverse effect of influencing rotation of the motors which drive the developer feed rollers 103 and 110, e.g., change in the driving force, thus resulting in the problem of irregular image quality.

In addition, with the developer feed roller 120 shown in FIG. 116, the scrubbing member 105 must dig into a sponge 121 when it is attempted to scrub the developer 106 caught in the sponge 121, and this also results in increased torque of the developer feed roller 120. Further, the sponge-coated roller is more expensive than resin rollers.

Furthermore, with the sponge-coated roller, the developer 106 once scrubbed from the sponge 121 tends to be caught by the sponge 121, and this results in lower capacity to convey developer 106.

On the other hand, since the developer feed roller 130 with bristles 131 which is shown in FIG. 117 requires an increased amount of digging by the scrubbing member 105, torque of the developer feed roller 130 increases.

Further, in the same manner as with the developer feed roller 120 coated with the sponge 121, the developer 106 once scrubbed from the bristles 131 tends to be caught again by the bristles 13, and this results in lower capacity to convey developer 160 as well. An additional problem is the increased cost of the materials.

A problem with the circular developer feed roller 201 shown in FIG. 118 is that its capacity to move developer 106 by its rotation is low, and this results in lower capacity to supply the developer 106. This problem causes a further problem of creation of sections free of developer 106 on the developing roller 202 after solid printing, and this increases the probability of white void in the solid printing.

These problems are particularly serious for compact printers. This is because compact printers, which use a downsized motor for miniaturization and cost-reduction, have a problem in that the developer feed roller 103 and other members constructed as described above tend to undergo change in torque and are therefore irregularly driven for rotation, resulting in the formation of images with unfavorable quality.

As a countermeasure against the problems mentioned above, for prevention of leakage of developers from developing devices before use, Japanese Unexamined Patent Publication JPA 58-107560 (1983) discloses a structure shown in FIGS. 119A and 119B, wherein the region of a developer storage section 301 is separated from the region of a developing roller 302 by a sheet-like sealing member 303 when in a not-yet used state so as to prevent leakage of the developer sealed in the developer storage section 301 through the developing roller 302 during transportation, which contaminates the surroundings, and just before use the sheet-like sealing member 303 is opened by an opening member 304 to provide double doors through which the developer is supplied to the region of the developing roller 302. This structure, however, is complicated and increases the cost.

On the other hand, with the prior art developing device 112 shown in FIG. 115, it is extremely difficult to level developer 106 by the control member 115 as the developer 106 passes along the member 115 on the way to the point of development. More specifically, the requirement of uniform pressing of the control member 115 against the developing roller 113 along the full axial length thereof is rather difficult to accomplish because adjustment of pressure for the uniform pressing is extremely troublesome, and this results in distribution of irregular axial force of pressing which in turn results in irregular amounts of deposition (amounts of application) of developer 106. Additionally, it is also extremely difficult to provide a smooth and even section of contact between the control member 115 and the developing roller 113. Therefore, formation of irregularities on the section of contact with the developing roller 113 may impair evenness of application. Conversely, if the control member 115 has an excessively smooth surface, the developing roller 113 may have increased torque.

In addition, even if developer 106 may be applied uniformly with the aid of the control member 115, repeated development tends to cause partially thinner density and gradual reduction in line width along the direction of paper conveyance when halftone images or solid images are developed. This tendency becomes more significant as the amount of developer 106 remaining in the developer tank decreases. Should this tendency further increase, torque of the developing device, particularly torque for rotating the developing roller 113 increases, and consequently there will occur a problem in that the developing roller is put out of rotation, or locked.

This is caused by gradual fusion of developer 106, which is controlled by the control member 115, to the control member 115 by pressure from the control member 115 and the developing roller 113. As a result, since the fused sections are elevated to provide irregularities (bumps and dents) at the section of the control member 115 which contacts the developing roller 113, and the amount of developer applied to the developing roller 113 becomes irregular accordingly in the peripheral direction along the irregular surface, that is, it is not consistent in the axial direction, and this results in the above-mentioned formation of streaks on the paper in the direction of conveyance. The fused developer 106 also increases the torque of the developing roller 113.

On the other hand, with the prior art developing device shown in FIG. 115, for deposition of developer 106 supplied by the feed roller 110 on the developing roller 113, the developer 106 passes along the developing roller 113, and the developer pressure in the developer-supplying chamber 107 is increased to promote deposition of the developer on the developing roller 113. In cases where the developer pressure in the supplying chamber 107 is not consistent due to the relationship between the feed roller 110 and the developing roller 113, the amount of charge of the developer 106 by friction is not stable, and thus since the pressure of the developer 106 to be deposited on the developing roller 113 is not constant, the amount of developer 106 deposited on the developing roller 113 is not stable.

With the developing device 112 shown in FIG. 115, the location of the scrubbing member 105 for scrubbing developer 106 remaining in the curved recess sections 111 of the feed roller 110 which supply developer 106 changes as the developer feed roller 110 rotates. For this reason, the volume of the developer-supplying chamber 107 changes, and thus the pressure of developer 106 at that location cannot be constant, as mentioned above. Accordingly, not only is the developer 106 inconsistently charged by friction, but there also remains the problem of the notable influence of the developing roller 113 on the amount of application of developer 106.

Although the foregoing description is centered on the amount of non-magnetic, one-component type developer 106 deposited on the developing roller 113, magnetic, one-component type developer 106 also must be deposited on the developing roller 113 in a constant amount, and for this the control member 115 is provided in the developer tank 114 as in the case with non-magnetic, one-component type developer. Even with this control member 115, since developer 106 is pressed against the developing roller 113 to control the amount of developer 106 to be deposited, the developer 106 is deposited on the control member 115, repeating the deposition causes fusion of the deposited developer and the inconvenience explained above occurs in the same manner.

SUMMARY OF THE INVENTION

The present invention has been accomplished to solve the problems of the prior art discussed above, and it is aimed at providing a developing device for image forming apparatuses which is designed to improve image quality and to reduce cost by consistent conveyance of developer by a developer feed roller and a developing roller.

Also, the present invention allows application of a constant amount of one-component type developer to a developing roller and stable development. Particularly, the present invention is aimed at allowing application of a constant amount of developer to a developing roller by minimizing deposition and consequently possible fusion of developer on a control member which controls the amount of developer deposited on the developing roller.

A developing device for image forming apparatuses according to a first embodiment of the present invention is a developing device for image forming apparatuses which uses a non-magnetic, one-component type developer, comprising a developing roller for supplying a developer to a photoconductor; a developer feed roller for conveying the developer to the developing roller while rotating, placed in non-contact with the developing roller; and a developer tank for receiving the developer, the developing roller and the developer feed roller, which is provided with irregularities formed at least at its inner surface facing the developer feed roller, which promote charging of the developer by friction.

A developing device for image forming apparatuses according to a second embodiment of the present invention is characterized by, in addition to the requirements mentioned above, the fact that the developer feed roller is formed as a regular polygonal prism.

A developing device for image forming apparatuses according to a third embodiment of the present invention is characterized by, in addition to the requirements mentioned above, the fact that the number of angles of the regular polygonal section is 3–8.

A developing device for image forming apparatuses according to a fourth embodiment of the present invention is a developing device for image forming apparatuses which uses a non-magnetic, one-component type developer, comprising a developing roller for supplying a developer to a photoconductor; a control member placed upstream in the direction of conveyance of the developer supplied to the photoconductor, which controls the thickness of the layer of the developer deposited on the developing roller; a developer feed roller for conveying and supplying the developer to the developing roller, placed in non-contact with the developing roller; and a developer-applying member placed extending in the direction of conveyance of the developer which is conveyed toward the control member by rotation of the developing roller and the developer feed roller and also extending in the axial direction of the developing roller near the developer feed roller and the developing roller, with decreasing distance from the surface of the developing roller.

A developing device for image forming apparatuses according to a fifth embodiment of the present invention is characterized by, in addition to the requirements mentioned above, the fact that the developer-applying member is formed of a material having elastic restoring force.

A developing device for image forming apparatuses according to a sixth embodiment of the present invention is characterized by, in addition to the requirements mentioned above, the fact that the tip of the developer-applying member is bent in the shape of an L or V.

A developing device for image forming apparatuses according to a seventh embodiment of the present invention is characterized by, in addition to the requirements of the fourth embodiment, the fact that the tip of the developer-applying member comprises two or more layers of plates.

A developing device for image forming apparatuses according to a eighth embodiment of the present invention is characterized by, in addition to the requirements mentioned above, the fact that irregularities are formed on the surface of the developer-applying member.

A developing device for image forming apparatuses according to a ninth embodiment of the present invention is characterized by, in addition to the requirements mentioned above, the fact that the ten-point mean surface roughness $R_Z$ of the irregularities and the mean particle size "r" of the developer satisfies the relation: $\frac{1}{2}\times r \leqq R_Z \leqq 10\times r$.

A developing device for image forming apparatuses according to a tenth embodiment of the present invention is characterized by, in addition to the requirements of the fourth embodiment, the fact that the developer-applying member is provided with a pressure-regulating valve which controls increase in the pressure of the developer which is conveyed between the developer-applying member and the developing roller.

A developing device for image forming apparatuses according to an eleventh embodiment of the present invention is a developing device for image forming apparatuses which uses a non-magnetic, one-component type developer, comprising a developing roller for supplying a developer to a photoconductor; a developer feed roller for conveying and supplying the developer to the developing roller, placed in non-contact with the developing roller; and a developer-applying member placed extending in the direction of conveyance of the developer which is conveyed by rotation of the developing roller and the developer feed roller with decreasing distance from the surface of the developing roller and also extending in the axial direction of the developing roller near the developer feed roller and the developing roller, a scrubbing member in contact with the developer feed roller being fixed to the developer-applying member for scrubbing the developer deposited on the developer feed roller, and the surface of the developing roller, the developer-applying member and the scrubbing member confining a space which functions as a pressurizing chamber for increasing the pressure of the developer during conveyance.

A developing device for image forming apparatuses according to a twelfth embodiment of the present invention is characterized by, in addition to the requirements mentioned above, the fact that a developer agitation roller is placed upstream from the developing roller in the path over which the developer is conveyed, for conveying the developer to the developer feed roller while agitating, with a blade material provided at the tip of the developer agitation roller.

A developing device for image forming apparatuses according to a thirteenth embodiment of the present invention is characterized by, in addition to the requirements of the eleventh embodiment, the fact that a through-hole is formed in the scrubbing member.

A developing device for image forming apparatuses according to a fourteenth embodiment of the present invention is a developing device for image forming apparatuses which uses a non-magnetic, one-component type developer, comprising a developer roller for supplying a developer to a photoconductor; a developer feed roller for conveying and supplying the developer to the developing roller, placed in non-contact with the developing roller; a developer tank for receiving at least the developer, the developing roller and the developer feed roller; and a developer-applying member which extends from the inner wall surface of the developer tank to the developer feed roller, facing the developing roller, to partition the developer tank, with the end extending to the developer feed roller being in contact with the developer feed roller to scrub the developer deposited on the developer feed roller, the developer-applying member being placed at such a position as to allow conveyance of the developer to a space between the developer-applying member and the developing roller by rotation of the developing roller and the developer feed roller, provided with a hole formed therein for the passage of the developer conveyed between the developer-applying member and the developing roller.

A developing device for image forming apparatuses according to a fifteenth embodiment of the present invention is characterized by, in addition to the requirements mentioned above, the fact that the developer-applying member is formed of a rigid material except in the vicinity of the end extending to the developer feed roller.

A developing device for image forming apparatuses according to a sixteenth embodiment of the present invention is characterized by, in addition to the requirements of the fourteenth embodiment, the fact that the width of the hole formed in the developer-applying member increases toward the side of the developing roller.

A developing device for image forming apparatuses according to a seventeenth embodiment of the present invention is characterized by, in addition to the requirements of the first, fourth, eleventh or fourteenth embodiment, the fact that a developer agitation roller which conveys a developer to the developer feed roller while agitating is provided upstream from the developer feed roller in the path over which the developer is conveyed, and the amount $S_1$ of conveyance per rotation of the developer feed roller, the amount $S_2$ of conveyance per rotation of the developer agitation roller and the ratio "b" of the number of rotations of the developer agitation roller to the number of rotations of the developer feed roller satisfies the relation: $S_1 \leqq b \times S_2$.

A developing device for image forming apparatuses according to an eighteenth embodiment of the present invention is characterized by, in addition to the requirements of the first, fourth, eleventh or fourteenth embodiment, the fact that a constant k representing $(S_t \times R_t)/(S_d \times R_d)$ satisfies the relation: $1 \leqq k \leqq 20$, wherein $S_t$ is the area of the developer feed roller to convey the developer, $R_t$ is the number of rotations thereof, $S_d$ is the area of the developing roller to convey the developer, and $R_d$ is the number of rotations thereof, provided that the length of the developer feed roller is equal to the length of the developing roller.

A developing device for image forming apparatuses according to a nineteenth embodiment of the present invention is a developing device for image forming apparatuses which uses a non-magnetic, one-component type developer, comprising a developer roller for supplying a developer to a photoconductor; a developer feed roller for conveying and supplying the developer to the developing roller, placed in non-contact with the developing roller; a developer tank for receiving the developer, the developing roller and the developer feed roller; and a developer-applying member which extends from the inner wall surface of the developer tank to the developer feed roller while facing the developing roller, to partition the developer tank, with the end extending to the developer feed roller being in contact with the developer feed roller to scrub the developer deposited on the developer feed roller, and which is placed at such a position as to allow conveyance of the developer to a space between the developer-applying member and the developing roller by rotation of the developing roller and the developer feed roller, a plurality of open sections formed in the developer-applying member by dividing a rectangular opening formed in the developer-applying member with its longer sides parallel to the axial direction of the developing roller, by parallelogrammic partitions which extend from one longer side to the other longer side, and the sum of lengths of the line segments crossing each opening on a perpendicular line segment drawn between the longer sides being constant.

A developing device for image forming apparatuses according to a twentieth embodiment of the present invention is characterized by comprising; a developing roller for supplying the developer to a photoconductor; a developer feed roller for conveying and supplying the developer to the developing roller, placed in non-contact with the developing roller; a developer agitation roller placed upstream from the developer feed roller in the path over which the developer is conveyed, to convey the developer to the developer feed roller while agitating; a developer-applying member extending along the direction of conveyance of the developer which is conveyed by rotation of the developing roller and the developer feed roller with decreasing distance from the surface of the developing roller and also extending along the axial direction of the developing roller near the developer feed roller and the developing roller and further toward the wall surface of the developer tank, with the distal end fixed by a fixing material provided on the wall surface; a developer tank for receiving the developer, the developing roller, the developer feed roller, the developer agitation roller and the developer-applying member; and a replaceable container which houses the developer tank, a guide groove being formed on the side wall of the developer tank which supports and guides the applying member in a slidable manner, protrusions being formed in the developer-applying member which is engageable with an anchor hole and the developer agitation roller, and an anchor protrusion engageable with the anchor hole being formed on the wall surface of the developer tank.

A developing device for image forming apparatuses according to a twenty-first embodiment of the present invention is characterized by, in addition to the requirements mentioned above, the fact that the developer-applying member is flexible and has a circular section.

A developing device for image forming apparatuses according to a twenty-second embodiment of the present invention is characterized by, in addition to the requirements of the twentieth embodiment, the fact that the developer agitation roller is rotated prior to operation of the image forming apparatus.

A developing device for image forming apparatuses according to a twenty-third embodiment of the present invention is characterized by, in addition to the requirements of the twentieth or twenty-second embodiment, the fact that a gear mounted around the section of an extension of the developer agitation roller outside the container is engaged with an engageable gear mounted on an image forming apparatus to cause rotation when the container is mounted in the body of the image forming apparatus.

A developing device according to a twenty-fourth embodiment of the present invention is characterized in that in order to deposit a developer on a developing roller which is placed facing a recording medium to convey the developer for development, a developer feed member is provided in a developer tank to deposit the supplied developer on a developing roller, and then the developer deposited on the developing roller is leveled by rotation of a cylindrical control roller which is a control member for controlling the amount of the developer to be applied.

More specifically, the developing device of the present invention is provided with a developer feed member which is placed facing a photoconductor serving as the recording medium, to convey developer to a position of development which faces the photoconductor and to supply the developer to a developing roller for development; a member placed facing the developing roller at a given distance away from the developing roller; and a rotatable control roller shaped like a roll which allows passage of the supplied developer between the member and the developing roller and controls the amount of developer to be applied to the developing roller, and driven to rotate so as to move in the same direction as the rotation of the developing roller at a point of contact with the developing roller.

The peripheral speed of rotation of the control roller according to a twenty-fifth embodiment of the present invention is set to be higher than the peripheral speed of the developing roller.

The control roller according to a twenty-sixth embodiment of the control roller is formed of a conductive material and is connected to a grounding potential.

The developing device according to a twenty-seventh embodiment of the present invention is provided with a cleaning member which is brought into contact with the surface of the control roller which has controlled the amount of developer to be applied to the developing roller, in order to remove the developer deposited on the control roller to prevent fusion of the deposited developer.

According to the configuration of the first embodiment, the non-magnetic, one-component type developer is preliminarily charged to a degree by friction with the rotating developer feed roller and by friction with the inner surface of the developer tank. An increased amount of this preliminary charge prior to full-scale charging with the developing roller results in smooth electrostatic adsorption of the developer on the photoconductor.

According to the configuration of the first embodiment, irregularities for promoting frictional electrification of the developer are formed on the inner surface of the developer tank which faces the developer feed roller. Accordingly, the frictional force between the inner surface of the developer tank and the developer increases during the course of conveyance of the non-magnetic, one-component type developer via the space between the developer feed roller and the opposing inner surface of the developer tank by rotation of the developer feed roller. In addition, disturbance of the flow of the developer by the irregularities promotes agitation of the developer. As a result, as compared with the case where the developer tank has a mirror-like inner surface, the amount of charged developer increases due to the increased frictional force, and the charging is conducted more uniformly due to the agitation action.

The amount of preliminary charge of the developer may be increased in this way by charging due to the friction with the inner surface of the developer tank in addition to charging due to the friction with the rotating developer feed roller.

Here, the closer the developer feed roller is located to the inner surface of the developer tank, the higher the pressure of the developer passing the space is, and this results in increased frictional force between the inner surface of the developer tank and the developer and consequently more effective frictional electrification.

According to the configuration of the second embodiment, since the developer feed roller is shaped as a regular polygonal prism and the developer is conveyed along the side surfaces of the regular polygonal prism, the capacity of conveying developer is greater than with a cylindrical type. Therefore, conveyance of the developer to the developing roller is ensured even for solid printing which consumes a large amount of developer.

In addition, since the developer feed roller is a regular polygonal prism and thus the side surfaces are plain surfaces having no recess sections, no member for scrubbing the developer remaining in recess sections is needed, thus resulting in cost-reduction. Furthermore, even in cases where a scrubbing member is provided, since the member has no recess sections, the developer feed roller undergoes less change in torque and is consistently driven to rotate. Furthermore, since the conveyance of the developer is stable, consistent images free of overfed developer may be produced.

According to the configuration of the third embodiment, the surface angle with respect to the direction of rotation may be set to 22.5°–60° which allows conveyance of a large amount of developer by setting the number of angles of the regular polygonal section of the developer feed roller to 3–8. This allows downsizing of the diameter of the developer feed roller which leads to space savings. In addition, since the number of rotations may be decreased, consumption of energy may also be decreased.

According to the configuration of the fourth embodiment, the developer conveyed around the developing roller by the developer feed roller is pressed toward the developing roller by the force of conveyance of the developer feed roller, and the developer is deposited on the surface of the developing roller by the pressing force due to this conveyance. The thickness of the layer of the deposited developer is controlled for a consistent and smaller value by the control member. The pressing force due to the conveyance alone, however, is not always enough to cause the developer to be deposited on the developing roller. As a countermeasure against this, according to the present invention, the developer-applying member is provided along the direction of conveyance of the developer which is conveyed toward the control member, with decreasing distance from the surface of the developing roller. In addition, the developer-applying member extends along the axial direction of the developing roller. This results in an increased pressure of the developer in the course of conveyance of the developer along the developer-applying member and consequent increased pressing force on the developer against the surface of the developing roller. Since the developer is densely applied to the surface of the developing roller in this way, a constant layer thickness may be easily maintained by the control member, resulting in great reduction in inconsistencies in density and in overfed developer of printed images.

According to the configuration of the fifth embodiment, the developer-applying member, being formed of a material with elastic restoring force, may absorb variation in the pressure caused by movement of the developer under conveyance and variation in the pressure caused by eccentricity of the developer feed roller and/or the developing roller. This allows application of the developer on the surface of the developing roller under stabilized pressure, and thus a constant layer thickness may be more easily maintained by the control member, resulting in great reduction in inconsistencies in density and in overfed developer of printed images.

According to the configuration of the sixth embodiment, the tip of the developer-applying member may be bent as an L, with the corner in contact with the developing roller under pressure to make even the surface of contact between the developing roller and the developer-applying member thereby providing a consistent pressure on the surface of the developing roller and to reinforce the developer-applying member. Accordingly, application of developer may be conducted in a uniform and stable manner without being influenced by the qualitative characteristics of the developer-applying member. In addition, in cases where the tip of the developer-applying member is bent as a U, and the curved section of the U is brought into contact with the developing roller under pressure, since the contact surface is curved, the developer moves easier under the reduced stress. As a result, high-quality images may be produced consistently even with lower accuracy in mounting the developer-applying member, thus allowing reduction in the cost.

According to the configuration of the seventh embodiment, it is also possible to use two or more layers of developer-applying members made of PET or the like, and this use results in permanent elimination of distortion thereof which allows long-term consistent application of a developer.

According to the configuration of the eighth embodiment, since irregularities smaller than the particle size of the developer are formed at least on the surface of the developer-applying member at the side of the developing roller, the developer is preliminarily charged by friction when it passes through the irregular section. The result is production of constant image quality free of overfed developer.

According to the configuration of the ninth embodiment, the friction between the inner surface of the developer tank or the surface of the developer-applying member and the developer is most effectively accomplished in cases where the ten-point mean surface roughness $R_Z$ of irregularities, defined in the first or eighth embodiment, and the mean particle size "r" of the developer satisfy the relation: $\frac{1}{2}\times r \leqq R_Z \leqq 10\times r$. More specifically, in cases where the ten-point mean surface roughness $R_Z$ is excessively smaller than the mean particle size "r" of the developer, the inner surface of the developer tank or the surface of the developer-applying member is almost in a mirror-smooth state, and thus only the developer flowing close to the inner surface of the developer tank or the surface of the developer-applying member is charged by friction, whereas the developer flowing away from both the inner surface of the developer tank and the surface of the developer-applying member resists charging. This is because the agitation by the irregularities formed to promote frictional electrification of the developer is more difficult with mirror-smooth surfaces. As a result, in cases where the ten-point mean surface roughness $R_Z$ is excessively smaller than the mean particle size "r" of the developer, the amount of preliminary charge of the developer varies, and the amount of charge of the developer applied to the surface of the developing roller also varies.

Conversely, in cases where the ten-point mean surface roughness $R_Z$ is excessively larger than the mean particle size "r" of the developer, since the developer caught in the irregularities cannot be released, friction is produced between the developer flowing near the inner surface of the developer tank or the developer-applying member and the developer caught in the irregularities, thus increasing the amount of the developer charged to the opposite polarity. Accordingly, in this case as well, the amount of preliminary charge of the developer varies, and thus the amount of charge of the developer applied to the surface of the developing roller also varies.

For these reasons, it is understood that the ten-point mean surface roughness $R_Z$ must have proper upper and lower limits. The range of the ten-point mean surface roughness $R_Z$ defined according to the ninth embodiment is the result of proper setting based on the results of measurement of variations in the amount of charge of the developer.

According to the configuration of the tenth embodiment, in cases where the pressure of the developer which is conveyed between the developer-applying member and the developing roller increases excessively, the pressure-regulating valve opens to maintain a constant developer pressure. Accordingly, since the developer is applied to the surface of the developing roller at more consistent pressure according to the configuration of the fifth embodiment, leveling of the layer thickness may be performed more easily with the control member, with the effect of greatly lowering inconsistencies in density and overfed developer of printed images.

According to the configuration of the eleventh embodiment, since the scrubbing member fixed to the developer-applying member is placed in contact with the developer feed roller and extends in the axial direction of the developing roller with decreasing distance from the surface of the developing roller, a space is formed which is confined by the surface of the developing roller, the developer-applying member and the scrubbing member. As a result, the developer conveyed and supplied to the developing roller by the developer feed roller cannot escape out of the space.

Since the developer is successively conveyed into this space by rotation of the developer feed roller and the developing roller, the developer becomes concentrated between the developer-applying member and the developing roller. Therefore, the space functions as a pressurizing chamber for increasing the pressure of the conveyed developer. In addition, since the developer scrubbed by the scrubbing member remains in the space, the pressure of the developer in this space is further increased.

Since the pressure of the developer against the surface of the developing roller increases with increasing pressure of the developer in the space, the developer is densely applied to the surface of the developing roller. This results in easier leveling of the layer thickness by the control member which is placed downstream from the developer-applying member and controls the layer thickness of the developer deposited on the developing roller, and thus inconsistencies in density and overfed developer of images may be greatly reduced.

According to the configuration of the twelfth embodiment, by providing the tip of the developer agitation roller with a blade material in a state capable of being brought into contact with the wall surface of the body of the container, it is possible to efficiently convey the developer remaining in the developer tank from the developer agitation roller to the developer feed roller thereby reducing the residue of the developer in the developer tank. As a result, since the developer loaded in the developer tank may be fully consumed, developer supply cost may be minimized.

According to the configuration of the thirteenth embodiment, in cases where a through-hole such as a hole or slit with a larger diameter than the diameter of the developer is formed in the scrubbing member, the developer may escape via the through-hole to prevent increase in torque of the developer feed roller when the pressure exerted on the developer from the developer-applying member increases.

According to the configuration of the fourteenth embodiment, since the developer-applying member faces the surface of the cylindrical developing roller or an elevated surface, the distance between the developer-applying member and the surface of the developing roller decreases in the direction from the developer feed roller to the developing roller and increases in the direction from the developing roller to the inner wall surface of the developer tank. In other words, a bottleneck is formed between the developer-applying member and the surface of the developing roller.

In addition, since the developer-applying member is provided at such a position as to allow conveyance of the developer to the space between the developer-applying member and the developing roller by rotation of the developing roller and the developer-applying roller, the developer pressure increases when the developer is sent into the bottleneck. This in turn results in increased pressure of the developer against the surface of the developing roller, and therefore the developer is densely applied to the surface of the developing roller. As a result, in cases where the control member which controls the layer thickness of the developer deposited on the developing roller is provided downstream from the developer-applying member, leveling of the layer thickness may be performed by the control member more easily, and inconsistencies in density and overfed developer of images may be greatly decreased.

In addition, since the developer-applying member has a hole which allows passage of the developer conveyed to the space between the developer-applying member and the developing roller, there is formed a circuit which allows the developer to return to the developer feed roller through the hole. With the formation of this circuit, excessive increase in the developer pressure may be prevented, and the developer may be pressed at all times against the surface of the developing roller at a proper pressure by appropriately setting the area of the hole. Since the amount of the developer deposited on the developing roller is made constant in this way, regardless of change in the pressure, the effect of greatly decreasing inconsistencies in density and overfed developer of images may be maximized.

According to the configuration of the fifteenth embodiment, the end of the developer-applying member is rocked when it contacts the developer feed roller to scrub the developer. However, since the developer-applying member is formed of a rigid material except in the vicinity of this end, the spacing between the developer-applying member and the developing roller is held consistently at all times without being influenced by the rocking of the end. Accordingly, the pressure of the developer against the surface of the developing roller is stable without being influenced by the rocking of the end, and thus the configuration of the fifteenth embodiment produces a better effect than the configuration of the fourteenth embodiment.

According to the configuration of the sixteenth embodiment, since the width of the hole formed in the developer-applying member increases toward the side of the developing roller, the frictional resistance between the developer and the wall surface of the hole decreases, and thus the developer may pass through the hole smoothly. As a result, since smooth circulation is ensured, which allows the developer conveyed to the spacing between the developer-applying member and the developing roller to return to the developer feed roller through the hole, there is no change in the pressure for conveyance of the developer or change in torque of the developer feed roller. This allows downsizing of motors for driving the developing device.

According to the configuration of the seventeenth embodiment, the amount $S_1$ of conveyance per rotation of the developer feed roller, the amount $S_2$ of conveyance per rotation of the developer agitation roller and the ratio "b" of number of rotations of the developer agitation roller to number of rotations of the developer feed roller satisfies the relation: $S_1 \leqq b \times S_2$. This relation signifies that the amount of the developer conveyed from the developer agitation roller at the upstream side to the developer feed roller is equal to or more than the amount of the developer conveyed from the developer feed roller to the developing roller at the downstream side.

In cases where the relation is satisfied, since the surroundings of the developer feed roller are kept full of the developer supplied by the developer agitation roller, it is possible to overcome problems encountered in solid printing which include decrease in density of solid portions of images with increasing numbers of printed sheets and difference in density at the front and rear ends of the same solid portion on one sheet.

According to the configuration of the eighteenth embodiment, representing the area of the developer feed roller to convey the developer as $S_r$, the number of rotations thereof as $R_r$, the area of the developing roller to convey the developer as $S_d$, the number of rotations thereof as $R_d$, and the $(S_r \times R_r)/(S_d \times R_d)$ as the constant k, the relation: $1 \leqq k$, that is, $S_d \times R_d \leqq S_r \times R_r$, is satisfied in cases where the length of the developer feed roller is equal to the length of the developing roller. This relation signifies that the amount of the developer conveyed from the developer feed roller to the developing roller is equal to or more than the amount of the developer conveyed from the developing roller to the photoconductor.

In cases where the relation is satisfied, the amount of the developer supplied to the developing roller is constant, and thus the same effects as those of the configuration of the seventeenth embodiment are produced.

In cases where the constant k is more than 20, the amount of the developer conveyed from the developer feed roller to the developing roller increases much more than the amount of the developer conveyed from the developing roller to the photoconductor. In this case, the developer is excessively deposited on the developing roller, and thus there is produced the defect of overfeeding of the developer to the printed images. Accordingly, the proper upper limit is placed on the constant k.

According to the configuration of the nineteenth embodiment, the shape of the hole formed in the developer-applying member of the eighth embodiment is modified.

More specifically, a rectangular opening is divided by means of a partition which satisfies all the following three requirements:

(1) The partition is shaped as a parallelogram extending from one longer side to the other longer side of the rectangular opening;

(2) Any perpendicular line segment drawn between the two longer sides crosses the partition; and (3) The length of the portion of any perpendicular line segment which crosses the partition is identical. Here, the three requirements apply without modification to cases where a plurality of partitions are provided. The partition also serves to prevent weakening of the developer-applying member due to the formation of the opening in the developer-applying member.

Here, "the length of the portion of any perpendicular line segment which crosses the partition is identical" means that the portion of a perpendicular line segment which crosses the non-open section which prevents passage of the developer has an identical length at all times, regardless of the point in the axial direction of the developing roller at which the perpendicular line segment crosses. Since it is natural from a geometrical point of view that the width of the rectangular opening, that is, the distance between the longer sides of the rectangular opening, is fixed, the combined length of the portions crossing the open sections, which allow passage of the developer, on a perpendicular line segment may be determined by subtracting the length of the portion of the perpendicular line segment which crosses the non-open section, from the width of the rectangle. It is apparent that as long as the width of the rectangle and the length of portion of a perpendicular line segment which crosses the non-open section are fixed regardless of the point in the axial direction of the developing roller at which the perpendicular line segment crosses, the difference between them, i.e., the combined length of the portions crossing the open sections on a perpendicular line segment is also fixed. The plurality of open sections formed in the developer-applying member are separated with such partitions.

Accordingly, the amount of the developer which passes through the open sections is constant in the direction perpendicular to the axial direction of the developing roller even in cases where passage of the developer is blocked by the partition. As a result, since the blocking of the passage of the developer by the partition has no effect of increasing the pressure of the developer, the pressure of the developer against the surface of the developing roller is constant in the direction perpendicular to the axial direction of the developing roller. Thus, the configuration of the nineteenth embodiment produces a better effect than the configuration of the fourteenth embodiment.

The container according to the twentieth embodiment is designed so that the inside of the container is completely partitioned by the developer-applying member into the region of the developer agitation roller and the region of the developing roller and the developer feed roller until the container is mounted in the apparatus body. Therefore, there is no risk of leakage of the developer out of the container.

Conversely, the rotation of the developer agitation roller brings the proximal end of the developer agitation roller into contact and engagement with the protrusions to move the developer-applying member upward until the distal end of the developer-applying member is brought into contact with the periphery of the developer feed roller. The developer-applying member is then fixed in this state which allows use of the container. In other words, in this state, the developer agitated by the developer agitation roller is conveyed by the developer feed roller toward the developing roller.

Accordingly, leakage of the developer in the container through the developing roller communicating with the outside may be prevented until the container is used, and further there is no need to additionally provide the open section with a lid or the like, and this results in reduction in the parts count and consequently in cost.

According to the configuration of the twenty-first embodiment, since the developer-applying member is flexible and has a circular section, it is possible to completely separate the region of the developer agitation roller from the region of the developing roller and the developer feed roller prior to sliding of the developer-applying member, and to fix the developer-applying member, after it slides, by fitting the anchor hole formed in the developer-applying member over the protrusion provided on the wall surface of the developer tank. More specifically, the circular developer-applying member which divides the regions is allowed to slide along the wall surface of the developer tank due to the flexibility of the developer-applying member. The configuration of the twentieth embodiment may be easily realized in this manner.

According to the configuration of the twenty-second embodiment, since there is no need to adjust the torque of rotation of the developer agitation roller while the developer-applying member is moved, the configuration of the device may be simplified.

Furthermore, according to the configuration of the twenty-third embodiment, the container is designed in such a manner that upon insertion into the apparatus body, the container is engaged with an engageable gear which is the rotation-driving means of the apparatus body to rotate the developer agitation roller a given turn. As a result, as mentioned above, since higher torque than that of normal rotation is needed in order to move the developer-applying member at the start of rotation of the developer agitation roller, the prior art requires operation to vary the torque of the developer agitation roller. Nonetheless, the configuration of the twenty-third embodiment allows rotation of the developer agitation roller while only relying on the force of insertion of the container for its mounting. This allows easier realization of the configuration of the twenty-second embodiment.

According to the configuration of the twenty-fourth embodiment, the developer in the developer tank which constitutes the developing device is supplied to the region of application which faces the developing roller as the feed roller rotates. The supplied developer passes along the path confined by the developing roller and a member located away from it at a given distance. During the passage through the path, frictional electrification occurs due to rotation of the developing roller, etc., and simultaneously pressure is exerted on the developer while passing through the path, to deposit and apply the developer onto the periphery of the rotating developing roller. The deposited developer is conveyed as the developing roller rotates, and reaches the control roller which is a roll-shaped control member.

Here, the amount of the developer deposited on the developing roller is controlled in response to rotation of the control roller, and the developer applied to the developing roller in a given controlled amount leaves the control roller and is conveyed to the region of development which faces the photoconductor which is the recording medium. Here, since the developing roller and the control roller are rotated in the same direction at the section of contact between them, the friction between the developer deposited on the surface of the developing roller and the control roller is lowered, and energy is not consumed uselessly by, for example, production of heat at the section of contact with the developer, thus accomplishing efficient control of the developer. Particularly, since the control member is in the shape of a roll (cylinder), even with some irregularities partially formed thereon, its rotation allows application of a constant amount of the developer. In addition, since the entire control roller is pressed against the developing roller, the section of contact between them tends to be in a uniform state of contact.

Particularly, according to the configuration of the twenty-fifth embodiment, since the developing roller is brought into contact successively with different sections of the surface of the control roller during rotation, even in cases where some sections of the control roller have irregularities formed thereon, the fresh sections act to level the uneven state of the developer deposited on the developing roller. Here, even if the developer is deposited on the control roller, and irregularities are formed due to fusion of the deposited developer by rotation of the control roller, fresh sections of the control surface are successively brought into contact with the developing roller, and therefore the uneven state of the developer is leveled. For this reason as well, it is important to rotate the control roller faster than the developing roller so that the developing roller contacts different sections of the surface of the control roller successively.

Electrostatic deposition of the charged developer on the control roller may be prevented by connecting the control roller to an grounding potential according to the configuration of the twenty-sixth embodiment, for example. This results in eliminating fusion of the developer deposited on the control roller and consequent formation of irregular sections on the surface of the control roller. Thus, it becomes possible to apply a constant amount of developer to the developing roller.

In addition, provision of means for removing the developer deposited on the control roller after control of the amount of the developer applied to the developing roller according to the configuration of the twenty-seventh embodiment, for example, serves to prevent the fusion of the developer deposited on the surface of the control roller, thus preventing the result of uneven application of the developer and increasing the life of the control roller.

BRIEF DESCRIPTION OF THE DRAWINGS

Other and further objects, features, and advantages of the invention will be more explicit from the following detailed description taken with reference to the drawings wherein:

FIGS. 23A and 23B are views of the developer cartridge equipped with a developer-applying member made of a rigid material, wherein FIG. 23A is a structural schematic view of the entire developer cartridge, and FIG. 23B is an enlarged view of the main portion which illustrates the relationship between the developer-applying member and the developing roller;

FIGS. 24A and 24B are views of the developer cartridge equipped with a developer-applying member made of an elastic material, wherein FIG. 24A is a structural schematic view of the entire developer cartridge, and FIG. 24B is an enlarged view of the main portion which illustrates the relationship between the developer-applying member and the developing roller;

FIGS. 27A and 27B are views of the developer cartridge equipped with a U-section developer-applying member, with the corner in contact with the developing roller under pressure, wherein FIG. 27A is a structural schematic view of the entirety, and FIG. 27B is an enlarged perspective view of the main portion;

FIGS. 28A and 28B are views of the developer cartridge equipped with a developer-applying member made of a thick, elastic material, wherein FIG. 28A is an entire structural schematic view of the developer cartridge, and FIG. 28B is an enlarged view of the main portion which illustrates the relationship between the developer-applying member and the developing roller;

FIGS. 29A and 29B are views of the developer cartridge equipped with two layers of sheet-like developer-applying members, wherein FIG. 29A is a structural schematic view of the entire developing cartridge, and FIG. 29B is an enlarged view of the main portion which illustrates the relationship between the developer-applying member and the developing roller;

FIGS. 31A and 31B are views of the state of a contact member attached to the distal end of the developer-applying member in the developer cartridge, wherein FIG. 31A is a structural schematic view of the entire developer cartridge, and FIG. 31B is an enlarged view of the main portion which illustrates the relationship between the developer-applying member and the developing roller;

FIGS. 32A and 32B are views of a bristle-tipped developer-applying member in the developer cartridge, wherein FIG. 32A is a structural schematic view of the entire developer cartridge, and FIG. 32B is an enlarged view of the main portion which illustrates the relationship between the developer-applying member and the developing roller;

FIGS. 34A through 34C are views of a hole or slit formed in the developer-applying member in the developer cartridge, wherein FIG. 34A is a structural schematic view of the entire developer cartridge, FIG. 34B is an enlarged view of the main portion which illustrates the slit state of the developer-applying member, and FIG. 34C is an enlarged view of the main portion which illustrates the state of the developer-applying member provided with a valve body for the hole or slit;

FIGS. 35A and 35B are views of a spring-biased state of the developer-applying member in the developer cartridge, wherein FIG. 35A is a structural schematic view of the entire developer cartridge, and FIG. 35B is an enlarged view of the main portion which illustrates the relationship between the developer-applying member and the developing roller;

FIGS. 38A through 38C are views of a sandblasted state of the developer-applying member in the developer cartridge, wherein FIG. 38A is a structural schematic view of the entire developer cartridge, FIG. 38B is an enlarged view of the main portion of the developer-applying member, and FIG. 38C is a view of the main portion which illustrates the relationship between the developer-applying member and the developing roller;

FIGS. 43A and 43B are views of the developer cartridge holder with a developer-applying member and a scrubbing member mounted thereon, wherein FIG. 43A is a side view of the main portion, and FIG. 43B is a front view of the main portion;

FIGS. 46A and 46B are views illustrative of the relationship between the size of cells and the amount of scrubbed developer in cases where the scrubbing member is made of polyurethane foam, wherein FIG. 46A shows the amount of scrubbed developer in cases where the cells are large, and FIG. 46B shows the amount of scrubbed developer in cases where the cells are small;

FIG. 60B is an enlarged view of the scrubbing member shaped as a sheet with a resin material;

FIGS. 64A and 64B are views of the developer cartridge which has the developer agitation roller provided with a blading material, wherein FIG. 64A is a structural schematic view, and FIG. 64B is an enlarged perspective view of the main portion;

FIGS. 65A and 65B are views of the developer cartridge which has the developer agitation roller provided with a recovery blade for recovering developer residing upward from the developer-layer thickness control member into a developer tank, wherein FIG. 65A is an entire structural schematic view, and FIG. 65B is an enlarged perspective view of the main portion;

FIGS. 66A through 66C are views of the developer cartridge which is equipped with a recovery blade provided separately from the developer agitation roller to recover developer residing upward from the developer-layer thickness control member into a developer tank in a manner interlocked with the developer agitation roller, wherein FIG. 66A is an entire structural schematic view, FIG. 66B is an enlarged perspective view of the main portion, and FIG. 66C is a view illustrative of the operation;

FIGS. 72A and 72B are views illustrative of the angle of contact of the developer-applying member with respect to the developer-layer thickness control member in the developer cartridge, wherein FIG. 72A is a view of the movement of developer in cases where the developer-layer thickness control member is in contact with the developing roller at a right or acute angle, and FIG. 72B is a view of the movement of developer in cases where the developer-layer thickness control member is in contact with the developing roller at an obtuse angle;

FIGS. 80A and 80B are views illustrative of a developer-applying member with slits or holes formed therein, wherein FIG. 80A is a perspective view illustrative of the formation of slits, and FIG. 80B is a perspective view illustrative of the formation of holes;

FIGS. 85A and 85B are views illustrative of the developer cartridge equipped with the developer-applying member holed and provided with a valve body for the hole, wherein FIG. 85A is an entire structural schematic view, and FIG. 85B is an enlarged view of the main portion;

FIGS. 93A and 93B are views illustrative of the formation of a plurality of holes in the developer-applying member in the developer cartridge, wherein FIG. 93A is a perspective view of the developer-applying member and the scrubbing member, and FIG. 93B is a section view taken on line X—X in FIG. 93A;

FIGS. 94A and 94B are views illustrative of ribs formed in the developer-applying member in the developer cartridge, wherein FIG. 94A is a section view of V-section ribs, and FIG. 94B is a section view of U-section ribs;

FIGS. 96A, 96B and 96C are views of V-section and U-section, inclined ribs formed in the developer-applying member, wherein FIG. 96A is a front view of the developer-applying member, FIG. 96B is a section view of the V-section rib taken on line Y—Y in FIG. 96A, and FIG. 96C is a section view of the U-section rib taken on line Y—Y in FIG. 96A;

FIGS. 99A and 99B are views illustrative of the formation of one valve body for the holes of the developer-applying member, wherein FIG. 99A is a perspective view, and FIG. 99B is a side view;

FIGS. 119A and 119B are structural schematic views of an additional developer cartridge of the prior art which is equipped with a developer leakage-preventing device, wherein FIG. 119A is a structural schematic view of a virgin state thereof, and FIG. 119B is a structural schematic view of a usable state thereof.

DETAILED DESCRIPTION OF THE PREFERRED EMBODIMENTS

Figure 1:
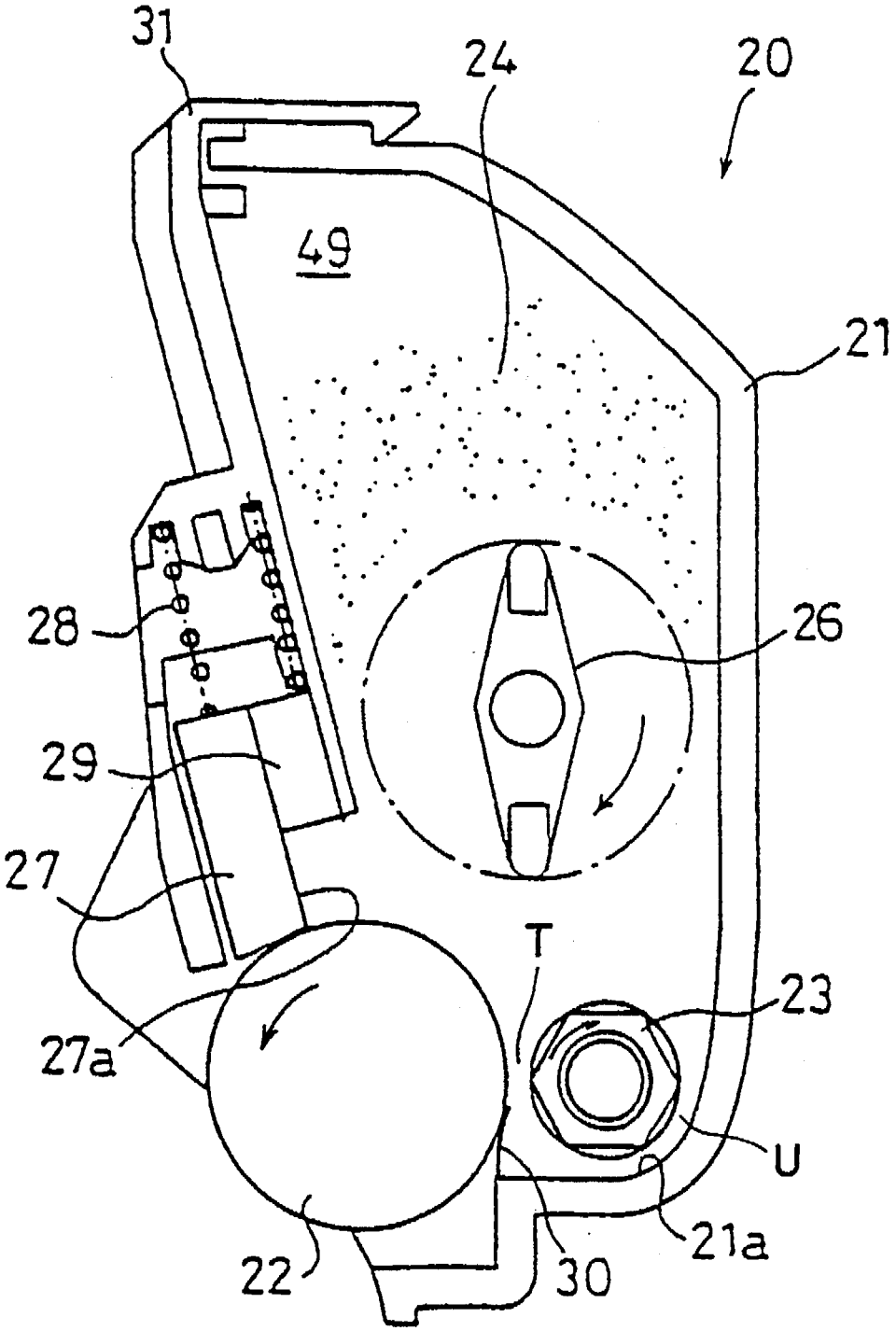
FIG. 1 is a structural schematic view illustrative of a developer cartridge for printers according to a first embodiment of the present invention.

Now referring to the drawings, preferred embodiments of the invention are described below.

EXAMPLE 1

An example of the present invention will be explained below with reference to FIG. 1 through FIG. 21.

Figure 2:
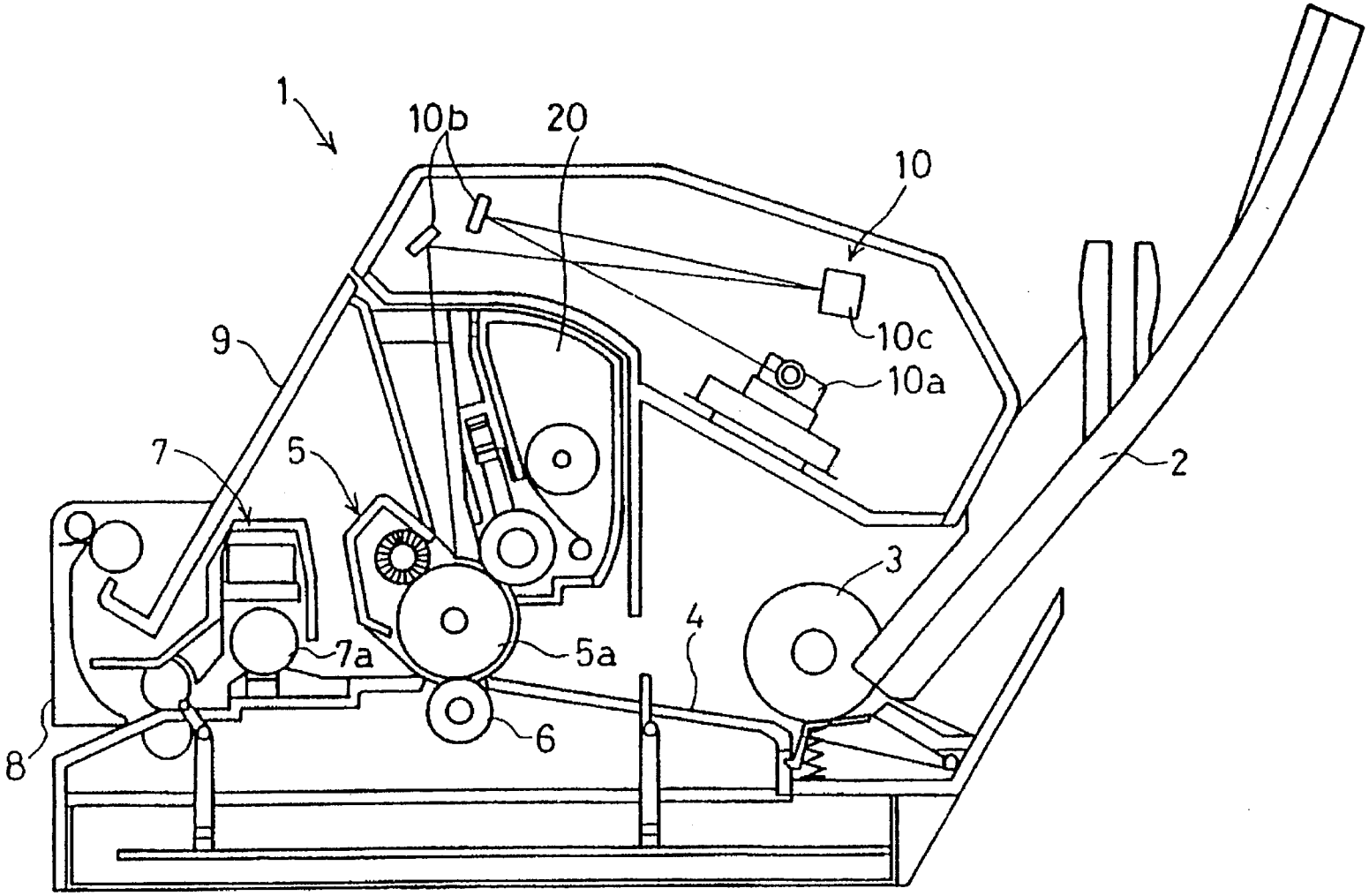
FIG. 2 is a structural schematic view illustrative of an entire printer with the developer cartridge mounted therein.

As shown in FIG. 2, a laser-beam printing apparatus as the image forming apparatus according to the present example (hereunder referred to simply as "printer") is equipped with a sheet feed tray 2 for inserting sheet-like recording paper (not shown) into a main body 1 at its side. A sheet feed roller 3 is provided at the sheet feed front side or the lower end side of the sheet feed tray 2, and a roughly horizontal sheet conveyer passage 4 is provided at the sheet feed front side of the sheet feed roller 3. Placed at almost the center of the sheet conveyer passage 4 are a drum cartridge 5 comprising a photoconductor drum 5*a*, and a transfer roller 6.

Also, provided at the sheet feed front side of the transfer roller 6 is a fixation unit 7 having a fixation roller 7*a*. A U-turn guide 8 for ejecting the recording paper upward is provided at the sheet feed front side of the fixation unit 7 in such a manner that the recording paper is ejected onto the front cover 9 of the main body 1 along the U-turn guide 8.

On the other hand, a developer cartridge 20 is provided above the drum cartridge 5 as the developing device to supply developer 24 to the surface of the photoconductor drum 5*a*, while an optical unit 10 for irradiating the photoconductor drum 5*a* with light is provided above the developer cartridge 20.

The optical unit 10 has a semiconductor laser device 10*a*, reflecting mirrors 10*b* and 10*b*, a polygonal mirror 10*c*, etc., which are all built-in, and light emitted from the optical unit 10 strikes the surface of the photoconductor drum 5*a* to expose the photoconductor drum 5*a* to light, thereby forming a given electrostatic latent image on the surface of the photoconductor drum 5*a*.

This electrostatic latent image formed on the photoconductor drum 5*a* is developed by the developer 24 which is supplied by the developer cartridge 20, and the resulting developer image is advanced clockwise toward the section of contact between the photoconductor drum 5*a* and the transfer roller 6.

In synchronization with this, recording paper is supplied from the sheet feed tray 2 via the sheet feed roller 3, and this recording paper is conveyed along the sheet conveyer passage 4 to the transfer region or the section of contact between the photoconductor drum 5*a* and the transfer roller 6.

While the recording paper passes through this region, the developer image formed on the surface of the photoconductor drum 5*a* is transferred onto the recording paper due to the potential difference between its charge and the charge on the surface of the recording paper.

Subsequently, the recording paper is conveyed to the fixation unit 7 with the fixation roller 7*a* and subjected to heating and pressing in the fixation unit 7. Here, the developer 24 on the recording paper is fusion-bonded onto the recording paper by heat and pressure from the fixation roller 7*a*. The recording paper, which has left the fixation unit 7, is then guided upward along the U-turn guide 8 and ejected onto the front cover 9 of the apparatus body 1.

As shown in FIG. 1, the cartridge body 21 of the developer cartridge 20 of the laser-beam printing apparatus of the present example has a developing roller 22, a developer feed roller 23 as the developer feed roller and a developer agitation roller 26 as the developer agitation roller, etc., which are all provided in a developer tank 49. The developing roller 22, the developer feed roller 23 and the developer agitation roller 26 are designed to be rotated by driving gears (not shown) in the respective directions indicated by the arrows, with the respective shaft sections (not shown) supported on the bearings provided on the cartridge body 21.

In addition, the developer cartridge 20 is provided with a developer-layer thickness control member 27 which controls the thickness of the layer of developer 24 which is the developer deposited on the surface of the developing roller 22, a spring 28, an upper sealing material 29, a lower sealing material 30, a cartridge cover 31, etc. The spring 28 biases the developer-layer thickness control member 27 so that the member 27 is brought into contact with and pressed against the developing roller 22. Also, the upper sealing material 29 is composed of an elastic member such as a sponge and is placed between the cartridge cover 31 and the developer-layer thickness control member 27 so as to prevent leakage of the developer 24 through the side, while the lower sealing material 30 is placed in contact with the developing roller 22 in order to prevent leakage of the developer 24 through the bottom of the developing roller 22.

The inside of the developer cartridge 20 constructed as mentioned above is designed so that the developer 24 in the developer tank 49 is conveyed toward the developer feed roller 23 by the developer agitation roller 26 and then toward the developing roller 22 after passing between the developer feed roller 23 and the section of the inner wall surface 21*a* of the cartridge body 21 which faces the roller 23 (hereunder referred to as "opposing inner wall surface"), and then deposited on the developing roller 22, adjusted to an even thickness by the developer-layer thickness control member 27 and finally deposited on the photoconductor drum 5*a* to develop the electrostatic latent image on the photoconductor drum 5*a*.

Figure 3:
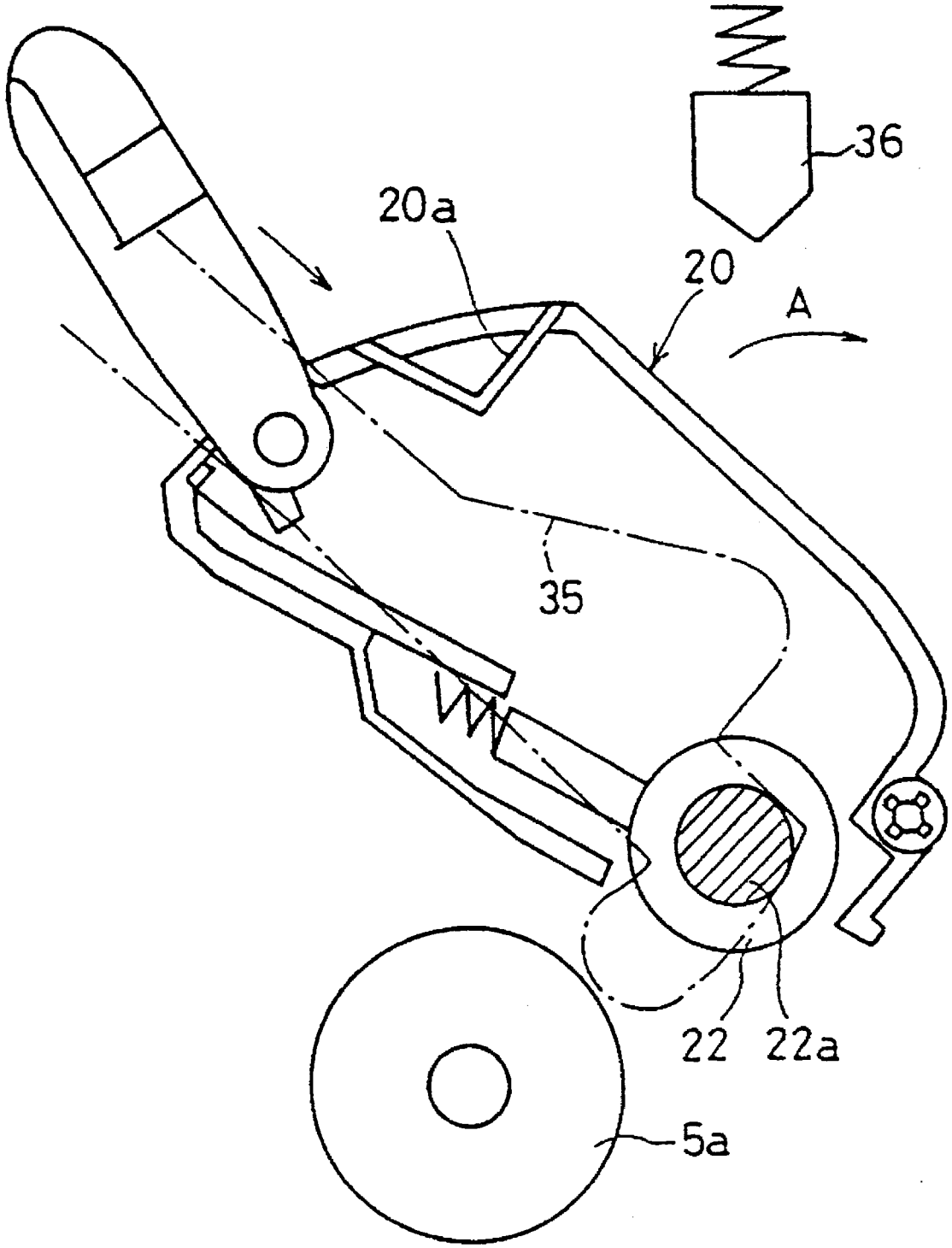
FIG. 3 is a view which illustrates how the developer cartridge is mounted in the printer.

The developer cartridge 20 is a removable type; in order to install the developer cartridge 20, as shown by the alternate long and short dash line in FIG. 3, two ends of the shaft section 22*a* of the developing roller 22 of the developer cartridge 20 are inserted from above into the guide groove 35 formed in the apparatus body 1, and then the developer cartridge 20 is rotated in the direction of the arrow A. With this configuration, a recess section 20*a* formed at the top of the developer cartridge 20 is engaged with a drum-pressing spring 36 which biases the developer cartridge 20 toward the photoconductor drum 5*a*. This brings the developing roller 22 into contact with the photoconductor drum 5*a*.

Details of the developer cartridge 20 will now be explained.

In cases where a non-magnetic, one-component type developer is used, the developing roller 22 is in contact with the photoconductor drum 5*a* at a given nip, and is formed of polyurethane rubber having a volume resistance of, for example, $1\times10^8$ Ωcm. In this connection, since the developing roller 22 and the photoconductor drum 5*a* are brought into contact with each other with the given nip, preferably the raw material of the developing roller 22 is selected from rubber materials having electrical conductivity and elasticity. For example, urethane rubber, silicon rubber, and rubber of the NBR (Nitrile-Butadiene Rubber) family may be used.

The developing roller 22 is preferred to have an Asker C hardness of 50–90, while the volume resistance is preferred to be $10^4$–$10^8$ Ωcm; $10^6$–$10^7$ Ωcm provides the developing roller 22 with the best characteristics. Here, the Asker C is a standard for hardness specified by the Japanese Rubber Association, representing hardness based on the depth (indentation depth) into a specimen by a hardness measuring needle having a spherical tip in a specimen when the needle is pressed against the surface of the specimen by a spring until a balance is achieved between the resistance of the specimen and the force of the spring. According to the Asker C standard, a hardness of "0" is assigned to a specimen in cases where the indentation depth of the needle observed when a load of 55 g is imposed on the spring is equal to the greatest displacement of the needle, and a hardness of "100" is assigned to a specimen in cases where the indentation depth of the needle observed when a load of 855 g is imposed on the spring is zero.

Provided near the developing roller 22 and in non-contact therewith is the developer feed roller 23 which is the developer feed roller for conveying and supplying the developing developer 24 to the developing roller 22. The developer 24 is non-magnetic developer composed of a styrene-acrylic or polyester resin.

The developer feed roller 23 is a regular polygonal prism. Preferably the regular polygonal prism has, for example, a cross section bounded by three to eight line segments from the point of view of the amount of conveyance; a regular hexagonal prism is used in the present example.

Figure 4:
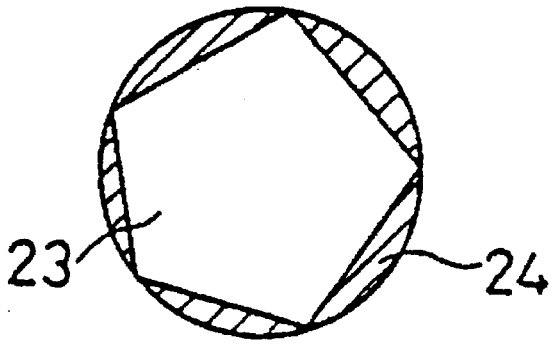
FIG. 4 is a view illustrative of developer-conveying sections of the developer feed roller in the developer cartridge.
Figure 5:
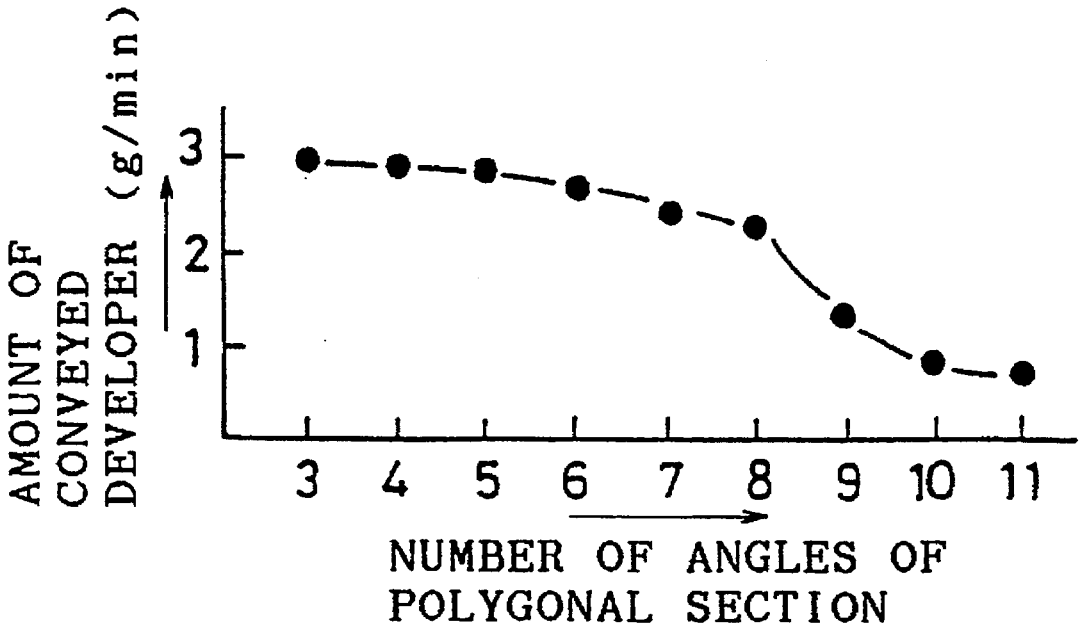
FIG. 5 is a graph illustrative of the relationship between the number of angles of the polygonal section of the developer feed roller and the amount of conveyed developer.

More specifically, as shown in FIG. 4, the developer 24 is conveyed along the side surface of the regular polygonal prism-shaped developer feed roller 23. Here, the amount of the developer to be conveyed by the developer feed roller 23 is calculated as the difference in volume between the cylinder circumscribing the regular polygonal prism and the regular polygonal prism. Based on this calculation method, the amount of the developer to be conveyed on respective regular polygonal prisms having a cross section bounded by three or more line segments is shown in FIG. 5. Plotted along the Y-axis in FIG. 5 is the amount of the developer conveyed per minute. A one-minute measurement was repeated five times, and the amount of the conveyed developer is taken from an average of five data for 5 minutes.

Figure 6:
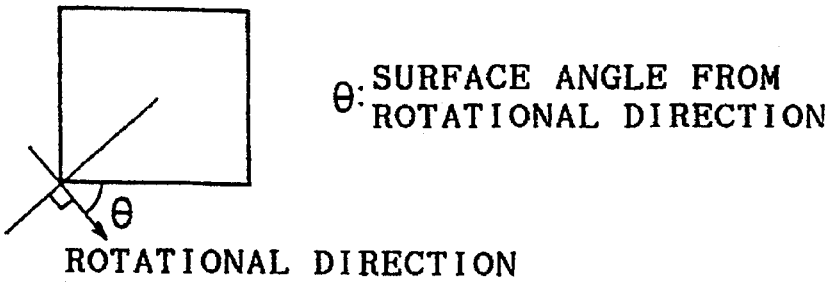
FIG. 6 is a view which illustrates definition of the surface angle with respect to the direction of rotation of the polygonal-section developer feed roller.

The relationship shown in FIG. 5 reveals that the regular polygonal prism is preferred to have a regular cross section bounded by three to eight line segments from the point of view of the conveyed amount. This is because the developer 24 experiences a force perpendicular to the surface of the regular polygon, and thus, in cases where the surface angle θ with respect to the direction of rotation shown in FIG. 6 is excessively small, the component in the direction of rotation of the force pushing the developer 24 outward becomes too small to convey the developer 24 along the direction of rotation, thus impairing the conveying capacity. Since the surface angle with respect to the direction of rotation is 60° for a regular triangular prism and 22.5° for a regular octagonal prism, desired amounts of conveyance may be established by controlling the surface angle with respect to the direction of rotation within a range of 22.5°–60°. Furthermore, since regular triangular prisms or regular tetragonal prisms provide uneven amounts of conveyance, a regular pentagonal prism or a regular octagonal prism is preferred for consistent conveyance of the developer 24.

Combinations of values designed for the developing roller 22 and the developer feed roller 23 for consistent conveyance of the developer 24 will now be exemplified. In a first instance where a non-magnetic, one-component type developer is used with a developing roller 22, the diameter set to 20 mm and the peripheral speed set to 25 mm/sec, and with the photoconductor drum 5*a* in contact with the developing roller 22 under pressure with a 0.15 mm nip, it is possible to shape the developer feed roller 23 as a regular heptagonal prism and to set the diameter of the circle circumscribing the prism to 15 mm and the peripheral speed to 40 mm/sec.

In a second instance where a non-magnetic, one-component type developer is used with a developing roller 22 made of electrically conductive urethane rubber, the diameter set to 20 mm and the peripheral speed set to 45 mm/sec, and with the photoconductor drum 5*a* in contact with the developing roller 22 under pressure with a 0.2 mm nip, it is possible to shape the developer feed roller 23 as a regular tetragonal prism and to set the diameter of the circle circumscribing the prism to 10 mm and the peripheral speed to 25 mm/sec.

In a third instance where a non-magnetic, one-component type developer is used with a developing roller 22 made of electrically conductive EPDM (Ethylene Propylene Diene Methylene) rubber, the diameter set to 15 mm and the peripheral speed set to 45 mm/sec, and with the photoconductor drum 5*a* in contact with the developing roller 22 under pressure with a 0.2 mm nip, it is possible to shape the developer feed roller 23 as a regular hexagonal prism and to set the diameter of the circle circumscribing the prism to 12 mm and the peripheral speed to 50 mm/sec.

In a fourth instance where a non-magnetic, one-component type developer is used with a developing roller 22 made of magnet-containing aluminum, the diameter set to 20 mm and the peripheral speed set to 50 mm/sec, and with a gap of 200 μm provided between the photoconductor drum 5*a* having a photoconductive selenium layer and the developing roller 22, it is possible to shape the developer feed roller 23 as a regular heptagonal prism and to set the diameter of the circle circumscribing the prism to 15 mm and the peripheral speed to 40 mm/sec.

Figure 7:
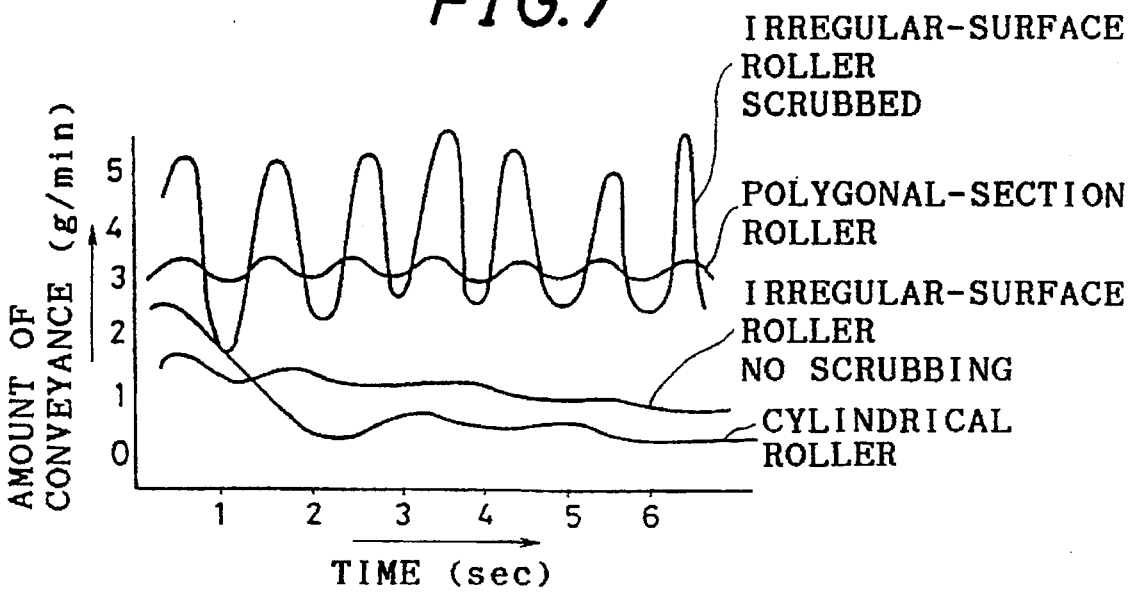
FIG. 7 is a graph illustrative of the amounts of developer conveyed by the polygonal-section developer feed roller and a circular-section developer feed roller.

The amount of conveyance in cases where the developer feed roller 23 is a hexagonal prism will now be analyzed in comparison with the performance of a cylindrical developer feed roller and a developer feed roller with irregularities formed thereon, both of the prior art. As shown in FIG. 7, the result is that the regular hexagonal developer feed roller 23 conveys the developer 24 in a greater amount than the cylindrical developer feed roller and more consistently than the developer feed roller with irregularities formed thereon. It has also been revealed that the amount of conveyance is insufficient in cases where the developer feed roller with irregularities formed thereon is not equipped with a scrubbing member, but a sufficient amount is conveyed by the regular hexagonal prism-shaped developer feed roller 23.

The data shown in FIG. 7 is for a case where the developer feed roller 23 is a regular hexagonal prism with an outermost diameter of 10 mm, and the cylindrical developer feed roller has a 10 mm diameter of the circle circumscribing the prism. In addition, the developer feed roller with irregularities formed thereon is a regular hexagonal prism with an outermost diameter of 10 mm and provided with six grooves each 2 mm wide and 1 mm deep, arranged along its transverse direction.

The rotation speed was 10 rpm in all cases. Regarding the developer feed roller with irregularities formed thereon, an analysis was carried out to collect data on the influence of the presence or absence of a scrubbing member. The amount of conveyance was determined by measuring the amount of the developer 24 which fell in the space for mounting the developing roller 22, but was emptied by removal thereof.

Figure 8:
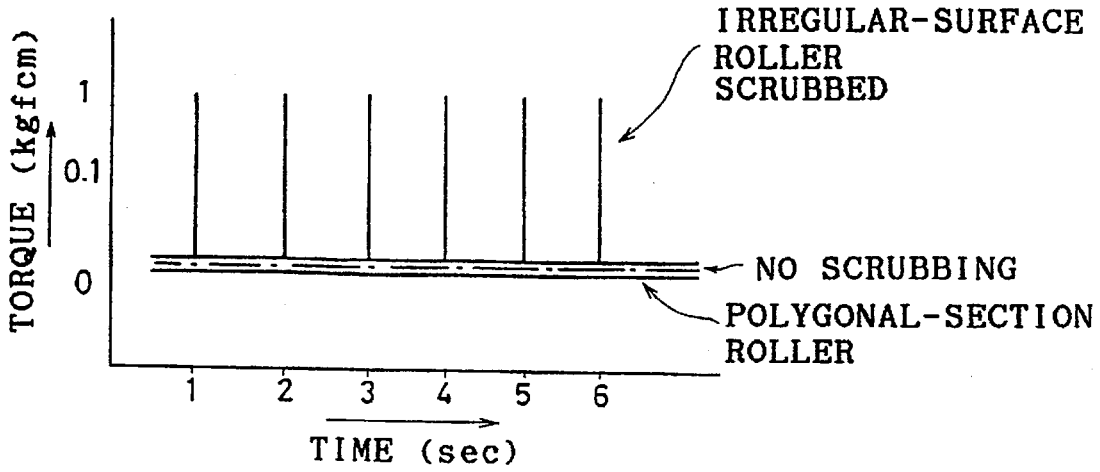
FIG. 8 is a graph illustrative of the torque of the polygonal-section developer feed roller and the circular-section developer feed roller.

Subsequently, an investigation was also made of change in driving torques of developer feed rollers of the types described above. Conditions for the rollers, etc. are the same as in FIG. 7. As a result, as shown in FIG. 8, it has been revealed that the regular hexagonal prism-shaped developer feed roller with irregularities formed thereon and provided with a scrubbing member undergoes great change in torque, whereas the torque of the regular hexagonal prism-shaped developer feed roller 23 is constant.

Figure 9:
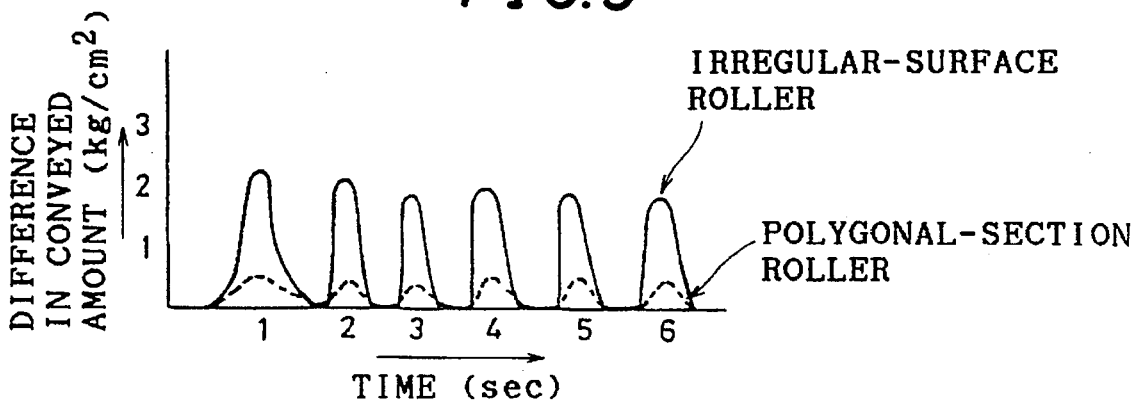
FIG. 9 is a graph illustrative of the difference in the amount of conveyed developer between the polygonal-section developer feed roller and a developer feed roller with irregularities formed thereon.

Subsequently, a change in the amount of conveyance was investigated for a change of +−1 mm in length of the scrubbing member with respect to that of the regular hexagonal prism-shaped developer feed roller with irregularities formed thereon. The results are shown in FIG. 9. Plotted along the Y-axis are absolute values of the differences between the amount of conveyance "a" for the longer scrubbing member and the amount of conveyance "b" for the shorter scrubbing member |a−b|, and times in seconds are plotted along the X-axis. Therefore, greater absolute values |a−b| reflect the need to use higher precision scrubbing members. As a result, it has been found that the performance of the regular hexagonal prism-shaped developer feed roller with irregularities formed thereon is greatly influenced by the length of the scrubbing member, whereas the length of the scrubbing member has hardly any effect on the performance of the regular hexagonal prism-shaped developer feed roller 23.

On the other hand, an investigation of the relationship between the amount of developer conveyed by the developer feed roller 23 and the amount of developer consumed by the developing roller 22 suggests that the amount of developer $V_S$ conveyed by the developer feed roller 23 per unit time may he expressed by the equation:

$$V_S=S_r\times L_r\times R_r$$

($S_r$: developer conveyance area, $R_r$: number of rotations, $L_r$: roller length) while the amount of developer $V_d$ consumed by the developing roller 22 per unit time may be expressed by the equation:

$$V_d=S_d\times L_d\times R_d$$

($S_d$: developer conveyance area, $R_d$: number of rotations, $L_d$: roller length).

Accordingly, in order to make the amount of the developer fed to the developing roller 22 more consistent, at least the relationship: $V_S\geqq V_d$, and more specifically $S_r\times L_r\times R_r\geqq S_d\times L_d\times R_d$, must be satisfied. Since the rollers 22 and 23 have the same lengths $L_d$ and $L_r$, the above-mentioned implies that all that is needed is to satisfy the relationship: $S_r\times R_r\geqq S_d\times R_d$, that is, $(S_r\times R_r)/(S_d\times R_d)\geqq 1$. In other words, representing the left side of the inequality by a constant k, k must be 1 or more.

Figure 10:
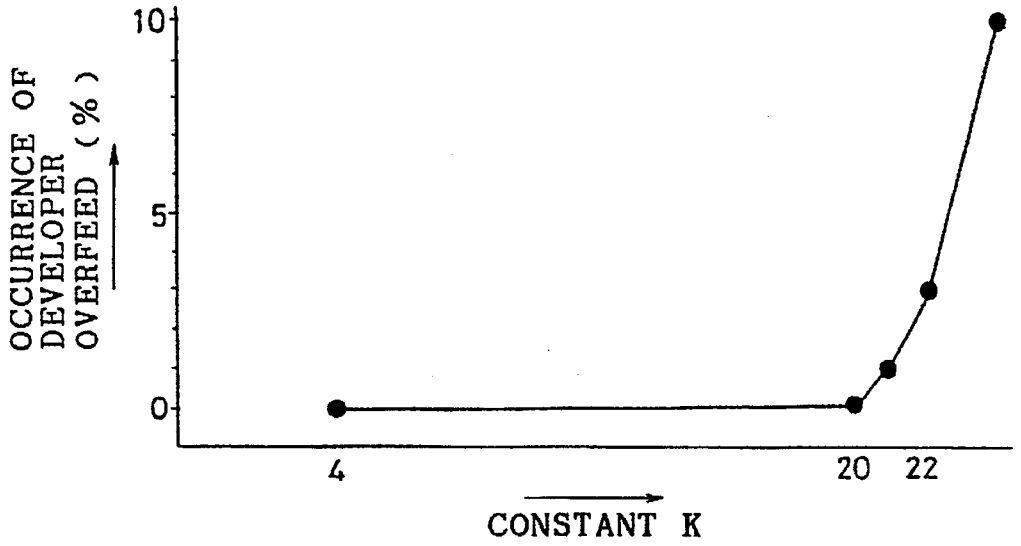
FIG. 10 is a graph illustrative of the relationship between the constant "k" and occurrence of background of developer by the developer feed roller.

The relation between the constant k and the occurrence of back ground of developer is shown in FIG. 10. According to FIG. 10, it is apparent that the constant k is preferred to be 20 or less. This means that as the constant k increases the amount of conveyance by the developer feed roller 23 increases too much to be controlled by the developer-layer thickness control member 27, and as a result a greater amount of the developer 24 is deposited than normal after passage of the developer-layer thickness control member 27, thus causing back ground of developer on the printed image. Conversely, in cases where the constant k is less than 1, the amount of consumption by the developing roller 22 exceeds the amount of conveyance, and thus solid printing cannot be accomplished. For the foregoing reasons, the relationship: $1\leqq k\leqq 20$ must be satisfied.

Discussion will now center on the distance U, as shown in FIG. 1, between the developer feed roller 23 and the facing inner wall surface 21*a* of the developer cartridge 20.

Figure 11:
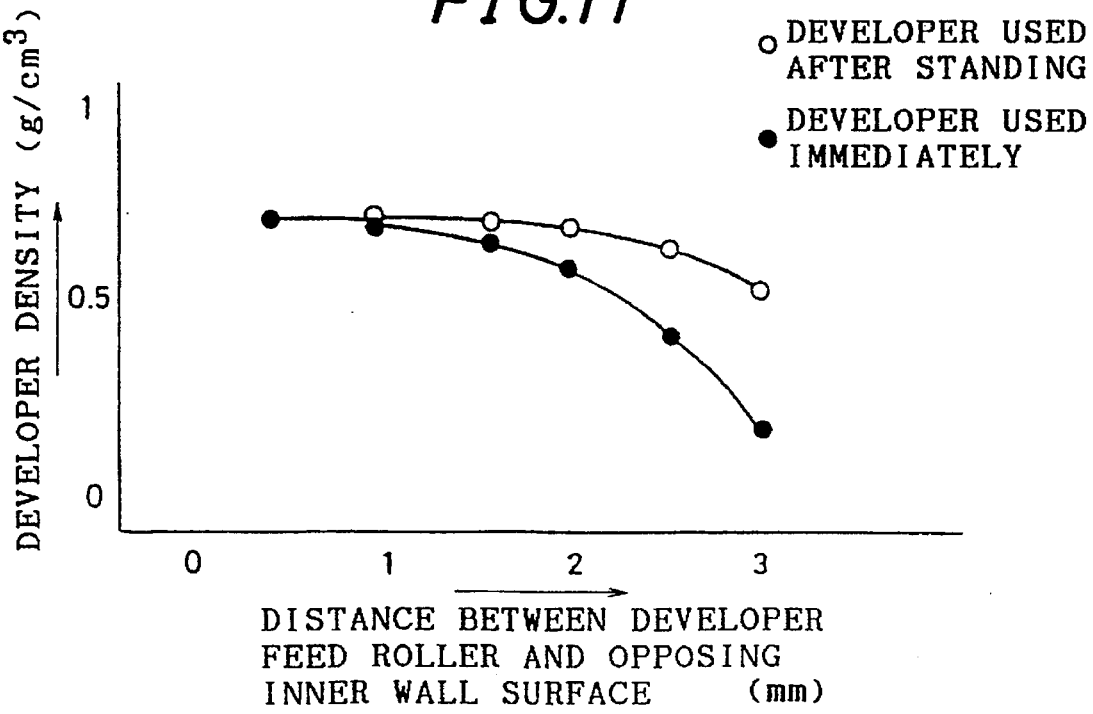
FIG. 11 is a graph illustrative of the relationship between the distance of the developer feed roller from the facing inner wall surface, and the developer density.

The relation between the distance U and the developer density is shown in FIG. 11. According to FIG. 11, it is apparent that a greater distance U results in a smaller developer density. In addition, by comparing performances in the cases where the developer 24 was used immediately after being packed into the developer tank 49 (indicated by solid circles) with performances in the cases where the developer 24 was used after being allowed to stand for a while in the developing tank 49 (indicated by circles), it is apparent that the smaller the distance U is, the more effectively the change in developer density due to the standing may be prevented to stabilize the k value described above. This apparently teaches that a smaller distance U results in provision of more stable image quality. In other words, the smaller the distance U is, a greater amount of the developer 24 may be packed around the polygonal prism-shaped developer feed roller 23, thus resulting in increase and stability of the developer density. The results shown in FIG. 11 suggest that the distance U has an optimum range of $0<U\leqq 2$ mm.

Figure 12:
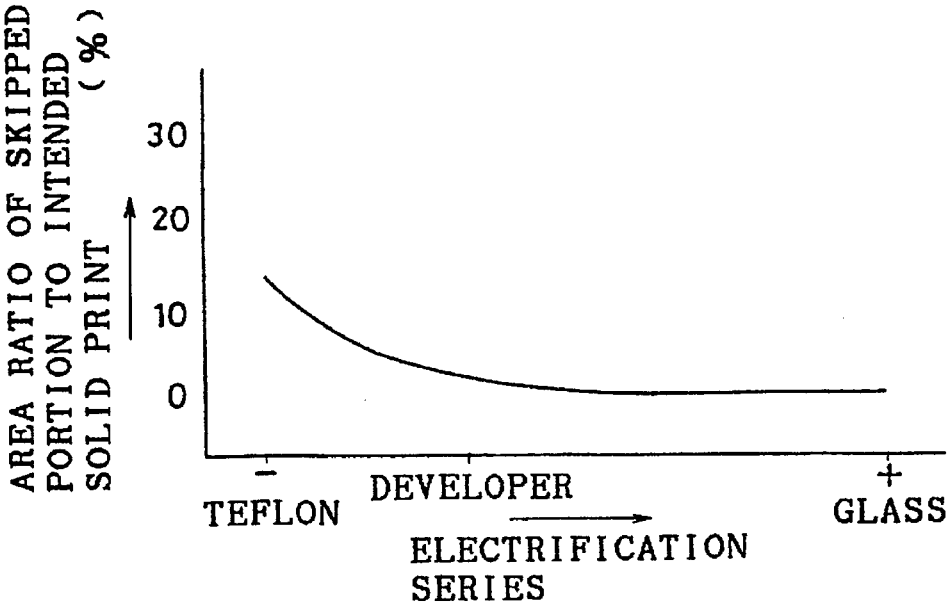
FIG. 12 is a graph illustrative of the relationship between electrification series of materials for the developer feed roller, and the area ratio of skipped portions to an intented solid black print.

On the other hand, the developer feed roller 23 is composed of, for example, aluminum or glass fiber which is located far from the negatively charged developer 24 in the electrification series. More specifically, in the present example, the developer 24 is composed of a styrene-acrylic resin as described above and thus is negatively charged. Here, in cases where the developer feed roller 23 is also composed of a material which is of a rank in the electrification series which tends to be negatively charged, the developer 24 has a lower tendency to be charged, and thus fails to accomplish charging in advance, or frictional electrification. In other words, as shown in FIG. 12, the developer 24 has a greater tendency to be charged negatively when the material composing the developer feed roller 23 ranks higher toward the + side of the electrification series. As a result, the area ratio of skipped or unprinted portions to the total intented solid black print (skipped area/total intented solid black print area) becomes smaller. In addition, the developer 24 causes back ground of developer when it is positively charged. Accordingly, when subjected to frictional electrification with a member which ranks higher than the negatively charged developer 24 toward the + side of the electrification series, the developer 24 is negatively charged to such a degree as to provide good image quality free from overfed developer.

Although aluminum or the like is used for the developer feed roller 23 in the present example, the present invention is not limited to the use thereof. For example, since the polarity of the developer feed roller 23 may be made opposite to the charged polarity of the developer 24 by adding a CCA (Charge Control Agent) to the material of the developer feed roller 23, it is possible to select a low-cost, easy-to-work material. As an example, mixing of at least 2% of a quaternary ammonium salt, which is a CCA charged more positively than the charged polarity of the developer 24, in a Teflon resin allows the developer 24 to be negatively charged. Mixing of glass fiber or the like in another type resin also produces the same effect as the above case of addition of a CCA.

The distance between the developer feed roller 23 and the developing roller 22 will now be analyzed.

Figure 13:
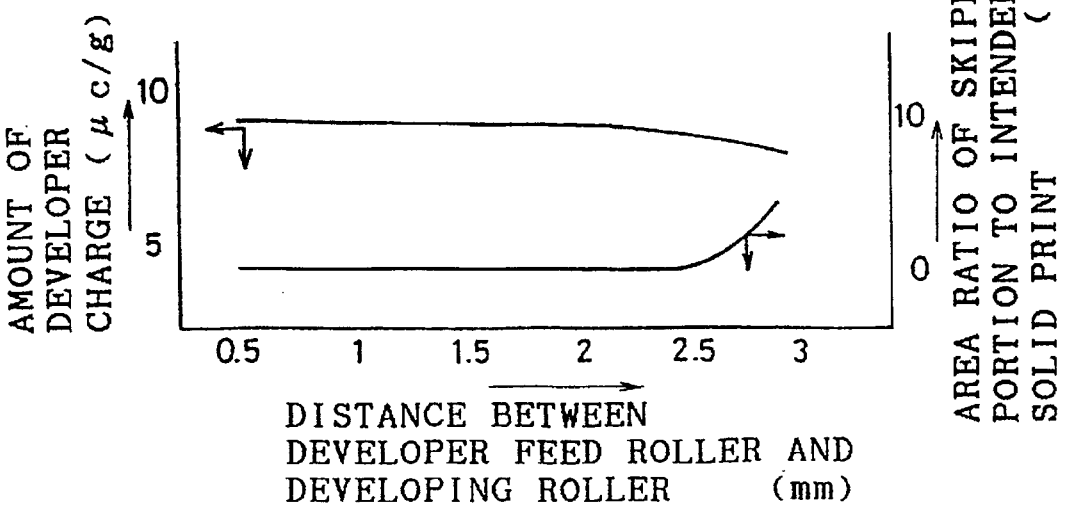
FIG. 13 is a graph illustrative of the relationship between the distance of the developer feed roller from the developing roller, and the area ratio of skipped portions to an intented solid black print.

Preferably the distance T between the developer feed roller 23 and the developing roller 22 is on the order of from 0.5 mm to 2 mm. That is, as shown in FIG. 13, the smaller the distance T between the developer feed roller 23 and the developing roller 22, the more developer is charged, and thus the less area is skipped in solid printing. Here, for collecting the data shown in FIG. 13, the developer feed roller 23 was composed of aluminum. In addition, the reason why FIG. 13 does not include data on the performance of the case where the distance T between the developer feed roller 23 and the developing roller 22 is less than 0.5 mm is that the torque increases too much to prevent their use in that case.

Figure 14:
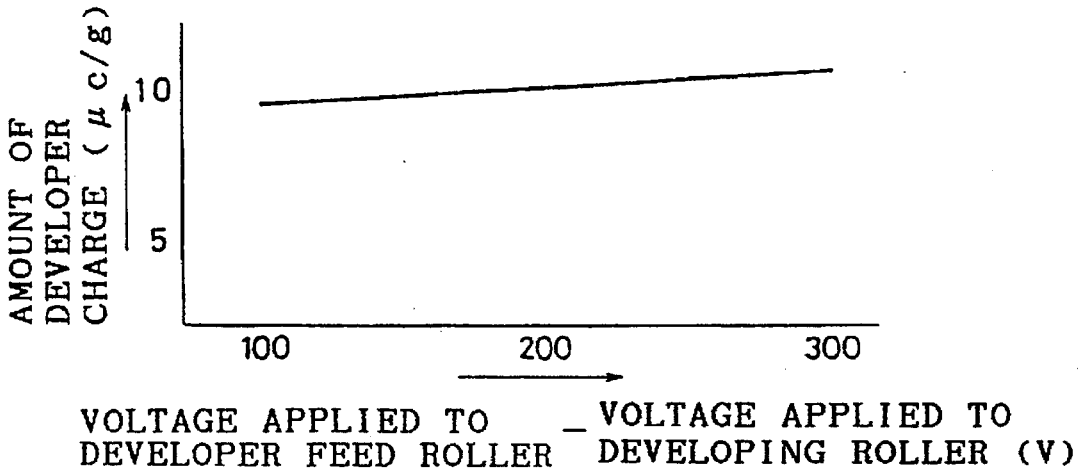
FIG. 14 is a graph illustrative of the relationship between the difference in applied voltages between the developer feed roller and the developing roller, and the amount of charge of developer.

In addition, a bias voltage of the same polarity as of the developer 24 is applied to the developer feed roller 23 in the present example. In this connection, the relation between the bias voltage applied to the developer feed roller 23 and the amount of charge of the developer 24 is shown in FIG. 14. As shown clearly in FIG. 14, as the absolute value |(voltage applied to the developer feed roller 23)—(voltage applied to the developing roller 22)| increases, the amount of charge of the developer 24 increases to accomplish solid printing in a consistent manner. This is because the developer 24 charged by injection of charge from the developer feed roller 23 is pressed against the developing roller 22 due to its potential difference from the developing roller 22 and increases the conveying capacity of the developing roller 22.

In the present example, as shown in FIG. 1, the opposing inner wall surface 21*a* has irregularities with a ten-point mean surface roughness $R_Z$ on the order of 10 μm, formed on the surface. Here, the "ten-point mean surface roughness" is an expression of surface roughness of industrial products as specified by the Japanese Industrial Standards, and is determined as follows. First, a site of a given length is selected for measurement, and a cross section curve of the site is prepared. Then, a mean line for the cross section curve is prepared, and first five maxima and first five minima of the curve with respect to the mean line are selected. Then, five values of difference between the corresponding maxima and minima, such as between the first maximum and minimum, between the second maximum and minimum, etc. are determined and the five values are averaged to determine the ten-point mean surface roughness $R_Z$.

An appropriate range of the $R_Z$ in connection with particle size of the developer is represented by the relationship: $\frac{1}{2}\times$(developer mean particle size)$\leqq R_Z \leqq 10\times$(developer mean particle size). In other words, by finishing the facing inner wall surface 21*a* to an irregular surface rather than to a mirror-smooth surface, the developer 24 is charged uniformly, thus providing overfed developer-free consistent images. This is because the irregularities on the facing inner wall surface 21*a* serve to agitate the developer 24 to facilitate its charging, and the agitated developer 24 is brought into uniform contact with the developer feed roller 23.

Figure 15:
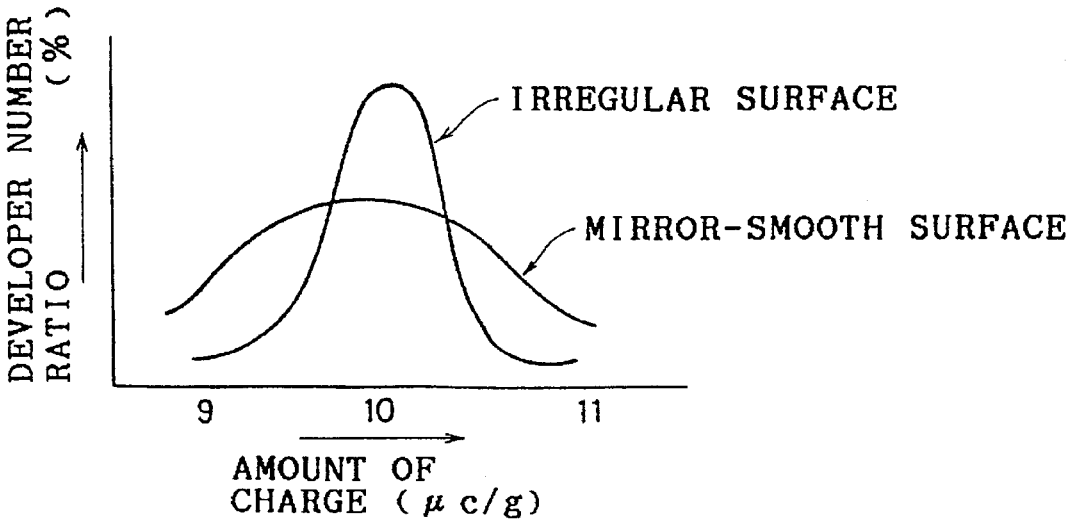
FIG. 15 is a graph illustrative of the relationship between the amount of charge of developer and the number of developer particles in cases where the developer feed roller has an irregular or mirror-smooth surface.
Figure 16:
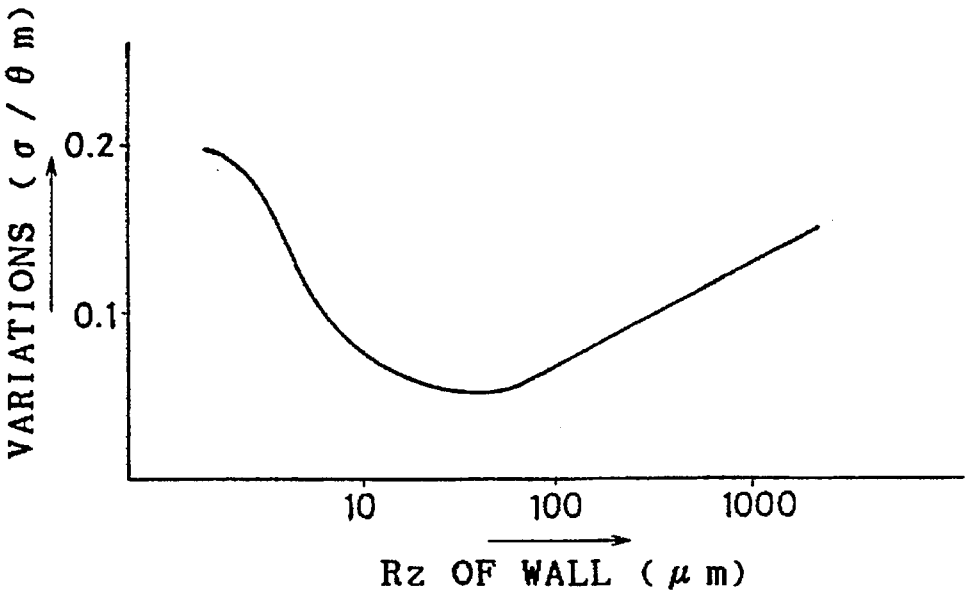
FIG. 16 is a graph illustrative of the relationship between the ten-point mean surface roughness $R_Z$ of the facing inner wall surface and the variation in the amount of charge of developer.

FIG. 15 shows that the finishing of the opposing inner wall surface 21*a* to provide the irregularities contributes to distribution of the sharply increased amount of charge of the developer 24. Accordingly, it is understood that the finishing to provide the irregularities serves to charge the developer 24 uniformly. Here, it is to be noted that, as shown in FIG. 16, the developer 24 exhibits a wide range of amounts of charge in cases where the ten-point mean surface roughness $R_Z$ is small. This is because the developer 24 is stiffly caught on the facing inner wall surface 21*a*, and therefore the developer 24 is charged by mutual contact, resulting in a greater amount of developer being charged to the opposite polarity.

Figure 17:
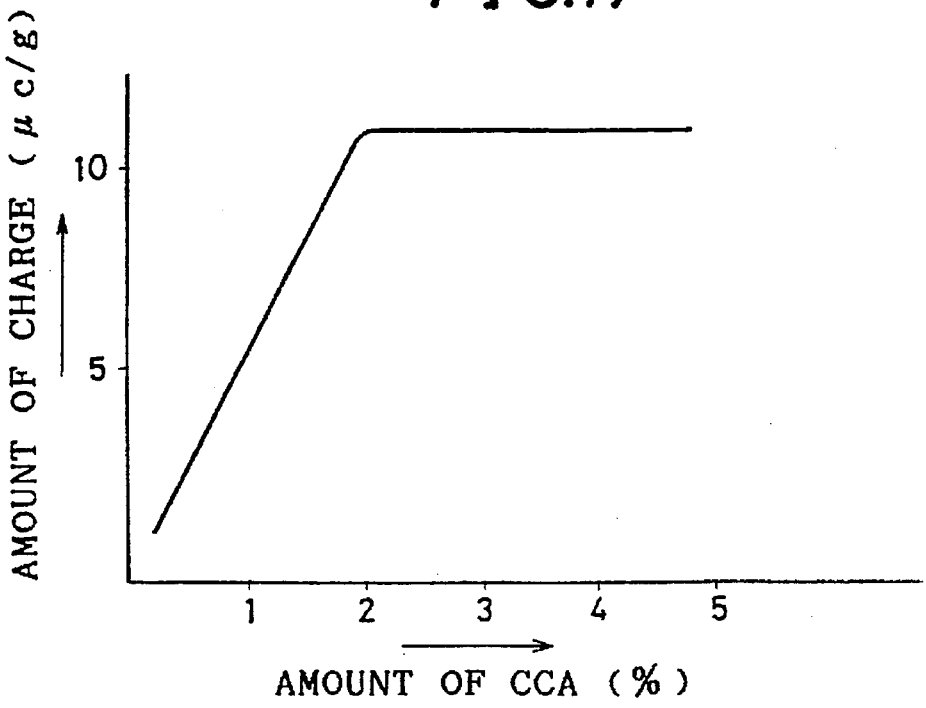
FIG. 17 is a graph illustrative of the amount of charge of developer in cases where a CCA is incorporated in the opposing inner wall surface.

Here, in cases where the opposing inner wall surface 21*a* contains an azo-based CCA, as shown in FIG. 17, the amount of charge increases by 0.5 μC/g in terms of Q/m (amount of charge per unit mass of developer), allowing provision of solidly-printed uniform images free from overfed developer.

Figure 18A:
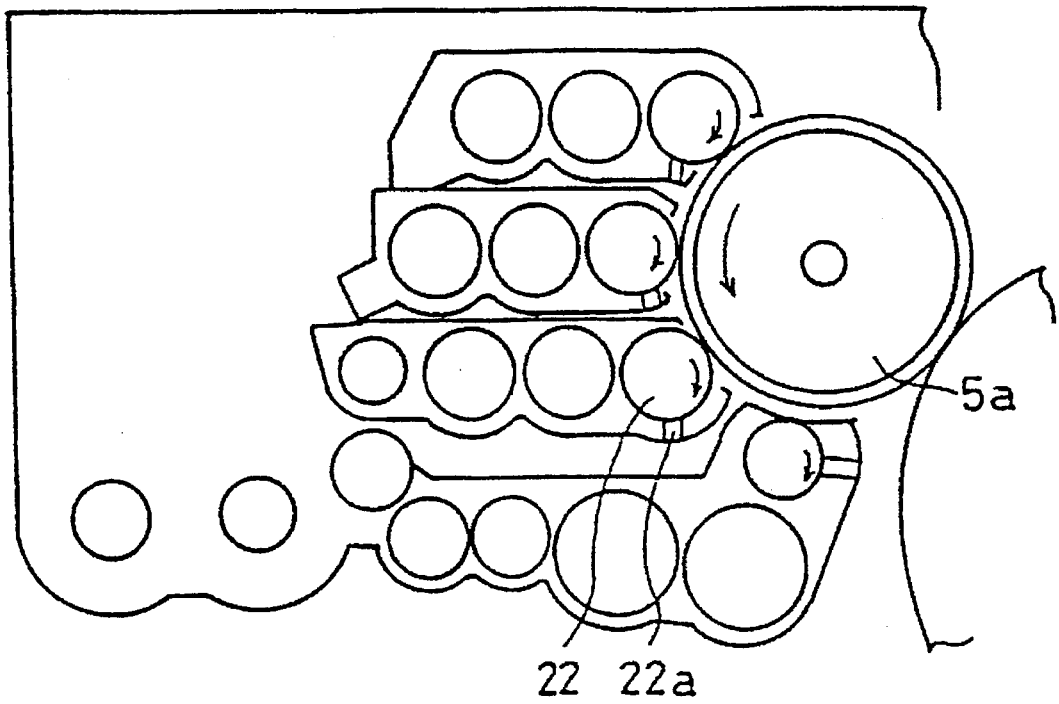
FIG. 18A is a view illustrative of a developer cartridge for color printers which has a scrubbing member on a developing roller.

Although only the use of the monochromic developer cartridge 20 has been explained in the present example, the present invention may also be applied to color printers equipped with a plurality of developer tanks 49. In the latter case, rotation of the developer feed roller 23 neighboring the developing roller 22 may be suspended in cases where, as shown in FIG. 18A, for example, the respective distances between the developing rollers 22 and the photoconductor drum 5*a* are greater than the respective thicknesses of the developer layers on the developing rollers 22, and scrubbing members 22*a* are provided to remove the developer 24 caught on the developing rollers 22.

Figure 18B:
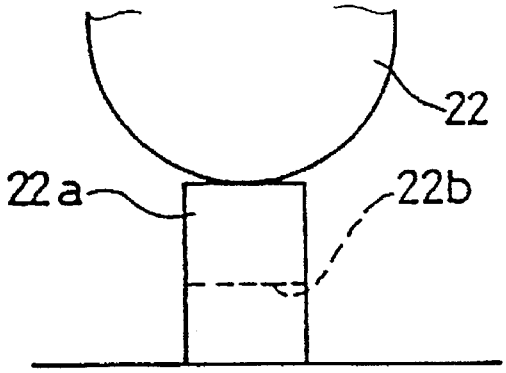
FIG. 18B is a view illustrative of the structure of the scrubbing member.

In other words, suspension of rotation of a developer feed roller 23 results in stopping provision of the developer 24 to the associated developing roller 22. Here, rotation of only the developing roller 22 aids the scrubbing member 22*a* in contact with the developing roller 22 in scrubbing the developer 24 left on the developing roller 22. In this connection, each scrubbing member 22*a* is provided with a passage 22*b* for returning the scrubbed developer 24 to each developing tank 49, as shown in FIG. 18B.

Figure 19:
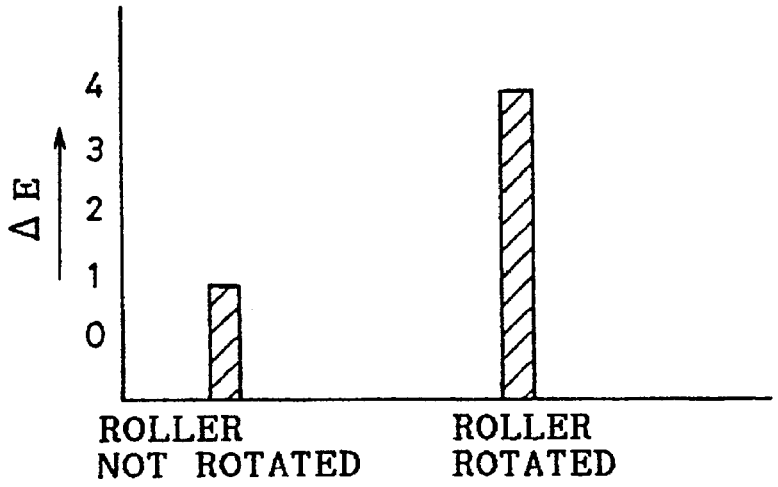
FIG. 19 shows the distance $\Delta E$ between pure yellow developer and the outputted sample on a gum chart, in cases where the developing roller of a color printer is rotated and not rotated.

Since differently colored developer 24 is developed in this way, any particular developer 24 in the course of non-development cannot be deposited on the photoconductor drum 5*a*, thus reproducing pure colors. For example, as shown in FIG. 19, printing was accomplished in a more vivid single color of yellow, etc. in cases where the developing roller 22 was suspended than in cases where the developing roller 22 was not suspended. Here, FIG. 19 shows the result of comparison in performance between printing in yellow and printing in black, the color sample on the tenth sheet of ten successive sheets printed in yellow being compared with pure yellow on a gum chart. The Y-axis represents the distance ΔE between yellow developer substance and the outputted sample on the gum chart. Higher values of ΔE reflect higher degrees of mixing in the developer 24.

In the case of color printers, the bias voltage applied to the developer feed rollers 23 may be reversed in the course of non-development. As a result, the developer 24 is so stiffly attracted by the developer feed roller 23 that it cannot be conveyed, and therefore the developer 24 on the developing roller 22 runs out, thus allowing reproduction of pure color.

Also, as shown in FIG. 1, a developer-layer thickness controller member 27 is provided above the developing roller 22. This developer-layer thickness controller member 27 is pressed against the developing roller 22 by a spring 28.

In the present example, the charged state of the developer 24 is designed to be stable by using a conductor as the developer-layer thickness controller member 27. More specifically, in cases where the regular polygonal prism-shaped developer feed roller 23 is used, approximately 90% of the amount of charge of the developer 24 is accomplished by the developer-layer thickness controller member 27. Furthermore, the amount of charge of the developer 24 is influenced by the potential of the developer-layer thickness controller member 27. Accordingly, since the developer-layer thickness controller member 27 is formed of a conductor, the amount of charge becomes consistent in cases where the regular polygonal prism-shaped developer feed roller 23 is used, resulting in image quality free of overfed developer.

Figure 20:
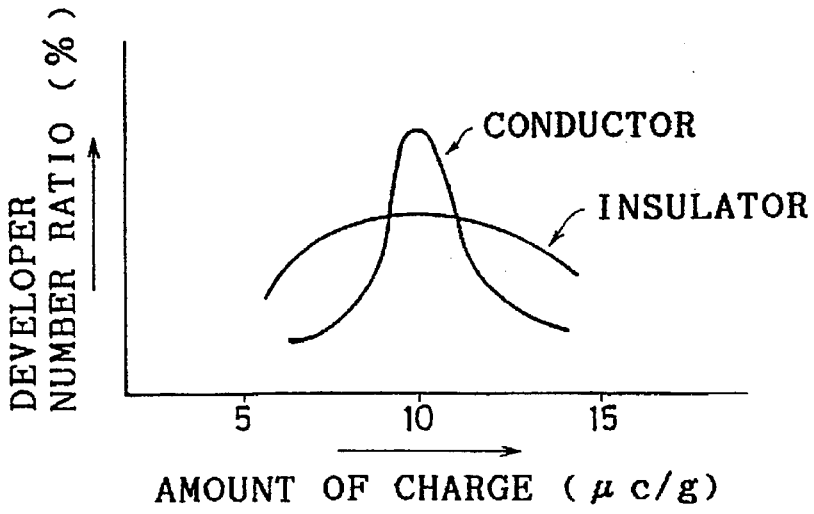
FIG. 20 is a graph illustrative of the relationship between the amount of charge of developer and the developer number ratio in cases where the developer-layer thickness control member of the developing cartridge is a conductor and an insulator.

This is because, as shown in FIG. 20, the potential of the developer-layer thickness controller member 27 becomes uniform and stable immediately in cases where the developer-layer thickness control member 27 is a conductor, whereas, in cases where the developer-layer thickness control member 27 is an insulator, the potential partially increases due to the potential produced by friction with the developer 24 and remains without escaping, thus making the charge unstable. Here, for measurement of the data shown in FIG. 20, aluminum was used as the material of the conductive, developer-layer thickness controller member 27, while nylon was used as the material of the insulating, developer-layer thickness controller member 27.

In cases where the developer-layer thickness controller member 27 is formed of an insulator, preferably a material having excellent resistance to abrasion is selected. The material may be, for example, alumite-coated aluminum, surface-oxidized iron, ceramic, glass, etc.

Figure 21:
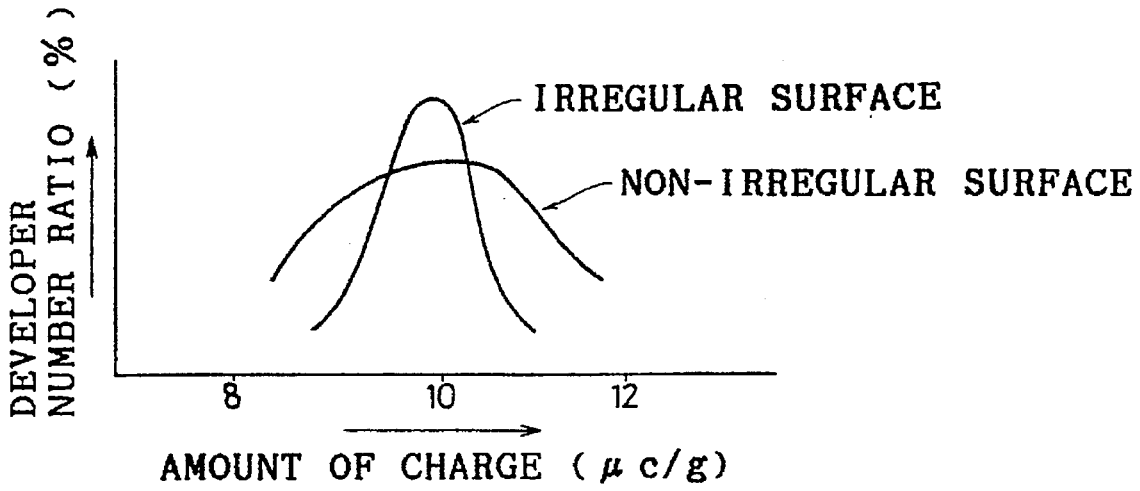
FIG. 21 is a graph illustrative of the relationship between the amount of charge of developer and the developer number ratio in cases where the developer-layer thickness control member has and does not have an irregular surface.

In addition, the developer-layer thickness control member 27 has irregularities formed at the section of contact with the developing roller 22. This construction results in uniform deposition of the developer 24 on the developer-layer thickness control member 27 and consequently in uniform amount of charge of the developer 24 as shown in FIG. 21, because the developer 24 is agitated when the developer 24 passes through the developer-layer thickness control member 27. Here, it is designed so that developer 24 excessively charged by the developing roller 22 while being agitated undergoes leakage of charge with the aid of the developer-layer thickness control member 27, whereas developer 24 not yet charged sufficiently is charged by the developer-layer thickness control member 27.

Since the developer feed roller 23 of the developing cartridge 20 of the printer of the present example is shaped as a polygonal prism, and thus the developer 24 is conveyed along the side of the polygonal prism, its capacity of conveying the developer 24 is improved over that of the cylindrical type to such a degree that a sufficient amount of the developer 24 for solid printing is always conveyed to the developing roller 22 without failure.

In addition, since the member for melting the developer 24 caught in the recess portion of the developer feed roller 23 is no longer needed, a reduction in cost may be realized. Further, in cases where a scrubbing material is provided, since no recess section is present, the scrubbing member need not be processed with high accuracy, and this results in further reduction in cost.

In addition, since no recess section is present, there is no increase in torque due to scrubbing of the developer 24 caught in the recess, thus stabilizing the driving. Furthermore, since the developer 24 may be supplied uniformly, consistent images free of overfed developer may be produced. As a result, image quality may be improved due to the constant conveyance of the developer by the developer feed roller 23.

Furthermore, the angle of the surface with respect to the direction of rotation may be adjusted within a range of 22.5°–60° by setting the number of angles of the polygonal prism constructing the developer feed roller 23 to 3–8, so that a maximum amount of the developer 24 is conveyed. This allows down-sizing of the diameter of the developer feed roller 23 and consequent space saving. Further, since the number of rotations may be reduced, energy consumption may be minimized.

Also, use of a material for the developer feed roller 23 which is charged opposite to the polarity of the developer 24 facilitates the deposition and charging of the developer 24. As a result, there is no possibility that the developer will be removed entirely by the developer-layer thickness controller member 27, causing a shortage of the developer 24 on the developing roller 22 still in the course of solid printing, and leading to the production of skipped portions.

Also, since the value of the constant k may be set to a preferred range of 1–8 by adjusting the distance U between the developer feed roller 23 and the facing inner wall surface 21*a* within a range of 0.5–2 mm, the amount of the supplied developer 24 becomes uniform and thus outputs consistent solid images free of overfed developer. Furthermore, since the range of values of the constant k is minimized by stabilizing the developer density $\alpha$, the number of rotations of the polygonal prism-shaped developer feed roller 23 may be lowered to save energy.

Also, adjustment of the distance T between the developer feed roller 23 and the developing roller 22 within a range of 0.5–2 mm facilitates the deposition and charging of the developer 24.

Also, by making the developer feed roller 23 conductive and applying to the developing roller 22 a bias voltage of the same polarity as the developer 24, the developer 24 may be made more inclined to deposition and charging.

Also, the developer 24 may be made further inclined to deposition and charging by adding a CCA of polarity opposite to that of the developer 24 to the material for forming the developer feed roller 23. The material for forming the developer feed roller 23 includes, for example, ABS (Acrylonitrile-Butadiene-n-Styrene) resin and POM (Polyoxymethylene).

Also, since the opposing inner wall surface 21*a* in proximity to the developer feed roller 23 has irregularities with a ten-point mean surface roughness $R_Z$ of 10–100 μm, the developer 24 is uniformly charged, and back ground of the developer is prevented.

Also, addition of a CCA to the material for forming the opposing inner wall surface 21*a* results in the uniform charging of the developer 24 and reduced back ground of the developer. An ABC resin or a polystyrene resin, for example, may be used as the material for forming the facing inner wall surface 21*a*.

Also, in the case of color printers, since the supply of the developer 24 to the developing roller 22 may be suspended during non-development by suspending rotation of the developer feed roller 23, the colors are prevented from mixing, thus allowing consistent outputting of sharp images.

Also in the case of color printers, since the bias voltage applied to the developer feed roller 23 may be reversed to suspend the supply of the developer 24 to the developing roller 22 during non-development, the colors are prevented from mixing, and sharp images may be outputted consistently. In addition, since these operations may be performed by simply switching the bias voltage, the cost may be lowered.

Also, since the developer-layer thickness control member 27 is a conductor, the developer 24 is consistently charged, and eventually the concentration of the developer 24 is always controlled so as not to be lowered, and back ground of the developer is also controlled.

In addition, since the developer-layer thickness control member 27 has irregularities formed at its section of contact with the developing roller 22, the developer 24 is consistently charged, and eventually the concentration of the developer 24 is always controlled so as not to be lowered, and back ground of the developer is also controlled, as is the case with the case mentioned above.

EXAMPLE 2

Another example of the present invention will now be explained with reference to FIG. 22 through FIG. 41. Here, for convenience in explanation only, members in the drawings which have the same functions as those shown in the drawings referred to in Example 1 described above are identified by like reference characters, and therefore explanations thereof are omitted.

Figure 22:
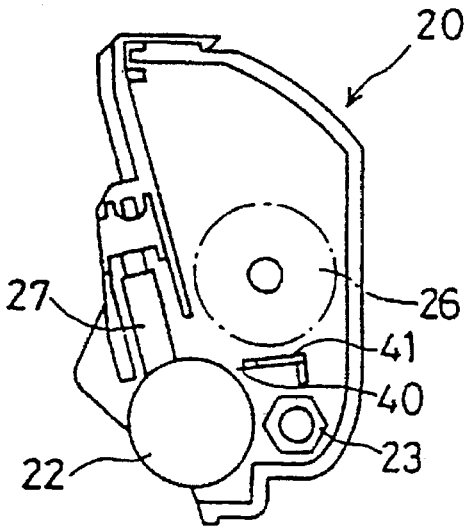
FIG. 22 is a structural schematic view of an entire developer cartridge for printers according to a second embodiment of the present invention.

In the present example, as shown in FIG. 22, a developer-applying member 40 attached to a holder 41 is provided at a section which corresponds to the midpoint of the developing roller 22. This developer-applying member 40 is designed to press the developer 24 deposited on the developing roller 22. More specifically, according to the prior art, since no developer-applying member 40 is provided, the developing roller 22 tends to be deposited nonuniformly, and consequently printed images tend to have concentration variations. In the present example, however, pressing the developer 24 against the developing roller 22 by the developer-applying member 40 allows uniform deposition of the developer 40 and ensures a sufficient thickness of the developer layer on the developing roller 22.

Figure 23A:
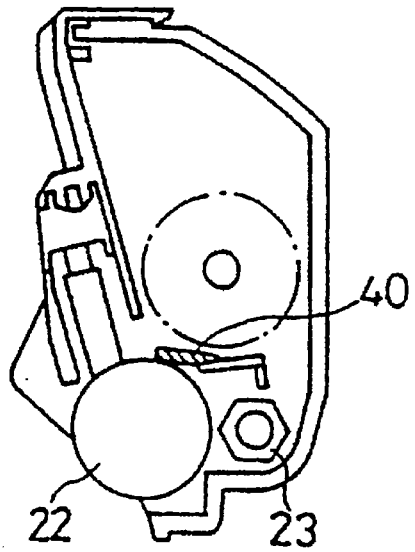
Figure 23B:
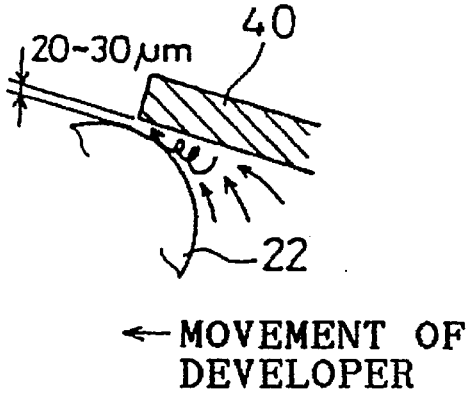

The developer-applying member 40 may be provided apart from the developing roller 22, but within a distance which allows pressing of the developer 24 on the developing roller 22, or, instead, as shown in FIGS. 23A and 23B, the developer-applying member 40 may be formed of, for example, a rigid body such as an SUS plate with a plate thickness on the order of 1–3 mm, with a close spacing of, for example, 20–30 μm, between its edge and the developing roller. This configuration contributes to the increased linear pressure on the surface of the developing roller 22, thereby establishing a stable surface of the developer 24 which is in contact with the developing roller 22, thus improving the application performance of the developer 24 and increasing evenness of the developer layer thickness. In addition, since the edge also has a function of scrubbing the developer layer, it is believed that the developer on the surface in contact with the developing roller 22 undergoes scrubbing and application in succession. For this, as indicated by the arrow in FIG. 23B which represents the movement of the developer 24, the developer layer is agitated once on the contact surface to circulate the developer 24 efficiently, thereby establishing consistent charging of the developer 24.

Figure 24A:
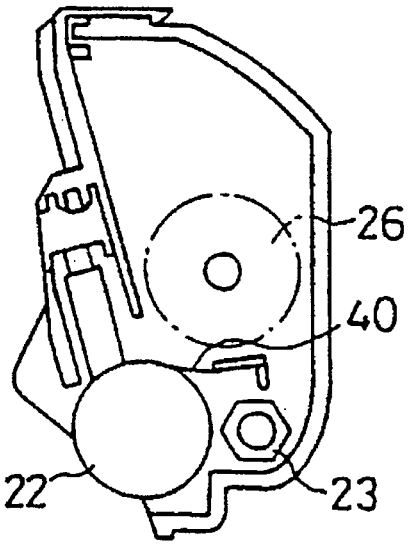
Figure 24B:
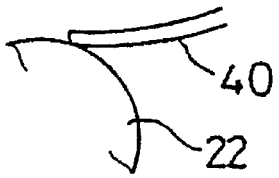
Figure 25:
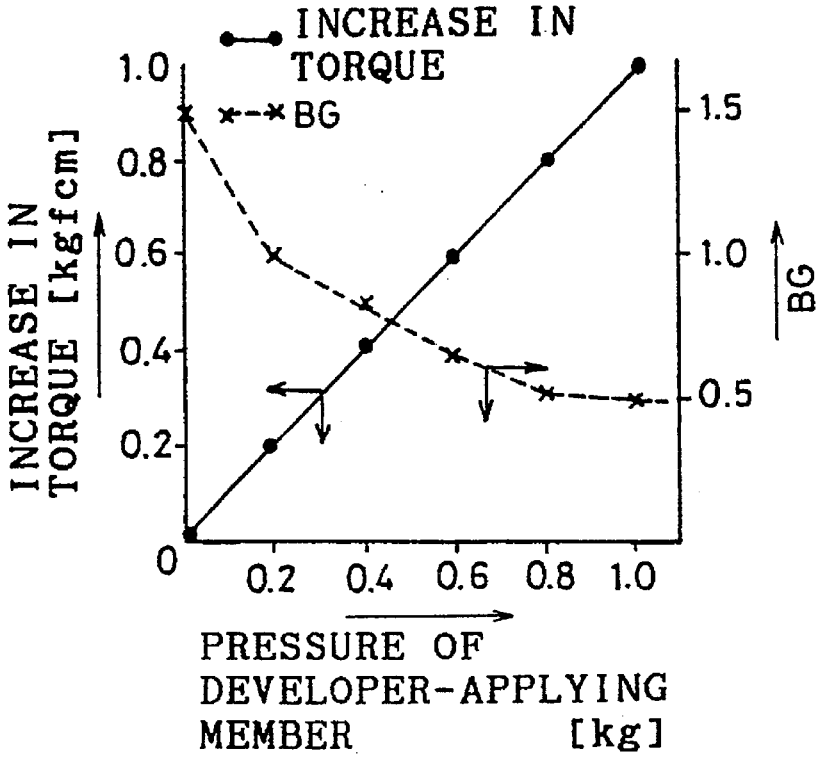
FIG. 25 is a graph illustrative of the relationship between the pressure of the developer-applying member, the torque of the developing roller and the BG in the developer cartridge.
Figure 26:
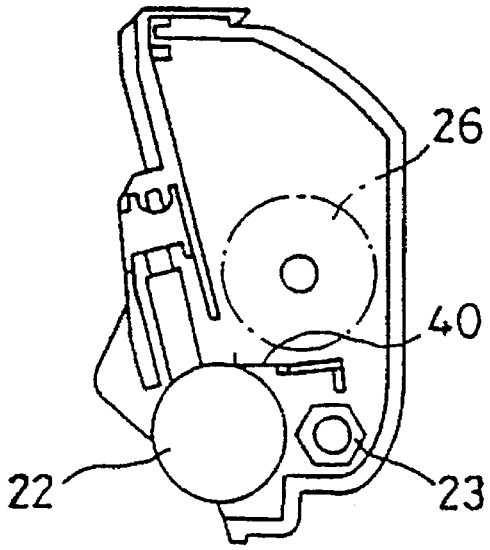
FIG. 26 is a structural schematic view of the entire developer cartridge equipped with an L-section developer-applying member, with the corner in contact with the developing roller under pressure.

Alternatively, the developer-applying member 40 may be formed of an elastic body such as PET (Polyethylene Terephthalate), and, as shown in FIGS. 24A and 24B, may be arranged with its tip in contact with the developing roller 22 under pressure by the elastic force. Since this configuration allows application of the developer 24 under a fixed pressure, the developer 24 may be deposited on the surface of the developing roller 22 in a reliable manner. Here, the pressing force of the tip of the developer-applying member 40 is preferably 0.4–1.0 kg, for example. That is, as shown by the solid line in FIG. 25, the pressing force of the developer-applying member 40 and the torque of the developing roller 22 are in a direct proportional relationship, whereas the BG (BackGround) tends to increase with decreasing pressing force of the developer-applying member 40, as shown by the broken line in the same drawing. Therefore, setting of the pressing force within the above range allows uniform application of the developer on the developing roller 22 and establishment of lower torque and better BG.

In addition, it is also possible to bend the tip of the developer-applying member 40 into an L-shape and to bring the corner into contact with the developing roller 22 for pressure. The developer-applying member 40 is formed of an elastic body such as a resin material, including PET, for example. The developer-applying member 40 has a thickness on the order of 0.5–1.0 mm, for example, and its tip is bent into an L-shape approximately 2–3 mm long. Since this configuration results in increased strength of the developer-applying member 40, the developer-applying member 40 may endure the developer pressure exerted thereon even if the developer pressure increases, the linear contact pressure exerted on the developing roller 22 may be made stable, and the evenness of the developer layer thickness of the developing roller 22 may be improved. In addition, there is less deformation of the developer-applying member 40 by a long-term use.

Figure 27A:
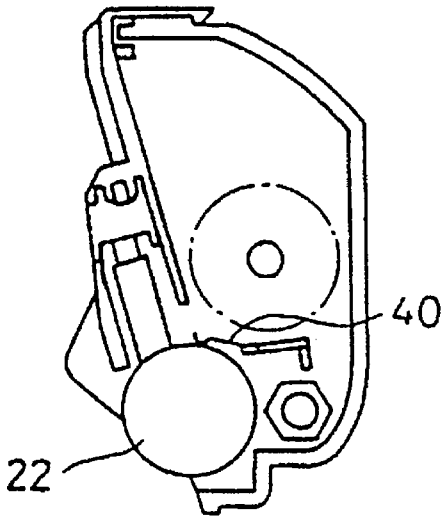
Figure 27B:
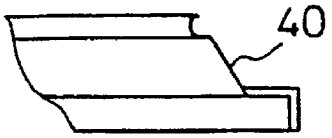

Alternatively, as shown in FIGS. 27A and 27B, the tip of the developer-applying member 40 may be bent into a U-shape instead of an L-shape, with the curved section of the U-shape in contact with the developing roller 22 under pressure. With this configuration, in the same manner as above, the linear contact pressure exerted on the developing roller 22 is made stable to increase the evenness of the thickness of the developer layer on the developing roller 22, and further, since the contact surface is curved, the developer 24 moves easier under the reduced stress.

Figure 28A:
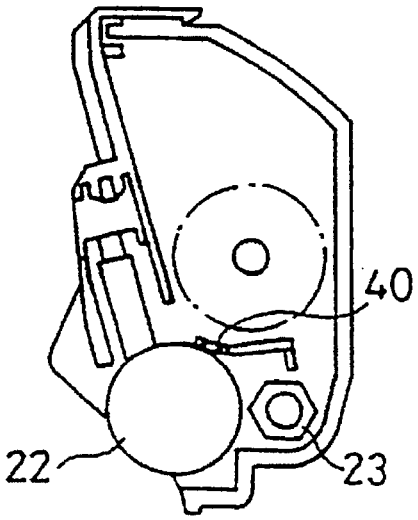
Figure 28B:
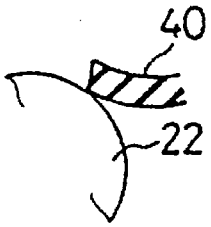
Figure 29A:
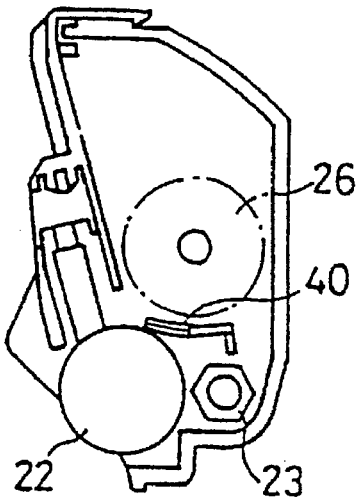
Figure 29B:
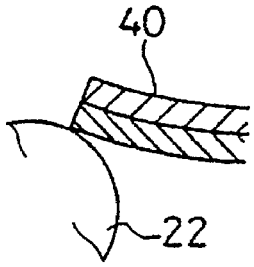
Figure 30:
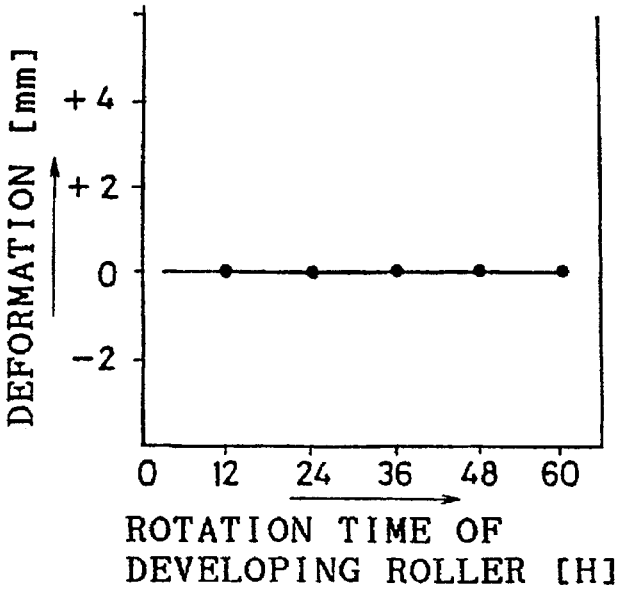
FIG. 30 is a graph illustrative of the relationship between the time of rotation of the developing roller and the amount of deformation of the developer-applying member in the developer cartridge.

Here, the developer-applying member 40, though being formed of an elastic body such as a resin material, including PET for example, as mentioned above, but without being limited thereto, may be formed of another elastic body including, for example, a resin material such as polyethylene, acrylic resin or nylon, rubber, a plate spring or another rigid body. The elastic body may be somewhat a thick rubber or rubber-like material, as shown in FIGS. 28A and 28, as well as a sheet-like one. The above nylon may be a nylon sheet or nylon fibers. In addition, these PET, nylon and other materials may be used in the form of a one-material single plate and further in the form of a composite of two or more of such one-material single plates, as shown in FIGS. 29A and 29B. As shown in FIG. 30, use of the composite causes no distortion of the developer-applying member 40 even when used for a long time, as shown in FIG. 30, and the developer may be applied uniformly for a long period of time.

Particularly, use of two layers of nylon facilitates negative charging of the developer 24, and consequently serves to reduce the BG and allows uniform application of the developer.

Figure 31A:
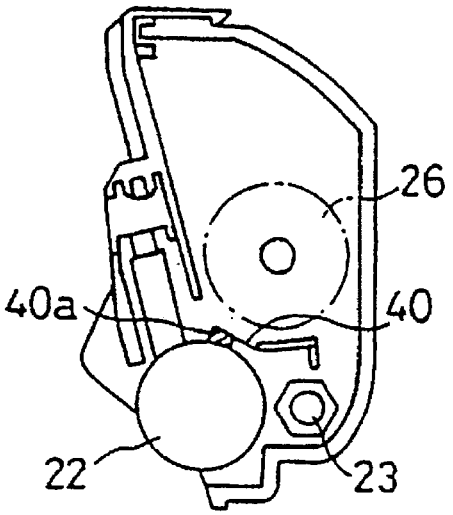
Figure 31B:
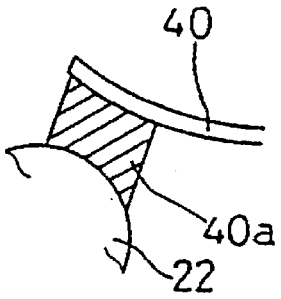
Figure 32A:
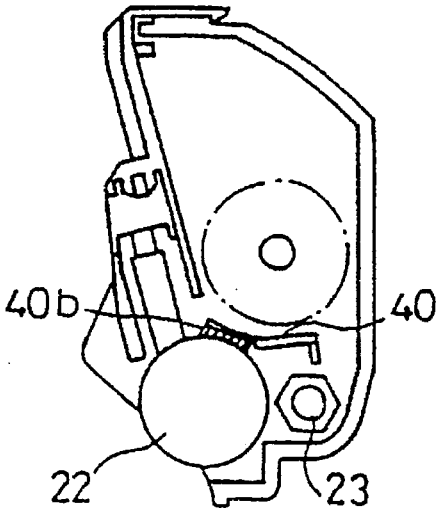
Figure 32B:
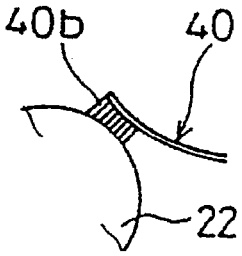

Although the developer applicator member 40 is formed as a single piece, it may be formed in a different manner; for example, as shown in FIGS. 31A and 31B, a contact member 40*a* made of polyurethane foam which has the same width as the developing roller 22 may be attached to the tip of the developer-applying member 40 made of PET to press the developing roller 22, or, as shown in FIGS. 32A and 32B, a brush 40*b* may be attached to the tip of the developer-applying member 40 made of PET to press the developing roller 22. These all serve to uniformly deposit the developer 24 on the developing roller 22. Particularly, the use of the brush 40*b* produces the favorable effect of making the thickness of the developer 24 uniform because the respective bristles of the brush 40*b* are placed in contact with the developing roller 22 to apply the developer 24 thereto.

In addition, use of the member attached to the tip of the developer-applying member 40 which is made of a material placed positive in the electrification series facilitates negative charging of the developer 24, and further serves to make more uniform the thickness of the developer layer on the developing roller 22.

Figure 33:
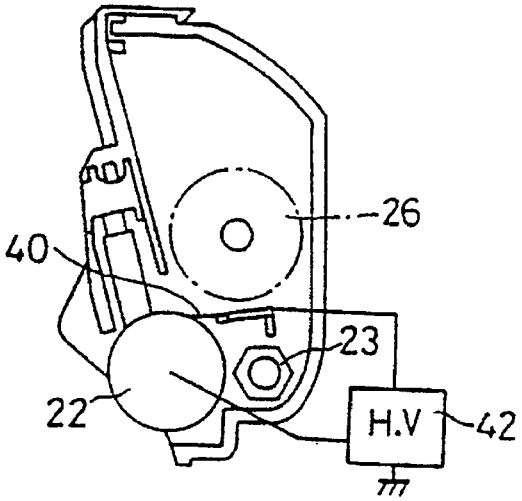
FIG. 33 is a structural schematic view of the entire developer cartridge, wherein the developer-applying member is formed of a conductive material, and a bias voltage is applied thereto.

In addition, the developer-applying member 40, though made of an insulating material in the above case, may be made of another type material; for example, as shown in FIG. 33, it is also possible to use a conductive material for contact with the developing roller 22 and to apply a bias voltage 42 thereto. More specifically, the developer-applying member 40 is formed of, for example, an approximately 0.3–0.7 mm-thick elastic body of a conductive material such as aluminum or SUS. Different from the above case, however, the conductive material must not be a metal and may be a resin which has been made conductive by carbon black or another conductivity-providing agent dispersed therein, for example.

In addition, a high bias voltage 42 is placed between the developer-applying member 40 and the developing roller 22 for efficient application and supply of the developer 24. In this case, since the developer 24 is negatively charged, the developing bias voltage is set to −300 V, and the developer application bias voltage to the developer-applying member 40 is set to −450 V, for example.

As mentioned above, since a bias voltage matching the polarity of the developer 24 is applied so that the developer 24 is supplied from the developer-applying member 40 to the surface of the developing roller 22, the developer 24 is smoothly conveyed from the developer-applying member 40 to the surface of the developing roller 22, thus improving the movability of the developer 24. As a result, since the developer 24 does not remain on the section of contact between the developer-applying member 40 and the developing roller 22, the chargeability of the developer 24 is increased, and there is less chance of inconvenience of forming images with overfed developer.

Figure 34A:
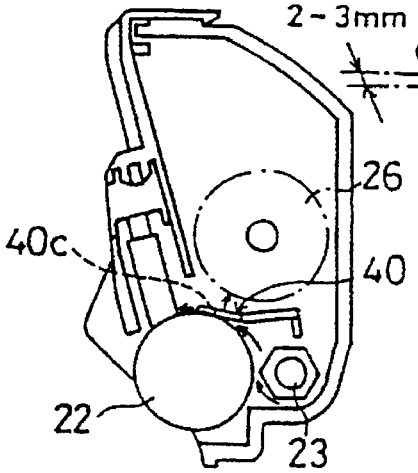
Figure 34B:
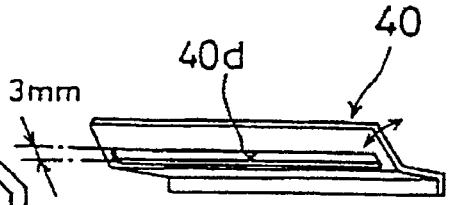

Alternatively, it is also possible to partially bore the developer-applying member 40. That is, as shown in FIG. 34A, a hole 40*c* is made in part of the developer-applying member 40, downstream from the developer 24, or as shown in FIG. 34B, for example, one or more slits each 2–3 mm wide are formed. This configuration allows exclusion of excess developer 24 via the hole 40*c* or the slit 40*d* in cases where the excess developer 24 is conveyed from the developer feed roller 23 to the tip of the developer-applying member 40 and applied to the surface of the developing roller 22 to increase the pressure of the developer-applying member 40. As a result, the pressing force of the developer-applying member 40 for application may be held constantly, and the developer may be applied consistently. In addition, solutions are provided to overcome inconveniences such as poor charging of the developer 24 due to increase in torque of the developer feed roller 23 and excess coating of the developer 24.

Figure 34C:
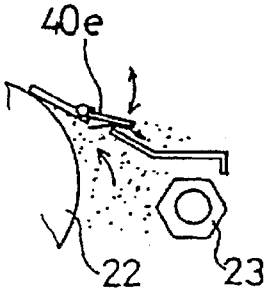

Here, as shown in FIG. 34*c*, provision of the hole 40*c* or the slit 40*d* in the developer-applying member 40 with an open/close pressure-regulating valve 40*e* designed in such a manner that it opens to allow the excess developer 24 to escape when the pressure has increased to a predetermined value, results in proper control of the pressure to allow more consistent application of developer.

Figure 35A:
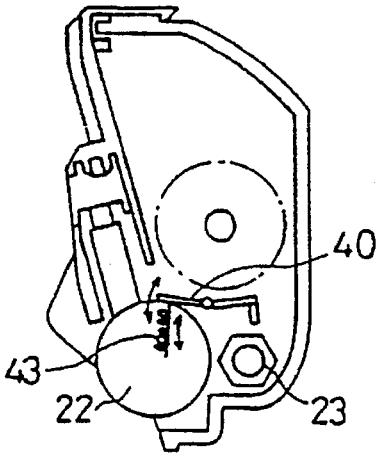
Figure 35B:
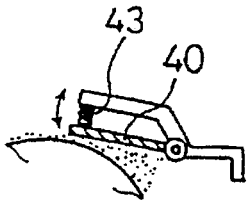
Figure 36:
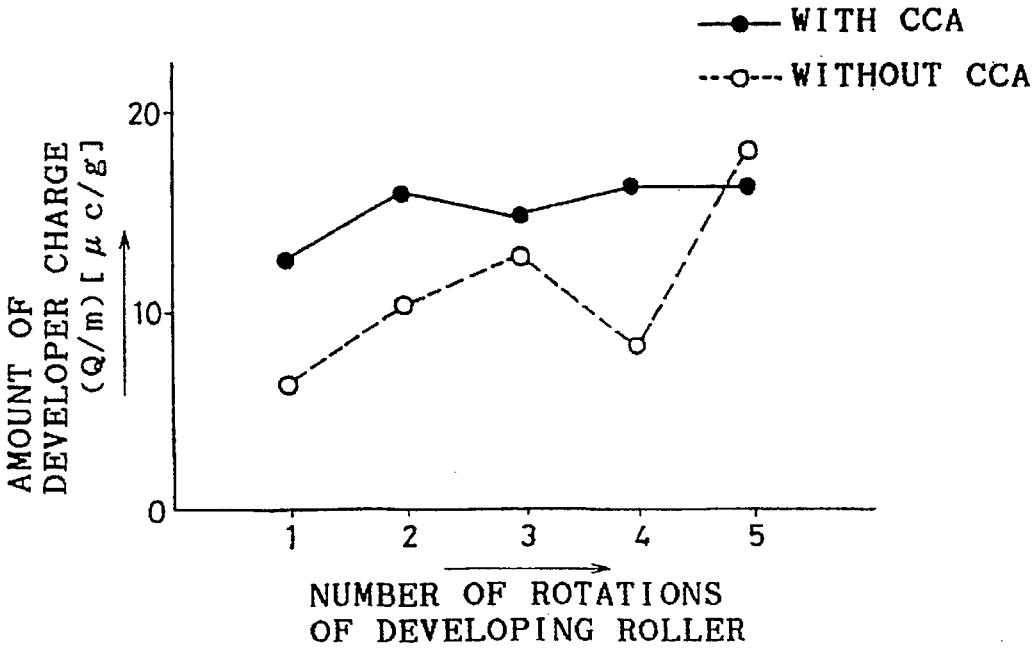
FIG. 36 is a graph illustrative of the relationship between the rotation of the developing roller and the amount of charge of developer in cases where a CCA is and is not incorporated in the developer-applying member in the developer cartridge.

As an alternative method of properly controlling the pressure to the developer 24 between the developing roller 22 and the developer-applying member 40, for example, the developer-applying member 40 may be biased by a spring 43, as shown in FIGS. 35A and 35B. More specifically, as shown in FIG. 35A, the biasing may be made from the side of the developing roller 22 so as to provide the developer-applying member 40 with a tensile force, whereas as shown in FIG. 35B, the biasing may be made from behind the developer-applying member 40 so as to provide the developer-applying member 40 with a pressing force. This results in consistent exertion of contact pressure of the developer-applying member 40 onto the surface of the developing roller 22. In addition, change in the tensile force of the spring 43 allows control of the developer-layer thickness of the surface of the developing roller 22 and the chargeability of the developer 24.

According to another method of improving the chargeability of the developer 24, for example, the material for forming the developer-applying member 40 may contain a CCA of the azo dyestuff family. As shown by the solid circles in FIG. 36, incorporation of a CCA in the developer-applying member 40 results in a greater amount of charge and more consistent chargeability of the developer 24 as compared with CCA-free cases (indicated by the circles in the same drawing). In other words, the charging capacity of the developer-applying member 40 largely depends on the chargeability of the developer 24, and variations in the charging capacity of the developer-applying member 40 cause variable amounts of charge of the developer 24. As a countermeasure, the chargeability of the developer-applying member 40 may be controlled by a CCA to charge the developer 24 consistently.

Figure 37:
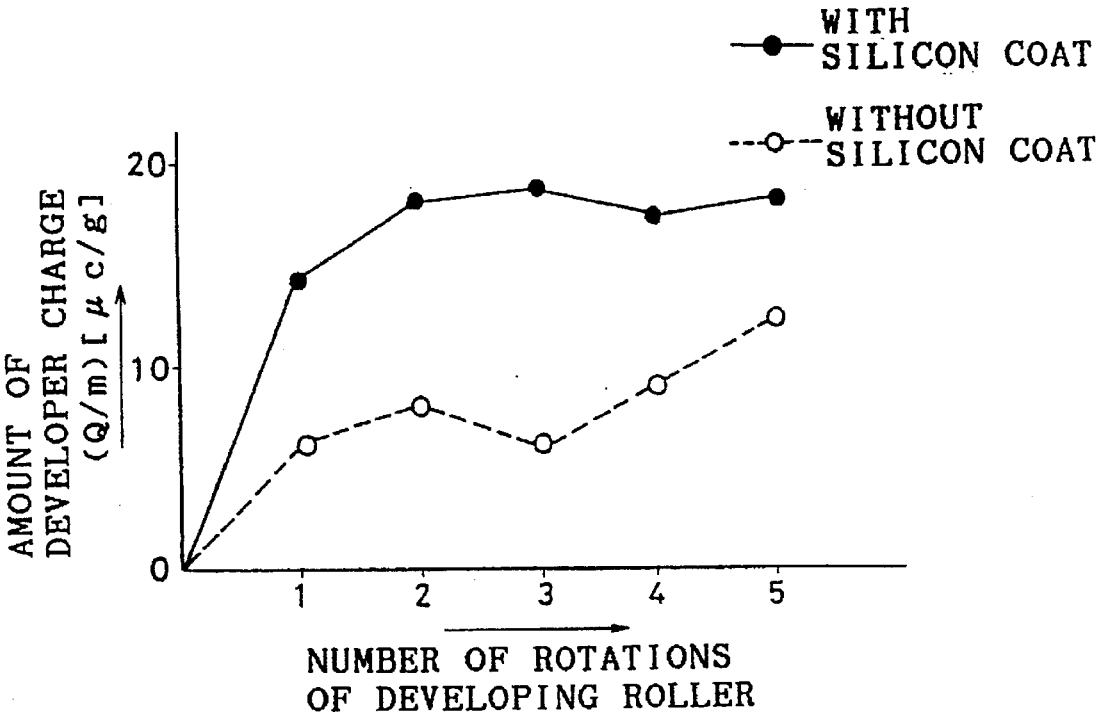
FIG. 37 is a graph illustrates of the relationship between the rotation of the developing roller and the amount of charge of developer in cases where a silicon coat is and is not applied to the developer-applying member in the developer cartridge.

In addition, according to another method of improving the chargeability of the developer 24, it is possible to use, for example, a material which is placed positive in the electrification series for forming the developer-applying member 40. More specifically, since the developer 24 is negatively charged, a coat of silicon which is placed positive in the electrification series relative to the developer 24 is applied to the surface of the developer-applying member 40 in this case, for example. As a result, as shown in FIG. 37, the amount of charge of the developer 24 increases, the charging of the developer 24 starts smoothly, and the developer 24 is consistently charged.

Figure 38A:
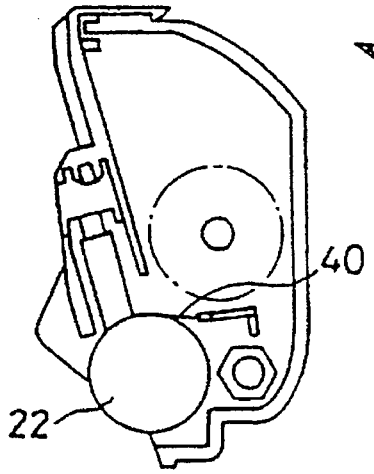
Figure 38B:
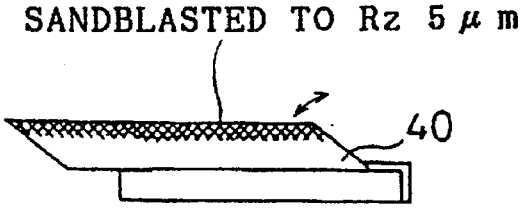

According to an alternative method of improving the chargeability of the developer 24, the surface of the developer-applying member 40 may be subjected to sandblasting, for example. More specifically, as shown in FIGS. 38A and 38B, the surface of the developer-applying member 40 at the side of the developing roller 22 is subjected to sand-blasting to form irregularities with a ten-point mean surface roughness $R_Z$ on the order of 5 μm. Although 5 μm is preferred for $R_Z$, the irregularities on member 40 can be made to satisfy $(1/2)r \leqq R_Z \leqq (10r)$ where "r" is the mean particle size of the developer.

Figure 38C:
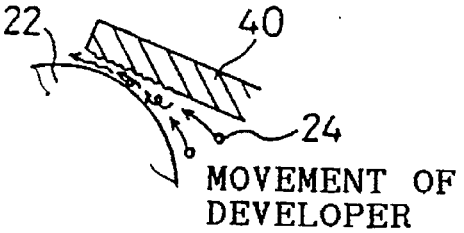

This formation, as shown in FIG. 38*c*, results in increased friction with the developer 24, thus increasing the amount of charge of the developer 24 and the uniformity of the developer-layer thickness.

Figure 39:
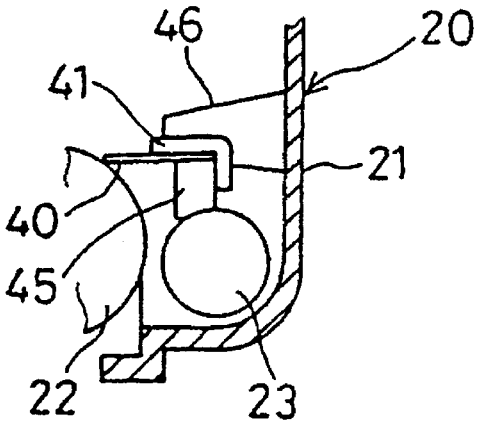
FIG. 39 is a side view of a ribbed holder of the developer cartridge.

In addition, as detailed in Example 3 given later and as shown in FIG. 39, for example, the holder 41 equipped with the developer-applying member 40 and the scrubbing member 45 tends to deflect at the center along the direction of the length of the holder 41. Deflection of the holder 41 causes non-uniform scrubbing of the developer 24 by the scrubbing member 45 and non-uniform amounts of supply of the developer 24 to the developing roller 22. Further, the pressing force of the developer-applying member 40 to the developing roller 22 changes causing non-uniform thicknesses of the developer layer on the developing roller 22. For these reasons, the deflection of the holder 41 must be minimized. Methods of preventing the deflection include, for example, attachment of a reinforcing member to the holder 41 and increase in the wall thickness of the holder 41, which, however, results in undesired increase in parts count and cost, and the deflection cannot be prevented by the increase in the wall thickness alone.

Figure 40:
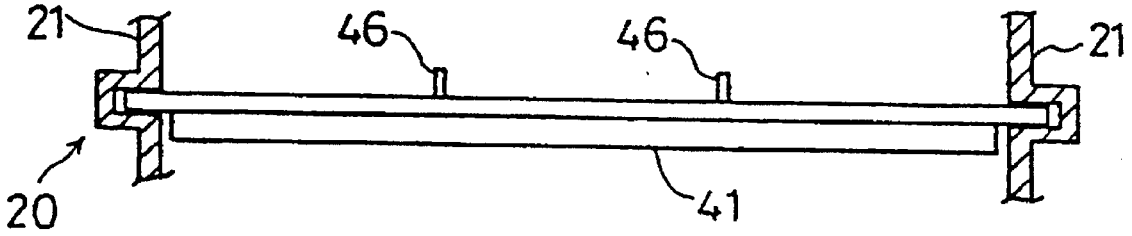
FIG. 40 is a front view of a ribbed holder of the developer cartridge.
Figure 41:
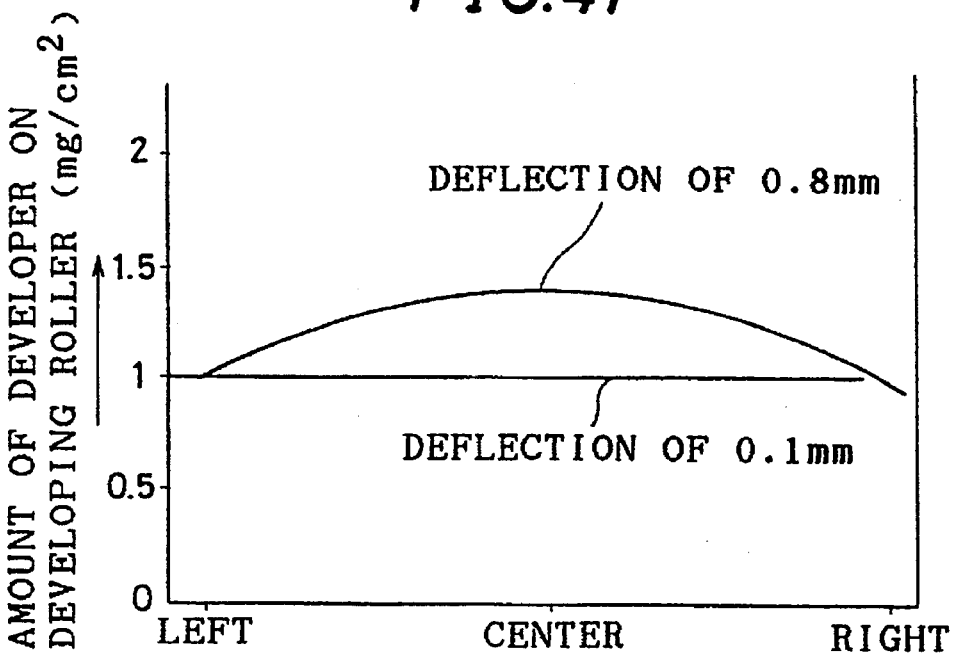
FIG. 41 is a graph illustrative of the relationship between the amount of developer on the developing roller and the position on the developing roller along the longitudinal direction in cases where the holder of the developer cartridge is ribbed and where the holder is not ribbed.

Therefore, the holder 41 of the present example is provided with a locator rib 46 at one or more positions along the longitudinal direction of the holder 41, for example, at two positions shown in FIG. 40, and these locator ribs 46 are fixed on the inner wall surface of the cartridge body 21, as shown in FIG. 39. As shown in FIG. 41, this configuration serves to control the deflection to 0.1 mm or less which is much smaller than the deflection of approximately 0.8 mm observed when the locator ribs 46 are absent.

As described above, the developer cartridge 20 for printers according to the present example is designed so that the developer 24 conveyed to the area around the developing roller 22 by the developer feed roller 23 is pressed by the conveying force to the side of the developing roller 22. Since the pressure due to this conveying force alone is not always sufficient to deposit the developer 24 on the developing roller 22, the present example is provided with the developer-applying member 40; this developer-applying member 40 additionally presses the developer 24 conveyed to the area around the developing roller 22 and applies and deposits the developer 24 on the surface of the developing roller 22. This results in uniform application of the developer 24 to the developing roller 22 under a fixed pressure, and this allows a great decrease in concentration variations and the BG.

In addition, in cases where the developer-applying member 40 is formed of a rigid body, the developer layer on the surface of the developing roller 22 may be made thinner to produce high-quality images, and further the performance of scrubbing the developer 24 is improved to promote uniform charging of the developer, thus allowing consistent application of the developer free of both back ground and scattering of the developer 24.

Further, since the developer-applying member 40 may be formed of an elastic body such as PET and is brought into contact with the developing roller 22 to press it, the developer 24 may be applied uniformly to the developing roller 22 under a fixed pressure, and this allows a great decrease in the concentration variations and the BG.

Furthermore, setting the fixed pressure within the range of 0.4–1.0 kg allows uniform application of the developer at low torque, and this results in reduced concentration variations and BG when printed.

Also, by bending the tip of the developer-applying member 40 in the form of the letter L and bringing its corner into contact with the developing roller 22 to press it, it becomes possible not only to make uniform the section of contact between the surface of the developing roller 22 and the developer-applying member 40 to maintain consistent contact pressure on the surface of the developing roller 22, but also to strengthen the developer-applying member 40. In this way, the developer may be applied uniformly and consistently without being influenced by the characteristics of the material constructing the developer-applying member 40. In addition, in cases where the tip of the developer-applying member 40 is bent into a U-shape and the curved section of the U-shaped tip is brought into contact with the developing roller 22 to press it, since the contact surface is curved, the developer 24 moves more easily under the reduced stress on the developer 24. The result is that higher image quality may be produced consistently, and further the developer-applying member 40 may be attached with less accuracy, thus allowing reduction in cost.

Alternatively, in cases where a rubber material is used to form the developer-applying member 40, the developer 24 may be applied uniformly because the developer 24 may be applied to the developing roller 22 under a fixed pressure at an even width. The result is reduction in the concentration variations and the BG.

In addition, it is also possible to use two or more layers of the developer-applying member 40 made of PET or the like, and this use results in permanent elimination of distortion and thus allows uniform application of the developer for a long period of time. Alternatively, in cases where nylon or nylon fibers are used in two layers, the developer may be applied more consistently because the characteristics of nylon increase the tendency of the developer 24 to be charged.

It is also possible to fasten a molt 40*a* to the tip of the developer-applying member 40 made of PET or to attach a brush 40*b* to the PET product to press the developing roller 22 in a contact state. This also serves to apply the developer with an even width under a fixed pressure, thus accomplishing uniform application of the developer.

It is also possible to form a scrubbing member to be attached to the tip of the developer-applying member 40, of a material which is placed positive in the electrification series, thereby negatively charging the developer 24 more easily to further increase the uniformity of the developer layer on the developing roller 22.

It is also possible to form the developer-applying member 40 of a conductive material so that the developer 24 is applied along the surface of the developing roller 22, and a consistent developer layer may be produced by placing a bias voltage between the developing roller 22 and the developer-applying member 40.

Further, since the pore 40*c* or slit 40*d* formed in part of the developer-applying member 40 serves to discharge the excess developer 24, the application pressure may be kept constant to accomplish consistent application of the developer. In addition, since the stress placed on the developer 24 may be reduced, the useful life of the developer 24 may be made longer to bring down running costs.

Biasing of the developer-applying member 40 by a spring 43 toward the developing roller 22 allows adjustment of the application pressure to permit variation in the application of developer, regardless of the material of the developer-applying member 40 and the characteristics thereof. The result is that the device may be attached with less accuracy, and thus the cost may be lowered.

It is also possible to incorporate a CCA of the azo dyestuff family into the material of the developer-applying member 40. This incorporation promotes charging of the developer 24 to accomplish consistent application of the developer 24; the images are free of the inconvenience of overfed developer, and the image quality is consistent.

Also, the developer-applying member 40 may be made of a material which is placed positive in the electrification series. This allows consistent application of the developer 24 with increased charging efficiencies.

Further, the surface of the developer-applying member 40 may be treated by sand-blasting. This treatment causes increase in the area of contact between the developer-applying member 40 and the developer 24, resulting in more smooth movement of the developer 24 with increased chargeability and provision of a consistent developer layer on the developing roller 22.

It is also possible to provide locator ribs 46, 46 at two positions, for example, along the longitudinal direction of the holder 41 holding the developer-applying member 40 and the scrubbing member 45, and further to fix these locator ribs 46, 46 to the cartridge body 21. This configuration which includes the formation of the locator ribs 46, 46 results in reduction of the amount of deflection of the holder 41 to 0.1 mm, which is much smaller than the deflection of about 0.8 mm of the holder 41 in cases where no locator ribs 46, 46 are present, and further results in an even amount of the developer being deposited along the entire surface of the developing roller 22 to produce excellent images.

EXAMPLE 3

Another example of the present invention will now be explained with reference to FIG. 42 through FIG. 60. Here, for convenience in explanation only, members in the drawings which have the same functions as those shown in the drawings referred to in Example 1 and Example 2 described above are identified by like reference characters, and therefore explanations thereof are omitted.

Figure 42:
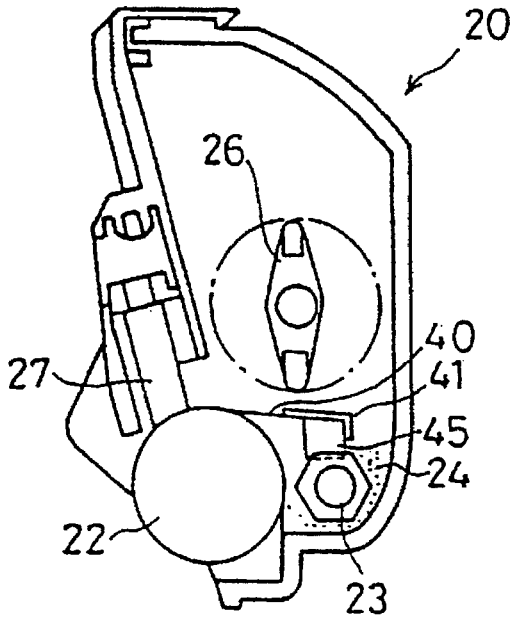
FIG. 42 is a structural schematic view of an entire developer cartridge for printers according to a third embodiment of the present invention.

In the present example, as shown in FIG. 42, the metal holder 41 placed almost at the center of the developer cartridge 20 is provided with the developer-applying member 40 which extends toward the developing roller 22, and a scrubbing member 45 is provided extending toward the developer feed roller 23 to scrub the developer 24 on the developer feed roller 23.

Figure 43A:
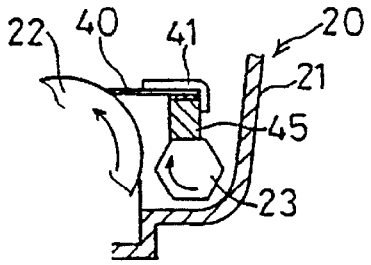
Figure 43B:
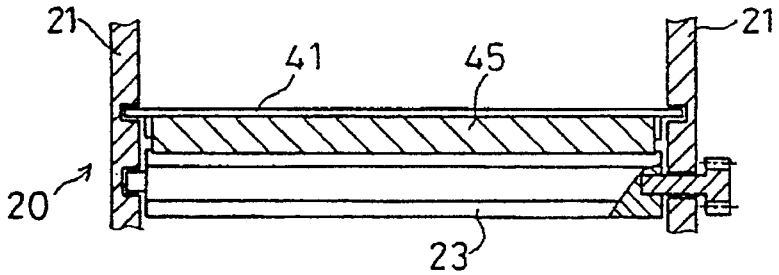
Figure 44:
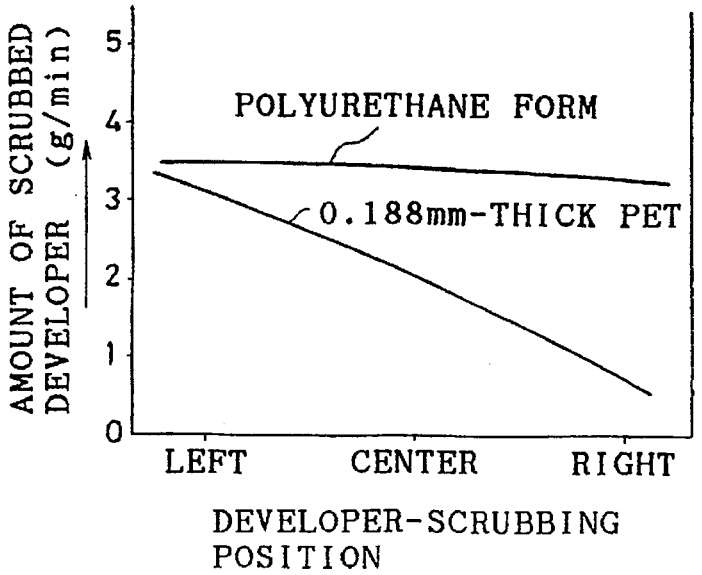
FIG. 44 is a graph illustrative of the relationship between the position at which a developer agitation roller scrubs developer and the amount of scrubbed developer in cases where the scrubbing member is made of polyurethane foam and PET, and there is a difference of 1 mm, due to variation in size, in the amount of penetration between the right and left positions.

More specifically, the scrubbing member 45, as shown in FIG. 43A and 43B, is affixed to the holder 41 attached to the cartridge body 21 together with the developer-applying member 40, with its tip brought into contact with the developer feed roller 23. As clearly shown in FIG. 44, since the scrubbing member 45 made of, for example, PET, causes variation in size depending on the location of scrubbing developer along the longitudinal direction of the developer feed roller 23, it is preferably formed of an elastic material such as polyurethane foam the scrubbing performance of which has a lower tendency to be influenced by variation in size.

In cases where polyurethane foam is used to form the scrubbing member 45, since polyurethane foam is placed more positive than the developer 24 in the electrification series, the developer 24 is further negatively charged preliminarily by frictional electrification between the negatively charged developer 24 and the polyurethane foam. As a result, the developer 24 is more preferably charged by the developer-layer thickness control member 27.

In order to prevent electrostatic deposition of the developer 24 on the scrubbing member 45, usually it is preferred to select a material for the scrubbing member 45 which is charged to the same polarity as the charged polarity of the developer 24 in cases where the charged polarity of the developer 24 is minus. On the other hand, the scrubbing member 45 is preferably charged positive in cases where the charged polarity of the developer 24 is plus. Accordingly, in cases where the charged polarity of the developer 24 is plus, the electrostatic deposition of the developer 24 may be prevented by using polyurethane of the same polarity as the charged polarity of the developer 24 to form the scrubbing member 45.

Operation in cases where the scrubbing member is provided will be explained in brief.

Figure 45:
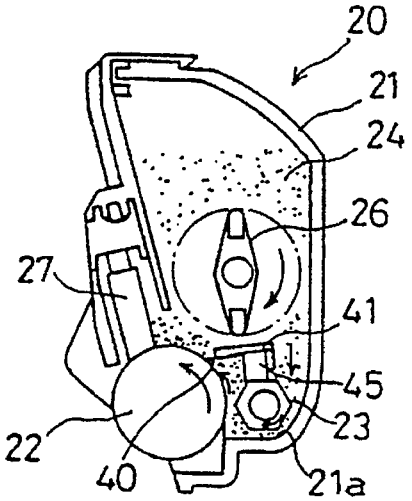
FIG. 45 is a view illustrative of the state of developer being conveyed in the developer cartridge with the developer-applying member and the scrubbing member mounted therein.
Figure 46A:
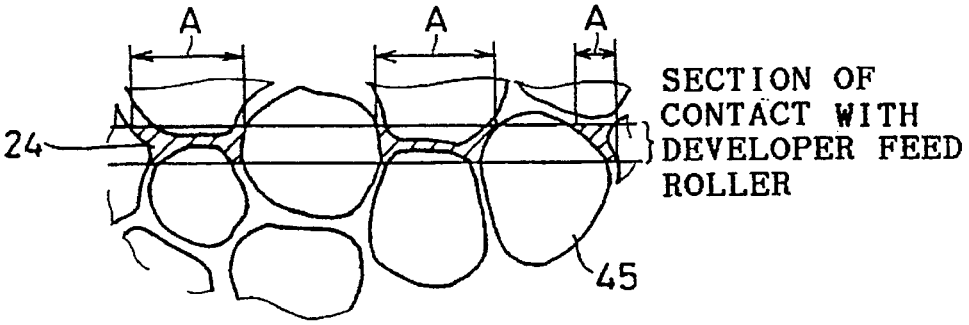
Figure 46B:
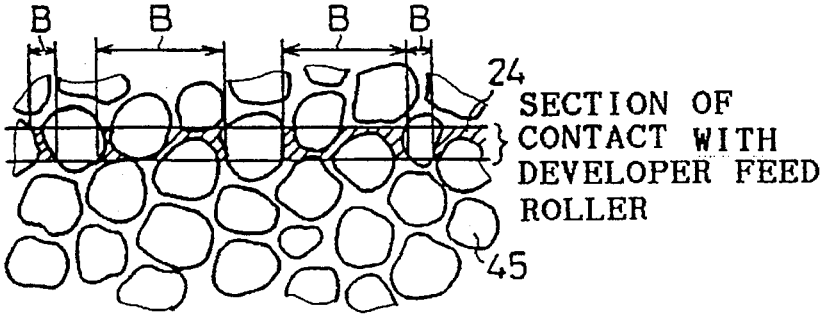

As shown in FIG. 45, the developer 24 in the developer cartridge 20 is conveyed toward the lower developer feed roller 23 as the developer agitation roller 26 rotates. The developer 24 is then conveyed toward the developing roller 22 passing between the developer feed roller 23 and the facing inner wall surface 21*a* as the developer feed roller 23 further rotates. Here, the developer 24 on the developer feed roller 23 is scrubbed by the scrubbing member 45 located above the developer feed roller 23. The developer 24 conveyed toward the developing roller 22 and the developer 24 scrubbed by the scrubbing member 45 are then applied together to the developing roller 22 by the developer-applying member 40. Upon arrival of the developer 24 at the developer-layer thickness control member 27 as the developing roller 22 rotates, the excess developer 24 is scrubbed by the developer-layer thickness controller member 27 to produce an even developer layer. Finally, the electrostatic latent image on the photoconductor drum (not shown) is developed as the developing roller 22 further rotates.

Figure 47:
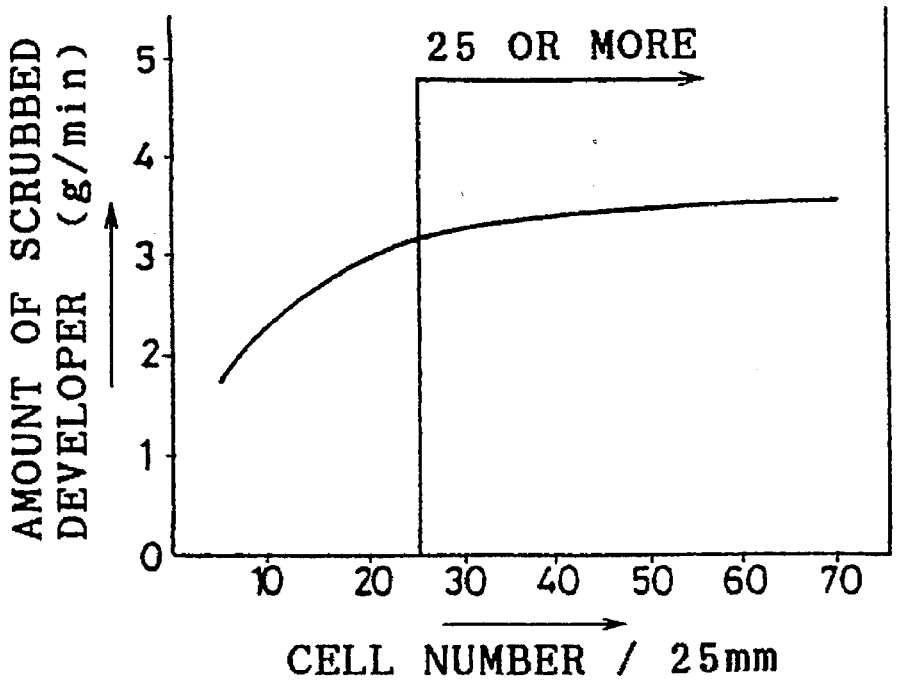
FIG. 47 is a graph illustrative of the relationship between the number of cells per unit distance and the amount of scrubbed developer in cases where the scrubbing member is made of polyurethane foam.

Here, the amount of the developer 24 on the developer feed roller 23 which is scrubbed by the foamed scrubbing member 45 made of polyurethane foam or the like depends on the size of the cell (respective separate air voids surrounded by polyurethane particles other than open air voids) present per unit length of the polyurethane foam which is the material of the scrubbing member 45. More specifically, comparison in terms of the amount of scrubbed polyurethane per unit length, between the total of respective amounts A of the developer 24 scrubbed in the case of larger cells shown in FIG. 46A and the total of respective amounts B of the developer 24 scrubbed in the case of smaller cells shown in FIG. 46B reveals that the total of the amounts B of the developer 24 scrubbed in the case of the smaller cells shown in 46B is greater than the other total. The relationship between the number of cells per unit length of 25 mm and the scrubbed amount is shown in FIG. 47. The results shown in FIG. 47 suggest that the number of cells of the foamed scrubbing member 45 made of polyurethane foam or the like is preferably 25/25 mm or more.

Figure 48:
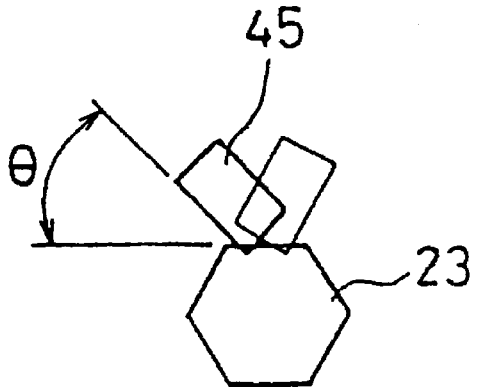
FIG. 48 is a view illustrative of the angle of contact of the scrubbing member with respect to the developer feed roller.
Figure 49:
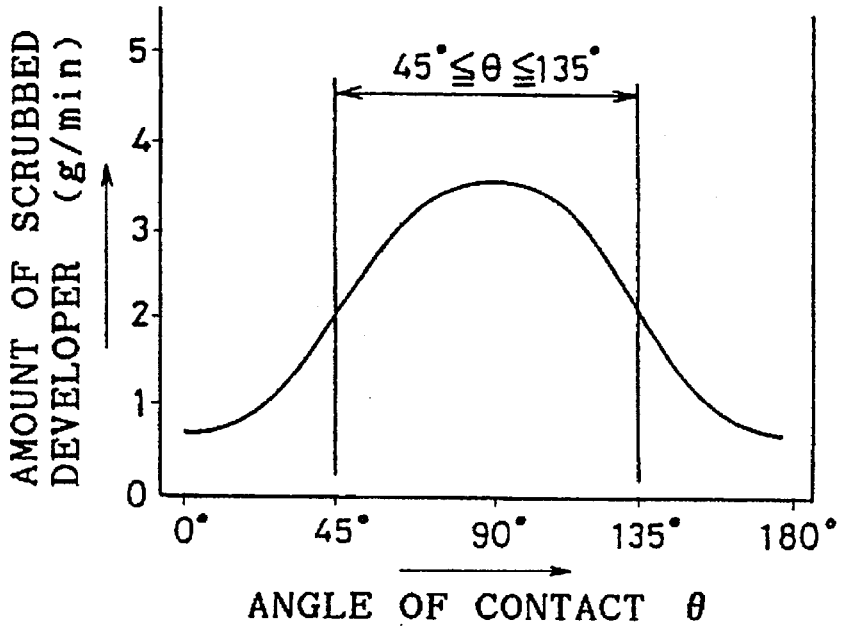
FIG. 49 is a graph illustrative of the relationship between the angle of contact of the scrubbing member with respect to the developer feed roller and the amount of scrubbed developer.

Also, the angle of contact of the scrubbing member 45 with respect to the developer feed roller 23 which is shown in FIG. 48 is preferred to be within a range of $45° \leqq \theta \leqq 135°$ with an optimum value on the order of 90°, judging from the scrubbing performance shown in FIG. 49.

Figure 50:
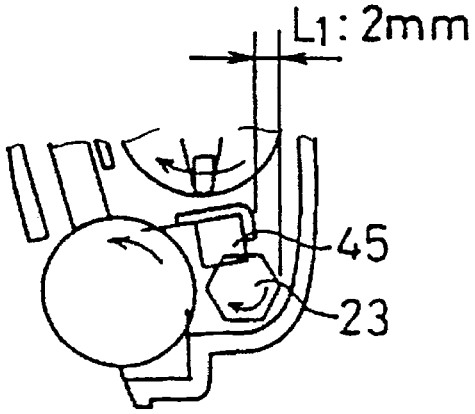
FIG. 50 is an enlarged view of the main portion which illustrates the position of contact of the scrubbing member, deflected by 2 mm with respect to the developer feed roller.
Figure 51:
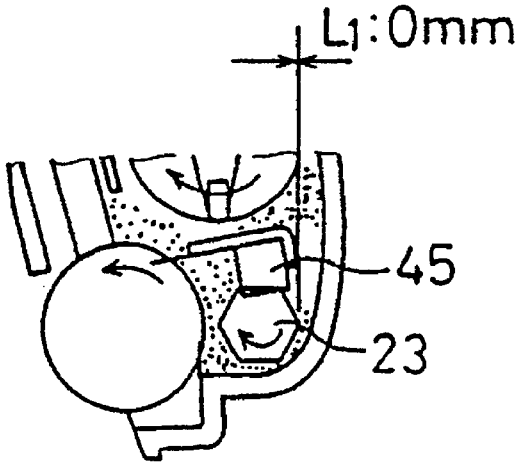
FIG. 51 is an enlarged view of the main portion which illustrates the position of contact of the scrubbing member, not deflected with respect to the developer feed roller.
Figure 52:
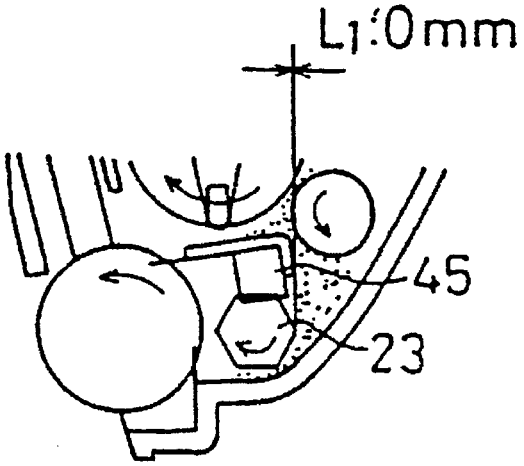
FIG. 52 is an enlarged view of the main portion in cases where the position of contact of the scrubbing member is not deflected with respect to the developer feed roller, and an additional conveying roller is provided.
Figure 53:
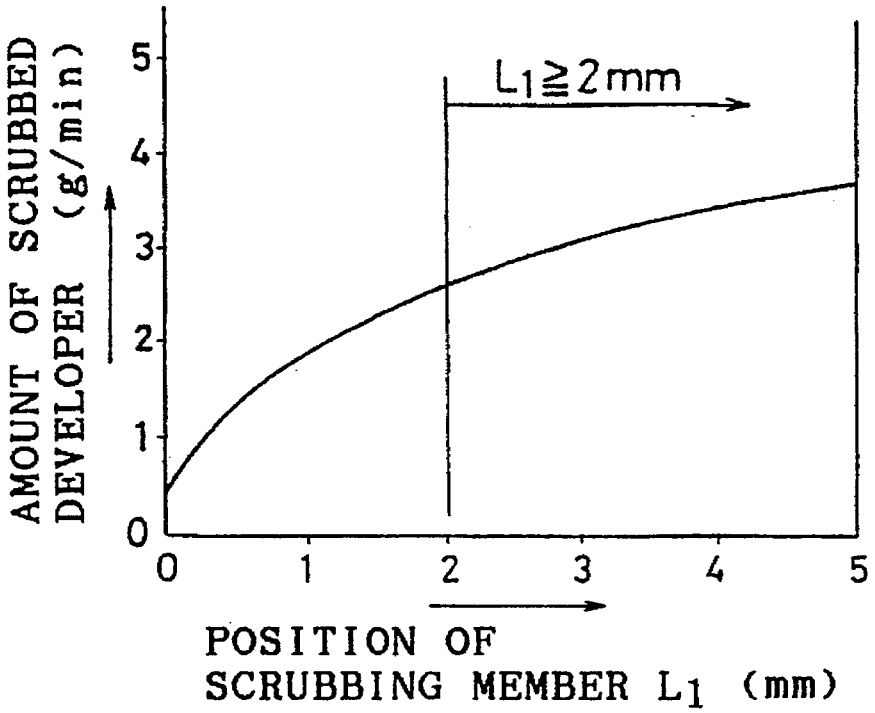
FIG. 53 is a graph illustrative of the relationship between the position of contact of the scrubbing member with respect to the developer feed roller and the amount of scrubbed developer.

In addition, as shown in FIG. 50 through FIG. 52, the position of the scrubbing member 45 with respect to the developer feed roller 23 preferably satisfy the relation: $L_1 \geqq 2$ mm wherein $L_1$ is the distance between the right end of the developer feed roller 23 and the right end of the scrubbing member 45. This is because at a distance within this defined range the amount of the scrubbed developer increases, as shown in FIG. 53, and further blocking or solidification of the developer 24 may be prevented to improve its movability.

Figure 54:
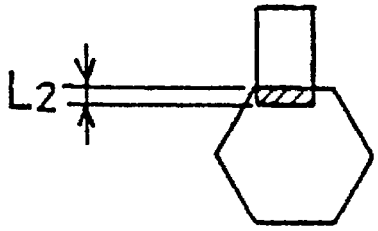
FIG. 54 is a view illustrative of the state of the scrubbing member penetrating in the developer feed roller.
Figure 55:
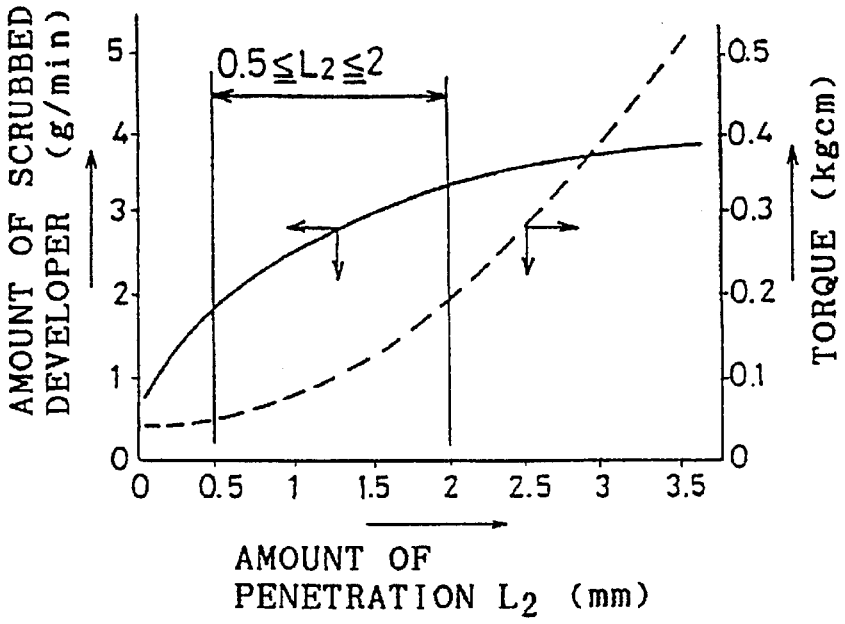
FIG. 55 is a graph illustrative of the relationship between the amount of penetration of the scrubbing member in the developer feed roller, the amount of scrubbed developer and the torque.

On the other hand, the penetration depth $L_2$ of the scrubbing member 45 in the developer feed roller 23 which is shown in FIG. 54 preferably satisfy the relation: 0.5 mm $L_2 \leqq 2$ mm. In other words, as shown in FIG. 55, a greater penetration depth $L_2$ results in higher torque of the developer feed roller 23. Conversely, a smaller penetration depth $L_2$ causes a lower scrubbing performance. Consideration of the scrubbing performance, the torque and the variation in size described above supports the above preferred range of the penetration depth $L_2$.

Figure 56:
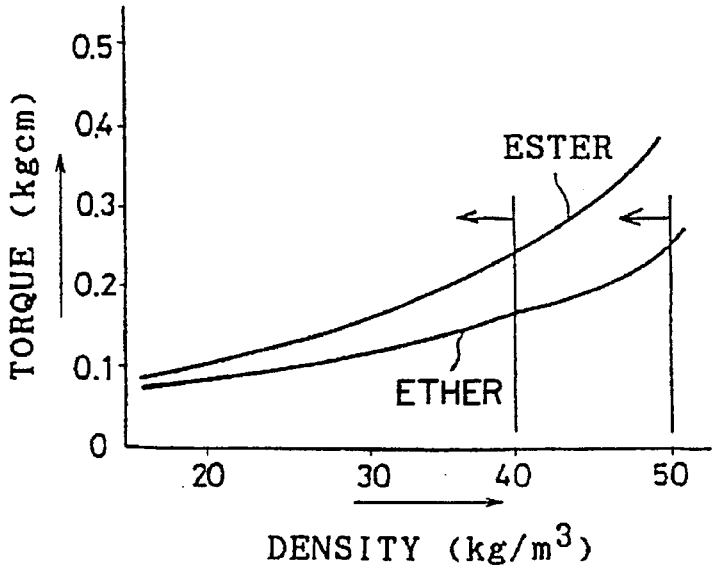
FIG. 56 is a graph illustrative of the relationship between the density of polyurethane and the torque in cases where polyurethane comprising the scrubbing member is an ester-derived and where polyurethane is an ether-derived.
Figure 57:
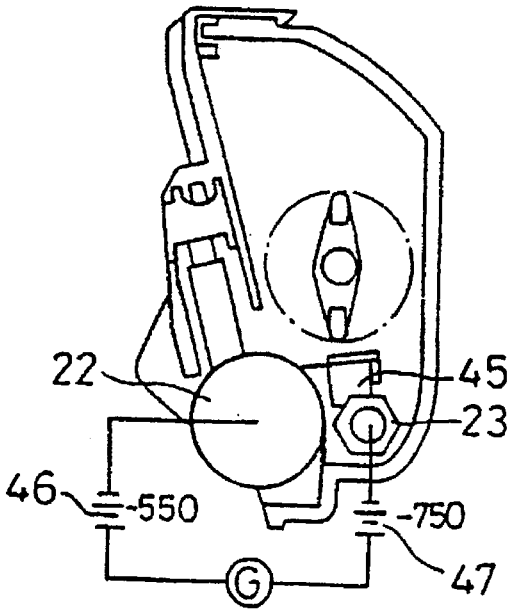
FIG. 57 is a structural schematic view of the entire developer cartridge equipped with a scrubbing member, wherein separate voltages are applied to the developing roller and the developer feed roller.

The torque of the developer feed roller 23 is also influenced by the density of the foamed scrubbing member 45 made of polyurethane foam or the like. More specifically, the elasticity decreases and the torque of the developer feed roller 23 increases with increasing density of the polyurethane foam, whereas the elasticity increases and the torque decreases with decreasing density of the polyurethane foam. In addition, esters and ethers have different levels of elasticity, as shown in FIG. 56. In conclusion, from the point of view of torque, the density is preferred to be 40 kg/m$^3$ or less for esters and 50 kg/m$^3$ or less for ethers.

On the other hand, it is also possible to form the developer feed roller 23 of a conductive material such as aluminum or SUS and to apply a feed roller-biasing voltage 47 of −750 V, for example, to the developer feed roller 23 while applying a developing roller-biasing voltage of −550 V, for example, to the developing roller 22. Since this produces a potential difference of 200 V, the negatively charged developer 24 is electrically attracted toward the developing roller 22 and applied efficiently by the developer-applying member 40. Here, the conductive member need not be a metal, and may be a resin which has been made conductive by carbon black or another conductivity-providing agent dispersed therein, for example.

Figure 58:
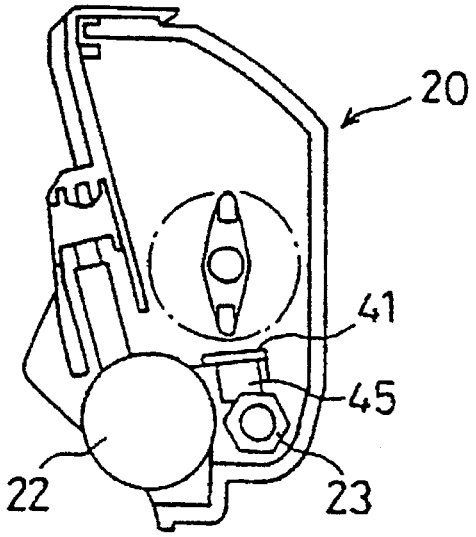
FIG. 58 is a structural schematic view of the entire developer cartridge equipped with a scrubbing member made of an elastic body composed of a resin material such as PET.

Also, the scrubbing member 45 need not be made of a foamed elastic body such as polyurethane foam, and may be made of an elastic body of a rubber material such as chloroprene rubber or a resin material such as PET, as shown in FIG. 58. Use of the latter type of material allows compensation of the difference in level between the plane sections and the edge line sections of the regular hexagonal prism when the scrubbing member 45 rubs on the side surfaces of the regular hexagonal prism-shaped developer feed roller 23, and scrubbing of the developer 24 on the developer feed roller 23 without clogging, unlike the case of using polyurethane foam or the like.

Figure 59:
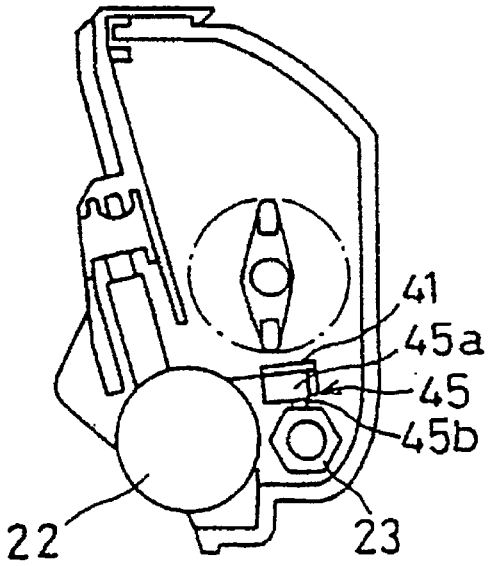
FIG. 59 is a structural schematic view of an entire developer cartridge equipped with a scrubbing member made of an elastic body consisting of a combination of materials with greater and smaller elastic forces.

Alternatively, it is also possible to construct the scrubbing member 45 by, as shown in FIG. 59, for example, attaching a weak elastic ether-based polyurethane foam 45*a* to the holder 41 and then providing its tip with a rubbing section 45*b* made of an elastic body such as chloroprene rubber or PET. This configuration allows compensation of the difference in level between the plane sections and the edge line sections of the regular hexagonal prism by the ether-based polyurethane foam 45*a* when the scrubbing member 45 rubs on the side surfaces of the regular hexagonal prism-shaped developer feed roller 23, and this in turn allows scrubbing of the developer 24 with less variation in torque of the developer feed roller 23.

Figure 60A:
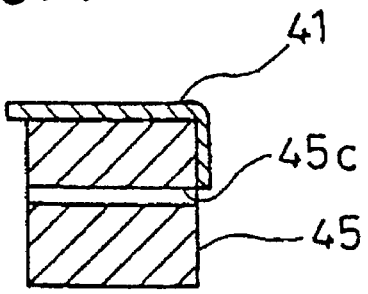
FIGS. 60A and 60B are views of the scrubbing member with a through-hole formed therein, wherein 60A is an enlarged view of a rectangular-section scrubbing member made of rubber.
Figure 60B:
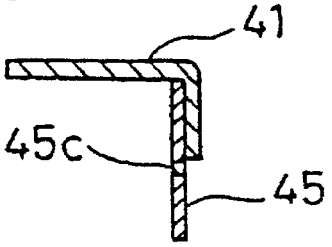

In cases where the scrubbing member 45 is formed of polyurethane foam or a rubber material such as chloroprene rubber, as shown in FIG. 60A, or in cases where the scrubbing member 45 is formed as a sheet of a resin material such as PET, a through-hole 45*c* may be formed through the scrubbing member 45, for example. This through-hole serves to prevent increase in torque of the developer feed roller 23 which tends to occur especially when a small number of prints are produced, by returning the excess developer 24 present between the developing roller 22 and the developer-applying member 40 via the through-hole 45*c*.

As mentioned above, the developer cartridge 20 for printers according to the present example is provided with the developer feed roller 23 formed in the shape of a regular polygonal prism such as a regular hexagonal prism and further with the scrubbing member 45 for scrubbing the developer 24 on the developer feed roller 23. This scrubbing member 45, being formed of an elastic body such as polyurethane foam, may be designed so as not to lower the scrubbing performance even with variation in sizes of the members. In addition, since there is no need here to use parts with high accuracy or to ensure high-precision assembly, the manufacturing procedure may be made simpler to lower the cost.

Also, use of a material such as polyurethane foam which is placed more positive than the developer 24 in the electrification series results in preliminary negative charging of the developer 24 with greater ease.

Here, the cell number is preferred to be set to 25/25 mm or more in cases where the scrubbing member 45 contains foams, as is the case where it is formed of polyurethane foam or the like. The downsizing of the cells in this way contributes to a greater scrubbing area which ensures a satisfactory level of scrubbing performance.

In addition, the angle of contact of the scrubbing member 45 with respect to the polygonal prism-shaped developer feed roller 23 preferably satisfy the relation: $45° < \theta < 135°$. If this relation is satisfied, the scrubbing performance may be fully ensured.

The positional deviation of the scrubbing member 45 from the developer feed roller 23, more specifically, the distance $L_1$ between the right ends of the two, preferably satisfy the relation: $L_1 \geqq 2$ mm. If this relation is satisfied, the required amount of scrubbing may be ensured, blocking of the developer 24 may be prevented, and the movement of the developer 24 may be improved. In addition, since no additional roller is needed to charge the developer 24, it is possible to simplify and downsize the structure and to reduce the cost.

In addition, in cases where the penetration depth $L_2$ of the scrubbing member 45 in the developer feed roller 23 satisfies the relation: 0.5 mm$\leqq L_2 \leqq$2 mm, the torque may be minimized while maintaining a satisfactory level of scrubbing performance.

On the other hand, in cases where the scrubbing member 45 is formed of polyurethane foam, the torque may be lowered while maintaining a satisfactory level of scrubbing performance by setting the density to 40 kg/m$^3$ or less for ester materials and to 50 kg/m$^3$ or less for ether materials. This also allows downsizing of the motor, and thus reduction in cost.

In addition, in cases where the developer feed roller 23 is formed of a conductive material, and a bias voltage is applied to each of the developing roller 22 and the developer feed roller 23, the negatively charged developer 24 may be electrically attracted toward the developing roller 22 and applied efficiently.

Alternatively, the scrubbing member 45 may be formed of a non-foamed elastic body such as rubber or resin, and this serves to prevent clogging while scrubbing and to prevent increase in torque.

Also, in cases where the scrubbing member 45 is composed of a more elastic member having a tip made of a less elastic material, variation in torque of the corner of the polygonal prism-shaped developer feed roller 23 may be compensated by the more elastic member, and thus the variation in torque may be prevented.

Also, in cases where a through-hole 45*c* such as a hole or slit with a larger diameter than the diameter of the developer 24 is formed in the scrubbing member 45, the developer 24 may escape via the through-hole 45*c* to prevent increase in torque of the developer feed roller 23 when the developer pressure from the developer-applying member 40 increases.

EXAMPLE 4

An additional example of the present invention may be explained as below with reference to FIG. 61 through FIG. 66. Here, for convenience in explanation only, members in the drawings which have the same functions as those shown in the drawings referred to in Example 1 through Example 3 described above are identified by like reference characters, and therefore explanations thereof are omitted.

In the present example, the developer agitation roller 26 of the developer cartridge 20 shown in FIG. 42 will be discussed from the point of view of the amount of conveyance.

First, for ready conveyance of developer 24 the developer cartridge 20 in the present example is a vertical type which utilizes gravity on the developer 24, equipped with a hopper for storing developer in the upper section, a developer agitation roller 26 located under the hopper and a developer feed roller 23 located under the developer agitation roller 26. By forming the developer feed roller 23 as a regular hexagonal prism, providing a developer-applying member 40 and a scrubbing member 45 and rotating the developer agitation roller 26, the developer feed roller 23 and the developing roller 22, a constant amount of developer 24 comprising both highly mobile developer 24 and less mobile developer 24 is conveyed to achieve consistent conveying performance even with decreasing amount of the developer in the developer tank, as shown by the solid line in FIG. 61. As a result, the developer 24 may be supplied consistently at all times, regardless of change in the mobility and the remaining amount of the developer 24 and of the physical properties of the developer 24.

Figure 61:
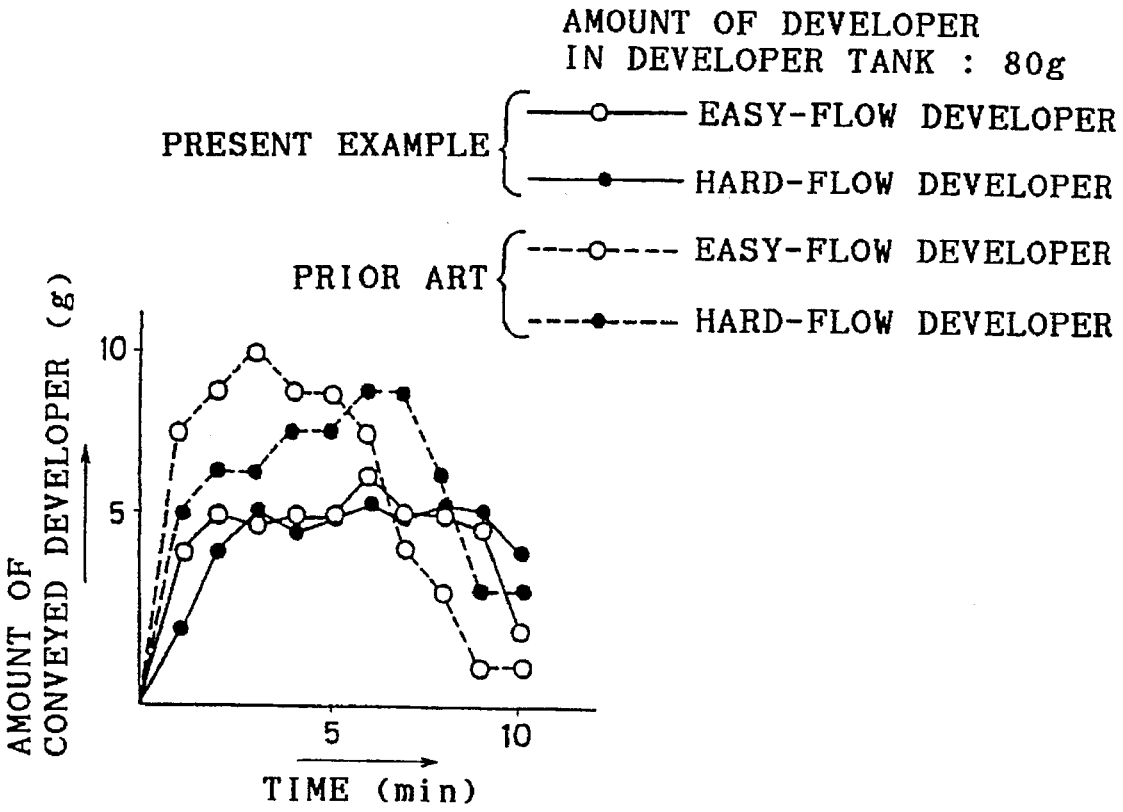
FIG. 61 is a graph illustrative of the change in the amount of conveyed developer due to the difference in flowability of developer.

In this connection, conveyance with a cylindrical developer feed roller of the prior art results in a small amount of developer being conveyed at the beginning which increases only gradually in cases where the developer 24 is less mobile, as shown by the broken line and the solid circles in FIG. 61. Accordingly, the developer 24 must be highly mobile in order to improve its movability. Increase in mobility of the developer 24 indeed results in an increased amount of the developer 24 being conveyed from the developer feed roller 23 to the developing roller 22; nonetheless, the increase also causes increase in pressure which is placed on the developer 24 from the developer-layer thickness control member 27, thereby increasing the tendency of the developer 24 to be fused to the developer-layer thickness control member 27, because the developer 24 on the surface of the developing roller 22 is smoothed out to an even layer having a thickness on the order of 20 μm by the developer-layer thickness control member 27.

As a result, although according to the prior art, formation of the developer layer on the developing roller 22 was disturbed due to fusion of the developer to the developer-layer thickness control member 27 and caused print white void and back ground of developer after printing of approximately 2,000–5,000 sheets, no such inconvenience was produced in the present example even after printing of approximately 5,000 sheets.

The relationship between the amount of developer 24 conveyed by the developer agitation roller 26 and the amount of developer 24 conveyed by the developer feed roller 23 will now be discussed with reference to FIG. 42 and FIG. 62.

Figure 62:
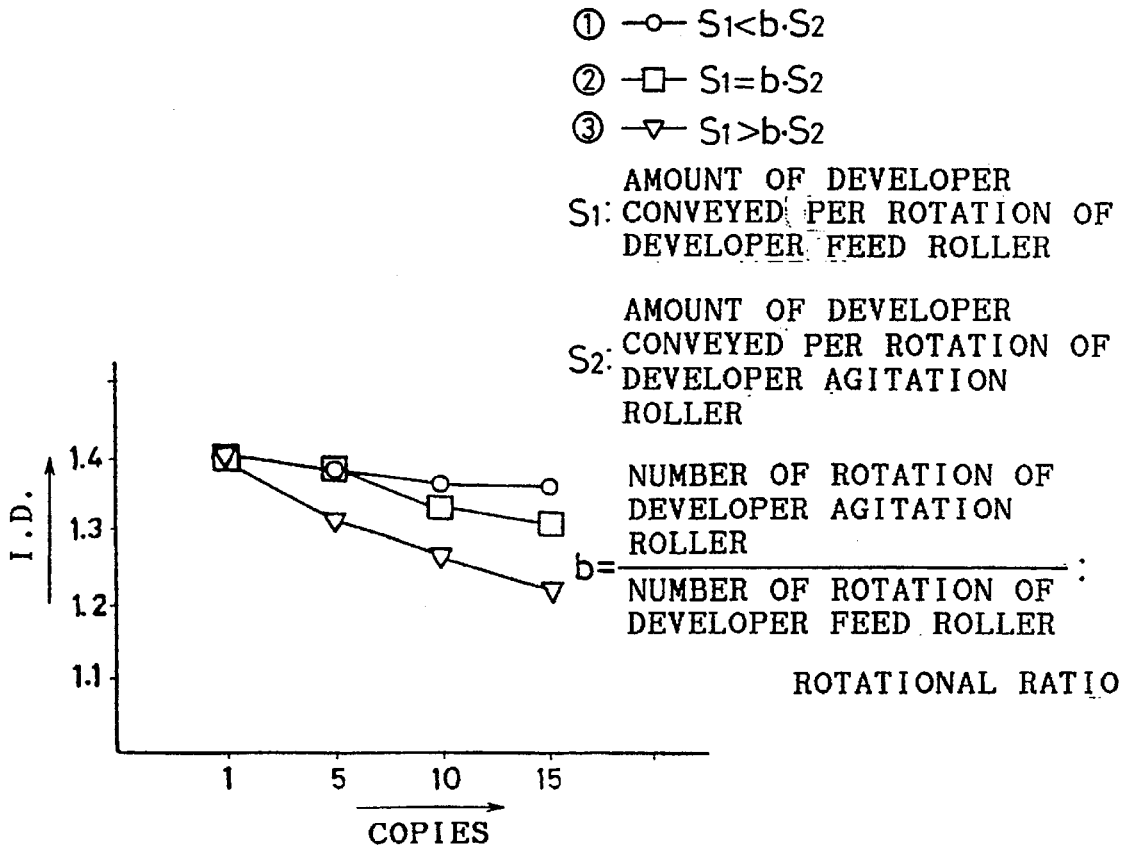
FIG. 62 is a graph illustrative of the change in density of images printed with the developer cartridge (solid portions were measured) as the ratio between the amount of developer conveyed by the developer agitation roller and the amount of developer conveyed by the developer feed roller.
Figure 63:
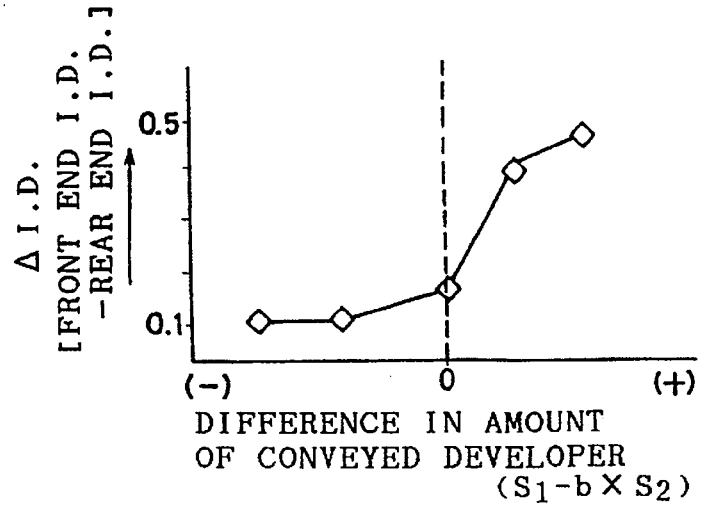
FIG. 63 is a graph illustrative of the change in the difference in density between the front ends and the rear ends of images solid-printed with the developer cartridge, which is determined by the relationship between the amount of developer conveyed per rotation of the developer agitation roller, the amount of developer conveyed per rotation of the developer feed roller and the rotational ratio.
Figure 64A:
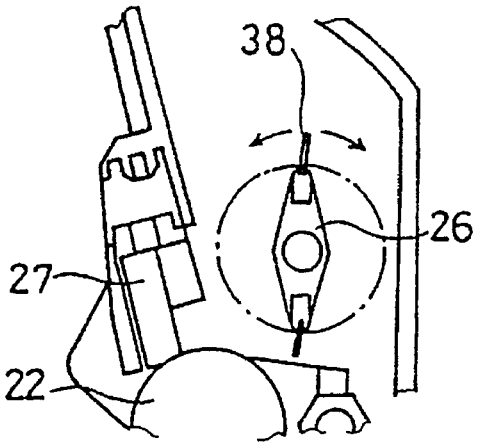
Figure 64B:
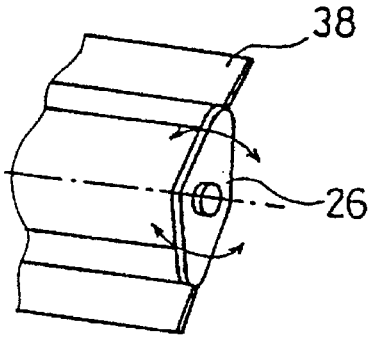

First, representing the amount of developer 24 conveyed by the developer feed roller 23, which is shown in FIG. 42, per rotation by S1, the amount of developer 24 conveyed by the developer agitation roller 26 per rotation by S2 and the rotational ratio between the developer agitation roller 26 and the developer feed roller 23 (number of rotations of the developer agitation roller/number of rotations of the developer feed roller) by "b", and changing the rotational ratio "b" while keeping the amounts of conveyance $S_1$ and $S_2$, in cases where $S_1>b\times S_2$, that is, the amount of conveyance $S_2$ by the developer agitation roller 26 is smaller, concentration of the solid image produced by solid printing gradually decreases as shown by the delta symbols in FIG. 62. Further, as shown in FIG. 63, the difference in concentration between the front end and the rear end of the solid image increases.

Therefore, in order to maintain consistent movability of developer 24 on the surface of the developing roller 22 in the case of solid printing or the like which requires large amounts of developer in high concentrations, it is necessary to satisfy the relation: $S_1<b\times S_2$ thereby keeping the developer feed roller 23 always surrounded by developer 24. The case where $S_1=b\times S_2$ is also acceptable, though the concentration of the solid-printed portion is somewhat lower than the case where $S_1<b\times S_2$, as indicated by the squares in FIG. 62.

Further, representing the speed of rotation of the developer feed roller 23 by $v_1$ and the speed of rotation of the developer agitation roller 26 by $v_2$, the relation of $v_2\geqq v_1$ is set so that the amount of conveyance $S_2$ by the developer agitation roller 26 exceeds the amount of conveyance $S_1$ by the developer feed roller 23.

In order to increase the amount of conveyance $S_2$ by the developer agitation roller 26, it is also possible to provide the tip of the developer agitation roller 26 with a blade 38 made of an elastic material such as PET in a manner which allows its contact with the wall surface of the cartridge body 21.

This configuration allows reduction in the amount of the residual virgin developer 24 left in the developer tank by approximately 20% of the amount according to the prior art.

On the other hand, as described above and as shown in FIG. 42, the developer-layer thickness control member 27 smooths out the developer 24 on the surface of the developing roller 22 to form a thin layer of the developer 24. This causes presence of the scrubbed excess developer 24 near and upstream from the developer-layer thickness control member 27. If this excess developer 24 remains near the developer-layer thickness control member 27, then the developer 24 conveyed from the developer feed roller 23 cannot enter into the area of the developer-layer thickness control member 27, or conversely, the amount of the developer 24 conveyed to the developer-layer thickness control member 27 increases excessively to raise the pressure of the introduced developer.

Figure 65A:
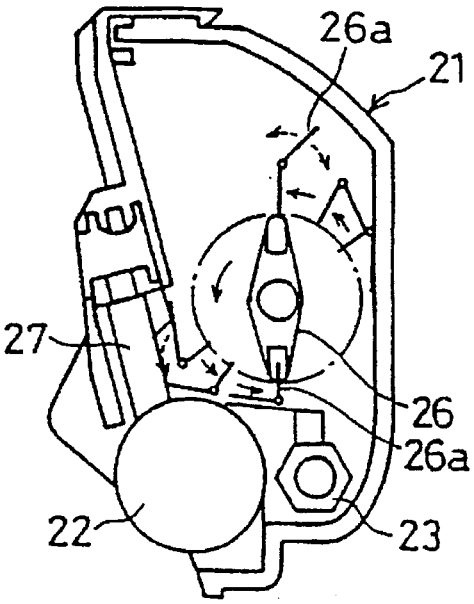
Figure 65B:
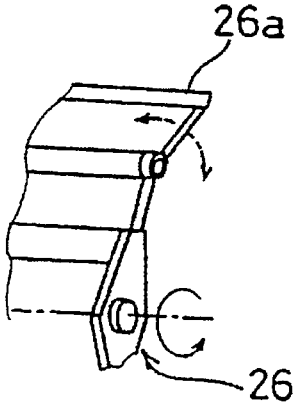

As a result, charging of the developer 24 by the developer-layer thickness control member 27 is prevented to produce the inconvenience of scattering of the developer 24 toward the downstream side of the developer-layer thickness control member 27 to facilitate fusion of the developer 24 to the developer-layer thickness control member 27. As mentioned above, it is not preferred that the once-smoothed developer 24 remain near the developer-layer thickness control member 27 when the developer layer is formed on the surface of the developing roller 22. For example, as shown in FIGS. 65A and 65B, the developer agitation roller 26 may be provided with recovery blades 26*a*, 26*a* supported at rotational ends of the blades 38, 38 in a rotatable manner, and these recovery blades 26*a*, 26*a* may be used to recover the developer 24 accumulated upstream from the developer-layer thickness control member 27 in the developer tank. This results in preventing the developer 24 from remaining near the upstream side of the developer-layer thickness control member 27 and in the formation of a developer layer on the surface of the developing roller 22 which consists only of the developer 24 conveyed from the developer feed roller 23. As a result, the amount of developer in the developer layer may be kept constant, and the developer 24 may be charged consistently as well, thus eliminating the inconvenience described above.

Here, the recovery blades 26a, 26a are designed to freely open and close crawling on the inner wall surface of the developer tank and the side surface of the developer-layer thickness control member 27 as the developer agitation roller 26 rotates, and thus do not prevent rotation of the developer agitation roller 26.

Figure 66A:
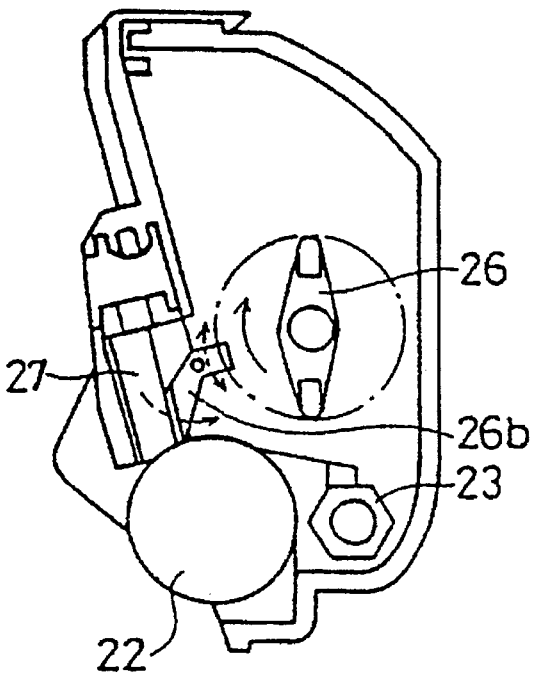
Figure 66B:
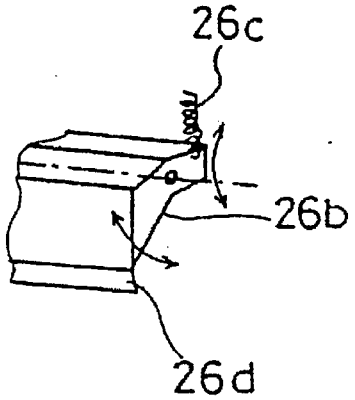
Figure 66C:
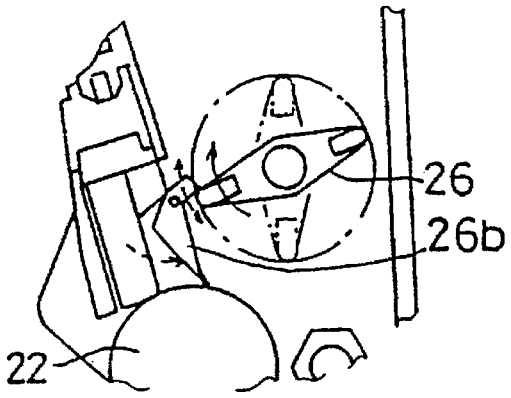

Alternatively, the recovery blades 26a, 26a, though being formed as blade-shaped recovery mechanisms attached to the developer agitation roller 26 in the above case, may be formed otherwise; for example, they may be replaced by other members which have the same functions when interlocked with the developer agitation roller 26. For example, as shown in FIG. 66A, a dogleg scrubbing blade 26b which is rotatable around its center may be formed near the developer-layer thickness control member 27. Further, as shown in FIG. 66B, the blade 26b may be biased at one end by a spring 26c to provide the blade 26b with a pressing force, and it may be provided with a blade material 26d at the other end. As shown in FIG. 66C, the developer agitation roller 26 rotates to contact and press the scrubbing blade 26b. At the same time, the dogleg scrubbing blade 26b rotates around its center to scrub the developer 24 remaining near the developer-layer thickness control member 27 and recover the developer 24 in the developer tank. Since the developer 24 may be recovered with only the members interlocked with the developer agitation roller 26 in this way, the parts count does not increase and thus increase in cost may be prevented.

As described above, in the developer cartridge 20 for printers according to the present example, the developer storage section with the developer agitation roller 26 is provided above the developer feed roller 23 for conveying developer 24 to the developing roller 22. Accordingly, the developer 24 may be conveyed consistently to produce consistent high image quality without being influenced by mobility of the developer 24 and the state of the developer 24 including the residual amount of the developer 24 in the developer tank, and further, since there is no need to provide additional carrying mechanisms, the entire developer cartridge 20 may be made more simple and compact, and thus the cost may be minimized accordingly.

Also, in the present example, representing the amount of developer 24 conveyed by the developer feed roller 23 by $S_1$, the amount of developer 24 conveyed by the developer agitation roller 26 by $S_2$ and the ratio of rotations between the developer agitation roller 26 and the developer feed roller 23 (number of rotations of the developer agitation roller/number of rotations of the developer feed roller) by "b", it is preferred that the relation: $S_1 \leqq b \times S_2$ be satisfied. In addition, the ratio "b" of rotations preferably satisfies the relation: $b \geqq 1$. If these relations are satisfied, a consistent amount of developer 24 may be supplied at all times; even in cases where developer 24 on the surface of the developing roller 22 is consumed, since conveyance of developer 24 from the developer feed roller 23 is ensured, favorable images may be produced consistently even when printing is performed in high concentrations.

Furthermore, since the tip of the developer agitation roller 26 is provided with the blade 38 in a state which allows its contact with the wall surface of the cartridge body 21, it is possible to efficiently convey the residual developer 24 in the developer tank from the developer agitation roller 26 to the developer feed roller 23, thus reducing the amount of developer remaining in the developer tank. As a result, developer 24 loaded in the developer tank may be fully consumed, and thus developer supply costs may be minimized.

In addition, since the developer agitation roller 26 is provided with the recovery blades 26a, 26a for recovering developer 24 smoothed by the developer-layer thickness control member 27 from the vicinity of the developer-layer thickness controller member 27, the developer 24 does not remain near the upstream end of the developer-layer thickness control member 27, and therefore the amount of developer in the developer layer may be kept constant, and developer 24 may be charged in a consistent manner, thus resulting in long-lasting consistent image quality.

EXAMPLE 5

An additional example of the present invention will now be explained with reference to FIG. 67 through FIG. 81. Here, for convenience in explanation only, members in the drawings which have the same functions as those shown in the drawings referred to in Example 1 through Example 4 described above are identified by like reference characters, and therefore explanations thereof are omitted.

Figure 67:
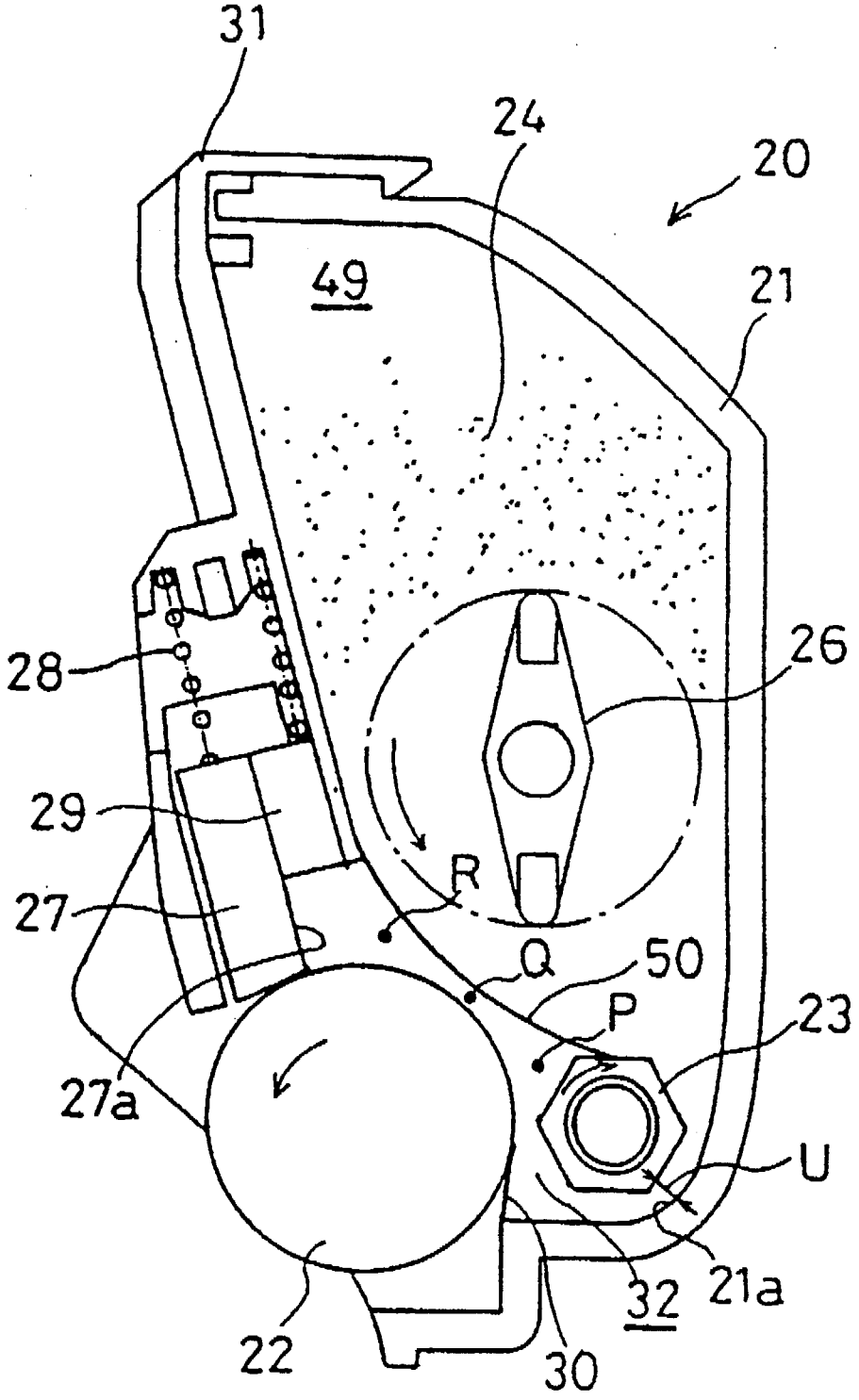
FIG. 67 is a structural schematic view of an entire developer cartridge for printers according to a fifth embodiment of the present invention, with a developer-applying member and a scrubbing member integrally provided in the form of an arc projecting toward the developing roller.

In the present example, as shown in FIG. 67, the developer-applying member 50 is formed of, for example, a sheet-like elastic body of a resin material such as PET, with one end affixed to the cartridge cover 31 and the other end being in contact with and pressing against the developer feed roller 23 so that developer 24 deposited on the surface of the developer feed roller 23 is scrubbed into the developer-supplying chamber 32. That is, the developer-applying member 50 also serves as a scrubbing member in the present example.

The developer-applying member 50, being formed of an elastic body of a resin material such as PET in the present example, is not limited thereto and may be formed of another material; for example, it may be formed of an elastic body made of a resin material such as polyethylene, acrylic resin or nylon, rubber, or a rigid body such as a plate spring, etc.

The developer-applying member 50 is shaped as an arc which curves outward toward the developing roller 22 and which serves as a partition to separate the developer-layer thickness control member 27 and the developing roller 22 from the other members in the developer tank 49. The developer-applying member 50 is designed to press the developer at the point Q in the developer-supplying chamber 32, the point on the developer-applying member 50 which is located nearest to the developing roller 22, so that the developer 24 is preliminarily deposited and preliminarily charged. This allows consistent charging of developer 24 as it passes through the developer-layer thickness control member 27, which will be discussed later.

Figure 68:
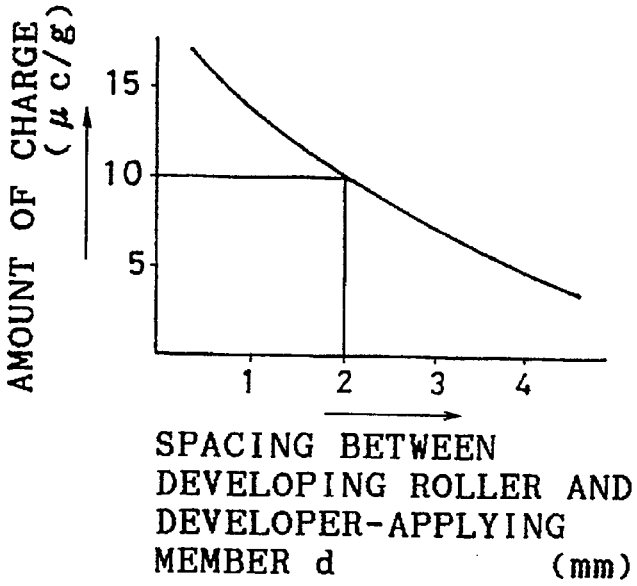
FIG. 68 is a graph illustrative of the relationship between the spacing between the developer-applying member and the developing roller, and the amount of charge of developer downward from the developer-layer thickness control member.
Figure 69:
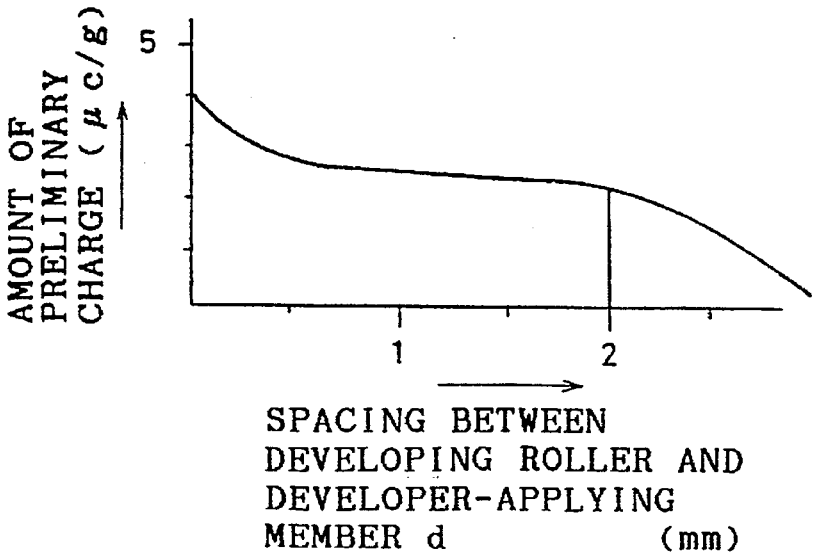
FIG. 69 is a graph illustrative of the relationship between the spacing between the developer-applying member and the developing roller, and the amount of preliminary charge of developer.

Here, an optimum distance or spacing "d" between proximate points of the developing roller 22 and the developer-applying member 50 is 2 mm or less ($0<d\leqq 2$) based on the relationship between the amount of charge and the spacing "d" which is illustrated in FIG. 68, because favorable images free of overfed developer are produced when the amount of charge is 10 μC/g or more. The relationship between the amount of preliminary charge and the spacing which is shown in FIG. 69 reveals that the amount of preliminary charge at that distance is 2.5 μC/g or more.

The material for forming the developer-applying member 50 is desired to be one which is placed more positive than the developer 24 in the electrification series. Therefore, an optimum material for the developer-applying member 50 is a sheet of nylon or an acrylic resin. More specifically, as described above, the developer 24 is composed of a styrene-acrylic resin and thus is negatively charged. Here, if the developer-applying member 50 is composed of a material which is placed to be easily charged negatively in the electrification series, then the developer 24 resists charging, thus resulting in a poor preliminary charge and frictional electrification. On the other hand, developer 24 is overfed when charged positively. Accordingly, in cases where negatively charged developer 24 is subjected to frictional electrification with one which is placed to be charged more positively than the developer 24 in the electrification series, the developer 24 receives a full negative charge to produce favorable image quality free of overfed developer. The desirability of having a different charging tendency from developer 24 also applies to the material for the developer feed roller 23.

Figure 70:
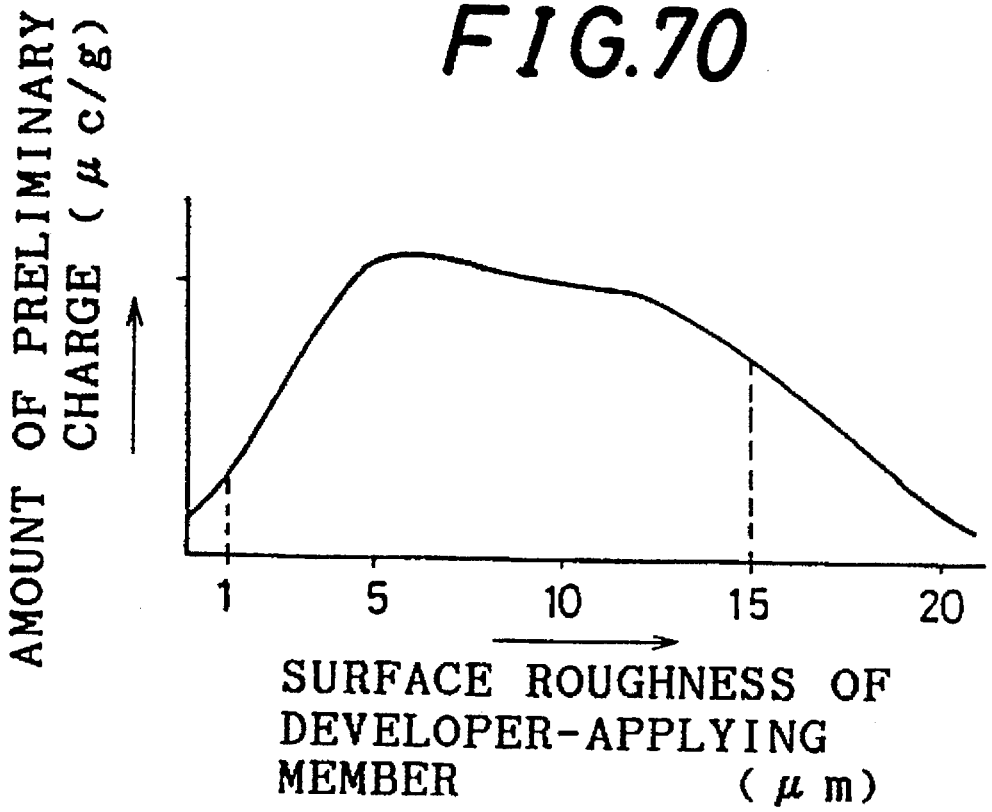
FIG. 70 is a graph illustrative of the relationship between the surface roughness of the developer-applying member and the amount of preliminary charge of developer.

Also, the developer-applying member 50 of the present example is provided with irregularities formed on the surface at the side of the developing roller 22 which has a ten-point mean surface roughness $R_Z$ on the order of 5 μm. Here, the relationship between the amount of preliminary charge and the surface roughness which is shown in FIG. 70 teaches that the preliminary charge tends to become poorer in cases where the ten-point mean surface roughness $R_Z$ is 1 μm or less, or 15 μm or more.

Figure 71:
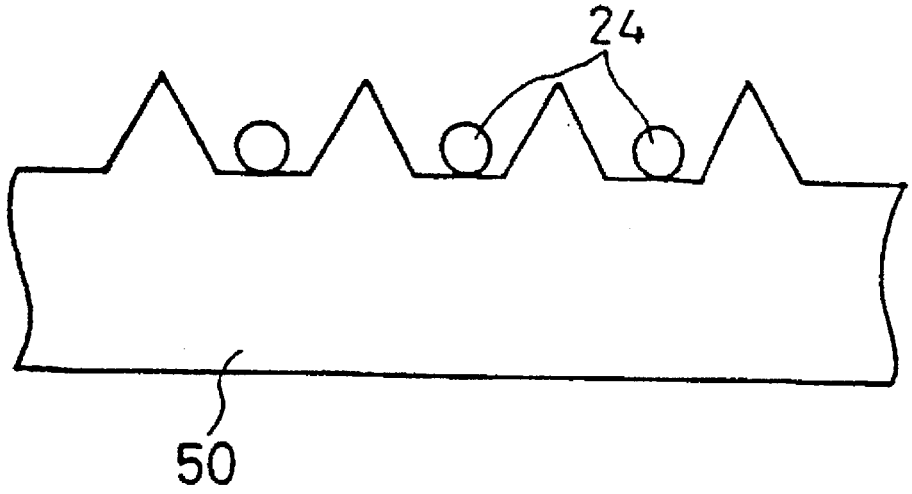
FIG. 71 is an enlarged view of the main portion which illustrates the state of developer on the developer-applying member which has an increased surface roughness.

This is because, since developer 24 has a particle size on the order of 8–10 μm, developer 24 slides on the surface of the developer-applying member 50 to cause poor frictional electrification between the developer 24 and the developer-applying member 50 and consequent poor preliminary charge in cases where the surface of the developer-applying member 50 is excessively fine ($R_Z \leqq 1$ μm). Conversely, in cases where the surface of the developer-applying member 50 is excessively rough ($R_Z \geqq 15$ μm), the developer 24 tends to pass through spaces between the irregularities, as shown in FIG. 71, with the same result of poor frictional electrification and poor preliminary charge as in the case described above.

Figure 72A:
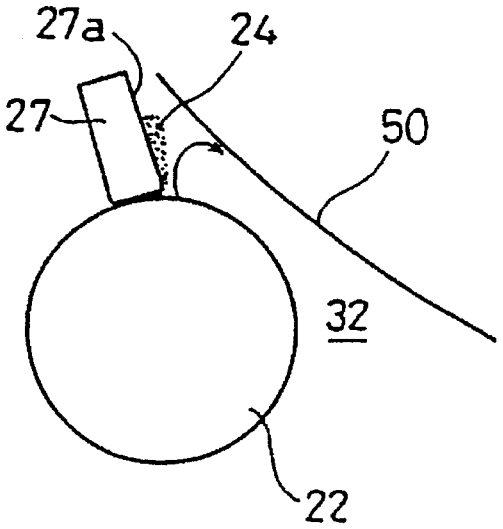
Figure 72B:
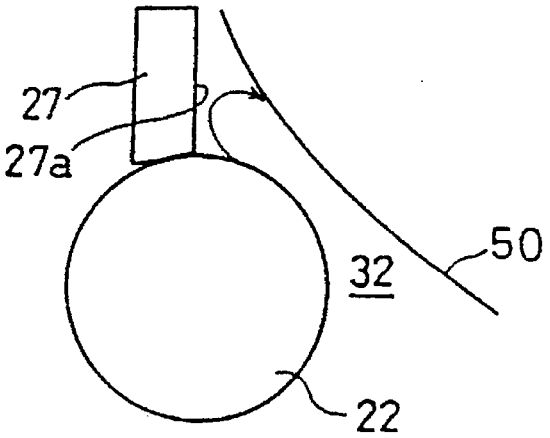

On the other hand, in the present example, the developer-layer thickness control member 27 is provided, as shown in FIG. 67, with a wall surface 27*a* placed in proximity to the developing roller 22, almost vertically or forming an acute angle with the vertical. This is because, if the wall surface 27*a* of the developer-layer thickness control member 27 leans with an obtuse angle from the vertical direction, then the excess developer 24 scrubbed by the developer-layer thickness control member 27 for control of developer layer thickness moves up along the wall surface 27*a* and remains along the wall surface 27*a*. The developer 24 remaining along the wall surface 27*a*, being preliminarily charged once, is destaticized to a lower dielectric constant while being deposited on the wall surface 27*a*. Therefore, if this developer 24 sometimes disintegrates, then it is mixed with developer preliminarily charged by the developer-applying member 50 to cause a non-uniform charge, thus increasing the tendency to produce images with overfed developer. In order to prevent this, the developer-layer thickness control member 27 in the present example is designed so that the wall surface 27*a* in proximity to the developing roller 22 is placed almost vertically, as shown in FIG. 72B. As a result, the developer 24 which has left the developer-supplying chamber 32 is scrubbed by the developer-layer thickness control member 27 and then returned immediately to the developer-supplying chamber 32 without remaining along the wall surface 27*a*. Back ground of developer may be prevented according to this design.

Figure 73:
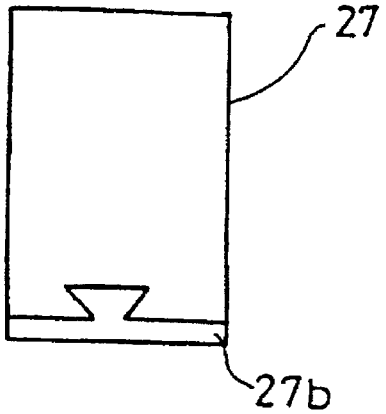
FIG. 73 is a structural schematic view of a replaceable section of contact of the developer-layer thickness control member with the developer roller in the developer cartridge.

More particularly, the developer-layer thickness controller member 27 is formed, as shown in FIG. 73, in such a manner that its section 27*b* of contact with the developing roller 22 (hereunder sometimes abbreviated to "contact section") is a replaceable type which may be withdrawn in the longitudinal direction thereof. More specifically, since the section 27*b* of the developer-layer thickness control member 27 which is brought into contact with the developing roller 22 tends to wear out due to the contact, the prior art requires that the entire developer-layer thickness controller member 27 be replaced by a new one once the contact section 27*b* has worn out. On the other hand, formation of a long-life developer-layer thickness control member 27 of a highly wear-resistant material causes increase in cost. Therefore, in the present example, increase in cost is prevented by providing a replaceable contact section 27*b*.

Here, the contact section 27*b* is designed in the present example so that it may be withdrawn in the longitudinal direction thereof; nonetheless, without being limited to this design, it may be formed so as to allow its withdrawal in the direction perpendicular to the longitudinal direction.

The section of the developer-layer thickness control member 27 which is brought into contact with the developing roller 22 also has irregularities which may be adjusted in the same manner as the irregularities formed on the surface of the developer-applying member 50.

Figure 74:
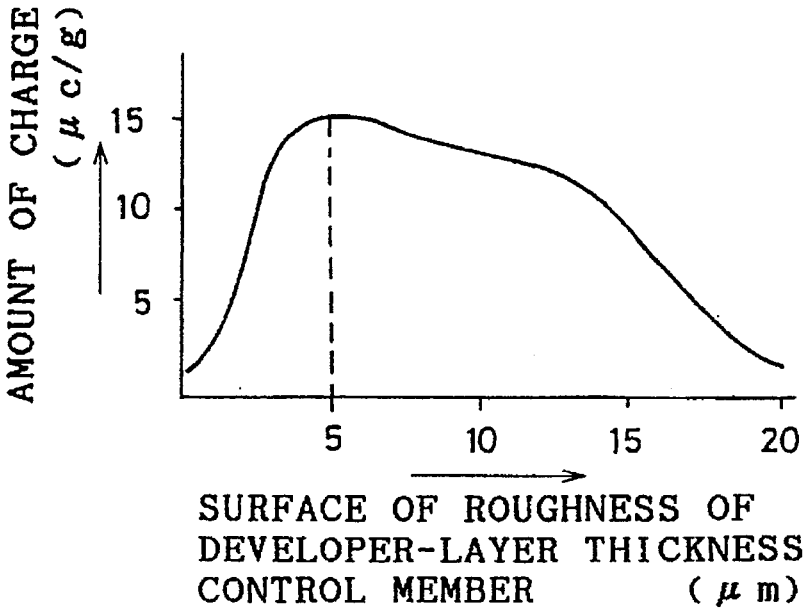
FIG. 74 is a graph illustrative of the relationship between the surface roughness of the developer-layer thickness control member and the amount of charge of developer.

More specifically, the surface roughness of and the amount of charge on the section of the developer-layer thickness controller member 27 which is brought into contact with the developing roller 22 has a relationship as illustrated in FIG. 74. Considering the relationship illustrated in FIG. 74, the section is designed to have irregularities with a ten-point mean surface roughness $R_Z$ on the order of 5 μm.

Figure 75:
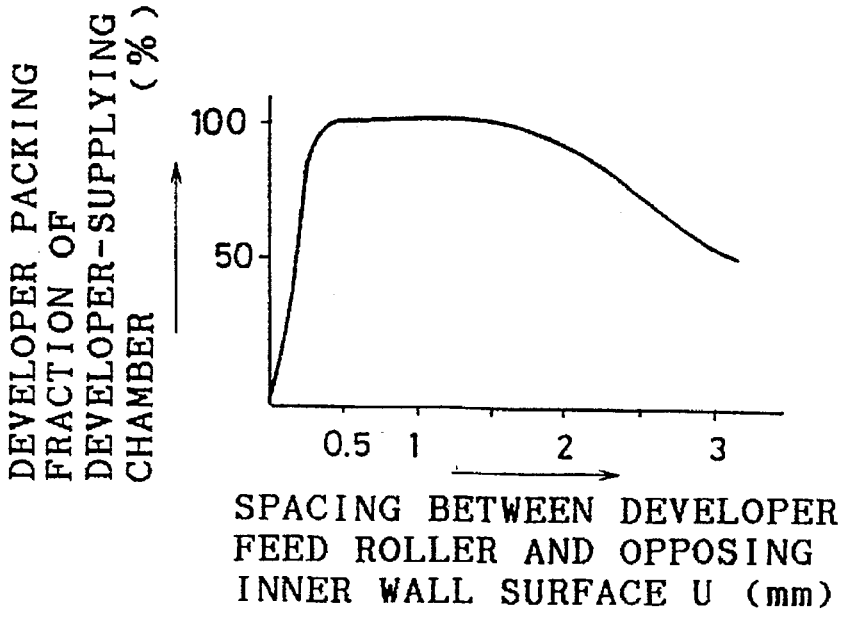
FIG. 75 is a graph illustrative of the relationship between the spacing between the developer feed roller and the opposing inner wall face, and the developer packing fraction of a developer-supplying chamber in the developer cartridge.

In the present example, as shown in FIG. 67, for instance, the spacing U between the developer feed roller 23 and the opposing inner wall surface 21*a* of the cartridge body 21 which is the section facing the developer feed roller 23 is set to approximately 1 mm. This is partially because the amount of developer supplied to the developer-supplying chamber 32 decreases, and consequently the developer packing fraction of the developer-supplying chamber 32 decreases as well in cases where the spacing U is 0.5 mm or less, as shown in FIG. 75 illustrative of the relationship between the spacing U and the developer packing fraction of the developer-supplying chamber 32. On the other hand, in cases where the spacing U exceeds 2 mm, there is a drop in the developer pressure from the developer agitation roller 26 onto the developer feed roller 23, and consequently also a drop in the developer packing fraction of the developer-supplying chamber 32. For these reasons, as mentioned above, the spacing U is set to approximately 1 mm in the present example. Although being set to approximately 1 mm in the present example, the spacing U is not restricted thereto; the relationship illustrated in FIG. 75 suggests that the spacing U preferably is 0.5–2 mm, and optimally 0.5–1.5 mm.

Figure 76:
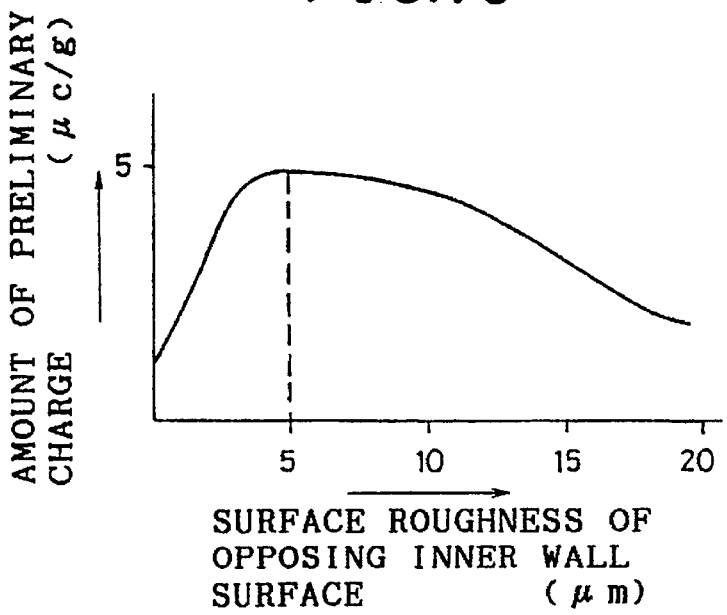
FIG. 76 is a graph illustrative of the relationship between the surface roughness of the facing inner wall face and the amount of preliminary charge of developer in the developer cartridge.

The opposing inner wall surface 21*a* and the surface of the developer feed roller 23 have irregularities with a ten-point mean surface roughness $R_Z$ on the order of 5 μm, as is the case with the developer-applying member 50 and the developer-layer thickness control member 27. As shown in FIG. 76 which illustrates the relationship between the amount of preliminary charge and the surface roughness, the preliminary charge tends to be poorer contrary to expectations in cases where the ten-point mean surface roughness $R_Z$ is 3 μm or less, or 15 μm or more.

This is because, since the developer 24 has a particle size on the order of 8–10 μm, developer 24 slides on the opposing inner wall surface 21*a* and on the surface of the developer feed roller 23 to cause poor frictional electrification between the developer 24 and the opposing inner wall surface 21*a* or the developer feed roller 23, and consequently poor preliminary charging in cases where the opposing inner wall surface 21*a* and/or the surface of the developer feed roller 23 is excessively fine ($R_Z \leqq 3$ μm). Conversely, in cases where the opposing inner wall surface 21*a* and/or the surface of the developer feed roller 23 is excessively rough ($R_Z \geqq 15$ μm), the developer 24 tends to pass through spaces between the irregularities, with the same result of poor frictional electrification and consequent poor preliminary charging as in the case mentioned above.

Operation of the developer cartridge 20 constructed as described above will now be explained. First, as shown in FIG. 67, developer 24 stored in the cartridge body 21 is agitated as the developer agitation roller 26 rotates counterclockwise and conveyed to a position above the developer feed roller 23 located thereunder.

Then, as the developer feed roller 23 rotates clockwise, the developer 24 passes through the space between the facing inner wall surface 21*a* of the cartridge body 21 which is the section facing the developer feed roller 23, and the developer feed roller 23, and is conveyed and supplied under pressure to the developer-supplying chamber 32 at the side of the developing roller 22.

In this connection, the relationship between the amount of developer conveyed by the developer agitation roller 26 and the amount of developer conveyed by the developer feed roller 23 will now be explained.

In the present example, axial lengths of the developer agitation roller 26 and the developer feed roller 23 are both 217 mm. The number of rotations of the developer agitation roller 26 was set to 58 rpm, the number of rotations of the developer feed roller 23 was set to 50 rpm, and further the amount of developer to be conveyed by the developer agitation roller 26 was set to 45.6 g/min and the amount of developer to be conveyed by the developer feed roller 23 was set to 58 g/min.

Figure 77:
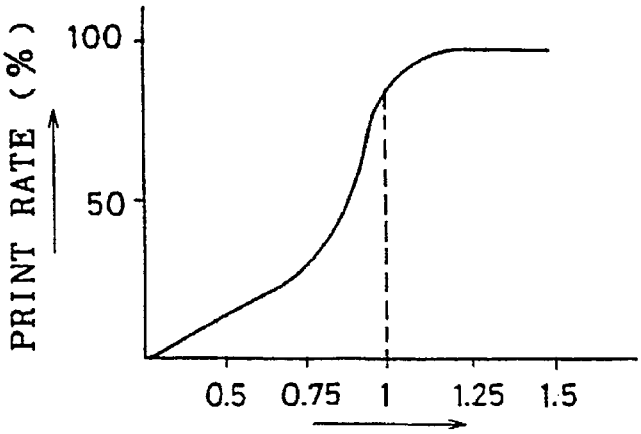
FIG. 77 is a graph illustrative of the relationship between the developer conveyance ratio between the developer agitation roller and the developer feed roller in the developer cartridge, and the print rate.

Here, the relationship between developer conveyance ratio I (=amount of conveyance by the developer agitation roller/amount of conveyance by the developer feed roller) and print rate is illustrated in FIG. 77. In practice, favorable printed image quality is provided at a developer conveyance ratio I of 1 or more, preferably 1.5 or more.

The amount of developer 24 conveyed by the developer feed roller 23 will now be discussed.

Figure 78:
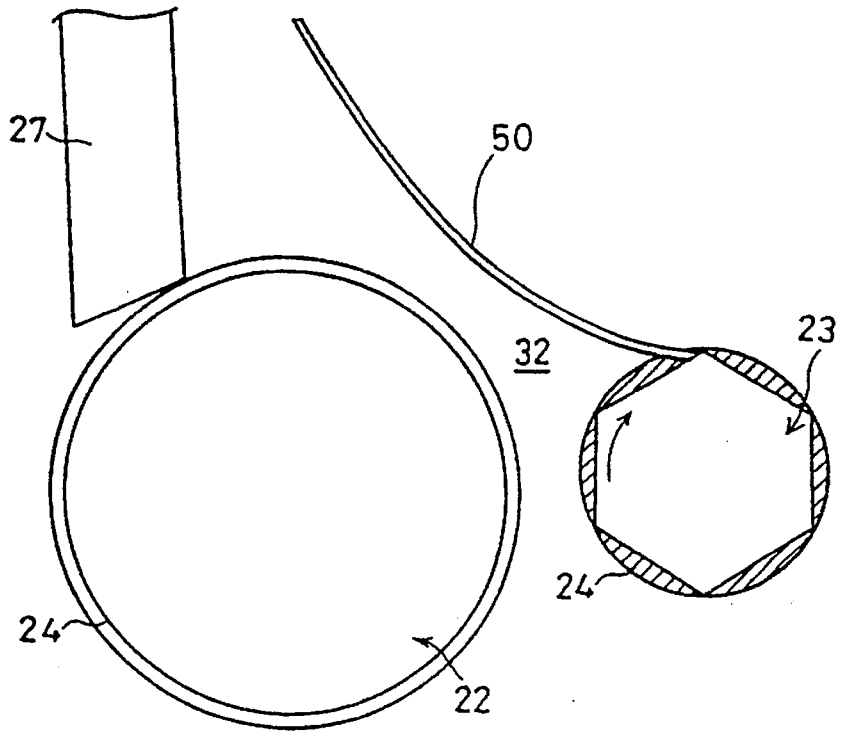
FIG. 78 is a view illustrative of how the amount of developer conveyed by the developer feed roller in the developer cartridge is calculated.
Figure 79:
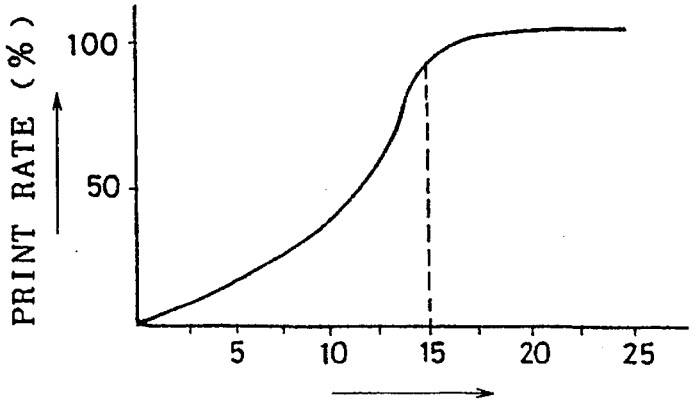
FIG. 79 is a graph illustrative of the relationship between the developer conveyance ratio between the developer feed roller and the developing roller in the developer cartridge, and the print rate.

As shown in FIG. 78, in cases where the developer feed roller 23 is a hexagonal prism with a 8 mm diameter of the circle circumscribing the prism, approximately 0.76 g of developer 24 is conveyed to the developer-supplying chamber 32 per rotation of the developer feed roller 23. More specifically, the amount of conveyance by the developer feed roller 23 is represented by the amount of developer deposited on the diagonally shaded area in FIG. 78, and calculated to be: cross-section of the diagonally shaded area ($cm^2$)× length of the developer feed roller (cm)×apparent specific gravity (=0.32 $g/cm^3$)=0.76 g.

On the other hand, the amount of developer deposited on the developing roller 22 is 0.05 g per rotation thereof. In cases where the total of the amount of developer 24 conveyed by rotation of the developer feed roller 23 and the amount of developer 24 scrubbed by the tip of the developer-applying member 50 is not sufficient, print white void occurs when the print rate is high. Therefore, the amount of developer to approximately fifteen times, and preferably twenty times or more the amount of developer on the developing roller 22.

In the above case, the developer conveyance ratio H (amount of conveyance by the developer feed roller/amount of deposition on the developing roller) is 0.76/0.05=15.2 times, and thus the developer 24 in the developer-supplying chamber 32 has a stabilized pressure and allows favorable printing. Conversely, in cases where the print rate is high, favorable results of printing are yielded in cases where the rotational speed of the developer feed roller 23 is increased or the developer feed roller 23 has a larger diameter to increase the developer conveyance ratio H twenty-fold or more.

As shown in FIG. 67, the developer 24 packed in the developer-supplying chamber 32 by pressure from the developer feed roller 23 is then conveyed from the point P in the developer-supplying chamber 32 to the point Q nearest to the developing roller 22 and is pressed by the developer-applying member 50 to be deposited on the surface of the developing roller 22. Upon arriving at a predetermined point on the top of the developer-layer thickness control member 27 by counter clockwise rotation of the developing roller 22, the excess developer 24 is removed by the developer-layer thickness control member 27. Here, the developer 24 deposited on the developing roller 22 is charged by friction with the developer-layer thickness control member 27 and the developing roller 22 and by mutual friction of the developer 24, and forms an even thin developer layer on the surface of the developing roller 22.

The developer layer formed on the surface of the developing roller 22 is brought into contact with a photoconductor drum 5*a* placed facing the developing roller 22 by further rotation of the developing roller 22, of which time the developer 24 is adsorbed on the photoconductor drum 5*a* to develop the electrostatic latent image formed on the photoconductor drum 5*a*.

Figure 80A:
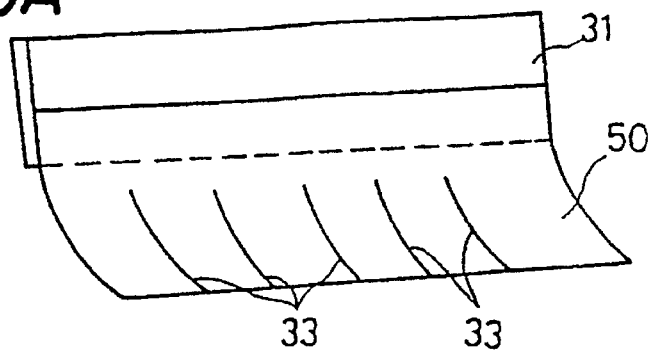
Figure 80B:
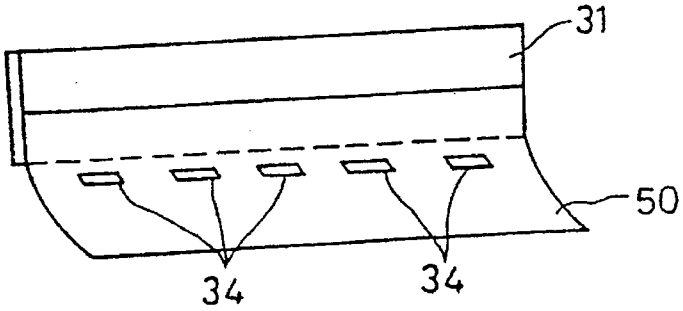

In order to return the excess developer 24, which has been cut off by the developer-layer thickness control member 27, from the point R in the developer-supplying chamber 32 to the side of the developer agitation roller 26, most preferably a slit 33 or a hole 34 is formed in the developer-applying member 50, as shown in FIGS. 80A and 80B. This prevents the pressure in the developer-supplying chamber 32 from increasing beyond a given value.

By using a magnetic, one-component type developer it is possible to prevent electrostatic deposition of charged developer on the developer-applying member 50 in cases where the developer-applying member 50 is formed of a conductive material. Clogging of the slit 33 or the hole 34 with developer may be prevented by, for example, using a resin incorporating a conductive material such as carbon, or a metal material such as iron, aluminum or an SUS material, and further by grounding the developer-applying member 50. In this way, the pressure in the developer-supplying chamber 32 may be made constant to form an even developer layer on the surface of the developing roller 22.

On the other hand, in cases where a non-magnetic, one-component type developer is used, developer 24 does not clog the slit 33 and/or the hole 34 even in cases where the developer-applying member 50 is formed of a conductive material, and a voltage of the same polarity as the charged polarity of the developer 24 is applied across the developer-applying member 50. The voltage to be applied may be set to −500 V, for example.

Figure 81:
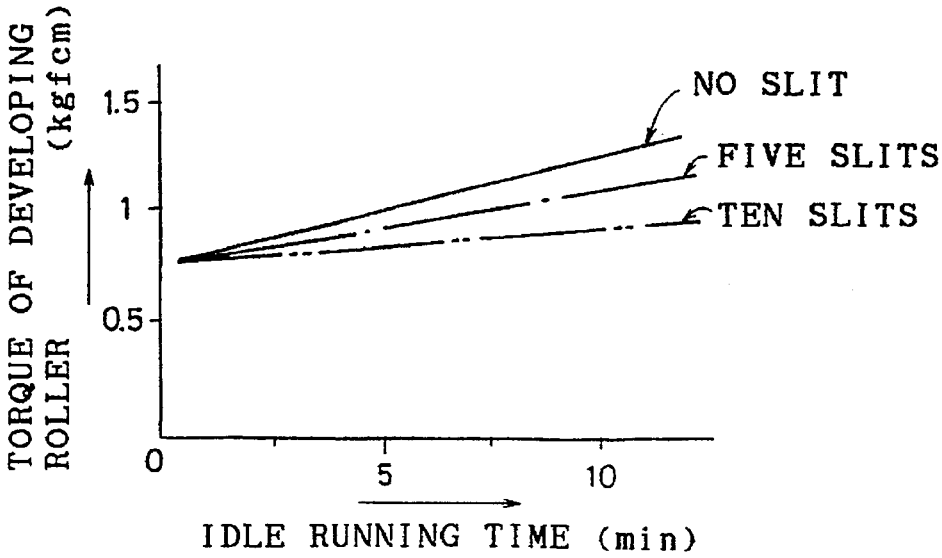
FIG. 81 is a graph illustrative of the relationship between the idle running time and the torque of the developing roller for various numbers of slits in cases where the developer-applying member are slit.

The pressure in the developer-supplying chamber 32 (driving torque of the developing roller 22) and the idle running time have such a relationship that the initial torque is 0.7 kgfcm in the absence of the slit 33 and increases to 1.3 kgfcm after 10-minute's idle running, as shown in FIG. 81. In addition, the torque increases to 1.0 kgfcm by 10-minute's idle running in cases where five slits 33 are formed, and to 0.8 kgfcm by 10-minute's idle running in cases where ten slits 33 are formed. This suggests that a greater number of slits 33 results in lower increase in driving torque of the developing roller 22.

Here, in practice, since the developer 24 deposited on the developing roller 22 is consumed by printing, the driving torque of the developing roller 22 is a little lower than the above data.

The above facts conversely suggests that a lesser amount of developer 24 is consumed for a lower print rate, and thus the pressure of the developer in the developer-supplying chamber 32 tends to increase. For this reason, formation of the slit 33 or the hole 34 produces a great effect in cases where the print rate is low.

As described above, since the developer cartridge 20 for printers according to the present example has a developer-applying member shaped as an arc which curves outward toward the developing roller 22 and which serves as a partition to separate the developer-layer thickness controller member 27 and the developing roller 22 from the other members in the developer tank 49, developer 24 conveyed by the developer feed roller 23 toward the developing roller 22 has an increased pressure during passage through the narrow space between the developing roll 22 and the developer-applying member 50 and applied to the developing roller 22 under the pressure. The layer thickness of the developer 24 applied to the developing roller 22 is then controlled by the developer-layer thickness control member 27, and excess developer 24 is scrubbed off. Here, since the developer-applying member 50 is shaped as an arc which provides a large space downstream from the developer-layer thickness control member 27, it is possible to prevent the developer returned to the downstream side of the developer-layer thickness control member 27 from clogging the space even with a large amount of developer 24.

The developer-applying member 50 is formed of an elastic material. The pressure of developer in the developer-supplying chamber 32 tends to become irregular in cases where printing is conducted at alternating higher and lower print rates; nonetheless, according to the present invention, since the elasticity of the developer-applying member 50 serves to absorb the developer pressure, the pressure of developer in the developer-supplying chamber 32 may be made consistent. More specifically, in cases where the print rate is low, since little developer 24 on the developing roller 22 is consumed and the rest is returned to the developer-supplying chamber 32, the amount of developer therein increases. Nonetheless, since the developer-applying member 50 is elastic, the developer-applying member 50 may be pressed apart from the developing roller 22 to widen the space of the developer-supplying chamber 32. As a result, the developer pressure does not increase, and thus the developer 24 does not cause clogging.

In addition, since the developer-applying member 50 and developer 24 are placed distantly in the electrification series, frictional electrification between the developer-applying member 50 and developer 24 may be fully conducted to accomplish sufficient preliminary charging. As a result, later full-scale consistent charging may be accomplished with the developer-layer thickness control member 27, resulting in consistent image quality free of overfed developer. Furthermore, since the developer feed roller 23 and developer 24 are placed distantly in the electrification series, the developer 24 may be fully charged by friction with the developer-applying member 50 when the developer 24 on the developer feed roller 23 is scrubbed thereby, thus resulting in sufficient preliminary charging.

In addition, since the developer-applying member 50 has irregularities formed at least on ifs surface at the side of the developing roller 22, which are smaller than the particle size of developer 24, the developer 24 is preliminarily charged by friction during its passage through the irregular section. As a result, consistent image quality free of overfed developer may be provided.

On the other hand, since the developer-layer thickness control member 27 is constructed with an angle of 90° or less formed between the axial horizontal surface of the developing roller 22 and the wall portion **27*a* of the developer-layer thickness control member 27, developer 24 scrubbed by the developer-layer thickness controller member 27 does not remain along the wall surface 27*a* of the developer-layer thickness control member 27. Accordingly, flow of developer 24 along the wall surface 27*a* of the developer-layer thickness control member 27 becomes smooth, and a lump of developer 24** is not deposited thereon, thus resulting in favorable image quality free of overfed developer.

In addition, since the section **27*b* of the developer-layer thickness control member 27 which is brought into contact with the developing roller 22 is a replaceable type, the worn contact section 27*b* alone may be replaced without replacing the entire developer-layer thickness control member 27. The result is reduction in initial and running costs for the developer-layer thickness controller member 27**.

Also, since the section **27*b* of the developer-layer thickness control member 27 which is brought into contact with the developing roller 22 has irregularities smaller than the particle size of developer 24, the developer 24 is charged by friction with the irregular section. This results in consistent charging of developer 24 and consequent consistent image quality free of overfed developer. Further, it is possible to avoid charging of only the surface of the developer layer on the developing roller 22, that is, to prevent the developer layer on the developing roller 22** from having differently charged lower and upper portions.

In the present example, the spacing U between the developer feed roller 23 and the facing inner wall surface **21*a* is set to satisfy the relation: 0.5 mm<U<2 mm. That is, developer 24 cannot be supplied fully to the developer-supplying chamber 32 if the spacing U is smaller than 0.5 mm, whereas the developer 24 present in the space cannot be conveyed by the developer feed roller 23 to the developer-supplying chamber 32 if the spacing U exceeds 2 mm. In the present example, since the spacing U is set to 0.5 mm<U<2 mm as mentioned above, a consistent amount of developer 24 may be supplied to the developer-supplying chamber 32** to provide consistent image quality.

In addition, since irregularities smaller than the particle size of developer 24 are formed on the outer surface of the developer feed roller 23 and the opposing inner wall surface **21*a*, developer 24 is preliminarily charged by friction when scrubbed by the developer-applying member 50 or during passage along the facing inner wall surface 21*a***. This results in consistent image quality free of overfed developer.

In addition, since the amount of developer 24 to be conveyed by the developer agitation roller 26 is set to be larger than the amount of developer 24 to be conveyed by the developer feed roller 23, a sufficient amount of developer 24 may be supplied to the developer-supplying chamber 32. As a result, consistent image quality may be established regardless of the print rate.

Also, since the amount of developer 24 to be conveyed by the developer feed roller 23 is set to be larger than the amount of developer 24 to be conveyed by the developing roller 22, a sufficient amount of developer 24 may be supplied upstream from the developer-layer thickness controller member 27. Therefore, even at higher print rates a sufficient layer thickness of developer 24 may be ensured on the developing roller 22, upstream from the developer-layer thickness control member 27.

In addition, since the developer-applying member 50 has the slit 33 or the hole 34 formed therein which allows passage of developer 24, it is possible to prevent excessive increase in the pressure of developer in the developer-supplying chamber 32 which occurs in cases where the print rate is not fixed.

EXAMPLE 6

An additional example of the present invention will now be explained with reference to FIG. 82 through FIG. 90. Here, for convenience in explanation only, members in the drawings which have the same functions as those shown in the drawings referred to in Example 1 through Example 5 described above are identified by like reference characters, and therefore explanations thereof are omitted. In Example 5 described above, the developer-applying member 50 had both the function as a developer-applying member for applying developer 24 in the developer-supplying chamber 32 to the developing roller 22 and the function of scrubbing developer 24 on the surface of the developer feed roller 23.

Figure 82:
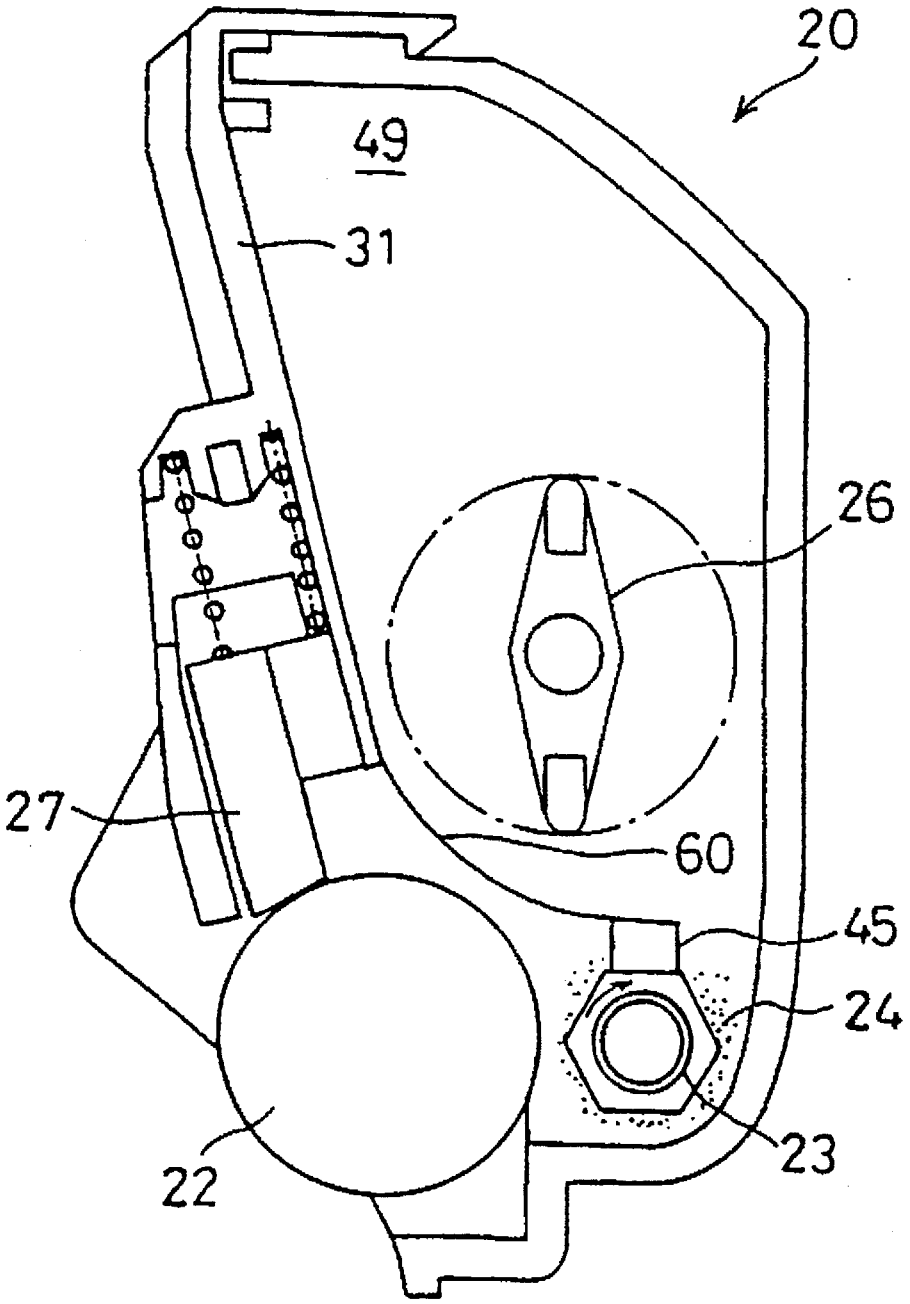
FIG. 82 is a structural schematic view of an entire developer cartridge for printers according to a sixth embodiment, with a developer-applying member provided in the form of an arc projecting toward the developing roller and provided with a separately provided scrubbing member.
Figure 83:
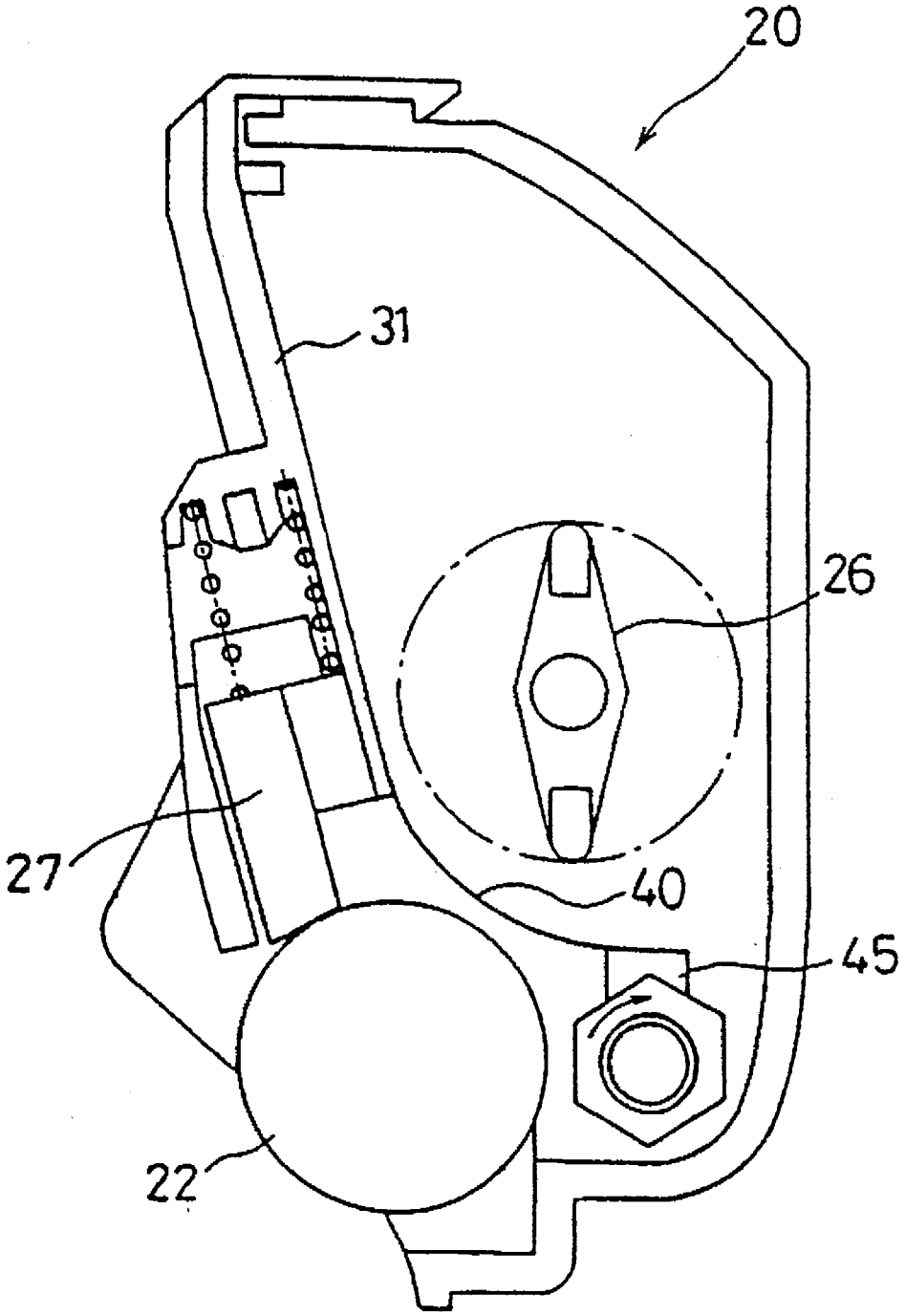
FIG. 83 is a structural schematic view illustrative of the entire developer cartridge, with the scrubbing member made of a sponge in contact with the corner of the developer feed roller.

In the present example, as shown in FIG. 82, a sheet-like developer-applying member 60 affixed to an end of the cartridge cover 31 is provided, at its tip, with a scrubbing member 45 being in contact with the developer feed roller 23. In the same manner as in Example 5, the developer-applying member 60 is shaped as an arc which curves outward toward the developing roller 22 and which serves as a partition to separate the developer-layer thickness control member 27 and the developing roller 22 from the other members in the developer tank 49.

The developer-applying member 60 is formed of the same type of elastic material as the developer-applying member 50 referred to in Example 5 above, and the scrubbing member 45 for scrubbing developer 24 on the surface of the developer feed roller 23 is shaped as a rectangular prism made of a sponge comprising closed foams smaller than the particle size of the developer 24. The penetration depth of the scrubbing member 45 in the developer feed roller 23 may be set to 0.5–1 mm, for example. The scrubbing member 45 consisting of a rectangular sponge scrubs developer 24 in the state shown in FIG. 82 in cases where the scrubbing member 45 is placed on the side of the regular hexagonal prism, and scrubs developer 24 in the state shown in FIG. 83 in cases where the scrubbing member 45 is placed on an edge line on the side of the regular hexagonal prism.

Therefore, developer 24 on the developer feed roller 23 may be scrubbed efficiently. In addition, since the sponge comprises closed foams smaller than the particle size of developer 24, the developer 24 cannot enter into the sponge, and thus the developer 24 on the developer feed roller 23 may be scrubbed in a reliable manner. Here, in cases where the sponge comprises open air voids larger than the particle size of the developer 24, the developer 24 enters into these air voids, thus increasing the weight of the sponge and consequently increasing the torque of the developer feed roller 23.

Figure 84:
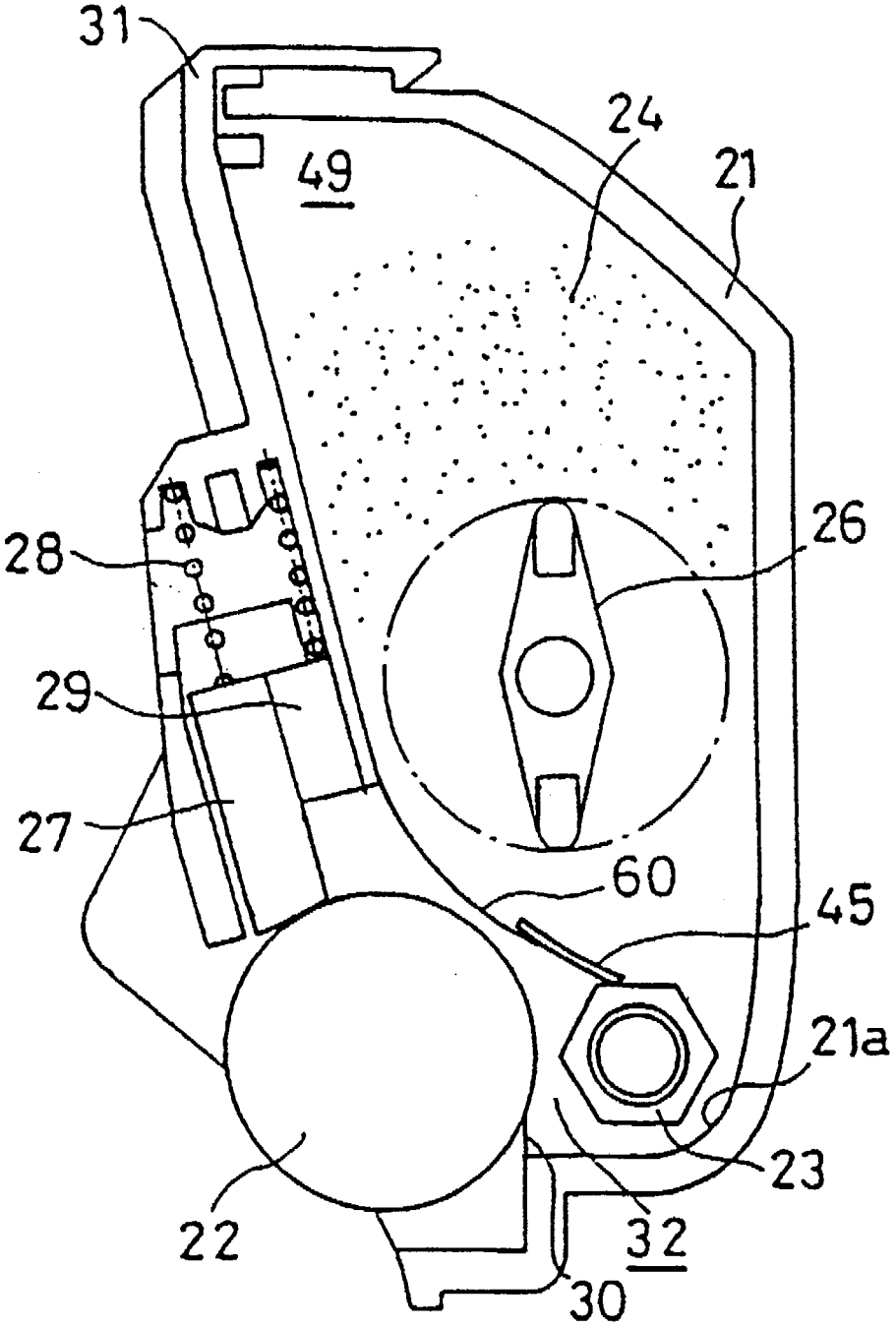
FIG. 84 is a structural schematic view illustrative of the entire developer cartridge, wherein the developer-applying member is formed of a rigid metal, and the scrubbing member is formed of PET.

In addition, as shown in FIG. 84, it is also possible to form the developer-applying member 60 of a rigid metal and to form the scrubbing member 45 of PET. Formation of the developer-applying member 60 of such a rigid metal allows maintenance of a fixed distance between the developer-applying member 60 and the developing roller 22 at all times and thus allows consistent preliminary charging all the times. Here, the developer-applying member 60 need not be formed of a rigid metal, and may also be formed of a rigid resin, for example.

Further, formation of the scrubbing member 45 of PET allows reliable scrubbing of developer on the developer feed roller 23 and consistent supply of the scrubbed developer to the developer-supplying chamber 32.

Figure 85A:
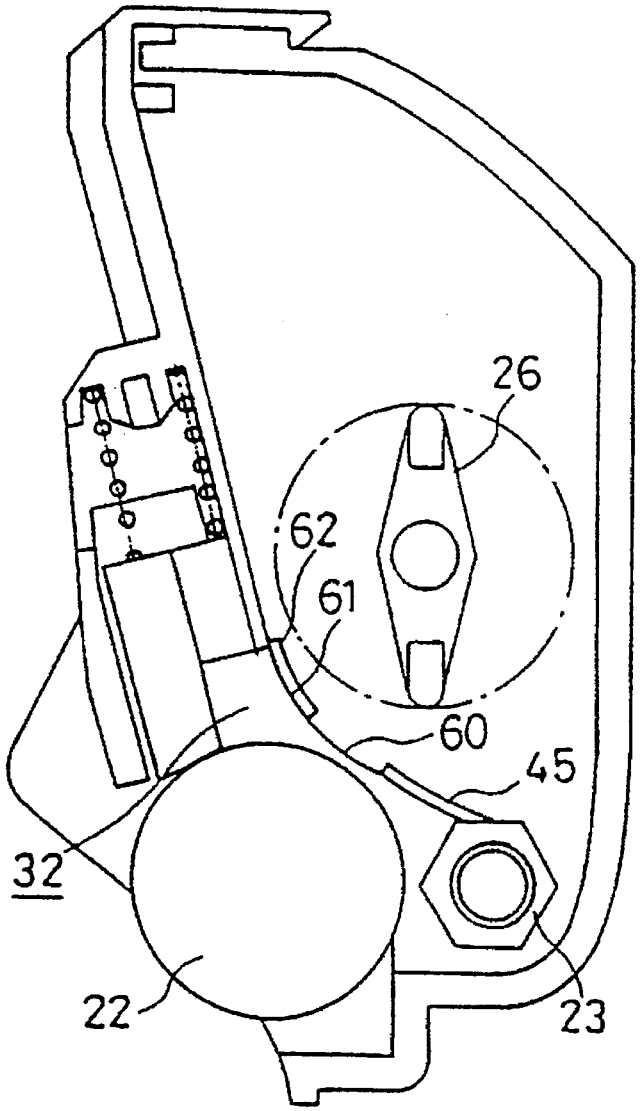
Figure 85B:
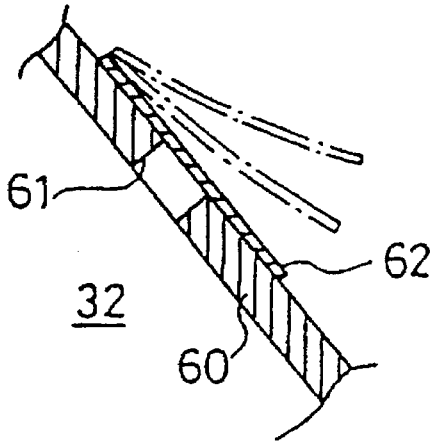
Figure 86:
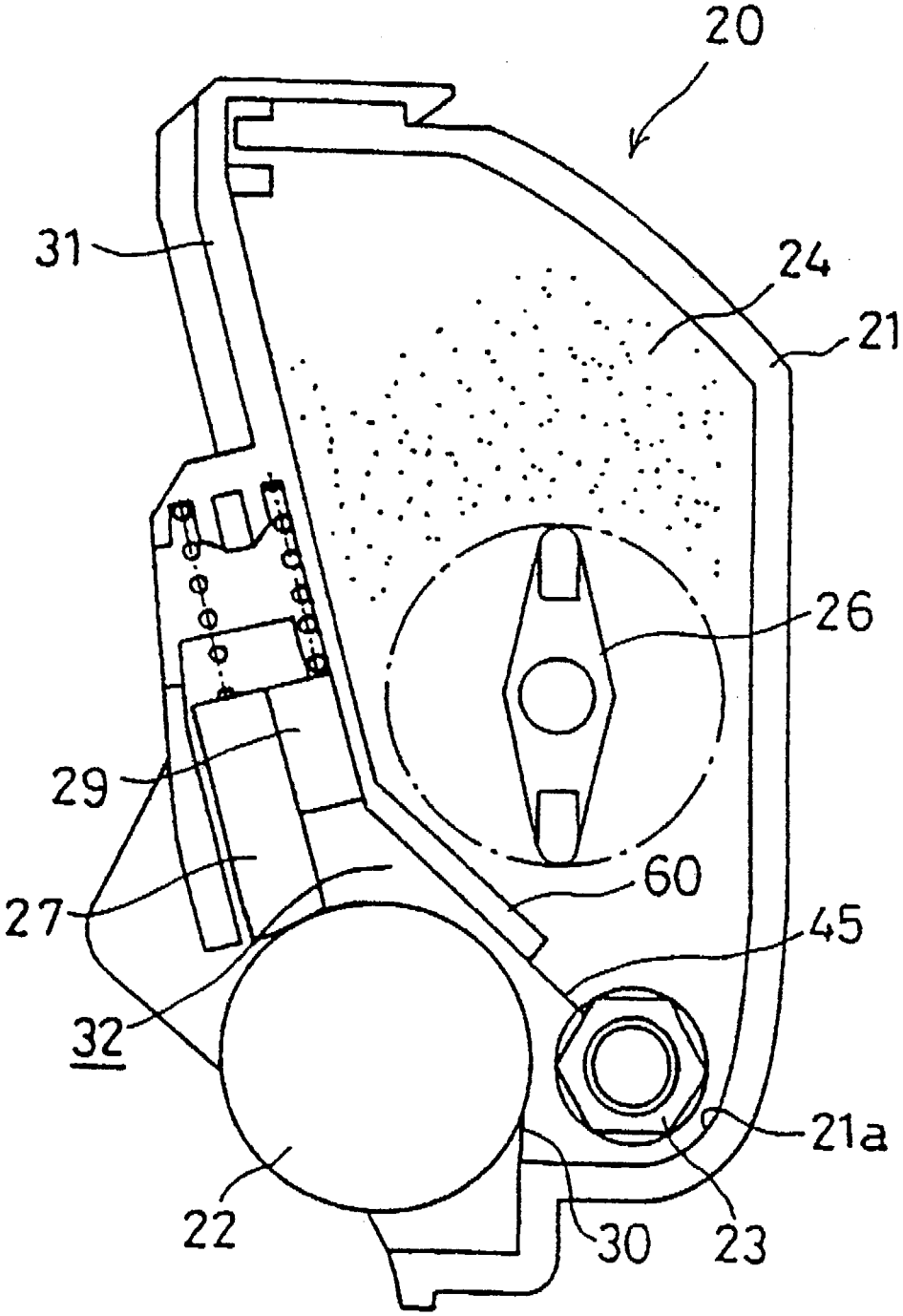
FIG. 86 is an entire structural schematic view of the developer cartridge equipped with the developer-applying member formed as an extension of an cartridge cover.

On the other hand, as shown in FIG. 85A, a hole 61 or slit may be formed in the developer-applying member 60, and a valve 62 which is made of an elastic material and covers the hole 61 may be provided at the side of the developer agitation roller 26. This valve 62, as shown in FIG. 85B, is supported at one end and is designed in such a manner that once the pressure of developer in the developer-supplying chamber 32 increases, the developer 24 having passed through the hole 61 presses the valve 62 to press up on the free end of the valve 62 thereby allowing movement of the developer 24 toward the developer agitation roller 26. Accordingly, particularly at lower print rates, developer 24 flows out of the developer-supplying chamber 32 toward the developer agitation roller 26 to maintain a constant developer pressure in the developer-supplying chamber 32.

In addition, it is also possible to form the developer-applying member 60 as an extension of the cartridge cover 31. This allows reduction in both the parts count and cost.

Formation of the developer-applying member 60 as an extension of the cartridge cover 31, however, presents the following problems because the developer-applying member 60 is rigid. That is, supply of developer 24 by the developer feed roller 23 to the developer-supplying chamber 32 results in the inconvenience of increased developer pressure in the developer-supplying chamber 32 and consequent increased torque of the developer feed roller 23 and/or the developing roller 22. There is an additional risk of increasing the torque to the point of locking operation of the developer cartridge 20 after repeated development.

Figure 87:
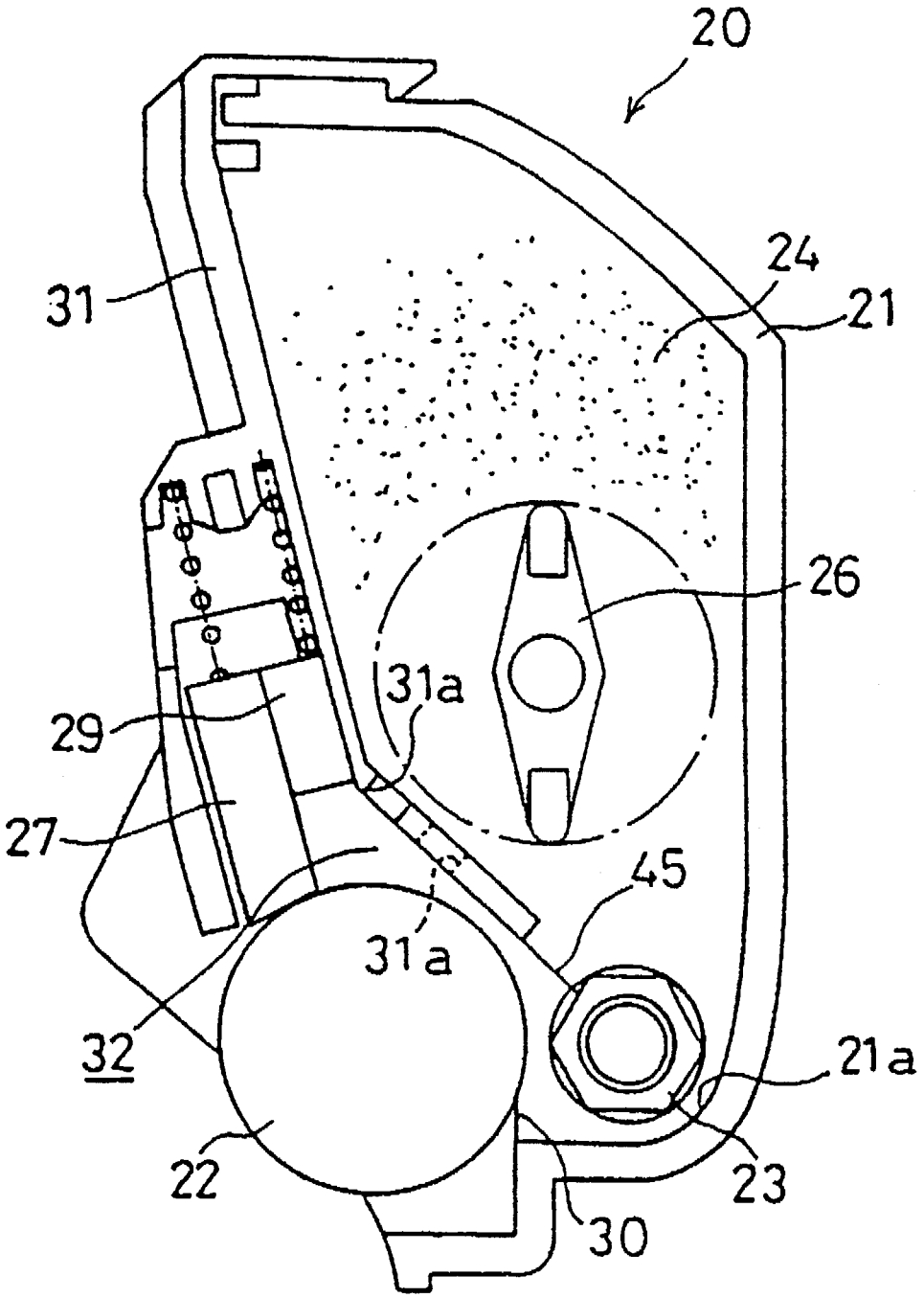
FIG. 87 is a structural schematic view of the entire developer cartridge equipped with the holed developer-applying member shown in FIG. 86.

As a solution to these problems, a hole 31*a* may be formed in the extension of the cartridge cover 31, as shown in FIG. 87. As described above, since this allows flow of developer 24 in the developer-supplying chamber 32 toward the developer agitation roller 26, particularly at lower print rates, the developer pressure in the developer-supplying chamber 32 may be kept constant.

Regarding the position at which the hole 31*a* is formed, although the hole 31*a* is formed closer to the developer-layer thickness control member 27 in FIG. 87, in practice it has been found that formation of the hole 31*a* closer to the developer feed roller 23 as indicated by the broken line in FIG. 87 results in production of a greater effect of maintaining a constant developer pressure in the developer-supplying chamber 32. Location of the upper end of the hole 31*a* above the section 27*b* of the developer-layer thickness control member 27 which is brought into contact with the developing roller 22, however, is a requisite for ready passage of developer 24 through the hole 31*a*.

Figure 88:
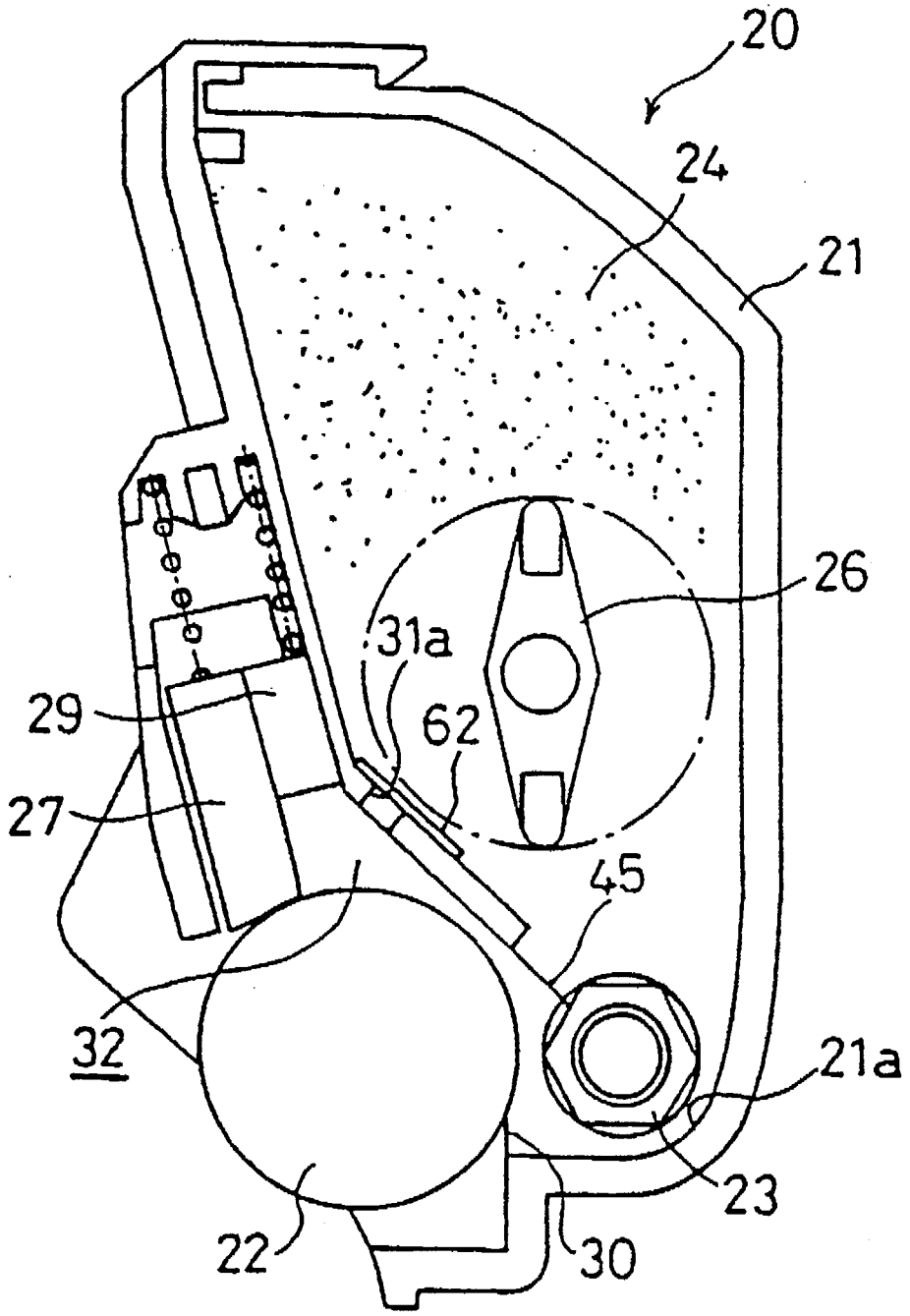
FIG. 88 is a structural schematic view of the entire developer cartridge equipped with the holed developer-applying member shown in FIG. 87 which has a valve body for the hole.

It is also possible to provide an elastic valve 62 which covers the hole 31*a*, as shown in FIG. 88.

Figure 89:
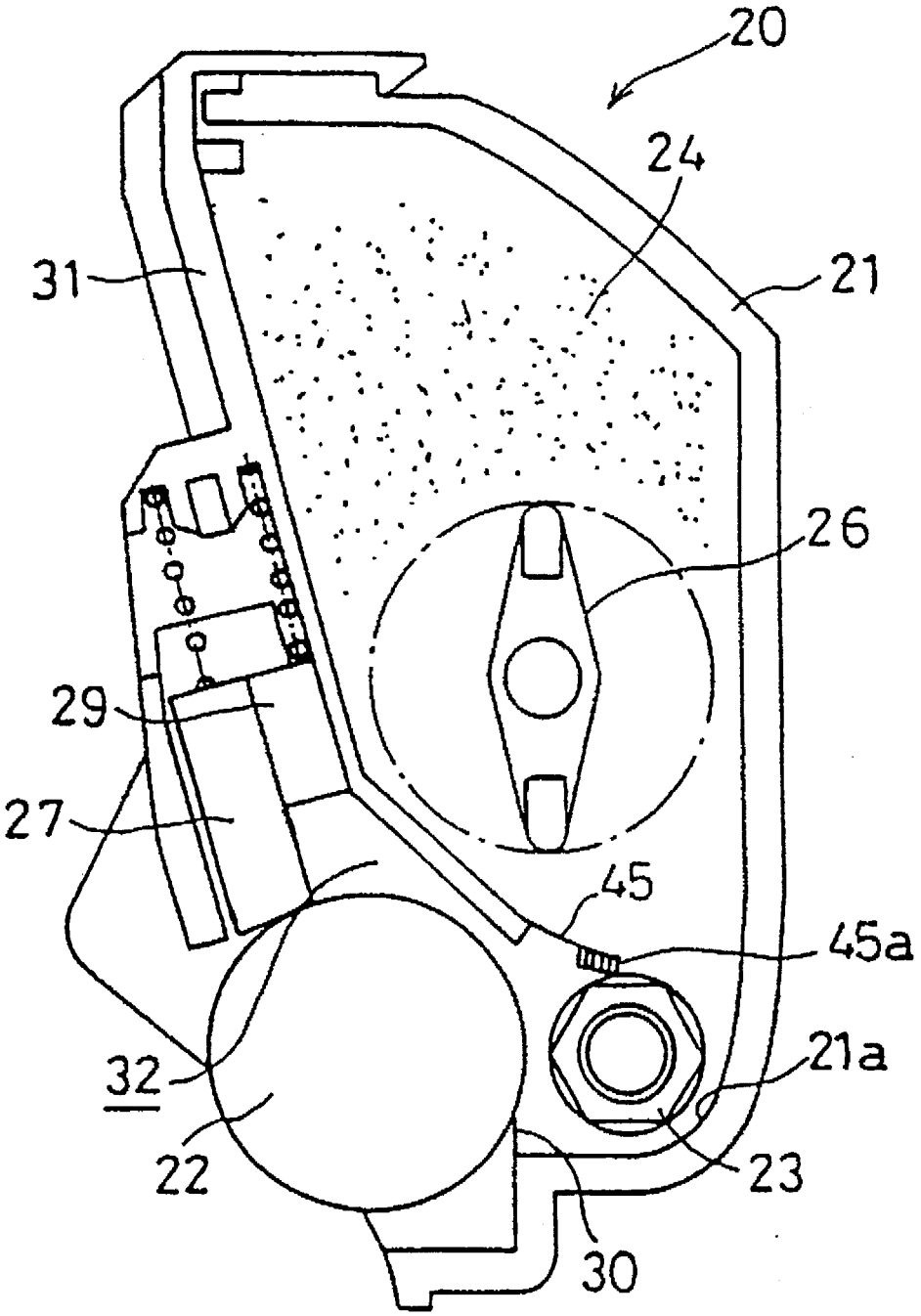
FIG. 89 is a structural schematic view of the entire developer cartridge equipped with the developer-applying member formed as an extension of a cartridge cover and with the scrubbing member which has a tip made of sponge.

In addition, as shown in FIG. 89, it is also possible to provide the cartridge cover 31 which serves as the developer-applying member, with a scrubbing member 45 which may in turn be provided with a contact section 45*a* made of a sponge at its tip. This also allows full scrubbing of developer 24 on the developer feed roller 23.

Figure 90:
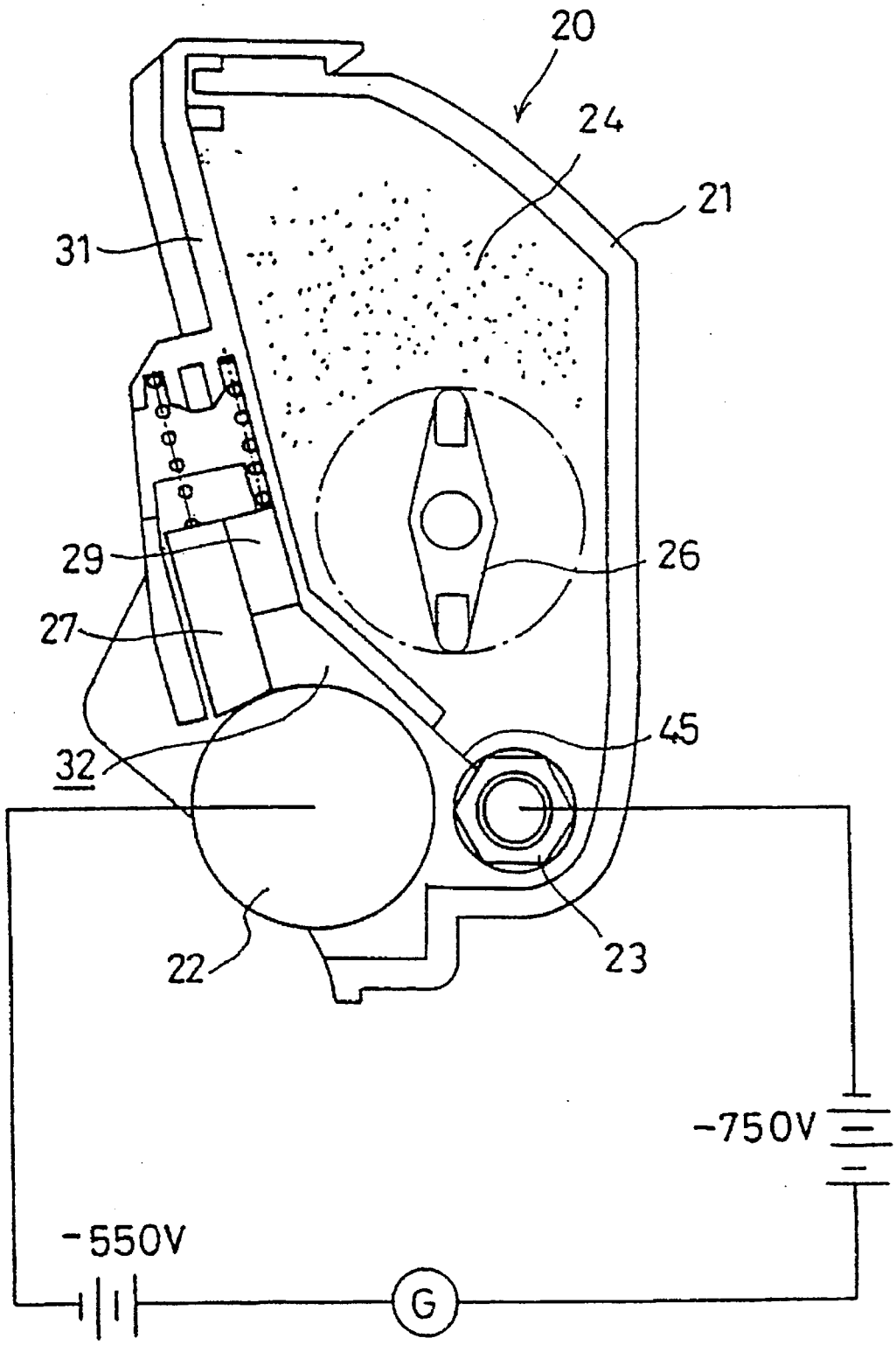
FIG. 90 is a structural schematic view of the entire developer cartridge, wherein the developer-applying member is formed as an extension of a cartridge cover, and bias voltages are applied across the developer feed roller and the developing roller.

On the other hand, as shown in FIG. 90, it is also possible to apply a voltage of, for example, −550 V to the developing roller 22 and to apply a voltage of, for example, −750 V to the developer feed roller 23. Since this helps the negatively charged developer 24 to be electrically attracted from the developer feed roller 23 to the developing roller 22 so that the developer 24 is deposited thereon, deposition of developer 24 on the developing roller 22 is facilitated.

As described above, with the developer cartridge 20 for printers according to the present example, it is possible to maintain a fixed distance between the developer-applying member 60 and the developing roller 22 by forming the developer-applying member 60 of a rigid body, thus allowing consistent preliminary charging of developer.

In addition, since the tip of the developer-applying member 60 is provided with the scrubbing member 45 made of an elastic material which is in contact with the developer feed roller 23, the torque of the developer feed roller 23 is not increased by scrubbing.

In addition, by having the scrubbing member 45 provided at the tip of the developer-applying member 60 as a rectangular sponge comprising closed foams smaller than the particle size of developer, since the sponge hangs over the edge lines a little in cases where the developer feed roller 23 is a regular hexagonal prism-shaped roller, all the developer 24 on the developer feed roller 23 may be scrubbed by the deformable sponge, regardless of whether the developer 24 remains on the plane surfaces or the edge lines of the regular hexagonal prism.

In addition, since the scrubbing member 60 for scrubbing developer 24 on the surface of the developer feed roller 23 is a rectangular sponge comprising foams smaller than the particle size of developer 24, the clogging may be prevented to ensure scrubbing of developer 24 on the developer feed roller 23 to a satisfactory extent, thus resulting in more consistent image quality.

Further, the formation of the hole 61 or the slit in the developer-applying member 60 serves to prevent excessive increase in developer pressure in the developer-supplying chamber 32 which occurs in cases where the print rate is not fixed.

In addition, the provision of the valve 62 which is composed of an elastic material and covers the hole 61 or the slit on the side facing the developer agitation roller 26 allows, in cases where continuous printing is conducted at a lower print rate, adjustment of flow of developer 24 by the elastic valve 62 when the increased developer pressure in the developer-supplying chamber 32 is lowered by discharging the developer 24 through the hole 61 or the slit. Therefore, regardless of the print rate, the developer pressure in the developer-supplying chamber 32 may be kept constant with increased accuracy.

In addition, the formation of the rigid developer-applying member 60 which is in non-contact with the developing roller 22 as part of the cartridge cover 31 or the like forming the cartridge body 21 results in reduction in both the parts count and cost.

The application of a voltage to the developer feed roller 23 formed of a conductive material results in electrical deposition of developer 24 on the developing roller 22 from the developer feed roller 23. The result is full deposition of developer 24 on the developing roller 22 which leads to satisfactory charging and consistent image quality free of overfed developer.

EXAMPLE 7

An additional example of the present invention will now be explained with reference to FIG. 91 through FIG. 100 and FIG. 109. Here, for convenience in explanation only, members in the drawings which have the same functions as those shown in the drawings referred to in Example 1 through Example 6 described above are identified by like reference characters, and therefore explanations thereof are omitted.

Figure 91:
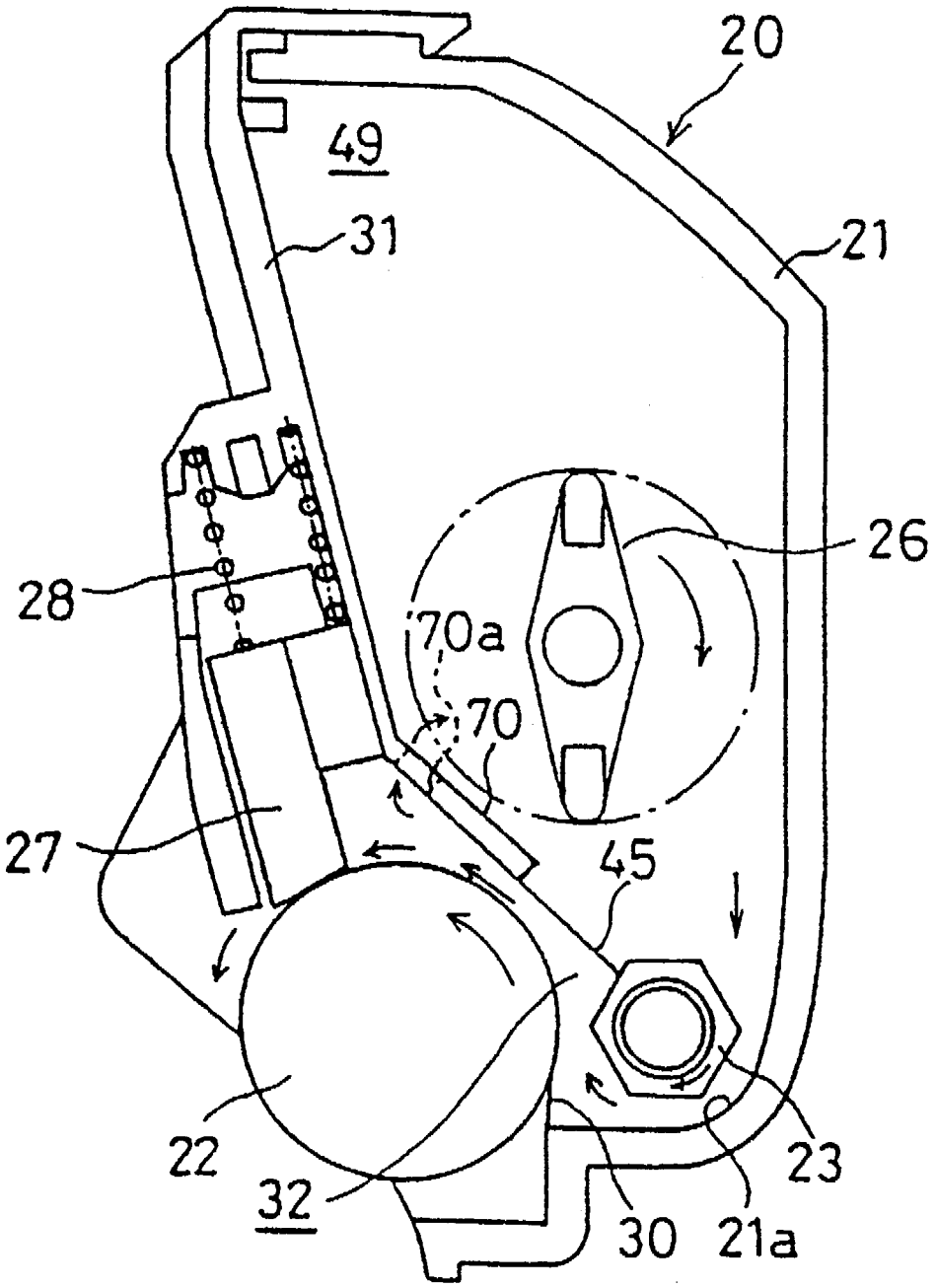
FIG. 91 is a structural schematic view of an entire developer cartridge for printers according to a seventh embodiment of the present invention.

In the developer cartridge 20 in the present example, as shown in FIG. 91, a rigid developer-applying member 70 is formed as an extension of the cartridge cover 31, with its distal tip provided with a scrubbing member 45 in contact with the developer feed roller 23.

Figure 92:
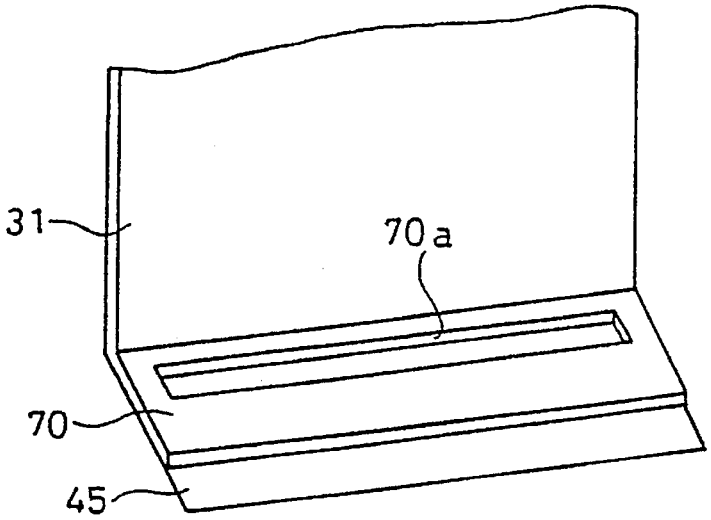
FIG. 92 is a perspective view of the developer-applying member and the scrubbing member which illustrates the formation of one hole in the developer-applying member in the developer cartridge.

In addition, as shown in FIG. 92, a hole 70*a* is formed in the developer-applying member 70 for circulation of developer 24 from the developer-supplying chamber 32 to the developer tank 49. This type of developer cartridge 20 was already explained in part in Example 1 through Example 6 above, but it will now be explained again in detail, with particular reference to modifications of the hole 70*a*. etc.

Figure 93A:
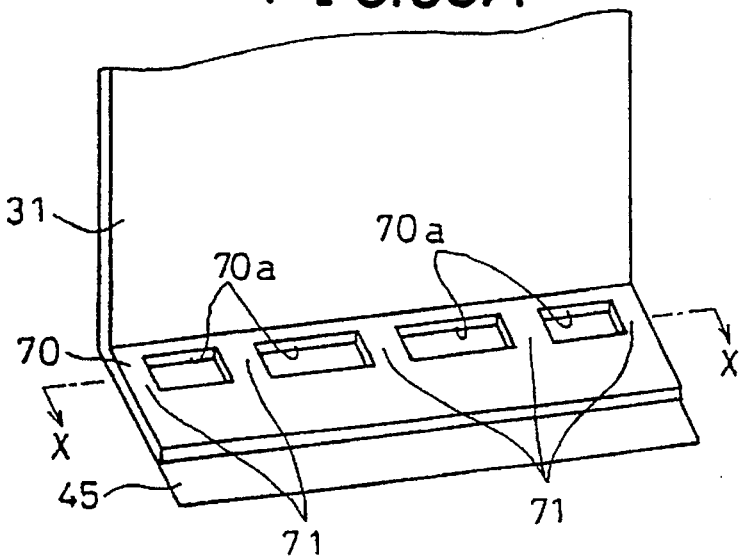
Figure 93B:
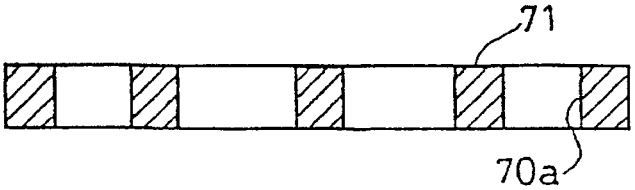

As shown in FIGS. 93A and 93B, one or more holes 70*a* may be formed in the developer-applying member 70. The holes 70*a* are preferably formed at positions somewhat far from the bend section which is the boundary between the developer-applying member 70 and the cartridge cover 31. This is because if the holes 70*a* are formed immediately at the bend section, then developer 24 easily passes through the holes 70*a* and moves upward in the developer tank 49, and thus the developer-supplying chamber 32 cannot hold developer 24.

In addition, these plurality of holes 70*a* are formed with greater diameters near the axial center of the developing roller 22 and with smaller diameters near the two axial ends of the developing roller 22. This is because developer 24 supplied by the developer feed roller 23 toward the developing roller 22 tends to concentrate near the axial center of the developing roller 22. As a countermeasure against this tendency, in the present example the plurality of holes 70*a* are formed in the developer-applying member 70, and in order to maintain a constant developer density along the axial direction of the developing roller 22, the sizes of the holes 70*a* are varied depending on variation in the developer density to keep a consistent developer pressure along the axial direction of the developing roller 22, thus resulting in favorable solid or halftone images with less irregular density. In addition, since there is no need for additional pressure on the developing roller 22, compact motors of low torque may be used.

Figure 94A:
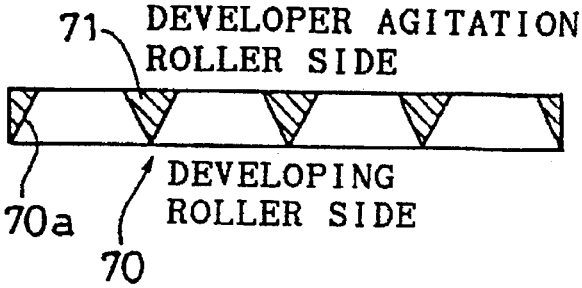
Figure 94B:
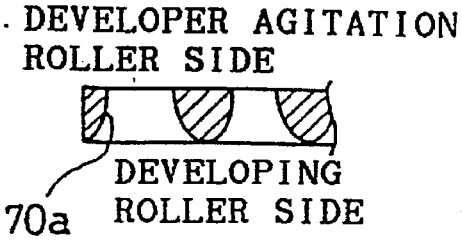

Ribs between the holes 70*a* and 70*a* in the developer-applying member 70 preferably have V- or U-sections tapering toward the developing roller 22, as shown in FIGS. 94A and 94B. Therefore, the sectional configuration of the holes 70*a* widens toward the developing roller 22.

Since this sectional configuration of the ribs 71 results in lower frictional resistance between the ribs 71 and developer 24 during circulation of developer 24 packed in the developer-supplying chamber 32 toward the developer agitation roller 26, the developer 24 is circulated smoothly, and thus the torque of the driving motor undergoes no change; compact motors may therefore be used.

Figure 95:
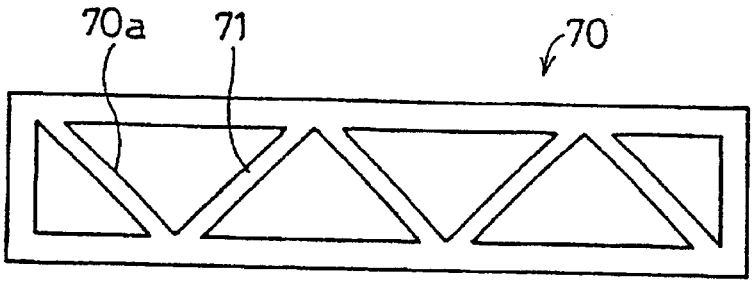
FIG. 95 is a front view of the developer-applying member which illustrates the formation of inclined ribs in the developer-applying member.

Alternatively, as shown in FIG. 95, the ribs 71 may be inclined with respect to the axial direction of the developing roller 22 so that the ribs 70*a* are shaped as triangles. This configuration also contributes to lower frictional resistance between the ribs 71 and developer 24 during circulation of the excess developer 24 in the developer-supplying chamber 32 toward the developer agitation roller 26, and as a result, since torque of the driving motor undergoes no change, the developer 24 may be circulated smoothly without causing change in the pressure of the developer 24 packed in the developer-supplying chamber 32. As a result, the developer pressure on the developing roller 22 is made consistent to produce favorable solid or halftone images with less irregular density.

Figure 96A:
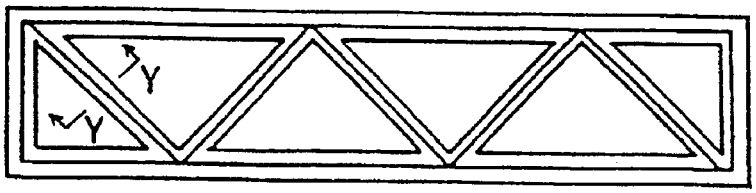
Figure 96B:
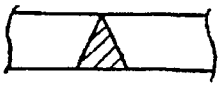
Figure 96C:
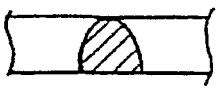
Figure 97:
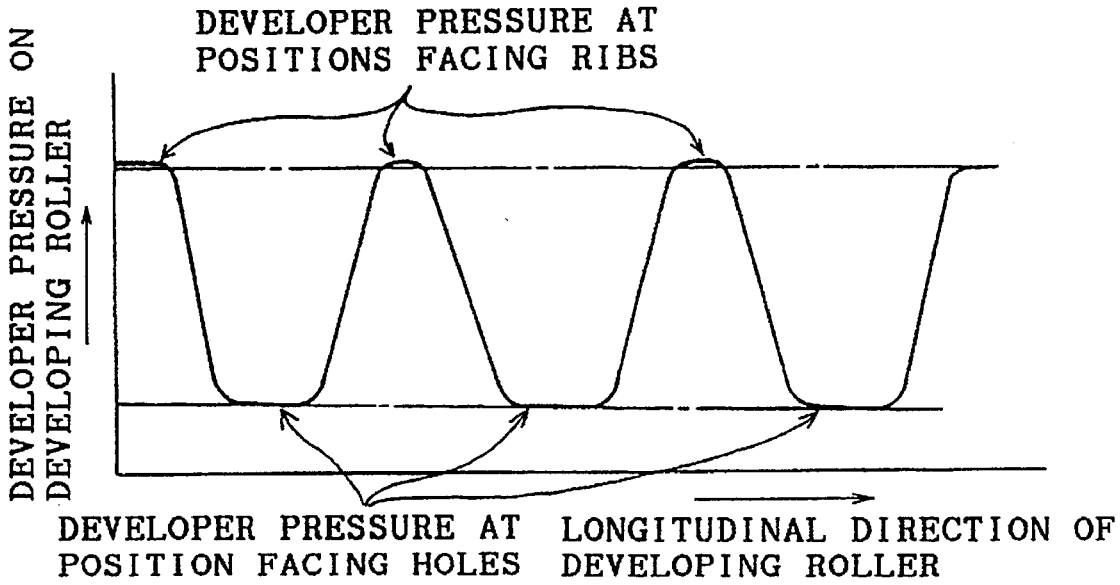
FIG. 97 is a graph showing the developer pressure on the developing roller in cases where the ribs of the developer-applying member have tetragonal sections.

Also, as shown in FIGS. 96A, 96B and 96C, by providing the ribs 71 shown in FIG. 95 with V- or U-sections tapering toward the developing roller 22, the frictional resistance between the ribs 71 and developer 24 during circulation of the developer 24 may be further reduced.

Figure 98:
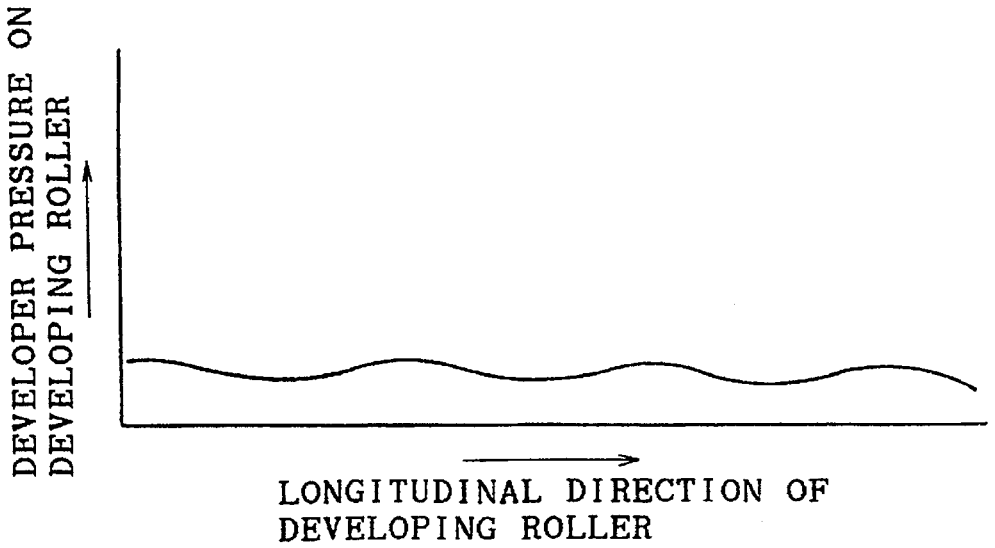
FIG. 98 is a graph showing the developer pressure on the developing roller in cases where the ribs of the developer-applying member have V- or U-sections.

This is because in cases where the ribs 71 have quadrangular sections, there is a considerable difference in the pressure of the developer pressure on the developing roller 22 at positions facing places of the ribs 71 and at positions facing places of the holes 70*a*. Increased developer pressure results in an increased amount of developer deposited on the developing roller 22, and consequently, for example, lines are printed more heavily, or prints are denser than expected. For this reason, prints corresponding to positions of the ribs 71 have irregular density or lines of varying thickness, resulting in unfavorable image quality. Conversely, as shown in FIG. 98, the difference in pressure at the two positions is greatly reduced in cases where the ribs 71 have V- or U-sections. Accordingly, the resulting effect is the production of favorable images.

Figure 99A:
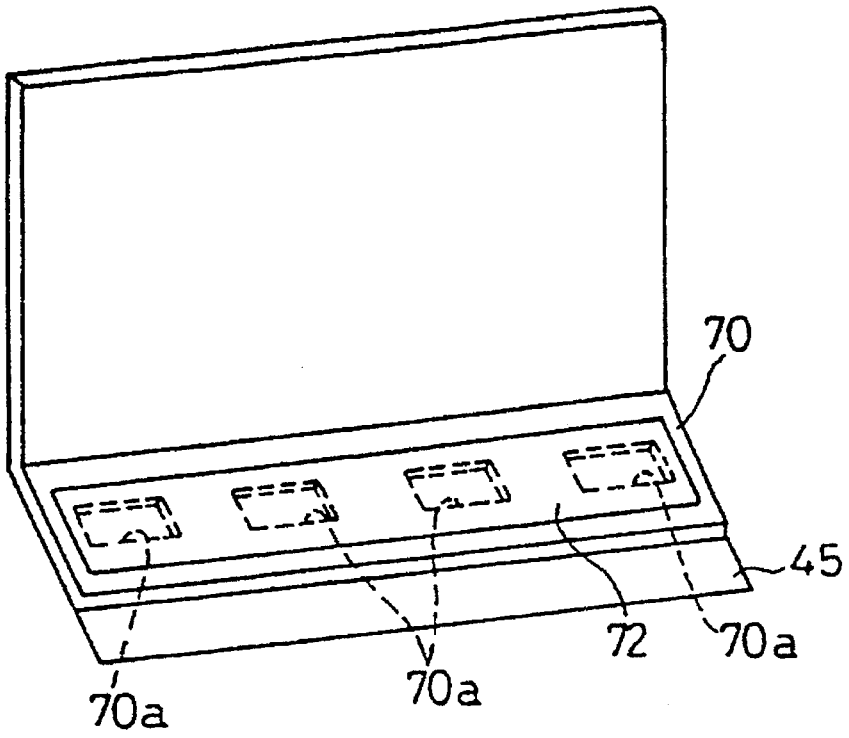
Figure 99B:
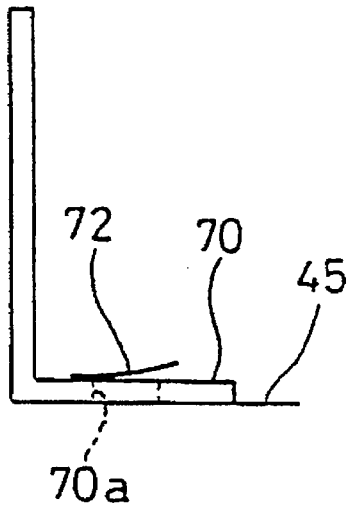

Alternatively, as shown in FIGS. 99A and 99B, it is also possible to provide a valve body 72, which is made of an elastic member and serves as a pressure control member, on the developer-applying member 70 at the side of the developer agitation roller 26 for the holes 70*a*, with one end bonded to the developer-applying member 70 and the other end designed as a free end. This elastic valve body 72 is formed of, for example, rubber, acrylic resin, polyethylene, phosphor bronze, SUS, etc.

In cases where the pressure in the developer-supplying chamber 32 is lower than a predetermined value, the pores 70*a* are sealed by the elastic force of the valve body 72 to maintain the pressure in the developer-supplying chamber 32. On the other hand, in cases where the pressure in the developer-supplying chamber 32 increases over the predetermined value, outflow pressure of developer 24 overcomes the elastic force of the valve body 72 to press up the valve body 72, thereby opening the pores 70*a* to help the developer 24 flow toward the developer agitation roller 26. Thereafter, in cases where the pressure in the developer-supplying chamber 32 decreases over the predetermined value, the pores 70*a* are again sealed by the elastic force of the valve body 72 to maintain the predetermined pressure in the developer-supplying chamber 32.

Figure 100:
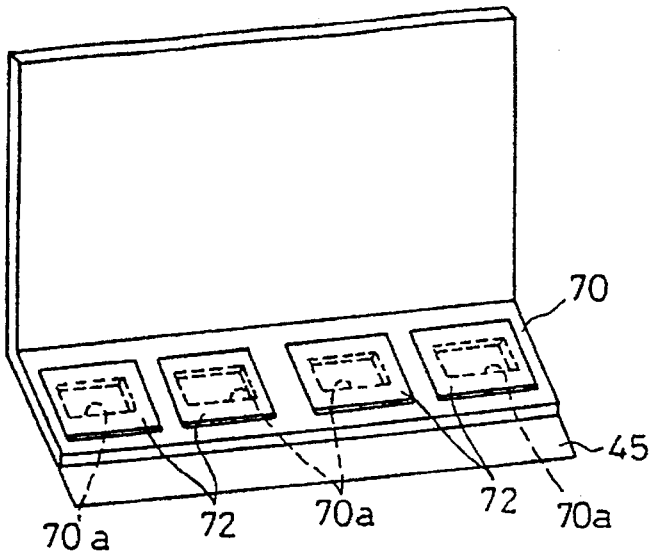
FIG. 100 is a perspective view illustrative of the formation of a valve body for each of the plurality of holes in the developer-applying member.

In this connection, as shown in FIG. 100, the respective holes 70*a* in the developer-applying member 70 may be provided with respective valve bodies 72 which may have different elastic forces. This configuration allows fine-tuning of the pressure of developer 24 on the developing roller 22. More specifically, since the amount of developer 24 may be properly adjusted in cases where the conveyance of developer by the developer feed roller 23 has become unbalanced or the conveyed developer 24 concentrates at the center of the developing roller 22, it is possible to prevent variation in the pressure of developer 24 packed in the developer-supplying chamber 32, along the axial direction of the developing roller 22. As a result, the developer pressure on the developing roller 22 becomes consistent, and favorable solid or halftone images free of irregular density are produced.

Figure 109:
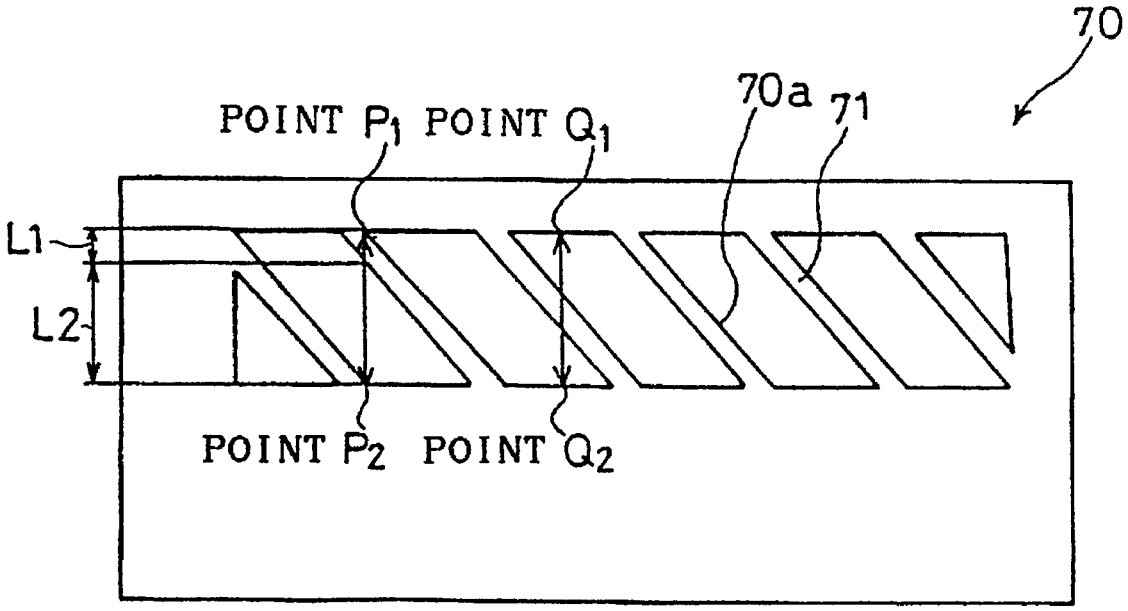
FIG. 109 is a front view illustrative of another embodiment with inclined ribs formed in an opening of the developer-applying member.

In addition, as shown in FIG. 109, a plurality of parallel ribs 71 may be formed which are inclined with respect to the axial direction of the developing roller 22 and satisfy the following conditions:

(1) All the ribs 71 have the same width; and (2) Neighboring holes 70*a* and 70*a* have such a relationship that the vertex P1 at the upper acute corner of one of the holes 70*a* and the vertex P2 at the lower obtuse corner of the neighboring hole 70*a* are on an identical vertical line.

If these conditions are satisfied, the holes 70*a* are rhombuses except that at the two ends of the developer-applying member 70 they form triangles.

With the ribs 71 formed in this way, all the holes 70*a* may have the same open areas, independently of their points of location along the axial direction of the developing roller 22. This is because, representing the length of the non-open section as $L_1$ and the length of the open section as $L_2$ in the line segment $P_1$–$P_2$ between the vertex $P_1$ and the vertex $P_2$, the length of the non-open section and the length of the open section in any line segment $Q_1$–$Q_2$ parallel to the line segment $P_1$–$P_2$ are always equal to $L_1$ and $L_2$, respectively.

As a result, even if the ribs 71 are formed to adjust the areas of the openings of the holes 70*a* for an optimum developer pressure in the developer-supplying chamber 32, increase in the developer pressure at positions on the developing roller 22 facing the ribs 71 may be prevented. Consequently, the developer pressure on the developing roller 22 is made more consistent, and producing more favorable solid or halftone images free of irregular.

Table 1 given below lists the results of evaluation of inconsistency of images observed while varying the residual amount of developer in cases where the pores 70*a* are formed as shown in FIG. 109. Here, a non-magnetic, one-component type developer was used, the developing roller 22 was set to have a diameter of 16 mm and a peripheral speed of 32.5 mm/sec, and the photoconductor drum 5*a* and the developing roller 22 were contacted under pressure with a 0.3 mm nip. Further, the developer feed roller 23 was set to have a diameter of 12 mm and a peripheral speed of 40 mm/sec.

TABLE 1

| | Developer residue | | | |
|---|---|---|---|---|
| Images | 100% | 50% | 30% | 15% |
| Halftone | Favorable | Favorable | Favorable | Some streaks |
| Solid Prints | Favorable | Favorable | Favorable | Favorable |
| Letters | Favorable | Favorable | Favorable | Favorable |

As understood from Table 1 given above, it has been confirmed that halftone images maintain consistency for the residue of developer up to 30%.

Determination was then made of the proper ratio of areas of open sections of holes 70*a* to the total of areas of the open sections of the holes 70*a* and areas of non-open sections of the ribs 71. Here, a non-magnetic, one-component type developer was used, the developing roller 22 was formed of conductive urethane rubber with a diameter of 20 mm, the peripheral speed was set to 45 mm/sec, and an organic photoconductor drum 5*a* and the developing roller were contacted under pressure with a 0.2 mm nip. Further, the developer feed roller was shaped as a regular tetragonal prism with 10-mm sides, and the peripheral speed was set to 25 mm/sec.

By setting the ratio of the areas of the open sections of the holes 70*a* to 60–95%, preferably 70–90% under the above-mentioned conditions, an even developer layer was formed on the developing roller 22 without clogging of the holes 70*a* by developer.

As described above, with the developer cartridge 20 for printers according to the present example, in cases where excess developer 24 conveyed by the developer feed roller 23 to the developing roller 22 and excess developer 24 scrubbed by the developer-layer thickness control member 27 remain just upstream from the developer-layer thickness control member 27 and the pressure of the developer 24 increases, the excess developer 24 may be returned toward the developer agitation roller 26 through the holes 70*a* formed in the developer-applying member 70.

As a result, the pressure of the developer 24 present just upstream from the developer-layer thickness control member 27 is lowered, and thus a consistent developer pressure on the developing roller 22 may be maintained, thereby forming a uniform developer layer on the developing roller 22. Accordingly, favorable solid or halftone images with less irregular density may be produced. In addition, since there is no need for additional pressure against the developing roller 22, compact motors of low torque may be used.

Also, ribs 71 between the holes 70*a* and 70*a* in the developer-applying member 70 have V- or U-sections tapering toward the developing roller 22 so as not to impede flow of developer 24. Therefore, since their frictional resistance to developer 24 may be minimized during circulation of the developer 24, a consistent developer pressure may be maintained on the developing roller 22 to provide an even developer layer on the developing roller 22.

Furthermore, since the ribs 71 are formed in inclination with a given angle with respect to the axis of the developing roller 22, the frictional forces between the developer 24 and the respective ribs 71 during circulation of the developer 24 are reduced to allow smooth discharge of the developer 24, and thus a consistent developer pressure is maintained on the developing roller 22 to produce an even developer layer on the developing roller 22.

In addition, a pressure-adjusting valve body 72 which may cover the holes 70*a* is provided on the developer-applying member 70 at the side of the developer agitation roller 26. Therefore, a consistent developer pressure may be maintained on the developing roller 22 because the developer pressure may be fine-tuned during circulation of developer 24.

In addition, the valve body 72 is formed of an elastic material and functions depending on the pressure of the developer 24 so that the holes 70*a* are sealed at pressures lower than the predetermined value, whereas the developer 24 is allowed to flow out through the holes 70*a* at pressures higher than the predetermined value. Therefore, a consistent developer pressure may be maintained on the developing roller 22 because the developer pressure may be fine-tuned during circulation of developer 24.

Furthermore, the plurality of valve bodies 72 provided in the axial direction of the developing roller 22 may be separately adjusted for pressure to produce a uniform developer layer along the axial direction of the developing roller 22.

EXAMPLE 8

An additional example of the present invention will now be explained with reference to FIG. 101 through FIG. 108. Here, for convenience in explanation only, members in the drawings which have the same functions as those shown in the drawings referred to in Example 1 through Example 7 above are identified by like reference characters, and therefore explanations thereof are omitted.

Figure 101:
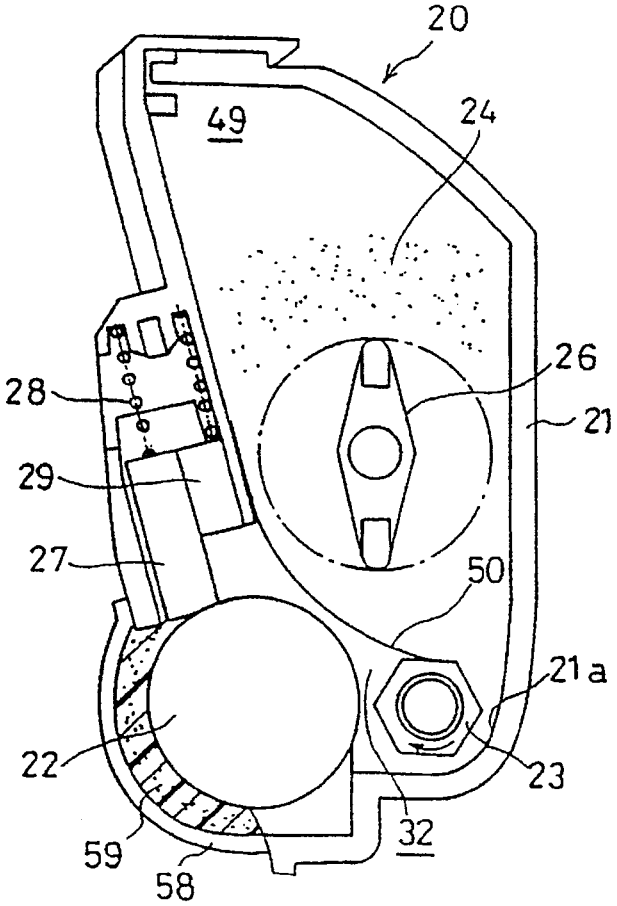
FIG. 101 is a structural schematic view of an entire developer cartridge for printers according to an eighth embodiment of the present invention.

The developer cartridges 20 for printers according to Example 1 through Example 7 above have a problem of leakage of developer 24 in the developer tank 49 through the open section of the developing roller 22 in the cartridge body 21 after it has moved between the developer feed roller 23 and the opposing inner wall surface 21*a*, through the developer-supplying chamber 32 and then between the developing roller 22 and the developer-layer thickness control member 27, before the developer cartridges 20 are used, as shown in FIG. 101. In order to solve this problem, therefore, it becomes necessary to provide additional functions by means of, in addition to a shipment cover 58, a cushioning material 59 between the shipment cover 58 and the developing roller 22, etc., as one of parts needed for shipment, and this presents the problem of increased cost.

Therefore, in order to solve these problems, the present example involves improvements which utilize the developer-applying member.

Figure 102:
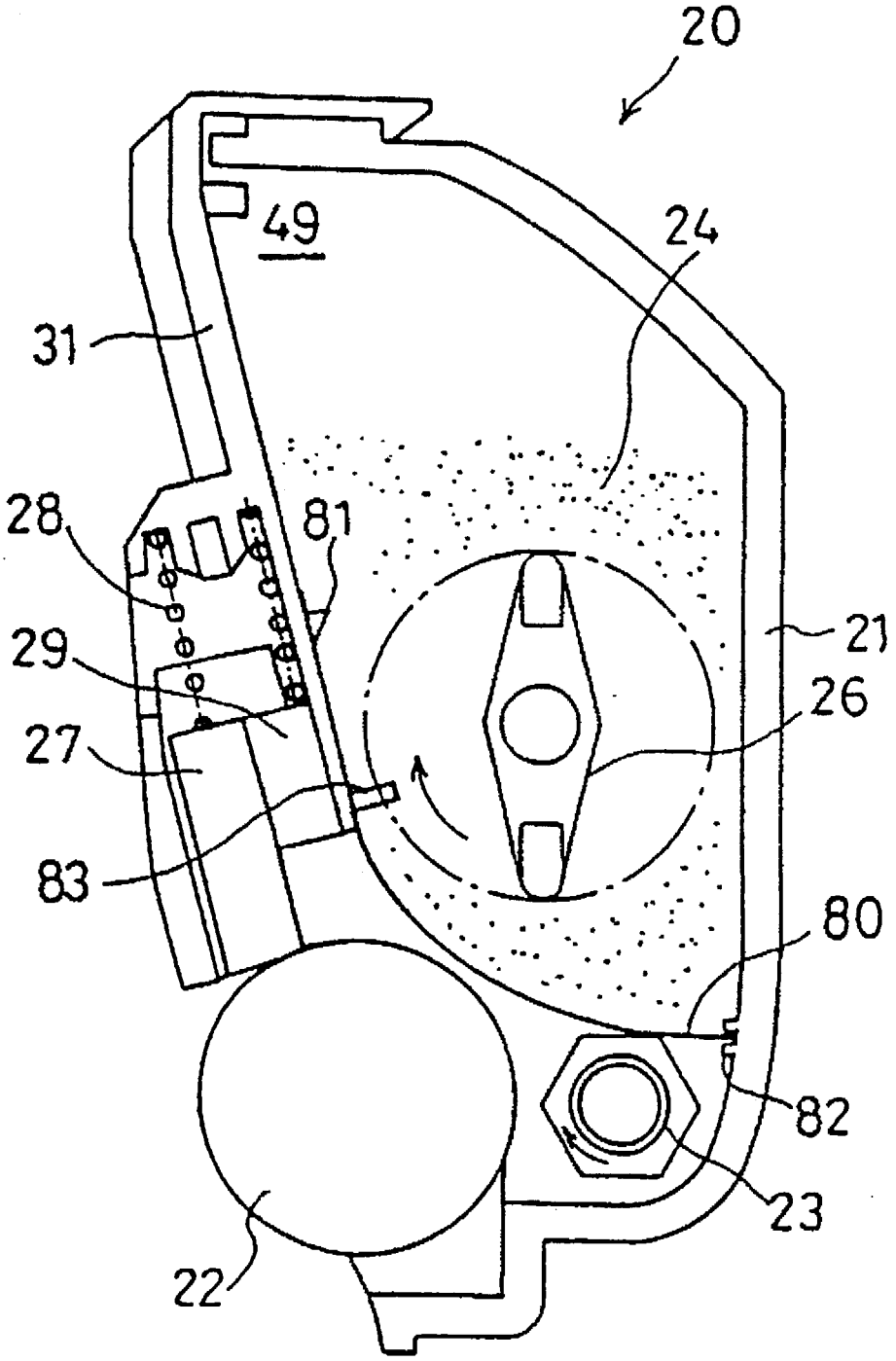
FIG. 102 is an entire structural schematic view illustrative of a not-yet-used state of the developer cartridge, with the developer-applying member extending to the wall surface of the cartridge body.

More specifically, the developer cartridge 20 of the present example, is designed, as shown in FIG. 102, in such a manner that, before it is used, the developer-applying member 80 is shaped as an are which curves outward toward the developing roller 22 and extends from the cartridge cover 31 to the wall surface of the cartridge body 21 as a partition for completely separating the developer agitation roller 26 from the developer feed roller 23 and the developing roller 22.

The developer-applying member 80 is formed of a flexible sheet of a resin material and is mounted onto the cartridge cover 31 in a slidable manner, whereas the section of the cartridge cover 31 which overlies the developer-applying member 80 bears a pair of roughly triangle-section anchor protrusions 81, 81 to allow the developer-applying member 80 to be mounted on that section. In addition, a fixing section 82 for fixing the tip of the developer-applying member 80 is formed on the wall of the cartridge body 21.

Figure 103:
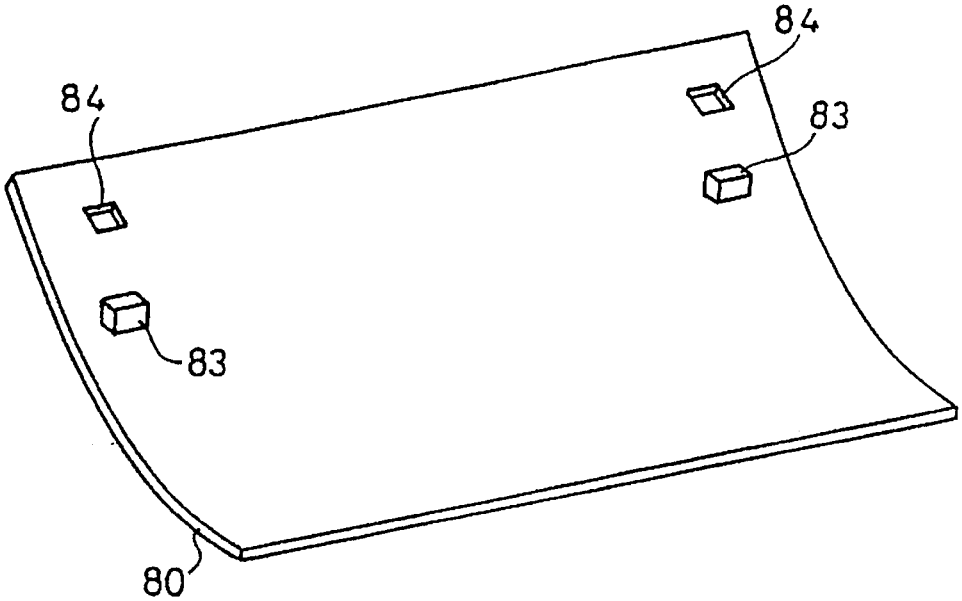
FIG. 103 is a perspective view of the developer-applying member.

As also shown in FIG. 103, the developer-applying member 80 has, on both ends along its longer direction, two protrusions 83, 83 which are engageable with the developer agitation roller 26 and further a pair of anchor holes 84, 84 into which the anchor protrusions 81, 81 fit.

Figure 104:
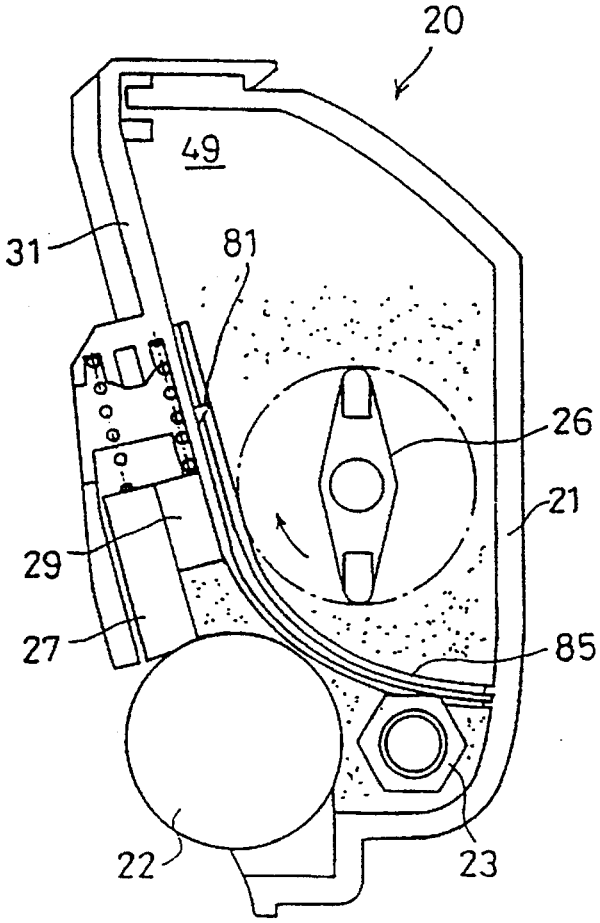
FIG. 104 is a structural schematic view illustrative of the entire developer cartridge which particularly shows a guide member formed on the side wall of the developer cartridge.

On the other hand, as shown in FIG. 104, both inner side walls of the cartridge body 21 of the developer cartridge 20 are provided with a projecting guide section 85 which supports and guides the developer-applying member 80 in a slidable manner. The developer-applying member 80 is designed so that both its ends fit in the channel formed in the guide section 85, thus allowing movement of the developer-applying member 80 therein in a slidable manner.

Figure 105:
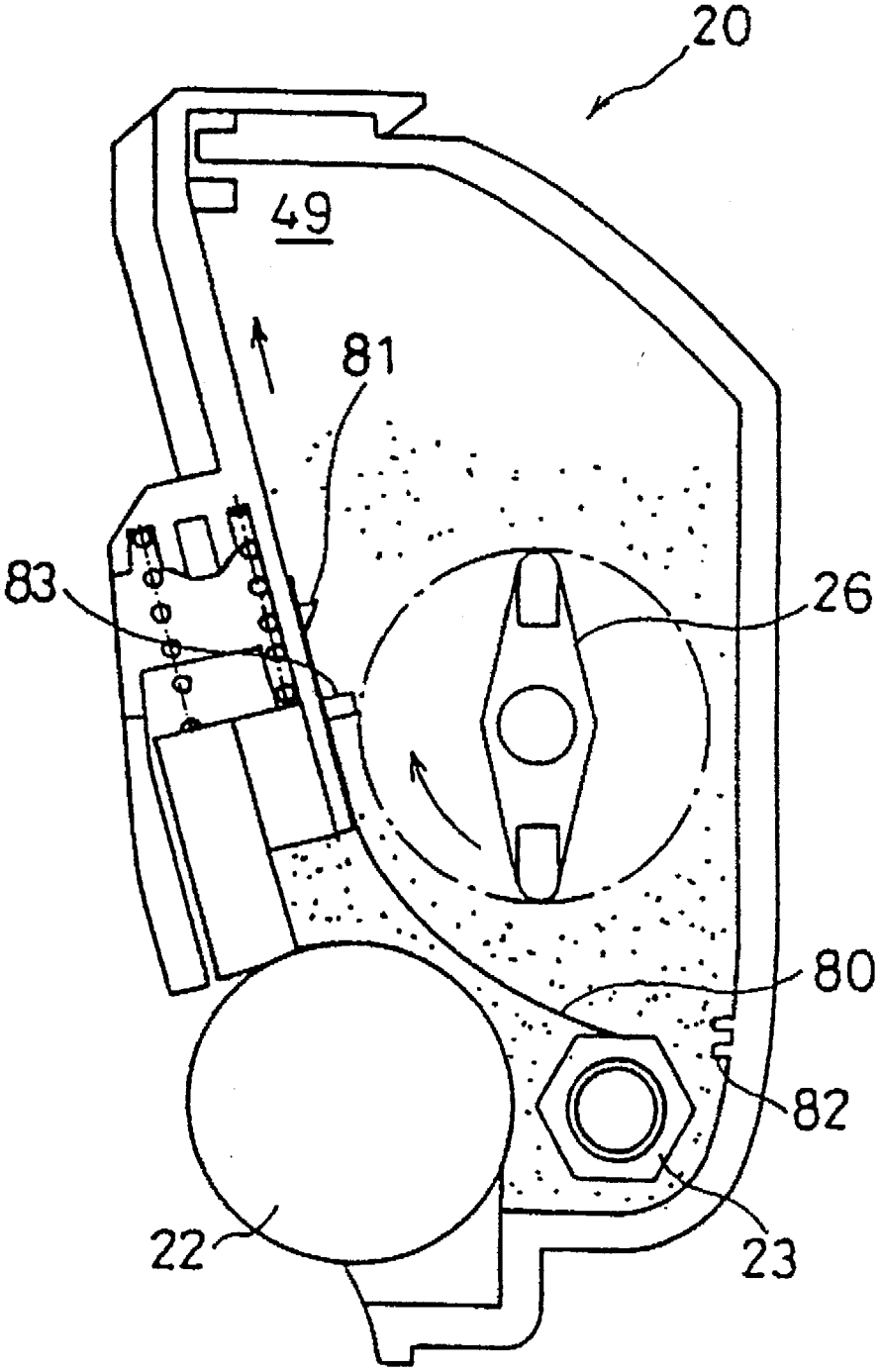
FIG. 105 is an entire structural schematic view illustrative of the developer cartridge in a usable state after upward movement of the developer-applying member.

Also, the developer-applying member 80 is designed in such a manner that it is fixed when the developer-applying member 80 moves upward in the channel in the guide section 85 in a slidable manner and the anchor protrusions 81, 81 fit in the anchor holes 84, 84 in the developer-applying member 80. Further, as shown in FIG. 105, the developer-applying member 80 is positioned in advance so that in that fixed state the other end of the developer-applying member 80 rests on the periphery of the developer feed roller 23.

Figure 106:
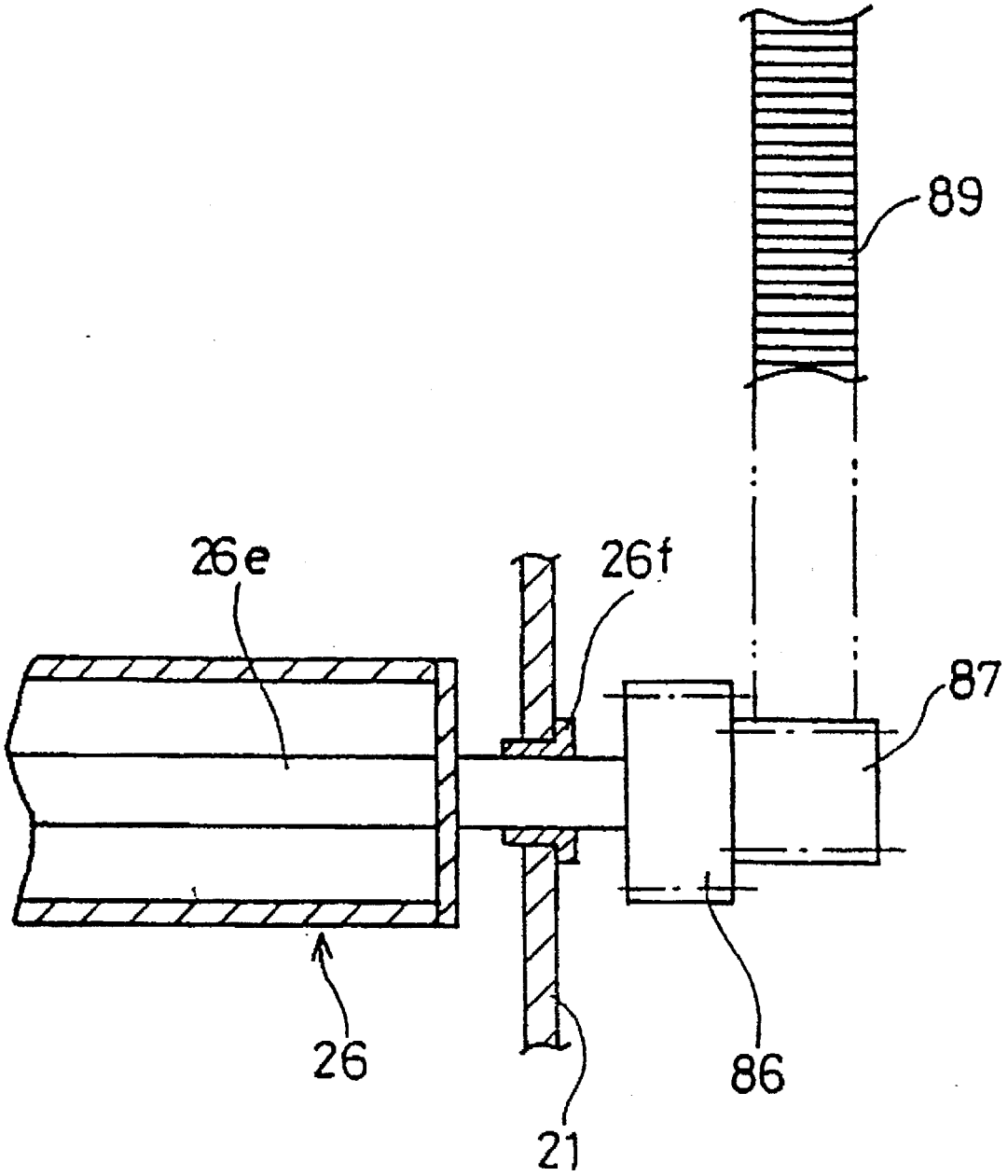
FIG. 106 is a section view illustrative of the vicinity of the developer agitation roller in the developer cartridge.
Figure 107:
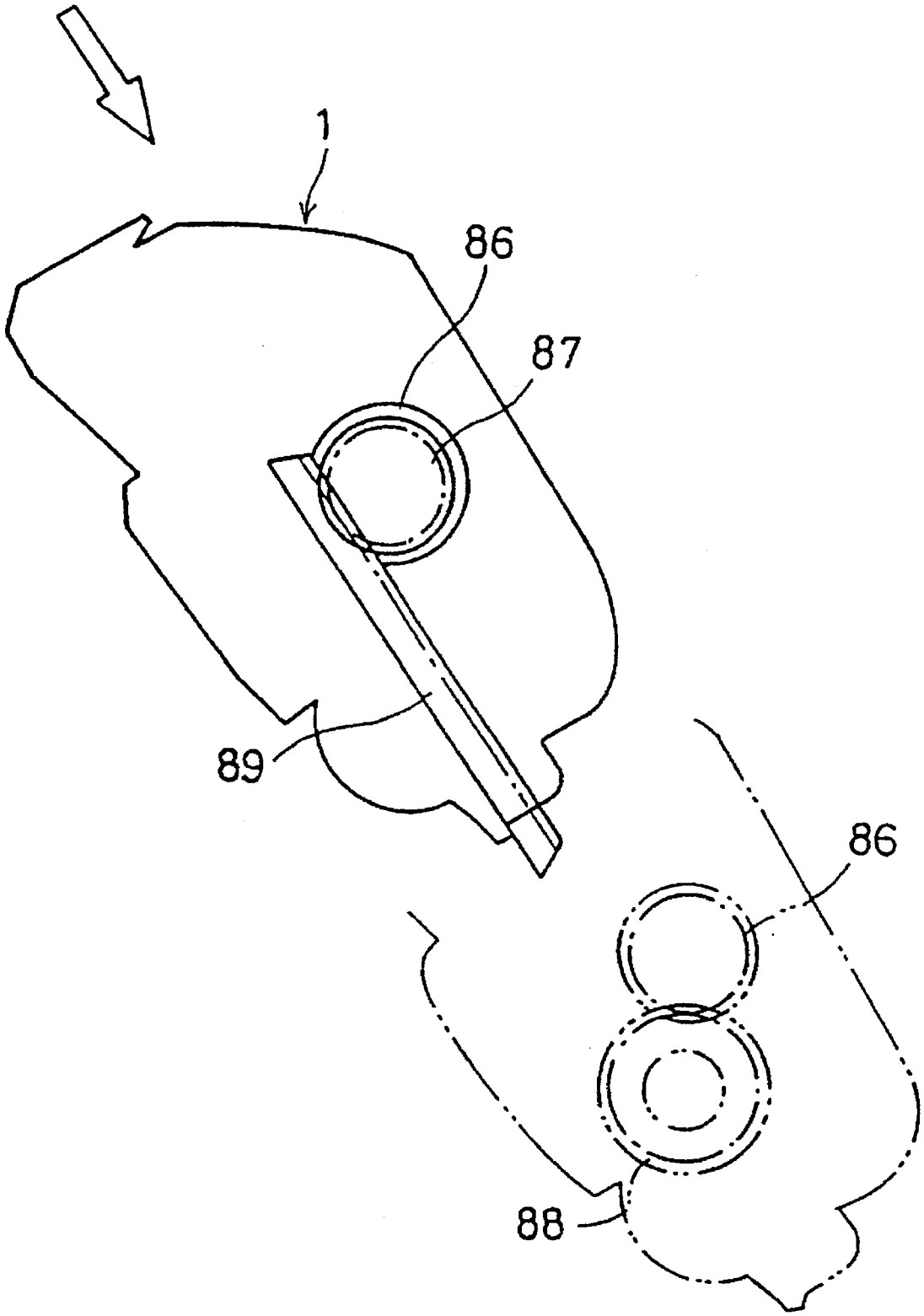
FIG. 107 is a view illustrative of bow the developer cartridge is mounted.

On the other hand, as shown in FIG. 106, the shaft 26*e* of the developer agitation roller 26 is formed extending through the bearing 26*f* to outside the wall of the cartridge body 21, with a first gear 86 and a second gear 87 mounted on the extension outside the wall. As shown in FIG. 107, when the developer cartridge 20 is mounted in the apparatus body 1, the first gear 86 is engaged with a driving gear 88 of the apparatus body 1 to allow driving of the developer agitation roller 26.

On the other hand, when the developer cartridge 20 is mounted in the apparatus body 1, the second gear 87 is engaged with a rack gear 89 provided on the apparatus body 1; the second gear 87 rotates in response to insertion and movement of the developer cartridge 20, and consequently the developer agitation roller 26 is driven to rotate by rotation of the shaft 26*e*. Here, as shown in FIG. 102, the rotation of the developer agitation roller 26 causes the developer agitation roller 26 to be brought into contact with and press up the protrusions 83, 83 of the developer-applying member 80 until the distal end of the developer-applying member 80 moves to a usable state in contact with the developer feed roller 23, as shown in FIG. 105. At the completion of mounting of the developer cartridge 20, as shown in FIG. 107, the second gear 87 is disengaged from the rack gear 89, and instead, the first gear 86 is engaged with the driving gear 88. Accordingly, with the configuration described above, when the developer cartridge 20 is mounted in the apparatus body 1, the developer agitation roller 26 rotates to press up the developer-applying member 80 to set the latter to a usable state.

In the case described above, the extension of the shaft 26*e* of the developer agitation roller 26 is provided with the second gear 87 which engages with the rack gear 89 in such a manner that the developer-applying member 80 is automatically pressed up when the developer cartridge 20 is mounted in the apparatus body 1, but the mechanism is not limited thereto.

Figure 108:
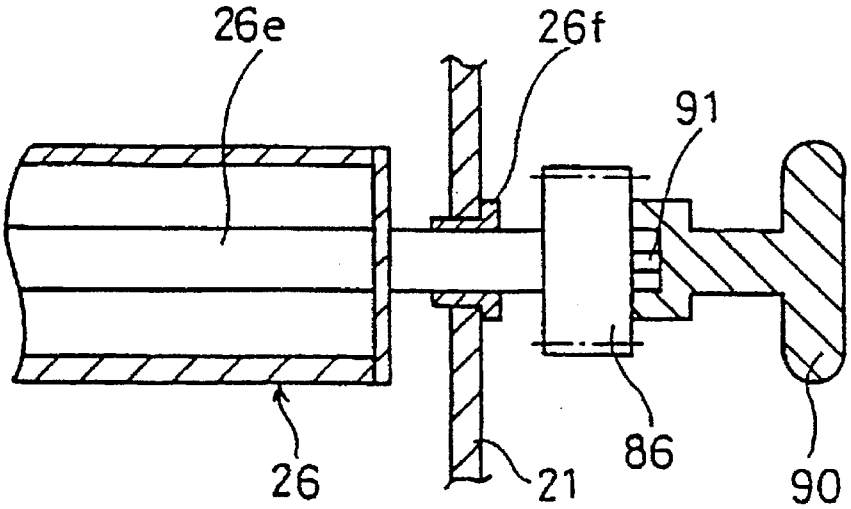
FIG. 108 is a section view of a hand-operated rotation lever which initiates rotation of the developer agitation roller.

That is, as shown in FIG. 108, for example, it is possible, after the first gear 86 is provided around the extension of the shaft 26*e*, to form an engaging section 91 for engaging a rotation lever 90 at the distal end of the extension.

With this configuration, when the developer-applying member 80 is pressed up, the rotation lever 90 may be engaged with the engaging section 91 to be rotated, thereby rotating the developer agitation roller 26.

Operation of the developer cartridge 20 constructed as described above will now be explained.

First, when the developer cartridge 20 is in a not-yet used state or in a factory-shipped state, the developer-applying member 80 is provided in a state extending from the cartridge cover 31 to the fixing section 82 of the cartridge body 21, as shown in FIG. 102. This configuration prevents leakage of developer 24 out of the developer cartridge 20, because the developer-applying member 80 completely separates the developer tank 49 from the developing roller 22 which communicates with the outside.

Further, when the developer cartridge 20 is mounted in the apparatus body 1, the second gear 87 of the developer feed roller 23 is engaged with the rack gear 89 of the apparatus body 1, as shown in FIG. 107, to rotate the developer agitation roller 26. As shown in FIG. 102, during the first rotation of the developer agitation roller 26 the developer agitation roller 26 is brought into contact with the protrusions 83, 83 of the developer-applying member 80, and the developer-applying member 80 is pressed up to the position shown in FIG. 105 as the developer agitation roller 26 rotates. Upon disengagement of the proximal end of the developer agitation roller 26 from the protrusions 83, 83, the anchor holes 84, 84 of the developer-applying member 80 fit over the anchor protrusions 81, 81 to fix the developer-applying member 80. In this state, the distal end of the developer-applying member 80 is in contact with the developer feed roller 23, and the developer cartridge 20 may be used. In other words, in this state, developer 24 agitated by the developer agitation roller 26 is conveyed by the developer feed roller 23 toward the developing roller 22.

As described above, the developer cartridge 20 for printers according to the present example is designed so that the inside of the developer cartridge 20 is completely partitioned by the developer-applying member 80 into the region of the developer agitation roller 26 and the region of the developing roller 22 and the developer feed roller 23 until the developer cartridge 20 is mounted in the apparatus roller 26, it is automatically in a usable state.

Furthermore, the developer cartridge 20 according to the present example is designed in such a manner that upon insertion into the apparatus body 1, the developer cartridge 20 is engaged with the rack gear 89 which is the rotation-driving means of the apparatus body 1 to rotate the developer agitation roller 26 a given turn. Since higher torque than that of normal rotation is needed in order to move the developer-applying member 80 at the start of rotation of the developer agitation roller 26, the prior art requires operation to vary the torque of the developer agitation roller 26. Nonetheless, the above design in the present example allows rotation of the developer agitation roller 26 while only relying on the force of insertion of the developer cartridge 20 for its mounting.

Further, since the developer agitation roller 26 may be rotated from outside the cartridge body 21 by operation with the special-purpose rotation lever 90, the developer agitation roller 26 may be manually rotated without varying the torque of the developer agitation roller 26.

An additional aspect of the present invention will now be explained with reference to FIG. 110 through FIG. 112.

Figure 110:
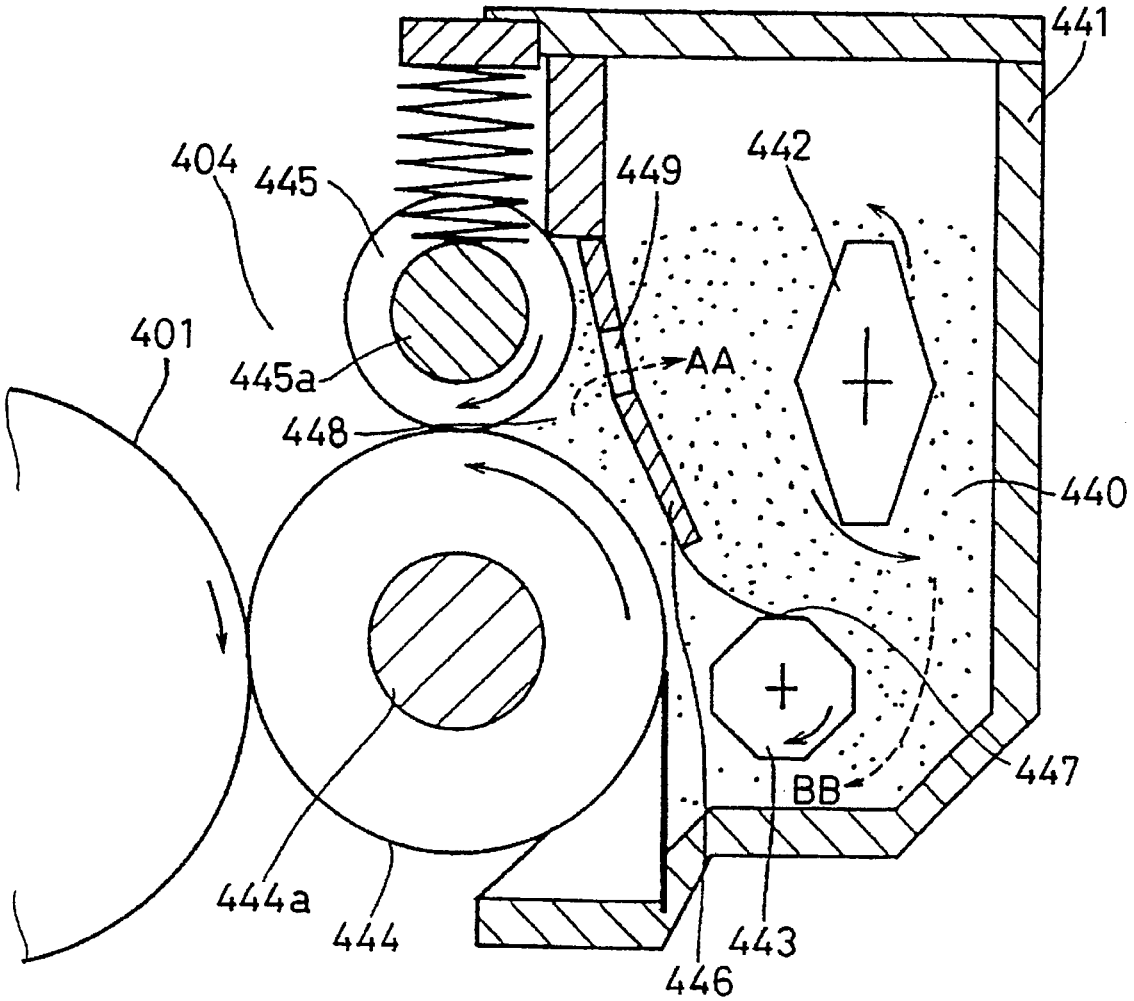
FIG. 110 is a section view illustrative of an embodiment of the developing device of the present invention.

FIG. 110 illustrates an embodiment of the developing device according to the present invention which is used for xerography-based image forming apparatuses. FIG. 111 is a body 1. Therefore, there is no risk of leakage of developer 24 out of the developer cartridge 20.

Conversely, during the first use after the developer cartridge 20 has been mounted in the apparatus body 1, the first rotation of the developer agitation roller 26 brings the proximal end of the developer agitation roller 26 into contact and engagement with the protrusions 83, 83 to move the developer-applying member 80 upward until the distal end of the developer-applying member 80 is brought into contact with the periphery of the developer feed roller 23. The developer-applying member 80 is then fixed in this state which allows use of the developer cartridge 20. In other words, in this state, the developer 24 agitated by the developer agitation roller 26 is conveyed by the developer feed roller 23 toward the developing roller 22.

Accordingly, leakage of the developer 24 in the developer cartridge 20 through the developing roller 22 communicating with the outside may be prevented until the developer cartridge 20 is mounted in the apparatus body 1, and further there is no need to additionally provide the open section with a lid or the like, and this results in reduction in the parts count and consequently in cost. In addition, the developer cartridge 20 is easy to handle because when it mounts and rotates the developer agitation front view which illustrates the state of contact under pressure of a developing roller which constructs the developing device and a controller member which controls the amount of developer to be deposited on the developing roller, and FIG. 112 is a schematic view of an image forming section which illustrates an application of the developing device of the present invention to a laser printer as an image forming apparatus.

Figure 112:
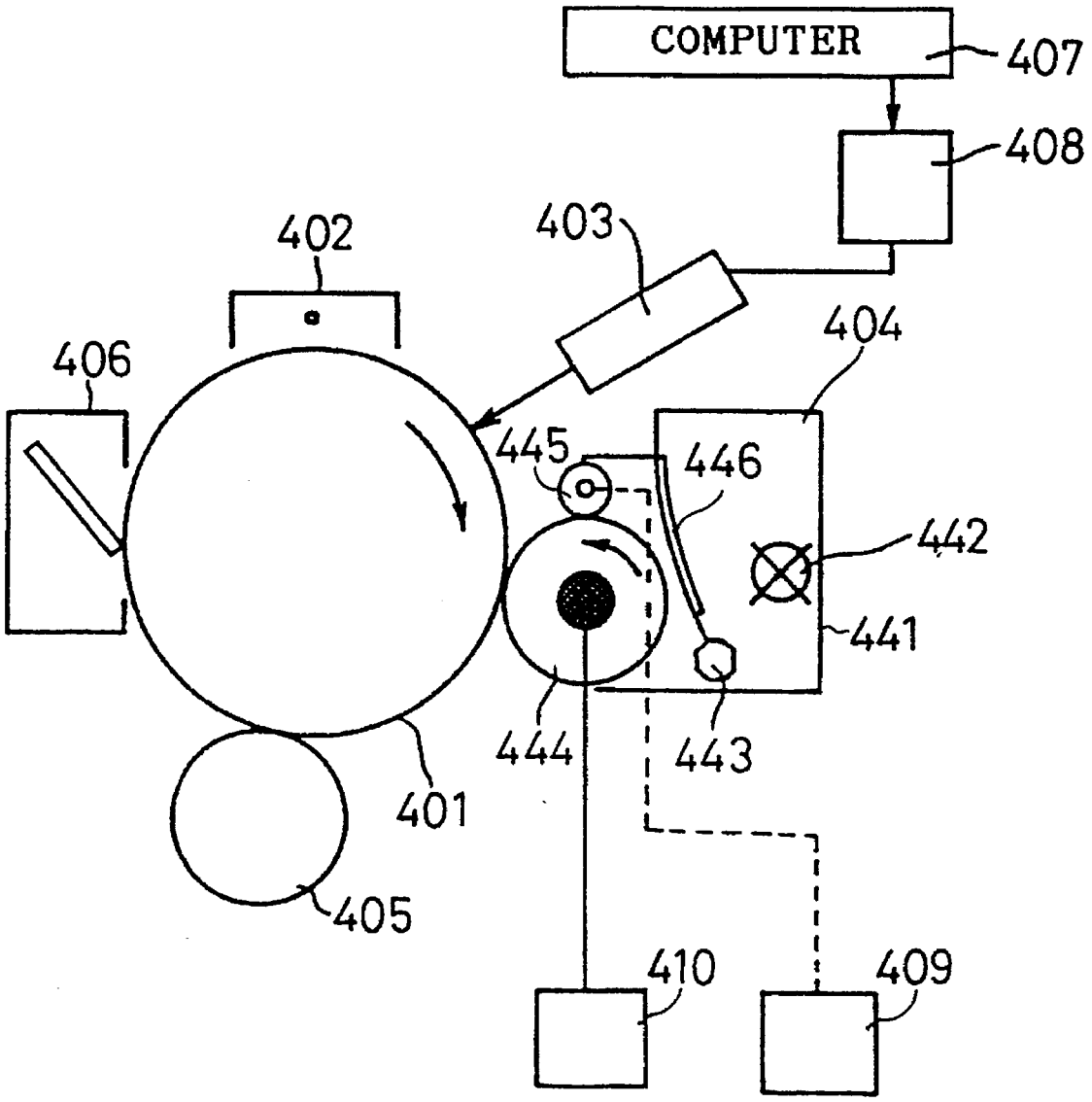
FIG. 112 is a section view of an entire system with the developing device of the present invention mounted in a laser-beam printer serving as an image forming apparatus.

The developing device according to the present invention not only may be applied to the laser printer shown in FIG. 112, but also may be used as developing means for image forming apparatuses which visualize (develop) the formed latent image with developer.

In FIG. 112, 401 indicates a photoconductor which is a recording medium shaped as a cylinder (drum), and the photoconductor 401 is driven to rotate at a given speed in the direction indicated by the arrow when an image is formed. Various devices necessary for forming images are placed around the photoconductor 401.

In the drawing, 402 is a charger for uniformly charging the surface of the photoconductor 401; 403 is a laser-beam irradiation device for projecting an optical image onto the charged surface of the photoconductor 401; 404 is a developing device for visualizing an electrostatic latent image formed on the surface of the photoconductor 401; 405 is a transfer roller for transferring a developed image or a developer image onto paper sheet which are appropriately conveyed; and 406 is a cleaning device for removing developer remaining on the surface of the photoconductor 401 after transfer, in preparation for formation of the next image.

The laser-beam irradiation device 403 converts image information inputted from the outside to optical information, based on control signals from a microcomputer 407 for controlling the entire laser printer, to project an optical image based on the optical information onto the surface of the photoconductor 401 as laser light, wherein a semiconductor laser is driven under control by a control circuit 408. With this configuration, an electrostatic latent image of charge corresponding to the projected optical image is formed on the surface of the photoconductor 401. Developer is deposited on this electrostatic latent image and developed by the developing device 404 in the next stage. Here, the developer has a charged polarity set so as to allow its deposition on the area irradiated with light.

The image formed as described above or a developer image is transferred onto paper which is appropriately conveyed, in an electrostatic manner through application of a voltage to the transfer roller, the paper is peeled off from the photoconductor 401 and conveyed outside the image forming apparatus after passing through a fixation device (not shown).

The developing device 404 used for the image forming apparatus constructed as described above is designed to convey, for example, one-component type non-magnetic developer 440 to the developing region facing the photoconductor 401, as shown in FIG. 110. The developing device 404 is provided with, all in a rotatable manner in a developer tank 441 for storing developing developer 440, an agitation member 442 for agitating and conveying the stored developer 440; a supplying member 443 for supplying the developer 440 conveyed by the agitation member 442 onto a developing roller 444; a developing roller 444 for conveying the developer 440 supplied to the developing region facing the photoconductor 401; and a control roller 445 for controlling the amount of the developer 440 to be applied to the developing roller 444.

Figure 111:
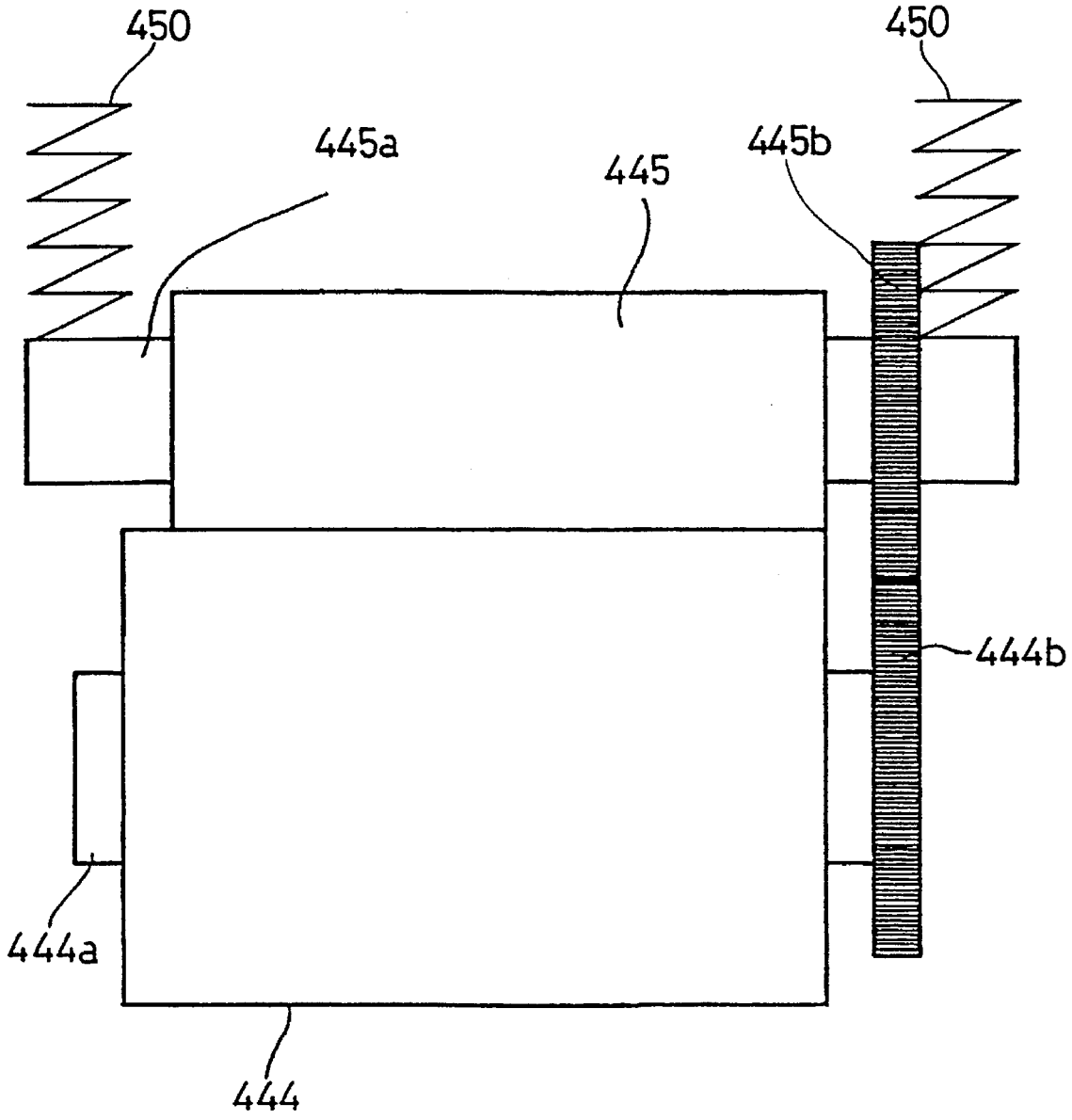
FIG. 111 is a front view illustrative of one of the mechanisms of the pressure of a control roller, which composes the developing device of the present invention for control of the amount of applied developer, on a developing roller.

Rotating shafts of the agitation member 442, the supplying member 443, the developing roller 444 and the control roller 445 are supported on the inner side wall of the developer tank 441 in a rotatable manner; as shown in FIG. 111, torque is transferred as necessary, via transferring means such as a clutch from a motor as the driving source to the driving gear **444*b* fixed at one end of the rotating shaft 444*a* of the developing roller 444 projecting into the developer tank 441. A follower gear 445*b* which is engaged with the driving gear 444*b* is fixed to the rotating shaft 445*a* of the control roller 445, and rotates in the opposite direction of the rotation of the developing roller 444. Therefore, at the section of contact between the developing roller 444 and the control roller 445**, the peripheries are driven to rotate for movement in the same direction.

Also, since the agitation member 442 and the supplying member 443 is rotated in the direction indicated in the drawing, power is transferred via a follower gear (not shown) which is engaged with the driving gear **444*b* of the developing roller 444**.

In addition, since the inside of the developer tank 441 constitutes a path for circulation of developer 440, there is provided an applying member 446 which functions as a partition in the developer tank; here, the applying member 446 is the partition between the developing roller 444 and the agitation member 442. This applying member 446 is placed far from the developing roller 444 with a spacing S, and to its tip is fixed a scrubbing member 447 composed of a film of polyethylene terephthalate (PET). The distal end of the scrubbing member 447 extends to the periphery of the supplying member 443 and scrubs developer 440 deposited on the supplying member 443, and in the same manner as the applying member 446, serves to separate the developer 440 supplied from the agitation member 442 from the developer 440 stored in the region of the agitation member 442.

As shown in FIG. 111, the control roller 445 is contacted with the developing roller 444 under pressure of a given load, and this contact under pressure controls the amount of developer 440 deposited on the developing roller 444 to a given amount of application. The chamber confined by the control roller 445, the developing roller 444 and the applying member 446 is a reservoir 448 for temporary storage of developer conveyed from the supplying member 443 via the narrow region between the applying member 446 and the developing roller 444. In order to prevent the pressure of developer 440 in the reservoir 448 which is successively supplied thereto from increasing over a predetermined value, an opening 449 is formed in the applying member 446 for returning developer 440 to the developer storage region around the agitation member 442 in the developer tank 441. As described above, the developer subjected to agitation by the agitation member 442 is conveyed via the supplying member 443, along the circulation path comprising the space S between the developing roller 444 and the applying member 446 and then the reservoir 448, and the excess developer not used to apply the developing roller 444 is circulated toward the agitation member 442 through the opening 449.

As shown in FIG. 111, the control roller 445 biases both ends of the rotating shaft **445*a* toward the developing roller 444 with springs 450 so as to press against the developing roller 444 at a given load. Each spring 450 is fixed at one end to the mounting member 451 which is in turn fixed to the developer tank 441, and is placed in contact with the rotating shaft 445*a* of the control roller 445 at the other end, thus pressing the control roller 445 against the developing roller 444**.

In the developing device 404 constructed as described above, developer 440 agitated and conveyed by the agitation member 442 is supplied to the developing roller 444 by the supplying member 443 via a passage at the bottom of the developer tank 441. The developer 440 supplied by the supplying member 443 is sent to the narrow region (space S) between the developing roller 444 and the applying member 446. supplying member 443 is scrubbed by a scrubbing member 447. The developer 440 is pressed as it passes through the narrow space S and applied to the developing roller 444. Here, since the developer 440 is compressed, the developer is firmly applied to the developing roller 444, and frictional electrification is accomplished simultaneously.

The developer 440 which has passed the narrow space S between the developer roller 444 and the applying member 446 is temporarily stored in the reservoir, and once the pressure of the developer 440 therein which is successively supplied thereto increases over the predetermined value, the developer 440 is returned to the developer storage region around the agitation member 442 via the opening 449 formed in the applying member 446. The developer 440 in the reservoir 448 is compressed by the successively supplied developer 440 and charged by friction during rotation on the developing roller 444. Here, a consistent developer pressure is maintained because the reservoir 448 has a fixed volume, and once the pressure of the developer 440 therein increases over the predetermined value as a result of increase in the supplied amount, the excess developer 440 is returned toward the agitation member 442 through the opening 449. In this way, the amount of developer 440 applied to the developing roller 444 is made consistent, while simultaneously accomplishing contact frictional electrification.

On the other hand, the amount of developer 440 applied to and deposited on the developing roller 444 is controlled by the rotating control roller 445. More specifically, being increased to a given pressure in the reservoir, developer 440 having a consistent thickness is applied to the developing roller 444. The developer is again controlled for the consistent thickness by rotation of the control roller 445 and then conveyed to the region of development which faces the photoconductor 401.

Here, at the facing section the control roller 445 rotates in the same direction as the direction of conveyance of the developer 440, i.e., the direction of rotation of the developing roller 444, the friction with the developer 440 is lowered, and unwanted energy consumption such as generation of heat at the section of contact with the developer 440 is minimized, thus efficiently controlling the amount of the developer 440 applied to the developing roller 444 to the consistent value. Therefore, there is no risk of causing fusion of the developer to the control roller 445 due to unwanted generation of heat.

More specifically, it is possible to prevent generation of heat which may cause fusion of the developer 440 to the control roller 445, and naturally irregularities resulting from the fusion of the developer 440 are not formed on the surface of the control roller 445, thus eliminating the cause of impairing consistent application of the developer 440. Should the developing developer 440 be deposited on the control roller 445, since the control roller 445 rotates, its section of contact with the developer 440 applied to the developing roller 444 changes constantly, and thus there is no chance that the developer 440 is inconsistent along the entire periphery of the developing roller 444 except at a few inconsistent sections; the entire periphery of the developing developer 444 may be applied almost consistently.

This results in substantial expansion of the area of the control roller 445 which faces the developing roller 444 to allow further control of the amount of the applied developer, thus establishing a thinner and more consistent layer of the developer on the developing roller 444.

Here, in cases where the rotational speed of the control roller 445, particularly the speed of the periphery (peripheral speed) of the control roller 445, is set to be higher than the speed of the periphery (peripheral speed) of the developing roller 444, sections of the control roller 445 which control the developer 440 on the developing roller 444 gradually shift so that sections of the control roller 445 successively control portions of the developer 440 already controlled by other sections; consequently, possible irregular application by partial irregular sections on the control roller 445 may be corrected for consistent application by control by the other sections. In other words, in cases where the control roller 445 and the developing roller 444 have an identical peripheral speed of rotation, the same section of the control roller 445 controls the same section of the developing roller 444 at all times. In cases where the peripheral speed of the control roller 445 is higher, however, since different sections of the control roller 445 contact with the same section of the developing roller 444, the area (region) of control of the amount of application to the developing roller 444 increases, and thus unevenly applied sections which may be present partially are corrected into evenly applied sections as the control roller 445 rotates.

The same effect is produced by setting the peripheral speed of the control roller 445 to be lower than the peripheral speed of the developing roller 444, because the sections of the control roller 445 which control the developer 440 deposited on the developing roller 444 gradually shift; a greater area (peripheral area in the direction of rotation) of control by the control roller 445 is, however, established in cases where the control roller 445 has a higher peripheral speed.

Here, in order to rotate the control roller 445 at a higher speed than the developing roller 444, as shown in FIG. 111, for example, the speed ratio of the two may be easily adjusted by proper setting of the gear ratio between the follower gear **445*b* fixed around the rotational shaft 445*a* of the control roller 445 and the driving gear 444*b* fixed around the rotational shaft 444*a* of the developing roller 444. More specifically, the peripheral speed of rotation of the control roller 445 may be increased by setting the number of gear teeth of the follower gear 445*b* to be smaller than that of the driving gear 444*a*; the speed may be adjusted as desired by changing the perimeter of the roller 445**.

Alternatively, in cases where the developing roller 444 and the control roller 445 are driven to rotate with separate driving sources, that is, separately provided driving motors, the peripheral speeds of the developing roller 444 and the control roller 445 may be easily set as desired by controlling the rotational speeds of the driving motors, without setting the speed ratio with the driving members.

The developing roller 444 is formed of an elastic material such as rubber so as to allow proper application of developer 440 and contact with the photoconductor 401 with a desired nip. The material for the developing roller 444 is, for example, a conductive elastic material such as urethane rubber, silicone rubber, NBR rubber, etc. In addition, the rubber which is used to form the developing roller 444 preferably has an Asker C hardness of 50–90; in cases where the rubber is more rigid, it is difficult to have a nip between the roller 444 and the photoconductor 401, whereas in cases where the rubber is less rigid, the amount of applied developer 440 varies. The enumerated materials are used with advantages in cases where the developer 440 to be used is a non-magnetic, one-component type.

In cases where the developer 440 is a magnetic, one-component type, however, since the developing roller 444 must adsorb the developer 440 through magnetic force, it is composed of, instead of the aforementioned materials, a magnet with a plurality of magnetic properties in a cylindrical rotary sleeve made of non-magnetic aluminum, stainless steel or the like. This allows magnetic deposition of developer 440 on the rotating sleeve without requiring the aforementioned applying member 445, etc. and also simultaneous control of the deposited developer 440 by the rotation-control roller 445 for a consistent amount of application.

Use of non-magnetic, one-component type developer 440 will now be explained. The resistance of the developing roller 444 preferably is $10^4$–$10^8$ Ωcm, and most preferably is $10^6$–$10^7$ Ωcm. This is because the charge of the charged developer is released at lower resistance, and thus resistance which does not allow discharge is preferable. Conversely, in cases where the resistance is excessively high, the charged developer 440 may be deposited on non-image regions, i.e., regions to which the developer 440 should not be deposited, because a developing bias voltage is applied across the developing roller 444. Here, in cases where the resistance of the developing roller 444 is inconsistent, the image has inconsistencies in density which are due to variations in the resistance. Therefore, it is effective to use a dispersion of a conductive material in rubber which has consistent resistance. Any material with good dispersibility may be used as the dispersoid conductive material.

In addition, the material for the control roller 445 which controls the amount of application to the developing roller 444 is one with excellent wear-resistance, and preferably is ceramic or glass, for example.

The feed member 443 which supplies developer 440 to the developing roller 444 is a roller having a regular polygonal section. For the same reason as given in the explanation with reference to FIG. 5, the polygon has 3 or more, preferably 5–8 angles.

In cases where the load pressing the control roller 445 against the developing roller 444 is excessively low, the capacity of control is reduced, and the developer may spout at the controlling position. Conversely, in cases where the load is excessively high, the developer tends to be fused to the control roller 445. Accordingly, the load of the control roller 445 on the developing roller 444 preferably is on the order of 500–2000 gf, and most preferably on the order of 700–1200 gf.

Outstanding effects of the present invention will now be explained with some additional examples given below.

EXAMPLE 9

The developing roller 444 used had a diameter of 16 mm and was made of urethane rubber having resistance of $10^7$ Ωcm and an Asker C hardness of 70. The developing roller 444 was placed near the photoconductor 401 with a 0.3 mm nip (determined on the width of the section in contact with the photoconductor, i.e., the peripheral length of that section). The peripheral speed of the developing roller 444 in this state was set to 32.5 mm/sec.

The control roller 445 with a diameter of 10 mm, made of a ceramic, was placed in contact with the developing roller 444 under pressure of a load of 800 gf and was set to a peripheral speed of rotation of 35 mm/sec. This peripheral speed of rotation was adjusted by appropriately setting the gear ratio between the driving gear **444*b* and the follower gear 445*b*, as shown in FIG. 111**.

For comparison with the developing device of the present invention, a comparative example which was a fixed, non-rotatable, prism-shaped control roller made of aluminum was pressed, at a load of 1 kgf, against a developing roller 444 with the same structure as the developing roller used in the present example.

For both the present example and the comparative example, the developer tank 441 had the configuration shown in FIG. 110, and the feed member 443 had a heptagonal-section with a 15 mm diameter of the circle circumscribing the prism and a peripheral speed of 40 mm/sec.

Table 2 given below lists the results of the comparative example, and Table 3 lists the results of the present example. Here, the developer used was non-magnetic, one-component type developer.

TABLE 2

| Image Printed copies | 1 k | 5 k | 10 k | 20 k |
|---|---|---|---|---|
| Halftone | Favorable | Some streaks | Stripped at both ends | 50% stripped |
| Solid Prints | Favorable | Favorable | Some streaks, but favorable | Skipped at both ends |
| Characters | Favorable | Favorable | Some streaks, but favorable | Skipped at both ends |

(k = kilocopies)

TABLE 3

| Image/ Printed copies | 1 k | 5 k | 10 k | 20 k |
|---|---|---|---|---|
| Halftone | Favorable | Favorable | Favorable | Some streaks |
| Solid | Favorable | Favorable | Favorable | Favorable |
| Letters | Favorable | Favorable | Favorable | Favorable |

As shown clearly above, the amount of application to the developing roller 444 was consistent at all times when controlled by the control roller 445 according to the present invention, and the time to replacement of the control roller 445 may be postponed by about four times as evidenced by favorable printing of 20 kilocopies when compared with 5 kilocopies which indicate replacement of the control roller according to the prior art. Thus the control roller 445 of the present invention may be used for a long period of time.

With the prior art prism-shaped control roller, the halftone images had streaks when approximately 5 kilocopies were printed; this shows that consistency in the amount of peripheral application of developer was lost. On the other hand, with the control roller 445 of the present invention, no streaks were formed until approximately 20 kilocopies were printed, and this clearly demonstrates that consistent application had been performed at all times.

Here, since the developing roller 444 is in contact with the control roller 445 which controls the layer thickness of developer 440, at a given load at all times, it is an important requirement that the developing roller 444 be made of a rubber material which has a reduced tendency of being permanently distorted. Since the control roller 445 is a control member, it can solve the problem of distortion unlike a control member having prism shape.

EXAMPLE 10

The developing roller 444 used had a diameter of 20 mm and was made of silicone rubber having resistance of $10^6$ Ωcm and an Asker C hardness of 60. The developing roller 444 was placed near the photoconductor 401 with a 0.15 mm nip. The peripheral speed of the developing roller 444 in this state was set to 25 mm/sec.

The control roller 445 with a diameter of 10 mm, made of iron, was placed in contact with the developing roller 444 under pressure of a load of 800 gf on the developing roller 444 and was set to a peripheral speed of rotation of 35 mm/sec.

Figure 113:
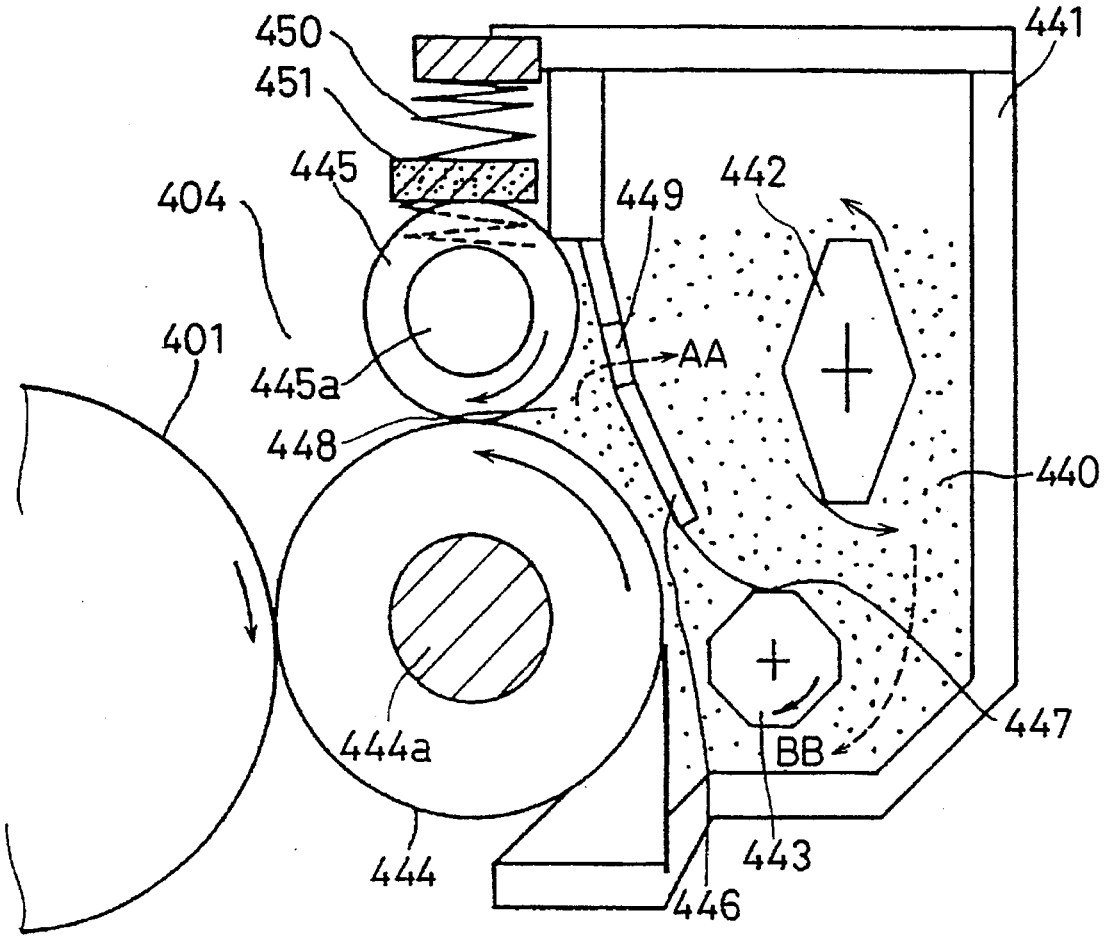
FIG. 113 is a section view illustrative of another embodiment of the developing device of the present invention.
Figure 114:
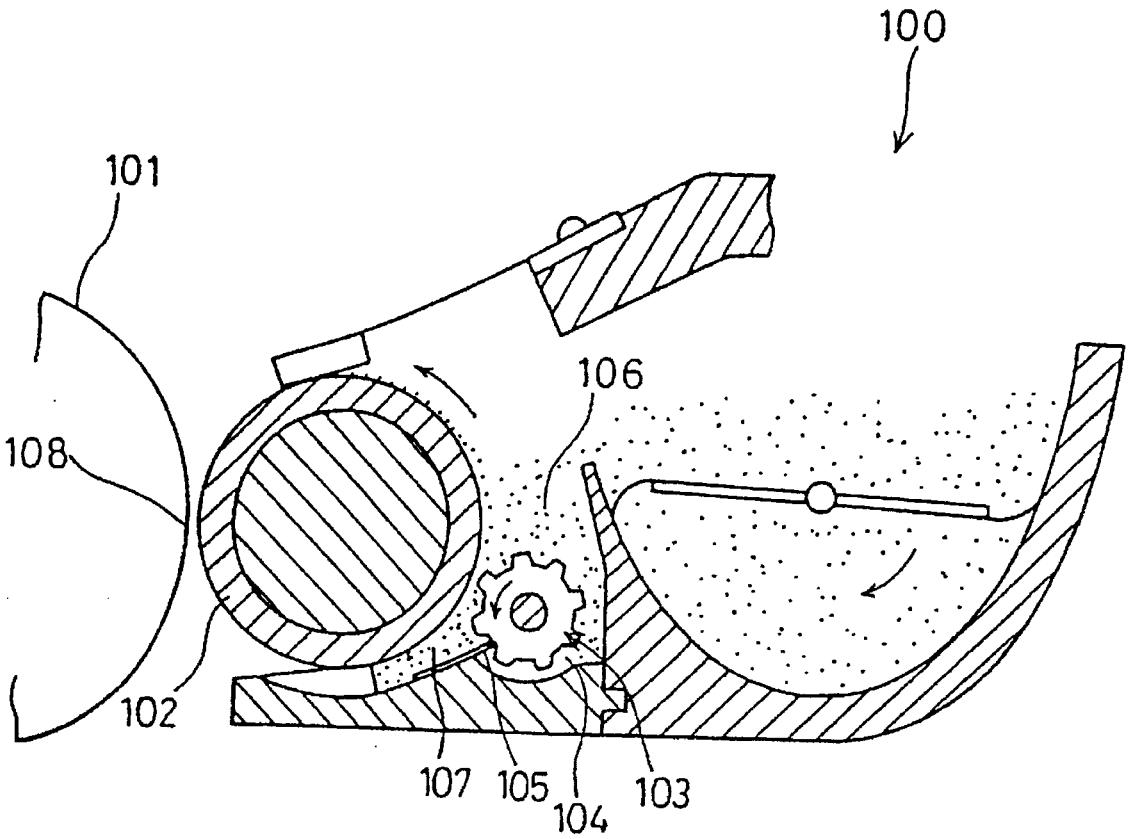
FIG. 114 PRIOR ART
FIG. 114 is a structural schematic view illustrative of a developer cartridge of the prior art.
Figure 115:
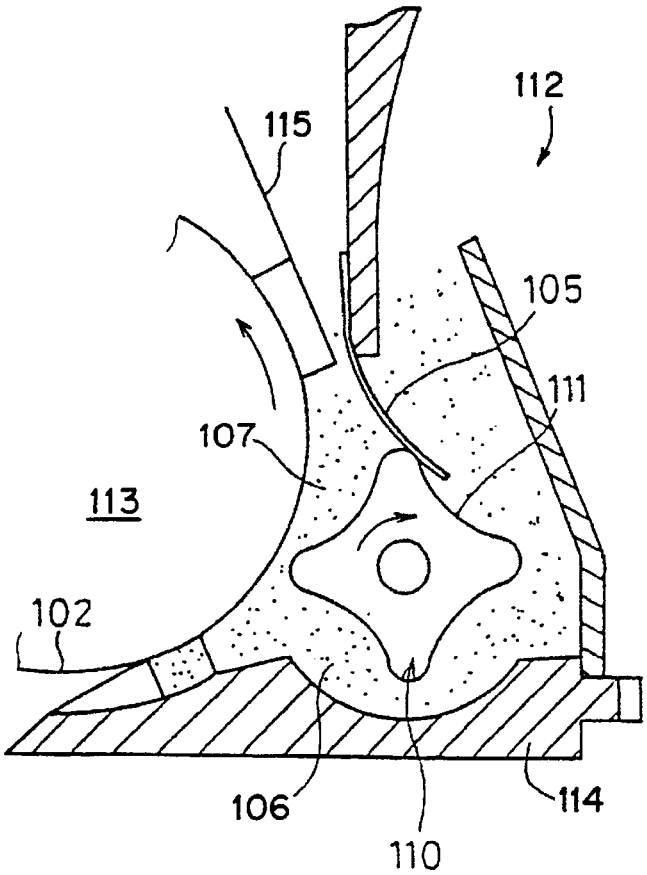
FIG. 115 PRIOR ART
FIG. 115 is a section view illustrative of a developer feed roller having a recessed surface, mounted in the developer cartridge.
Figure 116:
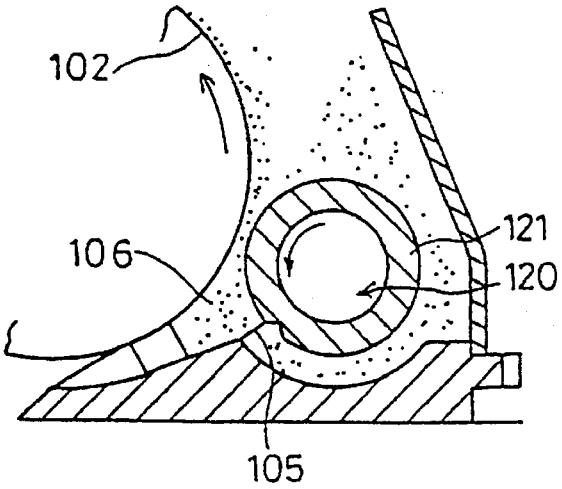
FIG. 116 PRIOR ART
FIG. 116 is a structural schematic view illustrative of a sponge-coated, developer feed roller mounted in the developer cartridge.
Figure 117:
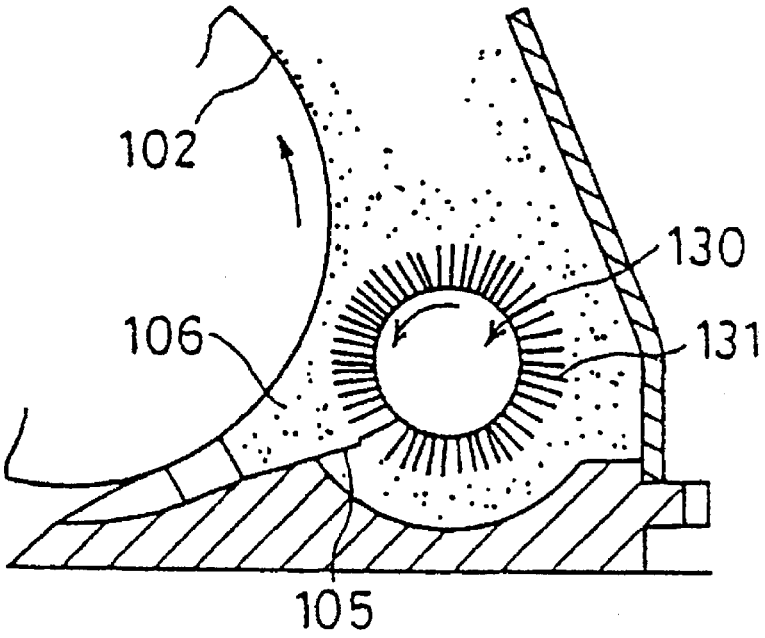
FIG. 117 PRIOR ART
FIG. 117 is a structural schematic view illustrative of a developer feed roller with bristles formed thereon, mounted in the developer cartridge.
Figure 118:
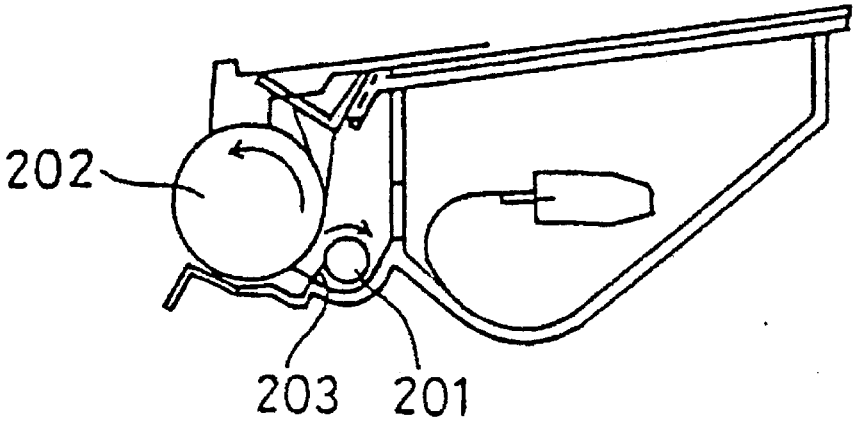
FIG. 118 PRIOR ART
FIG. 118 is a structural schematic view illustrative of another developer cartridge of the prior art which has a circular-section developer feed roller.
Figure 119A:
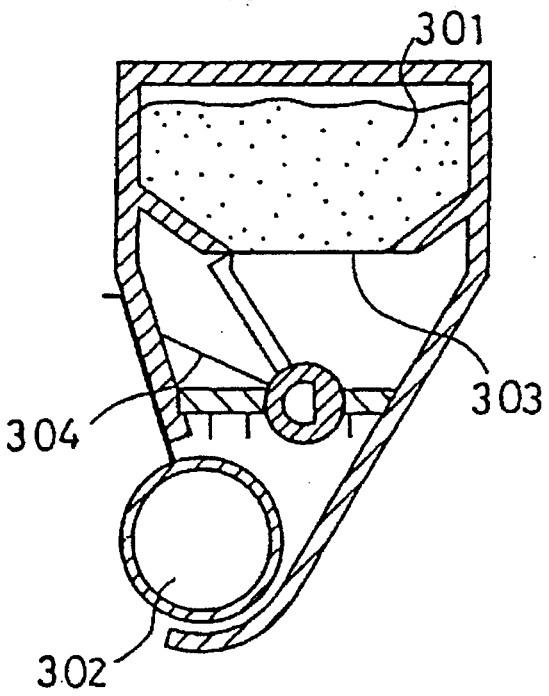
FIG. 119A PRIOR ART
Figure 119B:
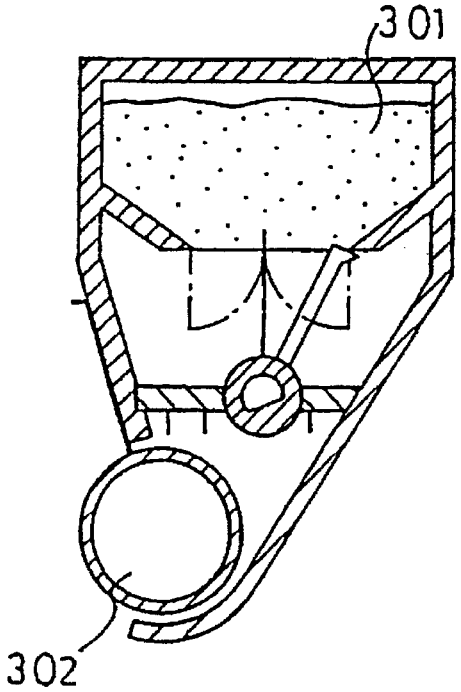
FIG. 119B PRIOR ART

In addition, as shown in FIG. 113, there was provided a cleaning member 451 made of a urethane sponge which was brought into contact with the control roller 445 after control of the amount of developer to be applied to the developing roller 444 to a constant value, to remove the developer 440 deposited on the surface of the control roller 445. The load on the cleaning member 451 pressing against the control roller 445 was set to 50–200 gf. The feed member 443 used to supply developer 440 was the same as the one used in Example 9.

With the configuration described above, the same effects as produced in Example 9 were produced, and further there was no risk of deposition of developer 440 on the control roller 445 which causes variations in the amount of applied developer 440, because the developer 440 deposited on the control roller 445 was removed by the cleaning member 451. The results are shown in Table 4 below.

TABLE 4

| Print time | 1 hr. | 5 hrs. | 10 hrs. | 20 hrs. |
|---|---|---|---|---|
| Without urethane | 5 mg | 20 mg | 30 mg | 50 mg |
| With urethane | 2 mg | 3 mg | 10 mg | 15 mg |

As shown in Table 4 above, since the amount of developer 440 deposited on the control roller 445 may be reduced by the cleaning member 451, the amount of developer applied to the developing roller 444 may be constant at all times. An additional effect is the prolonged life of the control roller 445.

EXAMPLE 11

Used in this example was one-component type magnetic developer, but not one-component type non-magnetic developer.

Since magnetic developer was used, the developing roller 444 was composed of a triple-pole magnet with a magnetic force of 600 G in a cylindrical rotary sleeve with a diameter of 20 mm, made of aluminum. The gap between the sleeve of the developing roller 444 and the photoconductor used, for example, a selenium photoconductor 401, was maintained at 200 μm. The peripheral speed of the rotary sleeve in this state was set to 50 mm/sec.

A control roller 445 with a diameter of 10 mm, made of aluminum, was brought into contact with the developing roller 444, more specifically its rotary sleeve, at the same load as in Example 9, and the peripheral speed of rotation in this state was set to 50 mm/sec.

The feed roller 443 which supplied developer 440 in the developer tank to the developing roller 444 had a heptagonal section with a 15 mm diameter of the circle circumscribing the section, and its peripheral speed of rotation was set to 40 mm/sec to supply the developer.

Even in the above case where one-component type magnetic developer was used, the amount of developer applied to the surface of the rotary sleeve constituting the developing roller 444 was consistent as well, thus resulting in consistent development.

Since the control roller 445 was made of aluminum and grounded, no charged developer 440 was electrostatically deposited on the control roller 445, and thus the amount of developer 400 deposited on and fused to the control roller 445 was reduced.

Here, although a developing bias voltage was applied between the developing roller 444 and the photoconductor 401, no problems such as leakage were observed during the experiment, because the control roller 445 was in contact with the developing roller 444 via the developer 440. Alternatively, the control roller 445 may be grounded via a high-resistance element to thoroughly solve the problem of leakage.

The material for the control roller 445 may be a metal material such as iron or stainless steel instead of aluminum, and may be grounded, or it may be a resin or the like which incorporates conductive carbon, etc. Iron, being a ferromagnetic material which tends to adsorb magnetic developer, is not a very appropriate material. In cases where the developer 440 is one-component type non-image developer, however, the control roller 445 may be made of iron.

Although the control roller 445 was set to have the same peripheral speed of rotation as the rotary sleeve of the developing roller 444 in the above example, the effect of controlling the amount of the deposited developer 440, i.e., the effect of consistent application may be enhanced by setting the speed of rotation of the control roller 445 to be higher or lower than that of the rotary sleeve of the developing roller 444.

EXAMPLE 12

A developing roller 444 with a diameter of 20 mm, made of conductive urethane rubber, was placed adjacent to a photoconductor 401 with an organic photoconductive (OPC) layer serving as the photoconductive layer, with a consistent 0.2 mm nip. The peripheral speed of rotation of the developing roller 444 in this state was set to 70 mm/sec.

A control roller 445 with a diameter of 10 mm, made of aluminum, was brought into contact with the developing roller 444 at a load of 800 gf, and its peripheral speed of rotation was set to 50 mm/sec.

The feed roller 443 for loading developer 440 in the developer tank 441 into the developing roller 444 had a heptagonal section with a 15 mm diameter of the circle circumscribing the section and a peripheral speed of rotation set to 40 mm/sec.

A voltage of −500 V of the same polarity as the negatively charged non-magnetic, one-component type developer 440 was applied across the control roller 445 constructed as described above, with power supply means 409 shown in FIG. 112, for example.

As a result, the charged developer 440 was no longer electrostatically adsorbed on the control roller 445 or fused to the control roller 445. Here, the photoconductor 401, after being negatively charged, was irradiated with a laser to form laser-irradiated, discharged sections of latent images corresponding to image portions such as characters or graphics, and a bias voltage of, for example, −300 V was applied from a power supply 410 across the developing roller 444 to electrostatically adsorb the negatively charged developer 440 on the laser-irradiated sections, as shown in FIG. 112.

In this case, there is no chance of discharge of the charged developer 440 through the control roller 445.

EXAMPLE 13

In this example, the rotational speed of the control roller 445 when developer 440 is applied to the developing non-magnetic, one-component type developer.

A developing roller 444 with a diameter of 20 mm, made of conductive urethane rubber, was placed adjacent to a photoconductor 401 with an organic photoconductive (OPC) layer serving as the photoconductive layer, with a 0.2 mm nip. The peripheral speed of rotation of the developing roller 444 in this state was set to 45 mm/sec.

A control roller 445 with a diameter of 10 mm, made of cylindrical aluminum, was brought into contact with the developing roller 444 at a load of 800 gf. Experiments were conducted on variation in the state of the applied developing roller 444 and in the amount of developer 440 deposited on the control roller 445 while varying the peripheral speed of rotation of the control roller 445.

The feed roller 443 had a tetragonal section with a 10 mm diameter of the circle circumscribing the section, and its peripheral speed was set to 25 mm/sec to supply developer 444 to the developing roller 444.

Results of the experiments show that the amount of applied developer 440 was consistent, but the proportion of developer 440 deposited on the control roller 445 increased in cases where the peripheral speed of rotation of the control roller 445 was lower than the peripheral speed of the developing roller 444. Conversely, in cases where the peripheral speed of the control roller 445 was higher than the peripheral speed of the developing roller 444, not only did the amount of applied developer 440 become consistent, but also the amount of developer 440 deposited on the control roller 445 decreased. This is because at low rotational speeds of the control roller 445 developer 440 tends to be applied to and deposited on the control roller 445 when the developing roller 444 is rotated, whereas the control roller 445 rotating at high rotational speeds tends to prevent deposition of developer 440 on the developing roller 444 to reduce the amount of deposited developer 440.

If the peripheral speed of the control roller 445 is excessively increased, the developer 440 deposited on the developing roller 444 is easily scattered; scattered developer 440 impairs consistent application and, when scattered outside the developer tank 441, even contaminates the inside of the image forming apparatus.

Therefore, the ratio of the peripheral speed of rotation of the control roller 445 to the peripheral speed of the developing roller 444 preferably is in a range of 1.01–2.0, and most preferably in a range of 1.05–1.5.

The supplied developer 440 passes between the applying member 446 and the developing roller 444, is temporarily stored in the reservoir 448 and, should the pressure therein exceed a given value, returned to the storage section around the agitation member 442 via the opening 449.

As described above in the respective examples, in order to use one-component type developer 440 and to apply a constant amount of the developer 440 to the developing roller 444 which conveys the developer 440 to the position of development which faces the photoconductor 401, it is important to provide the rotatable control roller 445 which serves as the control roller.

In order to level the amount of developer deposited on the developing roller 444 with this rotatable control roller 445, the rotational direction of the control roller 445 is set to be identical to the rotational direction of the developing roller 444 in the region of contact.

In addition, in order to enhance consistency in application of developer 440, it is important to set the peripheral speed of rotation of the control roller 445 to be lower or higher than the peripheral speed of the developing roller 444. Also, since deposition of developer 440 on the control roller 445 causes an inconsistent amount of developer 440 to be applied to the developing roller 444, from this point of view as well, it is important to set the peripheral speed of rotation of the control roller 445 to be higher than the peripheral speed of rotation of the developing roller 444. It is additional effective insurance to place cleaning means, which removes developer 440 deposited on the control roller 445, forcedly in contact with the control roller 445 after application of developer 440 to the developing roller 444 has been controlled.

In order to ensure consistent application to the developing roller 444, it is effective to provide means for pressing the supplied developer 440 against the developing roller 444. One effective method of realizing this is to place the supplied developer 440 under a given pressure at all times during its passage to the developing roller 444. Another method is to maintain a given passage space region between the developing roller 444 and the applying member 446, as shown in FIG. 110, and an additional effective method involves maintenance of constant pressure on the developer 440 being deposited on the developing roller 444, prior to control of the amount of the applied developer by the control roller 445. In order to carry out these methods, it is effective to provide a reservoir 448 confined by the applying member 446, the control roller 445 and the developing roller 444 and to provide a circuit pathway which returns developer 440 with pressure beyond a given value around the position on which the agitation member 442 in the developer tank 441 is arranged.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device for image forming apparatuses, said developing device comprising:

a developing roller for supplying a developer to a photoconductor;

a developer feed roller, provided in non-contact with said developer roller, for conveying and supplying the developer to said developer feed roller; and a developer tank for receiving the developer, said developer roller, and said developer feed roller, said developer tank having at an inner surface thereof that faces said developer feed roller, irregularities which promote charging of the developer by friction.

2. The developing device according to claim 1, wherein said developer feed roller is formed as a regular polygonal prism.

3. The developing device according to claim 2, wherein the number of angles of said regular polygonal prism is 3–8.

4. The developing device according to claim 1, further comprising:

a cartridge body for housing said developing tank, said cartridge body configured for mounting in an image forming apparatus; and a non-magnetic, one-component developer contained within said developing tank.

5. A developing device for image forming apparatuses, said developing device comprising:

a developing roller for supplying a developer to a photoconductor; a control member, placed upstream in the direction of conveyance of the developer being supplied to the photoconductor, for controlling the layer thickness of the developer deposited on said developing roller;

a developer feed roller, provided in non-contact with said developing roller, for conveying and supplying the developer to said developing roller; and a developer-applying member extending in the direction of conveyance of the developer which is conveyed toward said control member by rotation of said developing roller and said developer feed roller, with decreasing distance from the surface of said developing roller as well as extending in the axial direction of said developing roller near said developer feed roller and said developing roller.

6. The developing device according to claim 5, wherein said developer-applying member is formed of a material having elastic restoring force.

7. The developing device according to claim 5, wherein the tip of said developer-applying member is bent in the shape of an L or V letter.

8. The developing device according to claim 7, wherein the corner of the L or V letter contacts said developing roller.

9. The developing device according to claim 5, wherein the tip of said developer-applying member comprises two or more layers of plates.

10. The developing device according to claim 5, wherein said developer-applying member is provided with irregularities formed on the surface of said developer-applying member.

11. The developing device according to claim 1 or 10, wherein the ten-point mean surface roughness Rz of the irregularities relative to the mean particle size "r" of the developer satisfies the relation:

$$\frac{1}{2}\times r \leqq Rz \leqq 10\times r.$$

12. The developing device according to claim 5, wherein the decreasing distance creates a non-contact spacing of 20–30 μm from the surface of said developing roller to said developer-applying member.

13. The developing device according to claim 5, said developer-applying member including at least one hole for permitting developer to pass therethrough.

14. The developing device according to claim 13, wherein the at least one hole of said developer-applying member is provided with a pressure-regulating valve which controls increase in the pressure of the developer being conveyed between the developer-applying member and the developer roller.

15. The developing device according to claim 14, said developer-applying member including a plurality of the holes, and further including a respective pressure-regulating valve for each hole.

16. The developing device according to claim 5, wherein said developer-applying member includes a brush for contacting said developing roller.

17. The developing device according to claim 5, wherein said developer-applying member includes a foam portion for contacting said developing roller.

18. The developing device according to claim 5, further comprising a non-magnetic, one-component type developer.

19. The developing device according to claim 5, further comprising a biasing spring for biasing said developer roller and said developer-applying member toward one another.

20. The developing device according to claim 5, further comprising a cartridge body, said cartridge body including mounting ribs for connecting said developer-applying member to an inner surface of said cartridge body, the ribs extending generally perpendicular to the axial direction of said developing roller.

21. The developing device according to claim 5, further comprising a scrubbing member for scrubbing a surface of said developer feed roller.

22. The developing device according to claim 21, further comprising a holder for mounting both said scrubbing member and said developer-applying member to a body of said device.

23. The developing device according to claim 21, wherein said scrubbing member includes a first elastic portion and a second elastic portion, the second elastic portion contacting the surface of said developer feed roller and having less elasticity than the first elastic member.

24. The developing device according to claim 21, wherein said scrubbing member includes a through hole for permitting developing to pass therethrough.

25. The developing device according to claim 21, wherein said developer-applying member is a sheet attached at one end thereof to a body of said developing device, and attached at the other end thereof to said scrubbing member.

26. The developing device according to claim 25, wherein said sheet curves toward said developing roller.

27. A developing device for image forming apparatuses, said developing device comprising:

a developing roller for supplying a developer to a photoconductor;

a developer feed roller, provided in non-contact with said developing roller, for conveying and supplying the developer to said developing roller;

a developer-applying member extending in the direction of conveyance of the developer which is conveyed by rotation of said developing roller and said developer feed roller, with decreasing distance from the surface of said developing roller as well as extending in the axial direction of said developing roller near said developer feed roller and said developing roller; and a scrubbing member in contact with said developer feed roller for scrubbing the developer deposited on said developer feed roller, said scrubbing member being fixed to said developer-applying member, wherein the surface of said developing roller, said developer-applying member, and said scrubbing member confine a space which functions as a pressurizing chamber for increasing the pressure of the developer during conveyance.

28. The developing device according to claim 27, further comprising a developer agitation roller, provided with a blade material at a tip thereof, placed upstream from said developing roller in the path over which the developer is conveyed, to convey the developer to said developer feed roller while agitating.

29. The developing device according to claim 27, wherein a through-hole is formed in said scrubbing member.

30. The developing device according to claim 27, further comprising a non-magnetic, one-component type developer.

31. A developing device for image forming apparatuses, said developing device comprising:

a developing roller for supplying a developer to a photoconductor;

a developer feed roller, provided in non-contact with said developing roller, for conveying and supplying the developer to said developing roller;

a developer tank for receiving at least the developer, said developing roller, and said developer feed roller; and a developer-applying member for scrubbing the developer deposited on said developer feed roller, said developer-applying member extending from an inner wall surface of said developer tank to said developer feed roller, faced with the developing roller, to partition said developer tank, having an end thereof extending to said developer feed roller to be in contact therewith, being placed at such a position as to allow conveyance of the developer to a space between said developer-applying member and said developing roller by rotation of said developing roller and said developer feed roller, and being provided with a hole formed therein for the passage of the developer conveyed between said developer-applying member and said developing roller.

32. The developing device according to claim 31, wherein said developer-applying member is formed of a rigid material, except for in the vicinity of the end extending to said developer feed roller.

33. The developing device according to claim 32, wherein the rigid material of said developer-applying member is an extension of the material used to form said developer tank.

34. The developing device according to claim 31, wherein the width of the hole formed in said developer-applying member increases toward said developing roller.

35. The developing device according to any of claim 1, 5, 27, and 31, further comprising a developer agitation roller for conveying the developer to said developer feed roller while agitating the developer provided upstream from said developer feed roller in the path over which the developer is conveyed, and the amount S1 of conveyance per rotation of said developer feed roller, the amount S2 of conveyance per rotation of said developer agitation roller, and the ratio "b" of the number of rotations of said developer agitation roller to the number of rotations of said developer feed roller satisfy the relation:

$$S_1 \leqq b \times S_2.$$

36. A developing device according to any of claims 1, 5, 27, and 31, wherein a constant k representing (St·Rt)/(Sd·Rd) satisfies the relation:

$$1 \leqq K \leqq 20,$$

wherein St is the area of said developer feed roller to convey the developer; Rt is the number of rotations thereof; Sd is the area of said developing roller to convey the developer; Rd is the number of rotations thereof, provided that the length of said developer feed roller is equal to the length of said developing roller.

37. The developing device according to claim 31, further comprising a non-magnetic, one-component type developer.

38. The developing device according to claim 31, further comprising a pressure-regulating valve for the hole.

39. A developing device for image forming apparatuses, said developing device comprising:

a developing roller for supplying a developer to a photoconductor;

a developer feed roller, provided in non-contact with said developing roller, for conveying and supplying the developer to said developing roller;

a developer tank for receiving the developer, said developing roller, and said developer feed roller;

a developer-applying member extending from an inner wall surface of said developer tank to said developer feed roller, while facing said developer roller, to partition said developer tank, having an end thereof extending to said developer feed roller being in contact therewith to scrub the developer deposited on said developer feed roller, being placed at such a position as to allow conveyance of the developer to a space between said developer-applying member and said developing roller by rotation of said developing roller and said developer feed roller; and a plurality of open sections formed in said developer-applying member by dividing a rectangular opening with longer sides parallel to the axial direction of said developing roller, by parallelogrammic partitions which extend one longer side to the other longer side, wherein the parallelogrammic partitions are formed such that the length of the portion of any perpendicular line which crosses the partition is always constant when the perpendicular line is drawn from an arbitrary point of one longer side to the other longer side.

40. The developing device according to claim 39, further comprising a non-magnetic, one-component type developer.

41. A developing device for image forming apparatuses, said developing device comprising:

a developing roller for supplying a developer to a photoconductor;

a developer feed roller, provided in non-contact with said developing roller, for conveying and supplying the developer to said developing roller;

a developer agitation roller, provided upstream from said developer feed roller in the path over which the developer is conveyed, for conveying the developer to said developer feed roller while agitating the developer;

a developer-applying member extending in the direction of conveyance of the developer which is conveyed by rotation of said developing roller and said developer feed roller, with decreasing distance from the surface of said developing roller as well as extending in the axial direction of said developing roller near said developer feed roller and said developing roller, said developer-applying member further extending toward a wall surface of a developer tank, with an end thereof being fixed by a fixing section provided on the wall surface, said developer-applying member further including at least one anchor hole;

a developer tank for receiving the developer, said developing roller, said developer feed roller, said developer agitation roller, and said developer-applying member;

a guide groove, formed on a side wall of said developer tank, for supporting and guiding said developer-applying member in a slidable manner;

protrusions formed in the developer-applying member, the protrusions being engageable with said developer agitation roller; and an anchor protrusion formed on the wall surface of said developer tank and engageable with the anchor hole.

42. The developing device according to claim 41, wherein said developer-applying member is flexible and has a generally circular section.

43. The developing device according to claim 41, wherein, in use, said developer agitation roller is rotated prior to operation of the image forming apparatus.

44. The developing device according to claim 41 or claim 43, further comprising a first gear mounted around an extension of said developer agitation roller outside the device, said first gear being engageable with a second gear mounted on the image forming apparatus when the device is mounted in the body of the image forming apparatus.

45. The developing device according to claim 41, further comprising a non-magnetic, one-component type developer in said developer tank.

46. A developing device for image forming apparatuses, said developing device comprising:

a developing roller, placed facing a recording medium, for conveying a developer to the recording medium;

a developer feed roller, provided in non-contact with said developing roller, for conveying and supplying the developer to said developing roller;

a developer tank for receiving at least the developer, part of said developer roller and said developer feed roller;

a developer-applying member extending from an inner wall surface of said developer tank to near said developer seed roller, and faced with said developing roller, to partition said developer tank into two parts;

a scrubbing member in contact with said developer feed roller for scrubbing the developer deposited on said developer feed roller, said scrubbing member being fixed to said developer-applying member; and a control roller for controlling the amount of the developer to be supplied and deposited on said developing roller, said control roller being biased toward said developing roller by pressure and driven in the same direction as said developing roller, in a contact region where the control roller contacts the developing roller;

wherein at least said control roller, said developing roller, said developer-applying member, and said scrubbing member confine a space which functions as a pressurizing chamber for increasing the pressure of the developer being conveyed from the partitioned part of said developer tank which part is in non-contact with either of said control roller and said developing roller.

47. The developing device according to claim 46, wherein the linear speed of said control roller at the contact region is set to be higher than the linear speed of the developing roller at the contact region.

48. The developing device according to claim 46, wherein said control roller is formed of a conductive material and is connected to a grounding potential.

49. The developing device according to claim 46, further comprising a cleaning member, placed in contact with the surface of said control roller, for cleaning the surface of said control roller.

50. The developing device according to claim 46, further comprising a non-magnetic, one-component type developer.

* * * * *